US006659689B1

(12) United States Patent
Courtney et al.

(10) Patent No.: US 6,659,689 B1
(45) Date of Patent: Dec. 9, 2003

(54) GARMENT INTEGRATED PERSONAL FLOTATION DEVICE

(76) Inventors: William L. Courtney, 1990 Highway One, Elk, CA (US) 95432; Robert M. Carmichael, 940 NW. First St., Ft. Lauderdale, FL (US) 33311

( * ) Notice: Subject to any disclaimer, the term of this patent is extended or adjusted under 35 U.S.C. 154(b) by 0 days.

(21) Appl. No.: 10/047,682

(22) Filed: Jan. 15, 2002

Related U.S. Application Data

(63) Continuation-in-part of application No. 09/935,351, filed on Aug. 22, 2001, which is a continuation-in-part of application No. 09/827,831, filed on Apr. 6, 2001, now abandoned, which is a continuation-in-part of application No. 09/641,932, filed on Aug. 18, 2000, which is a continuation-in-part of application No. 09/618,333, filed on Jul. 18, 2000.

(51) Int. Cl.[7] ..... B63C 11/08; B63C 9/125

(52) U.S. Cl. ..... 405/186; 441/108; 2/2.5; 2/2.17

(58) Field of Search ..... 405/185–187; 441/108, 114, 129, 80; 2/1, 2.5, 2.15–2.17, 462, 467

(56) References Cited

U.S. PATENT DOCUMENTS 4,137,585 A * 2/1979 Wright, III ..... 405/193
4,324,234 A * 4/1982 Maness ..... 128/202.14
4,681,552 A * 7/1987 Courtney ..... 441/92
5,060,314 A * 10/1991 Lewis ..... 2/2.5
5,403,123 A * 4/1995 Walters ..... 405/186
5,584,737 A * 12/1996 Luhtala ..... 441/107
6,062,929 A * 5/2000 Hallstrom ..... 441/106

* cited by examiner

*Primary Examiner*—Thomas B. Will
*Assistant Examiner*—Tara L. Mayo
(74) *Attorney, Agent, or Firm*—Malin, Haley & DiMaggio, P.A.

(57) ABSTRACT

Airway and equipment protective buoyant, rescue, marking and recovery devices are disclosed. A garment mounted dual zipper cover releases a bladder that creates a reliable mandibular shelf and bracket while simultaneously encapsulating the crico-thyroid cartilage protecting it from compression. A dual wall personal floatation device (PFD) with its over sized inner bladder creates extended midline crossing. A dual chambered inner bladder separates the compressed gas inflated high-pressure low-volume bladder required for corrective turning from the higher-volume lower-pressure orally inflated chamber which provides the additional buoyancy needed to improve freieboard. A dual release fabric lock handle allows for the quick release of the deflated redundant abdominal PFD which then serves as an accurately thrown rescue inflatable. A PFD integrated variable-displacement dual-pressure personal life raft uses compressed gas to inflate a rigid floor conferring sufficient buoyancy to support the Marines 35 lb. Rucksack.

14 Claims, 95 Drawing Sheets

GARMENT INTEGRATED PERSONAL FLOTATION DEVICE

This application is a continuation-in-part of U.S. Ser. No. 09/935,351, filed Aug. 22, 2001, which is a continuation-in-part of U.S. Ser. No. 09/827,831, filed Apr. 6, 2001, now abandoned, which is a continuation-in-part of U.S. Ser. No. 09/641,932, filed Aug. 18, 2000, which is a continuation-in-part of U.S. Ser. No. 09/618,333, filed Jul. 18, 2000.

BACKGROUND OF THE INVENTION

1. Field of the Invention

The present invention relates generally to life jackets and other personal flotation devices ("PFDs"), and in particular to the prevention of airway submersion as a novel addition to the classic approach which is to recover the victim after they fall forward onto their face submerging their airway. Concurrently the instant invention continues to improve traditional face down; corrective turning action. Central to the prevention of airway submersion is the separation of the centers of ballast and buoyancy. This not only creates increased torque around the axis of rotation that parallels the spine, but because of the anterior posterior separation creates a new axis of rotation around an axis that passes side to side through the thorax. Further improvements in controlling movement of the head, side to side, reduces the amount of torque required for reliable corrective turning action. This results in either decreased bulk of the buoyant moment or the amount of fluid or solid ballast needed to achieve improved airway protection for either inflatable or inherently buoyant personal flotation devices. With increasing concern about passive aspiration leading to drowning while face up in a mounting sea state the current embodiment includes oral nasal airway protection. Due to the morbidity and mortality of rapid onset hypothermia immediate removal from cold water requires inclusion of a personal raft within the PFD that incorporates rapid inflation, and stability in choppy seas and means to survive until rescued. The present invention also provides a garment integrated multi-chambered personal flotation device, life jacket, and the like. The present invention also provides a garment mounted, integrated, or encapsulated crico-thyroid encapsulating midline closing mandibular supportive life jacket in high compression cover and redundant abdominal pfd, rescue inflatable, personal life raft and marking and recovery bladders.

2. Description of the Prior Art

Extensive pool and wave tank testing of fielded and prototype personal flotation devices ("PFDs") on divergent body types indicates the clear need for continued improvement in airway protective performance. None of the jackets tested at several joint international efforts reviewing testing methodologies provided 5-second recovery of the test subjects.

Corrective turning as assessed by every government agency has been restricted to the tester assuming a horizontal face down position taking three strokes, then the administrator assess whether the individual is rolled into a face up position within 5 seconds. Past PFD designs relied upon the common understanding and practice of placing the PFD's buoyancy high on the chest. All current PFDs tested by the author fail to provide airway protection. There have been PFD recalls and refusal to grant reciprocal approval to product already in the field based on current concerns of the inadequacy of test methodologies. Some agencies instruct their test subjects to place the arms at the sides, legs together and stretch out the back as a simulation of unconsciousness.

This methodology was introduced to allow comfortable recreational life jackets to be approved. The use of this methodology for approval of commercial open ocean life jackets has precipitated the global current crisis, with agencies from one country recalling product from another country. The United States Coast Guard ("USCG") is currently increasing the rigor of testing by the inclusion of new tests more accurately assessing the capacity to commercial jackets to roll an unconscious victim from any position into an airway protected position within 5 seconds as mandated by the Code of Federal Regulations. The current challenge to improve the accuracy of testing is seriously compounded by a lack of PFDs capable of withstanding close scrutiny.

Recent joint Canadian and US wave tank testing of an international selection of "safety of life at sea" ("SOLAS") class PFDs disclosed that the ability of any life jacket to provide surface airway protection is constrained by the same laws of physics. Even if one is turned face up in mounting seas at very low wave height and frequency the face is awash in waves. As the seas mount, the ballast of the body is driven down in the trough of the wave and the head completely submerged. The buoyant means about the neck if secure extracts the victim in a cyclic plunging action. Thus safety and survival at sea is dependant upon being able to immediately remove oneself from the sea as quickly as possible to avoid hypothermic induced unconsciousness and cumulative aspiration secondary to splashing waves or total submersion that occurs in even relatively mild seas.

The vast majority if not all current jackets fail to turn an unconscious victim who enters the water face first, but since face first water entry is not part of any PFD evaluation program this finding remains unknown therefore unaddressed. Current life jackets also possess a Danger Zone, defined as the vertical position in the water from which if the wearer passes out they then fall face forward into an airway submerged moment of stability. Until now the sole management of the Danger Zone was avoidance. The average user of PFDs is ignorant of the consequence of floating in the danger zone. In fact contrary to the lethal consequences of floating upright in the water column it feels intuitive to the uniformed. The vertical position is the ideal position from which to scan or signal rescue efforts. When you float upright it is easier to monitor the horizon behind you as well as that portion in front of you.

The body has highly developed postural muscles that in coordination with the vestibular apparatus of the inner ear maintain our vertical position in space. Prior jackets relied upon well-established principles that the buoyant moment belonged high on the chest in order to optimize airway protective turning. The prior art has relied strictly upon the use of buoyant means to generate the torque needed for turning and like a sail boat that had lost it's lead keel the purely buoyant PFD suffered from a lack of orientation, that is there are points of stability that are facedown as well as face up. Hence the urgent need to identify and remedy the Danger Zone.

The prior art is restricted to very severe limits on the angle of flotation of the body off of vertical as one means to avoid entering the Danger Zone. That is if a jacket floats the wearer closer-than 20 to 30 degrees off of vertical it would not pass testing and would not be approved for use. At issue is that prior Life Jackets allow the center of gravity of the jacket to be balanced above the center of buoyancy by the conscious wearer floating upright in the water column as they want to be when eagerly trying to spot search and rescue efforts. The intuitive element is that if a PFD allows the center of gravity to be located directly above the centroid of buoyancy the system is in balance and so requires very little muscular movement to maintain this position in gravity. However, the problem occurs as the water environment quickly wicks away the body's heat leading to hypothermia, obtundation and eventually loss of consciousness. Upon loss of consciousness the victim can no longer maintain their vertical position in space, they cannot even hold their head erect. The debility is so complete they cannot remove their face from the water.

Reviewing the mechanics of the Danger Zone, while conscious the victim can effortlessly balance himself or herself upright but when the head drops forward the center of gravity suddenly also shifts forward, and the individual slumps face down.

The entire global PFD community currently accepts the SOLAS standard for turning. A SOLAS Approved Life Jacket will roll an unconscious victim from any position into and airway protected position within 5 seconds. However that same community relies some variation of the Three-Stroke Test to confirm performance to that standard. PFD design has come to rely upon the assistance provided by the tester to the serious detriment of performance. One current test methodology simulates unconsciousness by instructing the tester to take three strokes, pull the arms to the sides, place the legs together, straighten the back then drop the head. This very complex maneuver aligns the body along the axis of rotation reducing the amount of torque the Life Jacket needs to generate in order to roll the victim over. The majority of the torque is generated from the water displaced by the buoyant moment. While the Three-Stroke test arose to facilitate the creation of comfortable recreational PFDs that same test replaced more passive simulations of unconsciousness. Clearly that more passive tester requires a Life Jacket of greater torque to perform corrective turning.

Both the commercial and recreational market place is currently full of Life Jackets that rely upon tester participation to compensate for insufficient torque. While these comfortable jackets take up less space aboard vessels allowing for the carriage of more passengers they fail the unconscious user. When the head drops forward shifting the center of gravity in front of the center of buoyancy the unconscious users slowly rocks forward covering their airway with water. An accurate simulation of loss of consciousness involves the production of minimal or ideally no kinetic energy. Under current efforts to review validity of current three stroke test methodologies, newer static tests of currently fielded Tested and Approved product although low volume, comfortable and stowable, fail to turn them into a face up position within the mandated 5 seconds.

The current standards are the product of a very large committee. 190 countries each advocating the interests of their individual manufactures has led to an assembly of contradictory mandates. For example, one has to be able to swim, while wearing the Life Jacket, a distance that exceeds what the average American is capable of swimming even without a Life Jacket. One needs to be able to climb into a life raft, which is very challenging even when the individual is not wearing a PFD. The Life Jacket needs to position the user upon completion of the corrective turn simultaneously within narrow limits for freeboard, head angle, body angle and face plane while not obstructing the view of the horizon. The same comfortable, snug, low profile Life Jacket must be stable in mounting seas. One size needs to be able to fit anyone and the user needs to be able to put it on from either the front or back in less than 1 minute from the first time the user sees it in the dark. This must all be accomplished in a vest that is so comfortable that it will be worn continuously, so small it will fit under the seat and usually sell for $11.00. Consequently, given these requirements, no current PFDs in the field perform to the standard as denoted in the Federal Code of Regulations.

The third party tester is thus charged with determining whether fielded Life Jackets are capable of rolling an unconscious victim floating face down into and airway protected position within 5 seconds. If the jacket allows a balance to be achieved when conscious, when the wearer looses consciousness, the head drops, moving the center of gravity forward and the wearer's face ends up in the water. At this point the life jacket has the sole responsibility to effect a corrective turning action. Few, if any, fielded life jackets are capable of corrective turning without the assistance of movement on the part of the wearer. Even if a life jacket could reliably turn the unconscious victim into an airway-protected position, the wearer is exposed to airway submersion during the recovery that will result in some degree of aspiration during the corrective turning action. If the amount of aspirated water accumulates to 200 cc the victim moves from near drowning to drowning.

Additionally, the simplest and lightest ballistic vest is Kevlar. In addition to the Kevlar vest the individual might place solid armor plates on the front and/or back. Further complicating the airway protection of the heavily armored individual is the divergent range and location of armaments and gear. As the amount of buoyancy is increased simply to keep the soldier or officer afloat the shear size of the buoyant device becomes a source of stability in the face up as well as face down situation.

Fifty percent of the sixteen fatalities in the Sleipner tragedy occurred because the victim slipped through the neck opening. Prior compressive collar PFDs while securely supporting the mandible also impinged upon the cricothyroid cartilage or voice box. The voice box is particularly sensitive to compression. What is an annoyance for small diameter necks becomes unacceptable for large diameter necks.

Previously the size of the storage container was restricted by the amount of frustration that could be borne by the individual required to pack the life jacket. The easier to pack, the bulkier the profile.

Prior single wall bilateral cervical compression PFDs were restricted because of the lack of fabric available. If the PFD opens at the midline even diagonal arms are less than ideal in that they retract in size upon inflation.

In order to avail the advantages of inflatable PFDs the US Coast Guard is accepting combined inflation means such as use of the very inexpensive 16 g $CO_2$ cylinder whose 15 lbs. of displacement is supplemented by oral inflation The personal life raft has a long history in the air force where it is included within the ejection seat of jet aircraft. In that application the weight, bulk and cost to include the means too fully inflate the raft with pressurized gas can be borne. Further the use of three layers of fabric to create a full floor with its improved conformation once inflated is acquired at considerable expense, bulk and weight. The personal life raft though similar in displacement must meet diametric design constraints and budgets. Routine inclusion within the body of the life jacket or aboard the off shore kayak must be of low volume when stored, light weight when worn and affordable. The two-layer raft, which is limited to an inflatable perimeter, is the most affordable design but the large outer tube requires considerable volume of air. Complete inflation by pressurized gas requires such a large, heavy and expensive cylinder as to be incompatible for continuous carriage within the PFD.

The only current UL standards for ballistics vests were developed for soft body armor with minimal concurrent armaments. Current regulatory performance expectations are that the applicable Type V Special Use Personal Flotation Device merely supply sufficient buoyancy to bring the individual back to the surface, face up or face down. There are no current assessments of capacity for airway protection because until now no products were capable of reliable airway protective corrective turning action, thus there remained a need for the extensive disclosure herein.

It is to the effective resolution of the shortcomings of the prior art that the present invention is directed.

SUMMARY OF THE INVENTION

The present invention provides a novel PFD that increases the amount of airway protective torque generated by the Life Jacket. Complementing the disclosed separation of the centers of gravity and centers of buoyancy to increase the generated torque are disclosures reducing the amount of torque required by stabilizing the victim's head in line with the axis of corrective turning action. The present invention also prevents airway submersion, rather than allowing the victim to fall face first into the water then attempting to recovery the victim within the allotted 5 seconds, which is common with conventional PFDs. The creation of an axis of rotation through the waist relies upon moving the ballast posterior and superior while shifting the center of buoyancy down and away from the axis of rotation. This axis pulls the obtunded victim straight back completely avoiding submersion.

The inclusion of ballast in the PFD results in two opposing forces participating in initiation and completion of corrective turning. In one embodiment a solid ballast, such as lead, is used because its high specific gravity allows the smallest diameter sphere per unit mass. The smaller ball can traverse smaller containers, also reducing cost. The smaller contained mobile eccentric ballast occupies less space within the cover of the PFD resulting in the preservation of the amount foam displacement means. In an alternative embodiment, water is introduced into the container, in lieu of solid ballast. The water is quite heavy when in the air and is uniquely neutrally buoyant when under water. The solid ballast is capable of staying near the perimeter where it reinforces the side high position with its reduced freeboard if not out right airway submersion.

The fluid ballast preferably flows over minor imperfections in the container's inner surface. The relocation of the fluid ballast begins immediately once the victim crosses the inflection point in the corrective turning action. The fluid ballast can relocate on a partial basis, rather than the all or nothing outcome of the solid ballast. While lead shot ballast of small diameter flows similar to a liquid it is not neutral once submerged and may not be reliable in traversing a soft fabric container where water can negotiate and surface with impunity.

The primary goal of the life jacket is to protect the airway upon entrance and during the initial shock that ensues. If trauma occurred prior to entry such as being struck by the boom of a sailboat then face up flotation is critical. If the individual is conscious depending on the water temperature they have sometimes less than an hour to exit the water or suffer a drop in core temperature that will lead to loss of consciousness. The Life Jacket must therefore also carry with it the means to exit the water. Bridging the two chest straps a life raft acts as a cummerbund holding the PFD to user. Once stable the PFD is removed.

The present invention also provides a valise that is securely attached to the life raft so that as the raft kites during inflation it will not blow away across the seas. Assisting this is a wrist lanyard at the opening of a windsock inflation means. The windsock is held aloft till full, then the neck is closed and the entrap air milked into the chambers of the raft either simultaneously or sequentially through the use of different pressure relief valves. Due to the extreme difficulty of controlling a six-foot inflatable in high winds a secondary body lanyard attaches the raft to the victim. If there is no wind the windsock can be shaken to scoop up air and then transfer that air to the raft. This rapid inflation occurs without the use of expensive, heavy, bulky compressed gas and inflation apparatus, which requires frequent maintenance and fears of failure at many points. Additional novel uses of the windsock further improve safety and survival at sea such as filling it with water to serve as a sea ballast, which helps hold the raft to the water's surface. In the event that the raft overturns on a breaking wave the sea ballast quickly reorients the raft and its victim if securely restrained within the raft.

A quick release cover serves not only to keep the victim aboard if it happens to overturn, but also to protect the victim from sunburn, as well as serve as a means to capture rain or wind as the weather improves. Approximately, one half of the cover can be quickly releasable in the event that the raft does not flip back over, when overturned, to allow the victim to slip out. When the windsock is attached at multiple points, one can preferably be the center of the body where it inflates the floor as well as one or two perimeter points of inflation. Once in the raft the windsock opening can be closed converting it into a sea ballast bag. A fill tube accessible to the raft's occupant allows the ballast bag to be filled. The ballast fuses the raft to the water's surface and supplies a massive keel in the event of broach.

If the seas are not breaking, the windsock can be detached and the reinforced perimeter attached at three points identified by grommets to allow the windsock to serve as a steering sea anchor orienting the raft in the waves. Once the storm is over the windsock with reinforced receiving pouch and lash cord can be attached to a paddle handle and serve as a spinnaker or sail as the victim attempts to move towards shipping lanes to improve chances of rescue. The windsock can be constructed from waterproof-coated fabric and can also serve as a funnel to collect and store rainwater. If the windsocks inner face is black or dark the inclusion of a piece of clear plastic allows the construction of a solar still capable of capturing potable condensate.

Thus, the invention provides for fluid ballast, alone or in combination with a solid ballast means that is functionally directed to different locations within the boater's personal flotation device or diver's Buoyancy Compensator BC through a rigid or flexible container. Complementing the effect of the shifting ballast on the PFD's airway protective turning action is the torque generated by the structurally enhanced buoyant means. The invention allows both the amount of ballast and buoyancy needed to effect reliable face flotation to be reduced to their minimum by a disclosed inverted configuration of the buoyant moment. Shifting the center of buoyancy away from the axis of rotation creates a longer arm and thus more torque per unit of displacement. Further the inverted configuration results in the buoyant force acting through the apex of its triangular configuration creating a hinge, which confers flexibility. That flexibility allows the buoyant moment to shift off to the side thereby helping to initiate turning.

The size of the connection between the inferior anterior buoyant means and the posterior superior cervical ballast allows escape of the submerged buoyant means to initiate turning. If the apex is overly narrow without the buoyant means moves without control, dissipating the energy needed for rotating the victim's face out of the water. The apical joint also flexes about the thorax increasing comfort. In addition the triangular configuration establishes an open space to allow unimpeded arm movement during. swimming as required for PFD approval.

The integration of ballast and buoyant moments into a continuous structural base layer improves transfer of torque from both the fluid/solid ballast and the opposing extended buoyant arm. The particular arrangement disclosed allows the unconscious victim to be pulled straight back thereby avoiding face down flotation rather than first allowing face down flotation then attempting to roll them over onto their back. The prevention of drowning relies upon a new described turning action about an axis through the waist. The disclosed product because of its combined use of dual arms demonstrates marked improvement in classic rotation about the spine previously the only identified or assessed corrective turning action. The disclosed adjustable cervical collar includes a mandibular shelf preventing both anterior posterior movement as well as side-to-side movement.

Controlling the considerable ballast of the head reduces the amount of torque required of the transpontine ballast and buoyant moments. In current automatically inflated PFD on face first entry, the neck is driven through the jacket opening and product failure consistently occurs. To assist in controlling the head and neck, the present invention provides overlapping and pneumatically compressed locks assist in maintaining necessary control, of the heads ballast. Decreased need for torque converts into a smaller PFD leading to increased comfort, compliance and therefore improved utility in preventing drowning. Due to mounting concerns from wave tank tests about drowning while floating face up several novel airway protective devices are disclosed that complement the airway protection that arises from either prevention of airway submersion or the rapid recover from the face down position in the event it occurs.

Furthermore, compliance with children is a serious problem, the child's vest is not only improved functional fluid ballast, its inclusion in a clear tube with brightly colored fish swimming around as the water moves improves the chances of being worn as well as providing enhanced airway protection. Additionally, survival at sea, if one does not immediately drown, is proportional to the rate of heat loss or passive intrusion of water from breaking waves. Disclosed is a rapid manual inflation means for a personal raft stowed within the back of the PFD. After inflation, the means of inflation can be used as a sea anchor to orient the vessel in building seas. In breaking seas the inflation means can be converted to an Icelandic sea ballast to secure the raft to the waters surface. Once the storm had past the detachable inflation means can then be held aloft to function as a sail to move the raft towards shipping lanes to improve chance of rescue. The raft inflation means constructed of coated fabric now acts as a funnel to collect and store rain. If constructed of dark coated fabric and can be combined with a clear cover and now serve as a solar still, dramatically extending the duration of safety and survival at sea from an hour to weeks.

Thus, in one embodiment the invention provides for fluid ballast, alone or in combination with a solid ballast means, that is functionally directed to different locations within the boater's personal flotation device ("PFD") or diver's Buoyancy Compensator BC through a rigid or flexible container. Complementing the effect of the shifting ballast on the PFD's airway protective turning action is the torque generated by the structurally enhanced buoyant means. The invention allows both the amount of ballast and buoyancy needed to effect reliable face flotation to be reduced to their minimum by a disclosed inverted configuration of the buoyant moment. Shifting the center of buoyancy away from the axis of rotation creates a longer arm and thus more torque per unit of displacement. The invention provides a vertically eccentric PFD, combining inferior and anterior shift in the center of buoyancy with superior posterior shift in the center of gravity, generating torque needed for improved corrective righting action of the PFD.

In another embodiment, the present invention also provides a multi-chambered high torque PFD for powerful corrective turning action of a weighted individual. Disclosed is a multi-chambered device capable of being adjusted to provide a wide range of buoyancy as might be needed under differing degrees of ballistic protection. The disclosed eccentric mobile buoyant system complements the massive displacement required to float the armored victim by providing the energy required to reliably initiate corrective turning action, regardless of the gear worn, position of water entry, or state of consciousness of the wearer. In the event the conscious victim desires to shed the body armor, a series of quick release means allows the victim to shed their ballistics vest while retaining their life jacket.

The individual wearing body armor or heavy equipment on or around the water creates a challenge in the event of sudden entry. In a military setting each strike plate weighs over 9 pounds, typically the individual is also carrying significant armaments, or additional gear. The individual needs not only to float but also to be assured that if they injured before suddenly entering the water that an integrated PFD will also orient them into a face up situation. Do to the shear mass attached to their person the buoyant moment attached needs to support the gear as well as the unconscious wearer. As the size of the bladders used to support the armored individual their size creates a secondary problem stability face down as well as face up. Additionally while the use of 9 lbs. of ballast on the back of the victim can augment the corrective Turing action of the integrated life jacket system it is possible that the individual may only have placed a plate on the front of their vest dramatically shifting the centers of ballast and buoyancy. Obviously arrangement of extra ammo, weapons and communication gear may also be of assistance like wise it may also be a detriment to the life jacket system. Further it is desirable that the Life Jacket be able to be activated while wearing the body armor but latter the victim may desire to drop their body armor with out loss of their life vest and thus it is desired that the integrated life jacket upon separation from the heavily ballasted body armor continue to provide reliable airway protection. Currently there are no ballistics vests that provide the unconscious victim with reliable corrective turning action yet alone to consistently provide airway protection under the wide variety of conditions disclosed.

The present invention provides a multi-chambered high torque PFD for powerful corrective turning action of a weighted individual. The multi-chambered device is capable of being adjusted to provide a wide range of buoyancy as might be needed under differing degrees of ballistic protection. An eccentric mobile buoyant system complements the massive displacement required to float the armored victim by providing the energy required to reliably initiate corrective turning action, regardless of the gear worn, position of water entry, or state of consciousness of the wearer. In the event the conscious victim desires to shed the body armor, a series of quick release means allows the victim to shed their ballistics vest while retaining their life jacket. The integrated life jacket upon separation from the heavily ballasted body armor continues to provide reliable airway protection. The present invention provides the unconscious victim with reliable corrective turning action and airway protection under the wide variety of conditions disclosed.

The present invention also provides for a garment mounted, integrated, or encapsulated crico-thyroid encapsulating midline closing mandibular supportive life jacket in high compression cover and a redundant abdominal PFD, a rescue inflatable, personal life. raft and marking and recovery bladders.

The inflatable cephalo-mandibular shelf which encapsulates the crico-thyroid cartilage protects it from compression by self closing unilateral or bilateral arms contained within a dual zipper cover. The invention provides a crico-thyroid cartilage protective variable volume, dual chambered, double walled cervical compression PFD, as well as a garment mounted, integrated or encapsulated high compression dual zipper cover. Also provided is a personal life raft with variable pressure hydrostatic pump, quick release abdominal rescue inflatable with transferable equipment marking and recovery system.

Thus, disclosed is an interchangeable, complementary and synergistic range of airway and equipment protective buoyant, rescue, marking and recovery devices, sequentially inflated by various means including, oral, manual or automatic compressed gas or variable pressure hydrostatic pump. A garment mounted, integrated or encapsulated dual zipper high-compression, low-profile cover releases a unilateral or bilateral, midline crossing or midline compressing bladder that creates a reliable mandibular shelf and bracket while simultaneously encapsulating the crico-thyroid cartilage protecting it from compression. A dual wall PFD with its over sized inner bladder creates extended midline crossing. A dual chambered inner bladder separates the compressed gals inflated high-pressure low-volume bladder required for corrective turning from the higher-volume lower-pressure orally inflated chamber which provides the additional buoyancy needed to improve freeboard. An over pressure valve connects the turning and freeboard chambers so that the sole source of compressed gals can be sized to inflate only the turning chamber or the turning chamber and part of the freeboard or completely inflate both chambers. A dual release mechanical and superimposed fabric lock handle allows for the quick release of the deflated redundant abdominal PFD which can then serves as an accurately thrown rescue inflatable. The abdominal body angle arm establishes the mandated in water position. Interchangeable bladders secured by a universal mounting system allow the quick in-field relocation of buoyant moments to offset the varying amounts and location of operation specific attached ballast. The disclosed variable volume, dual chambered, dual walled cephalo-mandibular supporting, crico-thyroid protective, high torque, garment integrated PFD appropriately reduced in proportion to the lack of attached ballast will supply the recreational boater the same novel advantages. The PFD integrated variable-displacement dual-pressure personal life raft uses compressed gas to inflate a rigid floor conferring sufficient buoyancy to support the Marines 35 lb. rucksack. Excess gas from use of larger cylinders passes through an over pressure valve between the floor and perimeter tube allowing the raft's displacement to be incrementally increased to support any portable ballast. The remainder of the raft is inflated by 3 to 5 cycles of a variable pressure hydrostatic pump which can be worked by a single arm or leg to rapidly fill then pressurize the high volume perimeter tube allowing the rapid exit from the water as needed to avoid hypothermia. The disclosed, flexible water extrication system was initially designed for the heavily ballasted military personnel wearing various combinations of soft and rigid body armor, guns, ammo, backpacks, heavy clothing and other miscellaneous gear and provisions. This individual may have 20 to 110 lbs. of gear attached to their person at the moment of sudden unexpected water entry. The chances of being shot, seriously injured, if not unconscious at the time of submersion are considerable. The soldier may be undertaking a fast moving 2 hour recognizance mission carrying very little gear and only in need of a single, low profile, airway protective collar PFD stowed highly compressed by a dual zipper cover. Alternatively they may be on an extended operation transporting a backpack with tents, sleeping bags and radio gear in addition to wearing 20 lbs. of tactical plates for protection from rifle shot as well as 10 lbs. of soft armor for extended protection from pistol shot or fragmentation. This individual's life depends not only upon rapid reliable return to the surface and face up flotation until conscious but their life also depends on concurrent recovery of their valued survival gear and exit from hypothermic water. This individual through this disclosure is now provided with an interchangeable, complementary and synergistic range of airway and equipment protective buoyant devices, sequentially inflated by variations in deployment means including, manual, automatic water or hydrostatic pressure activation. A dual release mechanical and superimposed fabric lock handle allows the external quick release of a deflated rescue PFD or for the user to release the abdominal bladder after it has been inflated. Reliance upon interchangeable bladders secured by universal mounts within universally mounted pneumatically self-releasing bladder containers allows the quick in-field recombination of displacement amount and location to match the divergent amounts and varied location of the situation specific ballast immediately attached to their person. The disclosed variable volume, dual chambered, dual walled cephalo-mandibular supporting, high torque, self rescue garment integrated PFD and equipment integrated bladders, appropriately reduced in proportion, will supply the recreational boater as well the individual working around water with heavy tool belts, the same novel advantages. The personal life raft's rigid floor confers sufficient buoyancy to support the 35 lb marine rucksack; spill over compressed gas inflation allows that amount to be raised to support the radioman's load. Disclosed variable pressure hydrostatic pump can be worked by a single arm or leg to rapidly fill then pressurize the high volume perimeter tube allowing rapid exit from hypothermic water.

DESCRIPTION OF THE PREFERRED EMBODIMENTS

Figure 1:
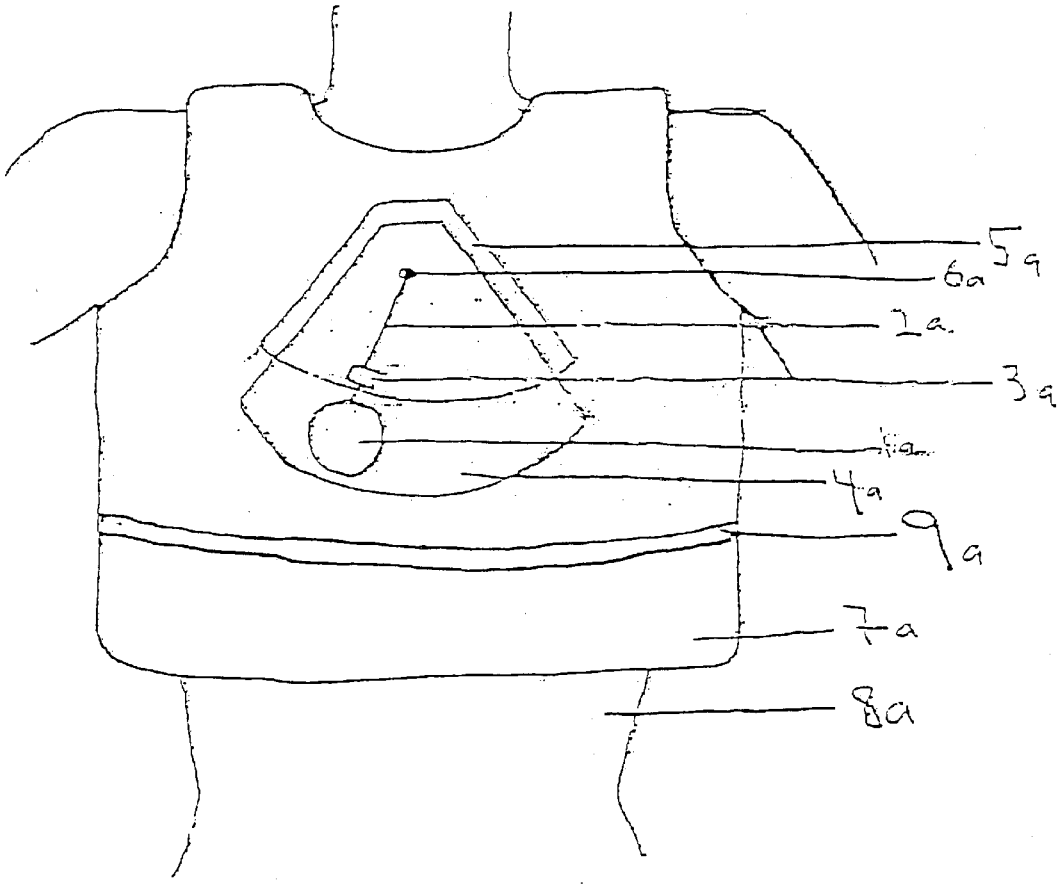
FIG. 1 is a posterior view of a vest style personal flotation device ("PFD") illustrating middling mobile ballast.
Figure 3:
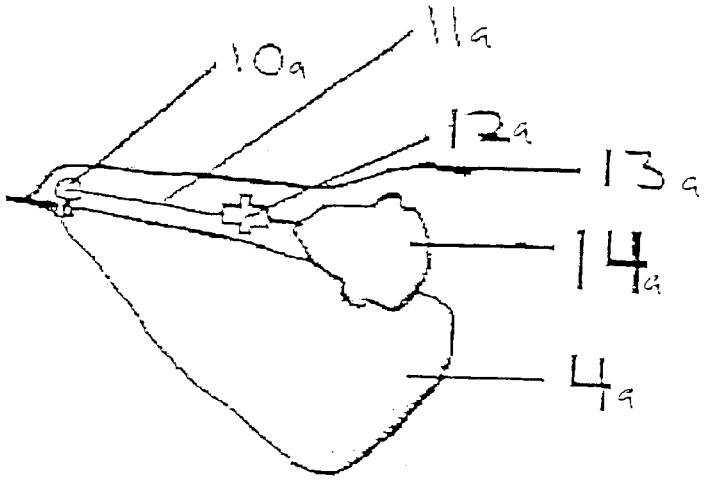
FIG. 3 is a side view of a mobile ballast attachment means illustrating numerous components facilitating mobility of the ballast member.
Figure 2:
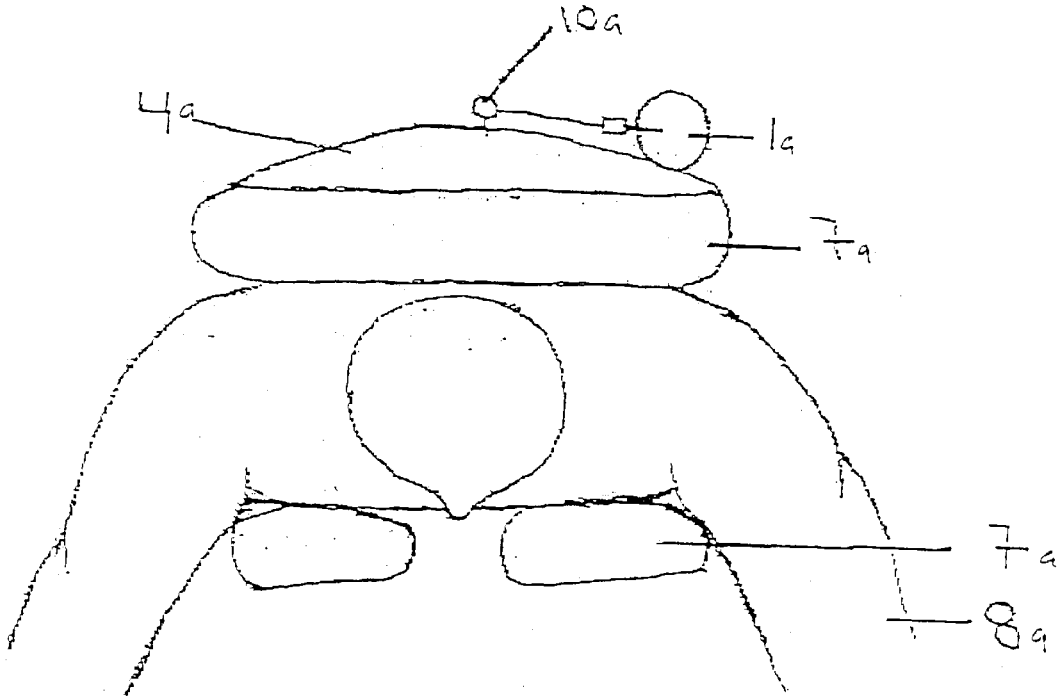
FIG. 2 is a cephalic view of a victim wearing a vest style PFD illustrating the eccentric positioning of mobile ballast.
Figure 4:
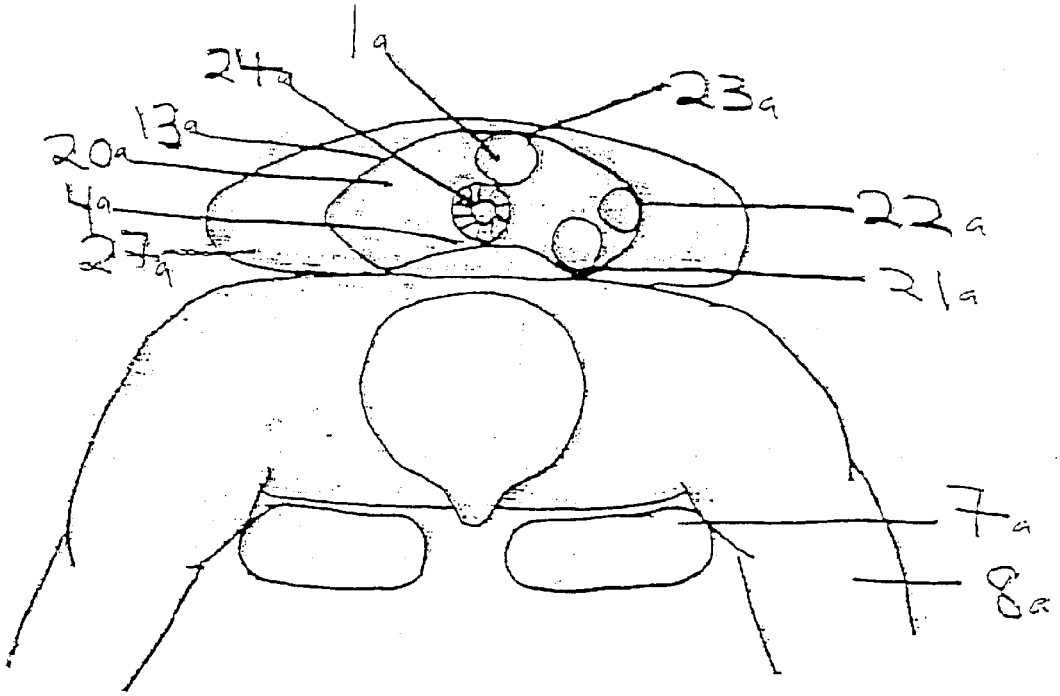
FIG. 4 is a cephalic view of a victim wearing a vest style PFD illustrating a freely mobile ballast within a container that redirects the ballast's movement as the victim rolls.
Figure 5:
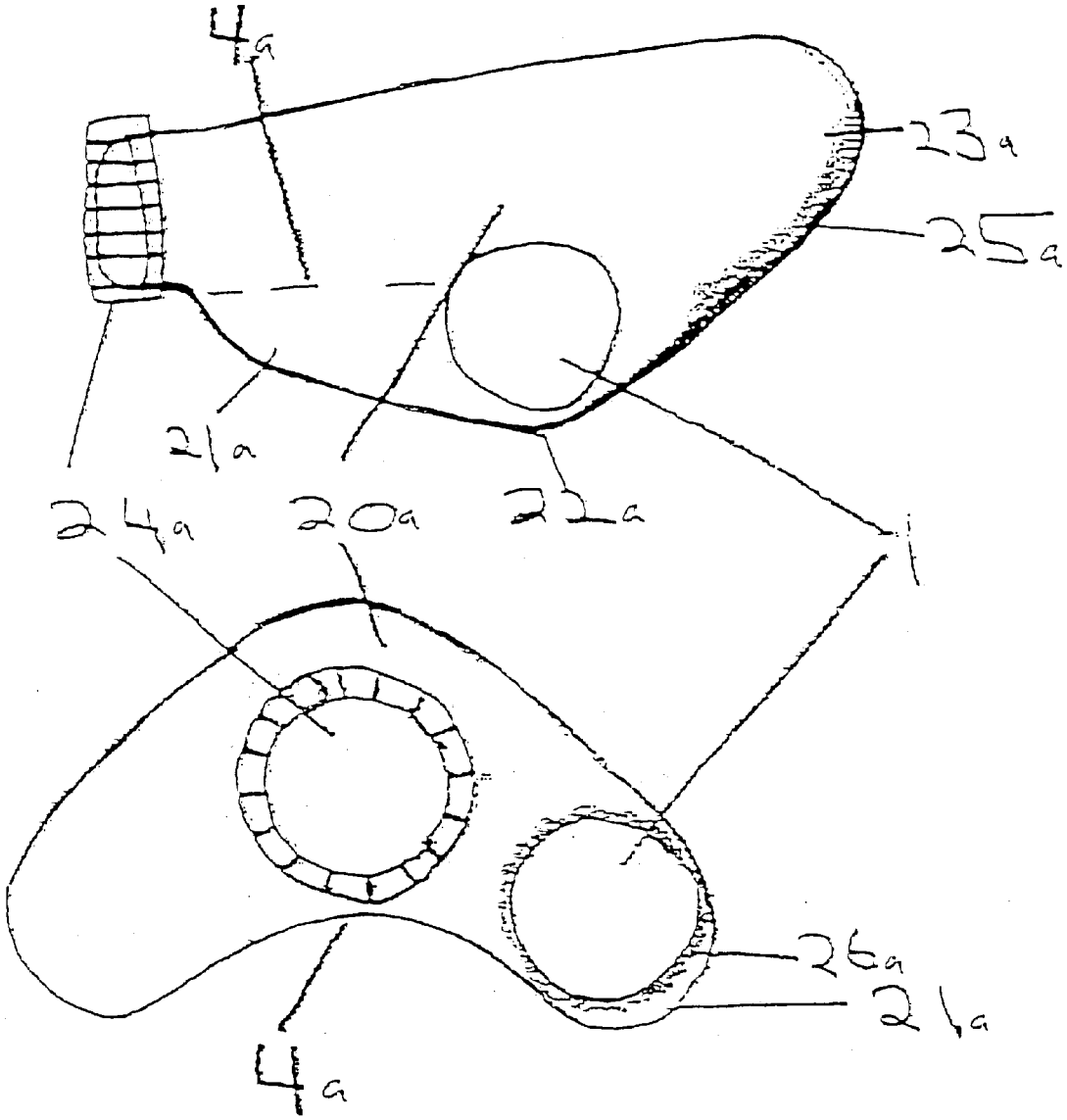
FIG. 5 is a lateral and cephalic view of the mobile ballast's container illustrating the multiple points of stability, as it is reoriented in three dimensions.
Figure 6:
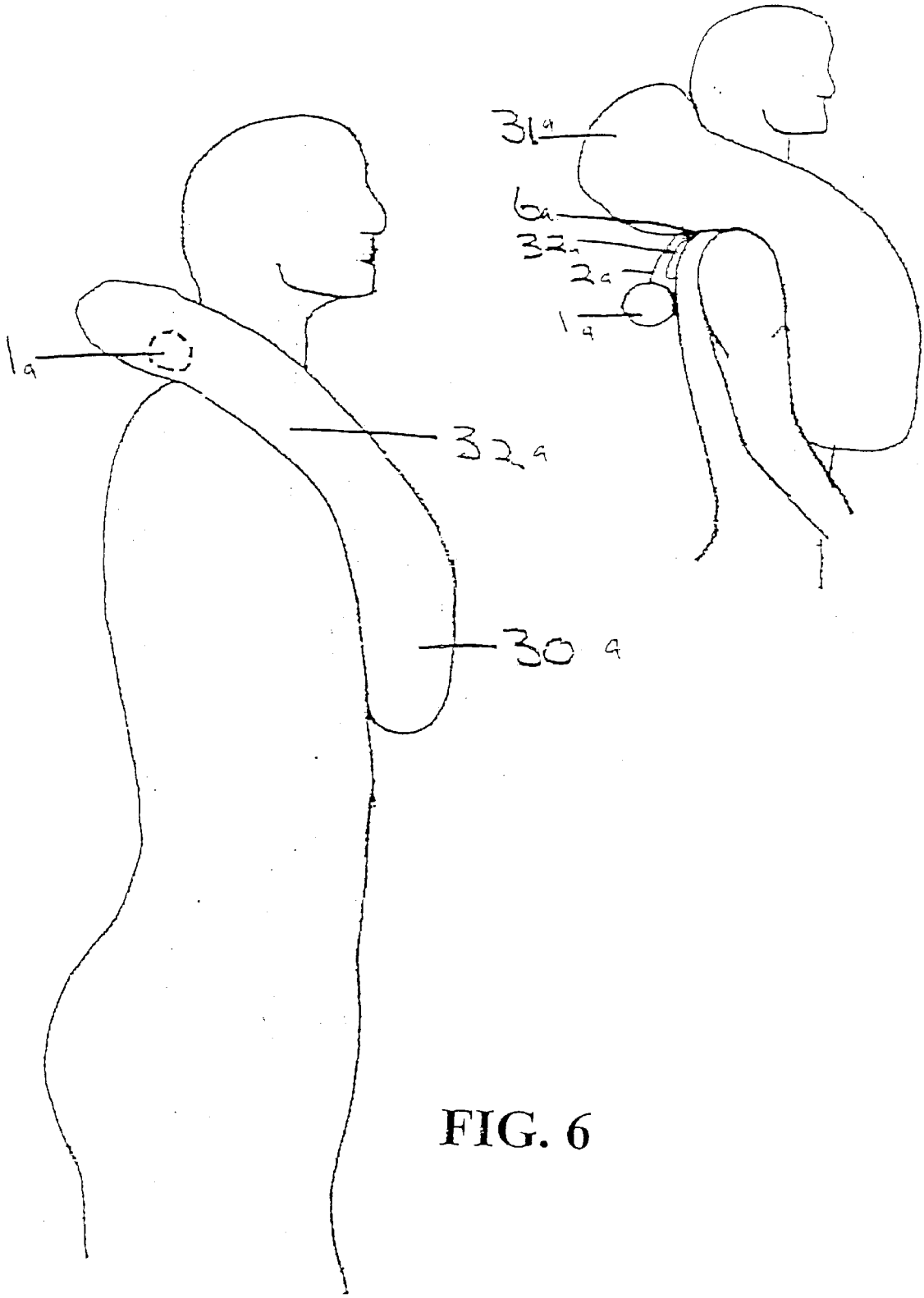
FIG. 6 are lateral views of a deflated then inflated PFD illustrating stowage then deployment of the ballast member.
Figure 7:
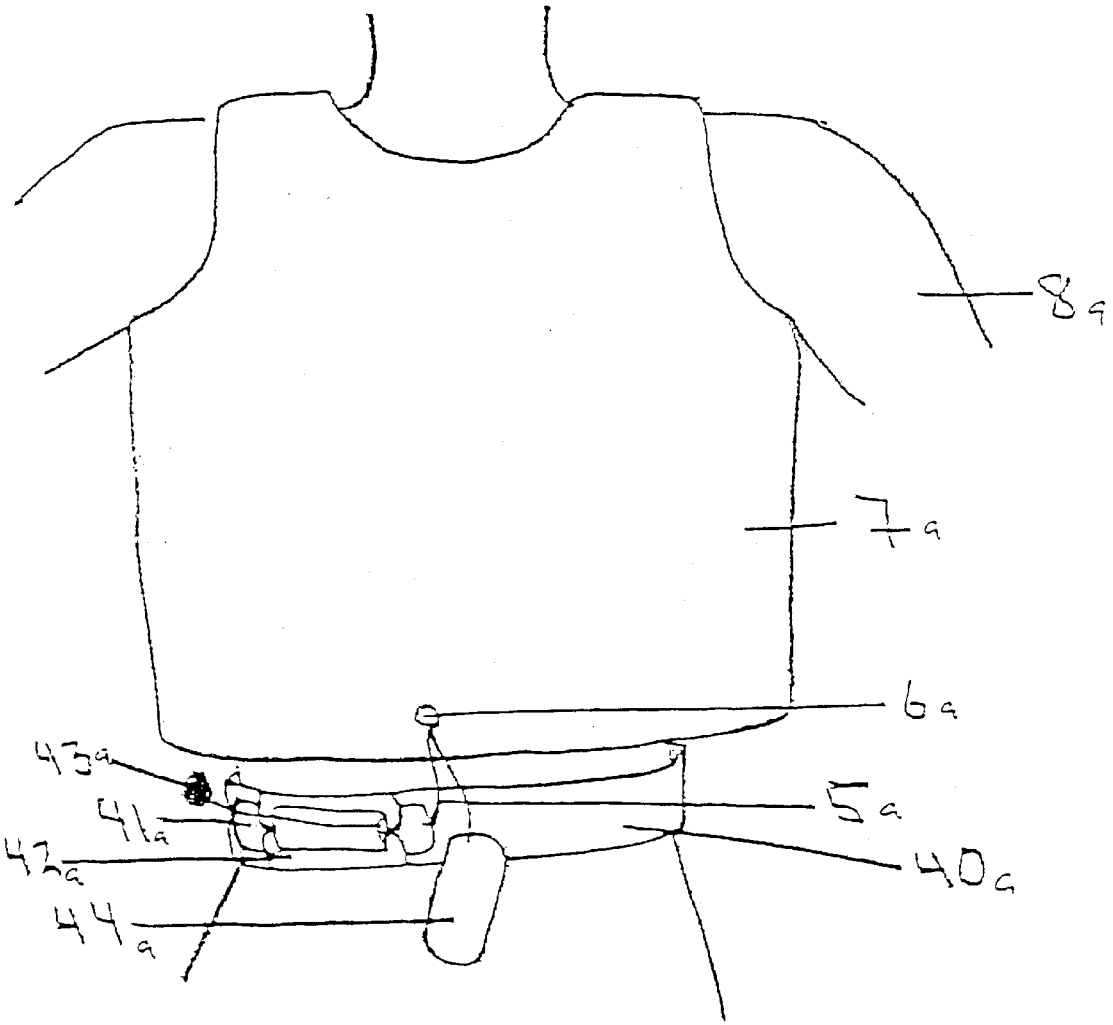
FIG. 7 is a posterior view illustrating a dual position minimally active eccentric fixed keel that can be released by the wearer into a maximally active mobile position.
Figure 8:
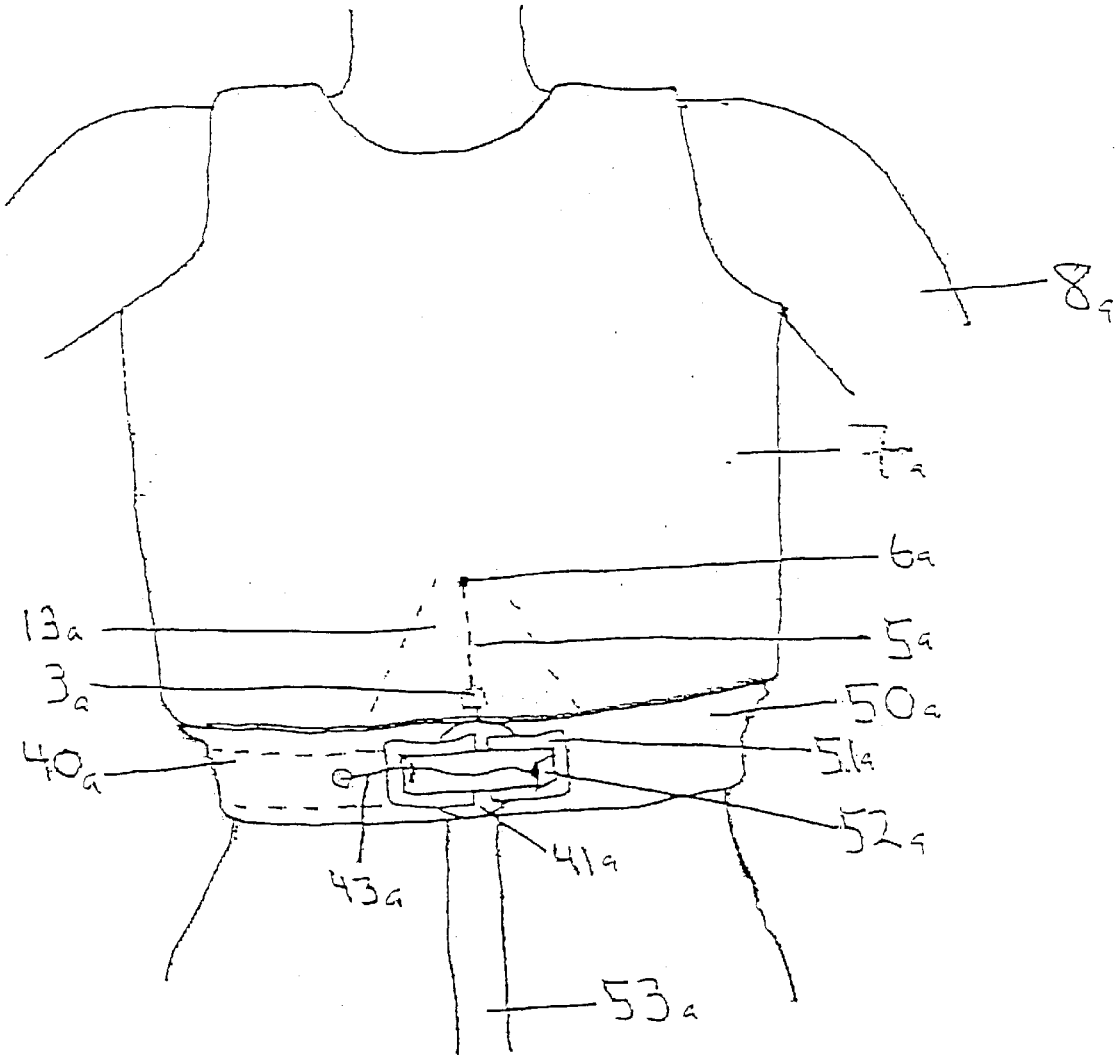
FIG. 8 is a posterior view showing an immobilized ballast member that can be released by the wearer into an active mobile position.

FIGS. 1 through 8 illustrate swing keel embodiments for a ballasted personal flotation device ("BPFD"), which allows the use of a relatively small (light) keel (weight/ballast) to enhance comfort and compliance of a personal flotation device ("PFD") while retaining the efficacy necessary to self-rescue an unconscious victim. PFD is defined, for all of the above and below disclosure, to include all various traditional personal flotation devices, as well as buoyancy compensators, and other types of dive gear. While permanent eccentric placement of the ballasting member achieves enhanced rotation, it leaves the victim floating off to one side, placing one corner of the mouth in closer proximity to the waters surface i.e. decreasing freeboard, a parameter used by testing laboratories to determine PFD efficacy. The placement of the mobile ballasting moment 1*a* on a centrally attached flexible 2*a* or rigid arm 11*a* allows movement of the keeling member towards either the left or right side. Once set in motion the keeling moment gains momentum, accelerating the victim about their axis of rotation, towards the position of greatest stability i.e. where the ballasting moment is suspended beneath the center of buoyancy rather than balanced above it and the victim's airway is consequently positioned out of the water.

The keel's arm can either be flexible 2*a* or rigid 11*a*. The swing of the keel is preferably constrained such that its course allows access to the left or right about a caudal arc but restricted in its cephalic swing such that the ballasting member cannot strike the victim's head. The location of attachment 6*a* of the keel's arm can be variable as dictated by location of the PFD's buoyant members or the individual's anatomy, i.e. such as one who has had a lung or limb removed with its dramatic impact on surface positioning. In general a central positioning provides the greatest symmetric freeboard. The keel's range can be limited by rigid 13*a* or flexible 5*a* member that constrains range of motion but ideally without impinging upon the ballasting member in such away that it would impair freedom of movement. A rigid cover 13*a* is preferred in protecting the head of the victim from being struck by the keel and provides reliable constraints upon the lateral and posterior range of motion. To reduce cost, a fabric cover 5*a* sewn above the keel arm 2*a* can alternatively be provided and determines the keel's lateral and posterior range of motion.

To enhance mobility of the keel a spherical design 1*a* promotes easy rotation about its arc, though other shapes are considered within the scope of the invention. Comfort, aesthetics and therefore compliance argue for a portion of the keeling member to be more cylindrical 14*a* to reduce the protuberance of the keel from the back of the PFD.

A swivel 3*a* integrated into the flexible arm 2*a* or rigid arm 11*a* of the swing keel can be provided to reduce resistance of the ballasting member rolling along its arc. Swivel 3*a* eliminates the opposition to rotation that can arise from twisting the rigid or flexible arm that attaches the keel to the BPFD and/or eliminates the drag that can arise as the keel is skidded or dragged along the surface rather than rolled.

Modification of the dorsal surface of the PFD into a complementary convexity 4*a* further reduces the incidence of the center of ballast to be stabilized above the center of buoyancy. While the foam of the jacket could be shaped into a convex surface 4*a* to meet this need, the storage of the BPFD might result in the high density keel deforming the foam, creating a depression with significant memory such that when the PFD is pressed into use the depression might entrap the keel allowing the victim to once again be stabilized in a face down position. Ideally convexity 4*a* is formed of some rigid material. The rigid surface can be independent or fused to the PFD's closed cell foam. Rigid convex surface

4*a* further reduces the coefficient of friction between rolling swing keel 1*a* and the surface of the PFD over which the keel is rolling. The improved ease of movement of the rigid keel upon the rigid convexity further contributes to the reduction in keel mass without sacrificing reliable airway protection.

A rigid container 20*a* can alternatively contain the ballasting member, to be freed from the constraints of the flexible or rigid arm. Fully enclosed the ballast sphere 1*a* could roll across a surface designed to enhance self-rescue. In the face down position the keel preferably resides on a rigid convexity 4*a* initiating movement to the left or right lateral gully the lowest point to the left or right upon face down entry into the water. Upon reaching the lateral gully of the container the surface would angle off towards the legs or Caudal gully 22*a*. This inferior movement of the mobile ballast 1*a* complements the naturally occurring motion of the victim where the initial axial rotation is supplanted by a pendular motion as the legs swing from the flexed position of the face down position into the extended position of a victim floating face up. The containers third low point, the posterior gully 23*a* would attract the mobile keel from either the left or right caudal gully 22*a*, moving the ballast away from the back of the victim, establishing then stabilizing the victim in the safe zone, approximately thirty (30°) degree off of dead vertical. The dangerous zone is identified as vertical to less than approximately twenty (20°) degrees off of vertical, in which position the head of the unconscious victim can flex forward submerging the victim's face and/or seriously compromising the victim's airway. The rigid container 13*a* provides a three-dimensional rigid surface upon which the keel can easily relocate, directing the mobile ballast 1*a* through a progressive series of angled surfaces complementing and thereby driving the complex maneuvers associated first with initiation of rotation then converting the victim's rotary motion into a cephalo-pedal swing and finally stabilizing the unconscious victim in the airway protected surface position known as the "safe zone".

The container if sealed 24*a* can contribute an inflatable element equal to its displacement minus the mass of the keel, to the buoyant means of the PFD. The "neutral" buoyant mobile ballast "swing" keel can thus be integrated into the body of the PFD, reducing bulk and thereby enhancing comfort appearance and therefore supporting the compliance critical to real world efficacy. Any decrement in comfort is outweighed by the superior performance of the BPFD over current PFDs.

The BPFD shifts the onus of rotating the unconscious victim from buoyancy alone to a system combining ballast and buoyancy. The secondary gain associated with the advent of the BPFD is that buoyancy now relieved of the task of rotation can be relocated from the ventral area to the peri-cervical-cephalo area where its displacement can be employed to improve freeboard enhancing victim viability in an inclement sea state rather than sitting uselessly above the water line upon the chest of the unconscious victim. Additionally, with the improved physics of self-rescue accomplished by using a combined ballast/buoyant PFD, some of the buoyancy previously employed for rotation in prior art PFDs can be eliminated reducing bulk and further increasing comfort and compliance.

For the individual occupied around the water environment, a soft coating of the mobile keel 26*a* and/or inner surface 25*a* of the container can be provided to mute the sound of the movement of the ballasting member 1*a*, promoting day in/day out comfort and compliance while retaining the advances of BPFD's reliable airway protection.

Environmental concerns mandate that the keeling members, ideally of high density comport with environmental responsibility. Given the life span of the fabric bodice of the PFD it is preferred that a non-lead keel be selected, though such is not considered limiting. The corrosive marine environment can be negotiated by an epoxy coated ferrous material that would exceed the life span of the other component of the PFD and not lead to a lead recovery problem.

There is currently a movement under way to convert the current complex classification of PFD's which is Type I through V into a more succinct and clear labeling of life jackets, Type A & B. Clear labeling would identify Type A as Airway Protective and Type B as a Buoyant Aid but not airway protection. The Type B can be identified with a pictograph showing a slash across a victim floating in a face up position. Complementing the new direction in PFD nomenclature, a quick release coupling 12*a* in the swing keel's arm 5*a* can be provided to allow the recreational boater required to wear PFD to comply with the law by routinely wearing a Type B Buoyant Aid, but in the event of deteriorating weather or impending emergency the connection of ballasting member 1*a* would allow the boater to upgrade the performance of their Type BPFD into a Type A Airway Protective PFD.

For the individual engaged in or about water, mobile ballast member 1*a* can be restrained in an inactive position 42*a* until released in the event of an emergency into its central active position 44*a*. Such release converts the BPFD from Type B into Type A. Ideally the outer shell of the PFD 50*a* continues down towards the waist to envelope a secure belt 40*a* to which the inactive immobilized ballast member 41*a* is secured by a quick release means 42*a*. In one embodiment, a pair of hook and/or loop fastening members can be closed or the immobilized ballast member 41*a* by a releasable piece of hook and/or loop fastening member connected by a pull cord 43*a* to the front of the BPFD. The secure belt holding the ballast in close and tight proximity to the body of the wearer 8*a* allows the ballast to be comfortably borne by the hips of the wearer rather than swinging about on their back. The dual position BPFD is preferably used with active water sports where the decision to convert from Buoyant Aid to Life Jacket occurs rarely, in contrast to the commercial Type A jacket, which is only donned in the event of an impending emergency water entry.

Additionally the mobile ballast 1*a* can be specifically adapted to inflatable PFD where it is stowed and restrained within the cover. Upon inflation of the buoyant chamber the mobile keel would be released into its active position.

Some of the advantages achieved with and/or features of one or more of the embodiments illustrated in FIGS. 1 through 8 include, but are not limited to, the following: (1) Mobile ballast member integrated into the buoyant means of a personal flotation device; (2) Mobile ballast member attached to life jacket by flexible means; (3) Mobile ballast member attachable at variable positions to the life jacket by flexible means; (4) Mobile ballast member attached to life jacket by flexible means held in inactive position until released; (5) Flexible means connected through swivel to ballast member; (6) Flexible means connected through quick release coupler to ballast member; (7) Mobile ballast member attached to life jacket by rigid means; (8) Rigid means connected through swivel to ballast member; (9) Rigid means connected through quick release coupler to ballast member; (10) Ballast member of spherical configuration to facilitate movement along arc; (11) Rigid convex surface over which ballast member rolls throughout the arc of rotation determined by attachment means; (12) Rigid convex surface integrated with displacement foam of life jacket; (13) Rigid cover limiting range of motion of ballast member;

(14) Flexible cover limiting range of motion of ballast member; (15) Enclosed container restricting range of motion of ballast member; (16) Enclosed container with convex surface—With second intersecting surface angled caudally—With third intersecting surface angled dorsally; (17) Enclosed container permanently sealed off to create buoyant means, less than, equal to or greater than ballasting means; (18) Enclosed container reversibly sealed off to create buoyant means, less than, equal to or greater than ballasting means; (19) Container and or ballast means coated with sound absorbing material; (20) Mobile Ballast secured quick release inactive position—Secured to belt about waist; (21) Belt loosely connected to PFD contained in Fabric of outer shell; (22) Quick release mobile ballast secured to crotch strap securing PFD to wearer; (23) Mobile ballast immobilized within storage shell of inflatable PFD, released upon inflation; and (24) Inflatable.

FIGS. 9 through 15 illustrate the eccentric fixed and mobile-ballasted life jackets embodiments of the present invention. While sufficient ballast placed along the posterior midline of a PFD will create instability of the face down position and therefore eventually initiate the airway protective roll, central positioning requires significantly more ballast and time to destabilize the face down position. The current invention provides several embodiments that allow a relatively small keel to achieve, more rapidly and comfortably, reliable airway protection. Given that a stackable Type 1 PFD only weighs 3–5 lbs., the addition of excessive amounts of high-density ballast is quite noticeable and uncomfortable to the wearer. Previously discussed tank mounted ballast for a typical midline keel weigh from the 6–8 lbs. The present invention reduces the weight to 1–2 pounds of highly; effective eccentric mobile ballast.

In the fixed posterior midline position discussed above, the keel is stabilized directly above the center of buoyancy, the horizontal distance of the keel from the axis of rotation is consequently zero and the rotational energy generated by the fixed midline keel is also unfortunately zero. A keel located top dead center is described as being at zero (0°) degrees on the circumference about the victim's axis of rotation.

When the keel is at ninety (90°) degrees the horizontal distance from the axis of rotation is at its maximum and therefore, for a given amount of ballast, so is the effort applied in rotation of the victim about their axis. When the keel is at one hundred eighty (180°) degrees it is suspended directly beneath the victim and the entire system's center of buoyancy. The effect of gravity upon the keel at one hundred eighty (180°) degrees is straight down once again i.e. no energy is being applied in an attempt to rotate the victim about their axis. This position, with the keel one hundred eighty (180°) degrees, places the victim face up airway protected and is the only stable moment in a correctly ballasted self-rescuing BPFD (Ballasted Personal Flotation Device). In the event that a large wave throws the victim over onto their face, once again the keel will seek its lowest point, suspended directly beneath the center of buoyancy, restoring airway protection.

The rate of self-rescue is dependant upon numerous factors in addition to size of the keel and are discussed below. Compliance (the presence of the Life Jacket on the victim at the onset of a water emergency) has been shown to be critical in drowning prevention as opposed to the PFD carried aboard the vessel but stowed rather than worn. The eccentric mobile ballast of the present invention by either its site of attachment off of the midline or its rapid movement away from the midline is able to initiate the self-rescue roll with relatively less energy input i.e. less weight. The eccentric keel optimizes the rotational energy per unit mass allowing reliable airway protection to coexist with wearer comfort, which has been shown to be a non-negotiable bottom line necessary to achieve real world compliance and therefore efficacy.

Figure 11:
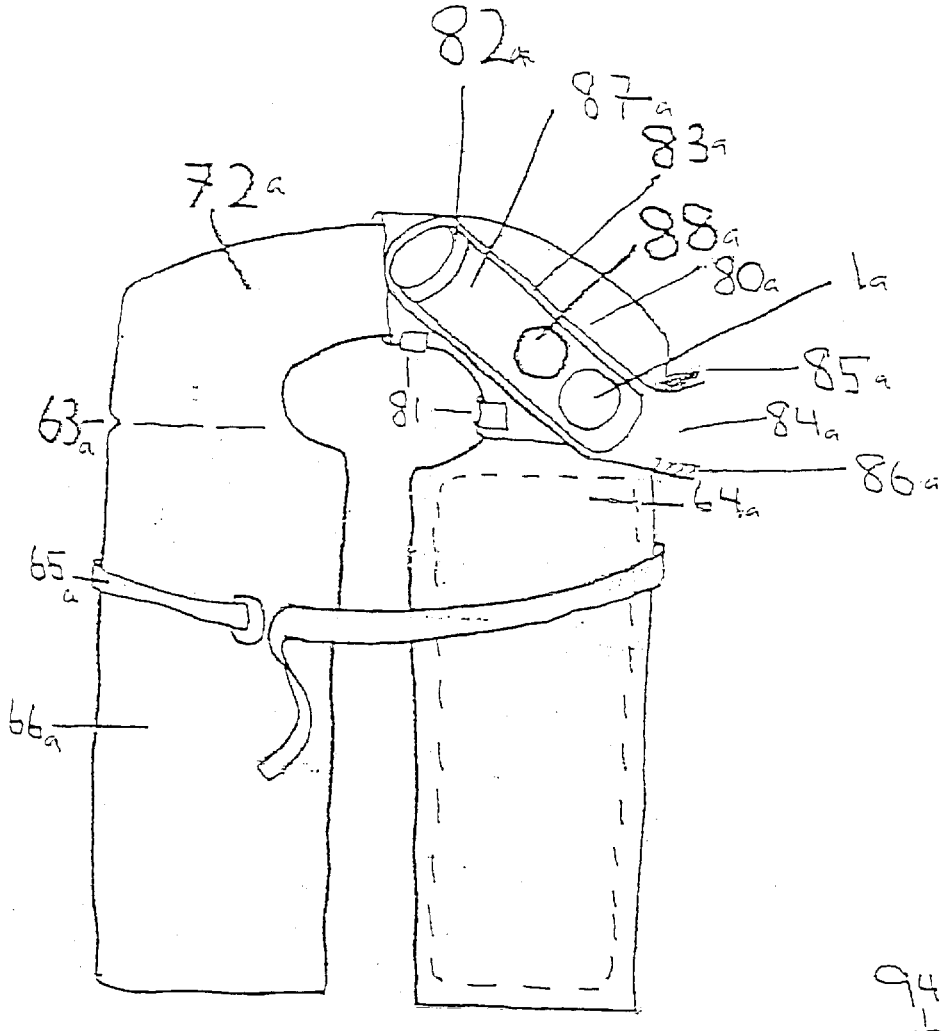
FIG. 11 is a posterior view of a yoke collar style or stackable PFD illustrating an externally attached eccentric cylindrical container for a mobile ballast member that can be put in place without having to remove the jacket.
Figure 12:
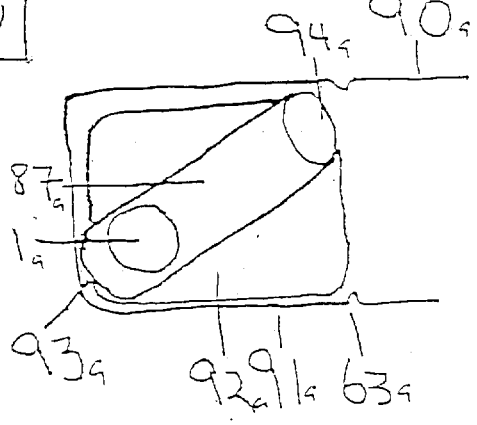
FIG. 12 is a lateral view of a yoke collar PFD showing the integrated form of FIG. 11 where the mobile ballast and containment means are embedded in the form of the neck of the jacket.
Figure 67:
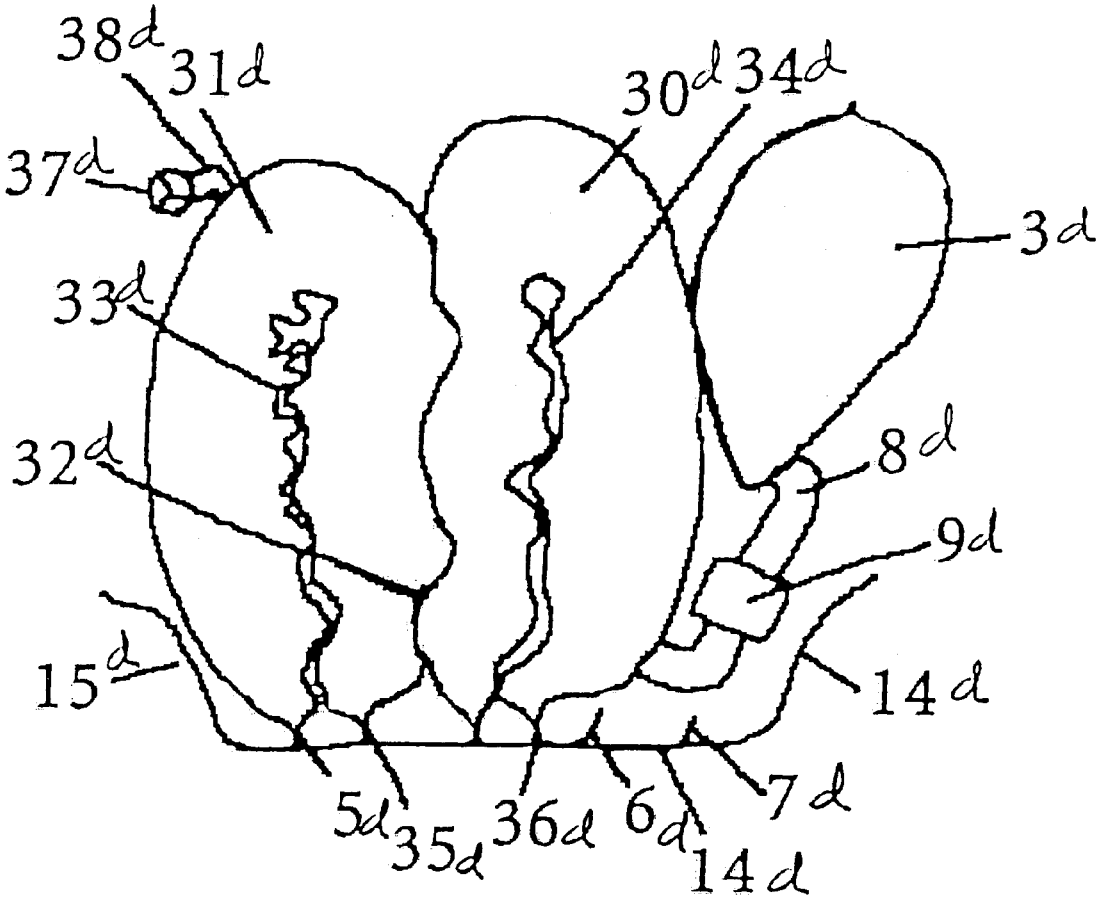
FIG. 67 is a side view of the abdominal chambers showing the inferior and superior bladders attached in the tightest configuration producing the lowest volume/lowest profile abdominal bladder.

There are a wide variety of prior art life jackets, with each design group unique in how they locate ballast about the victims neck and torso. That is referred to as the stackable PFD is a flat PFD that allows easy stowage. Some jurisdictions require the highest rated Life Jackets to roll a face down unconscious victim into and airway protected position within five (5) seconds in calm fresh water. FIGS. 9 through 15 illustrate a Yoke Style Collar or stackable PFD 66*a* having pericervical buoyant means 71*a* that supplies the displacement of the cervical collar 72*a*. FIG. 67 shows a relatively simple, reliable attachment means for securing one or more ballast moments to the perimeter of an existing PFD. Without any ballast the existing PFD is a buoyant aid, i.e. only capable of airway protection if the conscious wearer can position themselves in a face up position. This buoyant aid may be all that can be tolerated or necessary. If an emergency were to arise and the wearer was in warm water wearing minimal clothing a single ballast element is sufficient, if the emergency arise in an inclement environment in which the impending water victim is wearing thermal protective clothing, two or more elements maybe required to right an unconscious victim draped in water logged clothing. The eccentric ballast attachment member 126*a* is preferably comprised of a cylindrical ballast 100*a*, which is threaded onto a strap 124*a*. The strap is secured by attachment means 121*a* to the mounting strap 120*a* that envelopes the PFD. The mounting means 120*a* is secured by fastener member 122*a*, which preferably makes a reliable connection by relying upon multiple overlapping surfaces. If this closure mechanism were to fail the ballast would drop away and the life jacket would be reduced back to an airway submerging buoyant aid. Similarly cover strap 123*a* secures and protects the ballast belt 124*a* from being snagged and possibly released with the same consequences described above. Stiffener 125*a* supplies critical rigidity necessary to prevent ballast 100*a* from sliding from its position on the PFD's lateral surface onto the PFD's ventral, dorsal or medial surface where the selected ballast may be insufficient to effectuate the self-rescue roll. Notably ballast 100*a* is specifically selected so that it can be transferred to an integrated mobile ballast PFD as shown in FIG. 12. Once the ballast is located in a tubular containment member 87*a*, it can be continued to be used indefinitely, allowing its cost and ecological impact to be minimized.

Typically, a PFD's inherently buoyant means is comprised of multiple layers placed symmetrically about the wearer. However, the size of eccentric ballast can be reduced removing a portion of the buoyant means whether inherently buoyant, inflatably buoyant or of mixed origin. The eccentric placement of buoyant means about the PFD can be used to facilitate the self rescue roll by reducing the symmetry as well as by reducing the size, of the buoyant moment that must be submerged by the ballast during the initiation phase of self rescue (zero to ninety degrees).

Figure 13:
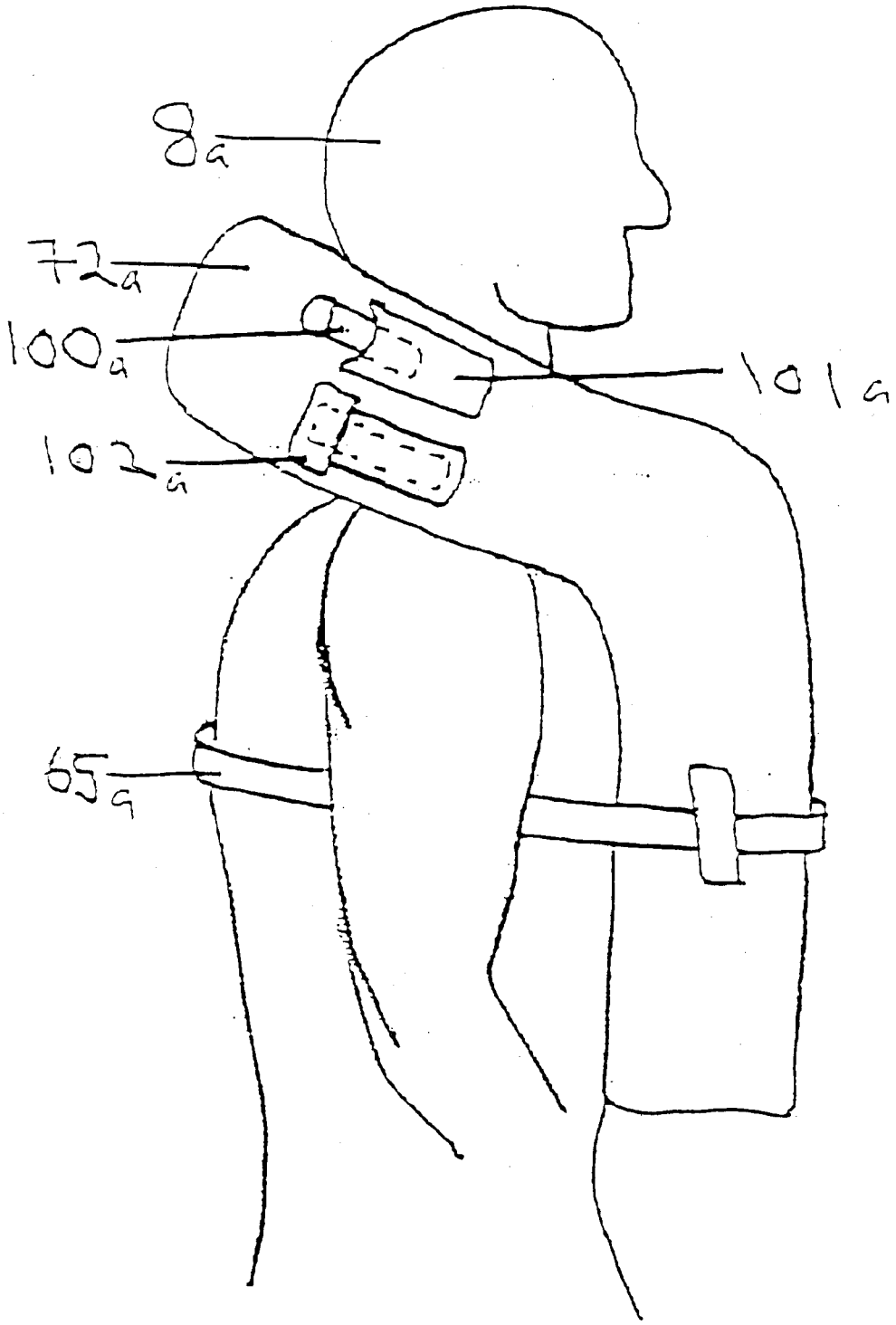
FIG. 13 is a lateral view of a yoke collar PFD while being worn and showing multiple external pouches built into the fabric of the jacket that allow the user accessible adjustment of an amount of ballast without having to remove the vest.
Figure 14:
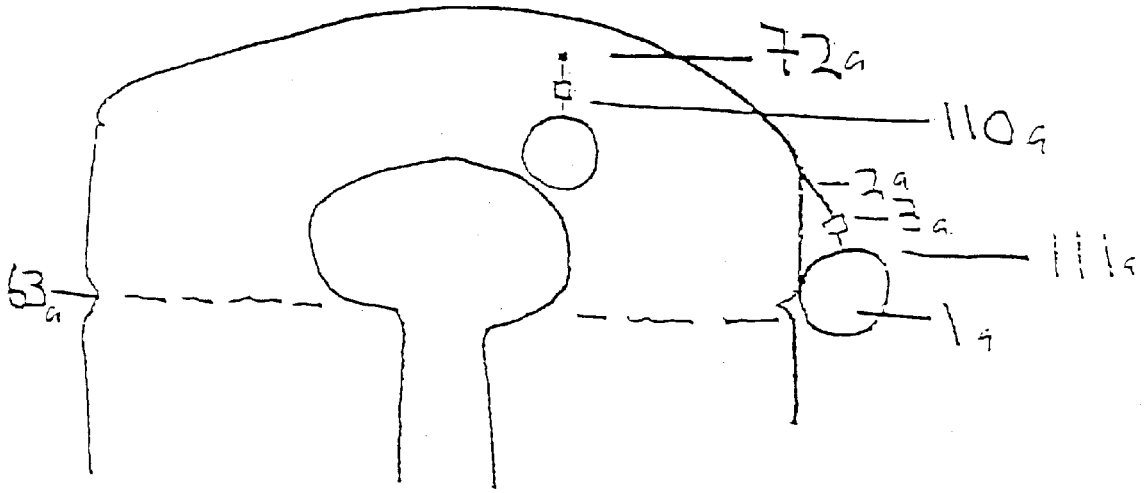
FIG. 14 is a posterior view of a cervical portion of a yoke collar style PFD illustrating eccentric placement of quick release mobile ballast members, one of which can preferably be added while wearing the PFD, one of which preferably cannot.
Figure 15:
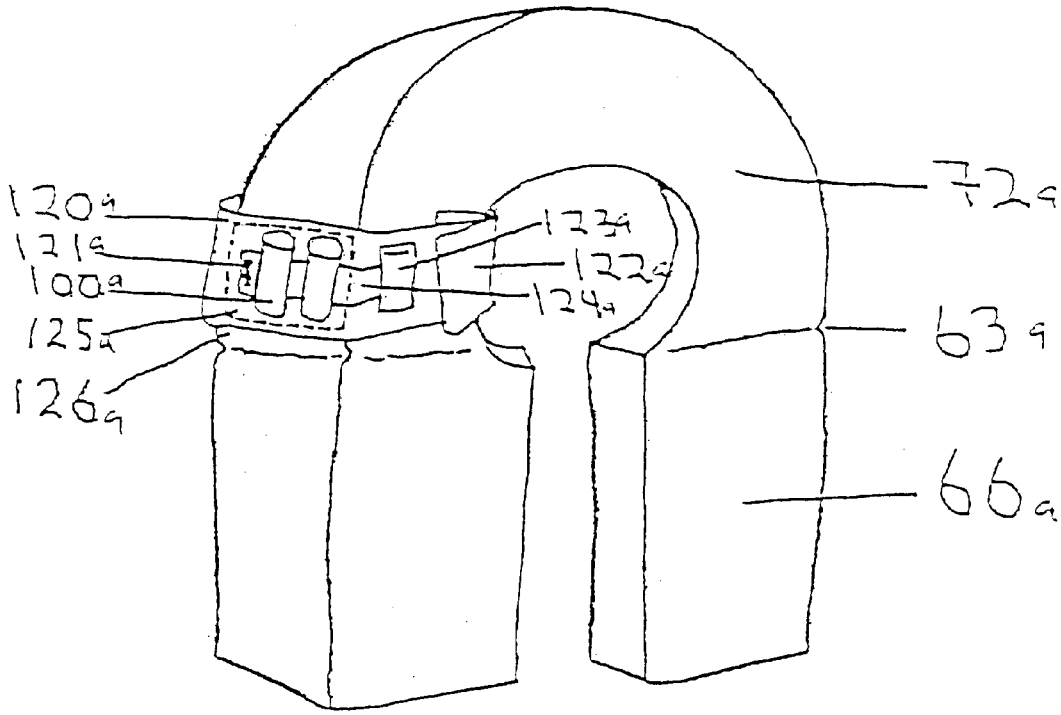
FIG. 15 is a right anteriolateral view of a yoke collar style PFD showing an externally attached eccentric fixed ballast system that can be adjusted while wearing the PFD.

The fixed, eccentric ballast as shown in FIG. 13 integrated into the construction of a new PFD locates the containment means 101*a* in an accessible area for wearer manipulation in the field. Significantly the jacket does not have to be removed in order to convert the jacket from a buoyant aid device into a Life Jacket with varying strengths of active self-rescue. FIG. 15 shows a "fix" for PFDs currently in existence. The eccentric fixed ballast means 100*a* are only applicable to those select PFDs which through specific placement of the buoyant means of the PFD, only need assistance with the initiation phase of the self rescue roll, i.e. zero (0°) to ninety (90°) degrees. Once PFDs of this design are moved out of the stable face down position the buoyant means alone is capable of completing the phase two of self rescue, i.e. ninety (90°) to one hundred (180°) degrees.

Other PFD designs in order to achieve reliable airway protection with minimal amounts of ballast require mobility of that ballast means to assist not only with phase one initiation but with phase two completion of active self rescue. A mobile ballast requires a containment means to limit and direct the keels movement to effectuate the conversion of stabilize face down flotation into face up. In PFDs of this design an eccentric fixed keel will roll the victim off their back and onto their side where they become stabilized in a side high position. However, the unconscious victim's flaccid airway is severely flexed to the point of obstruction and their airway remains submerged. In this side high position the victim often rapidly succumbs to Shallow Water Drowning. Notably both the eccentric fixed and mobile ballast elements rely upon being located off the midline to achieve phase one rotation with a minimum amount of ballast.

Figure 9:
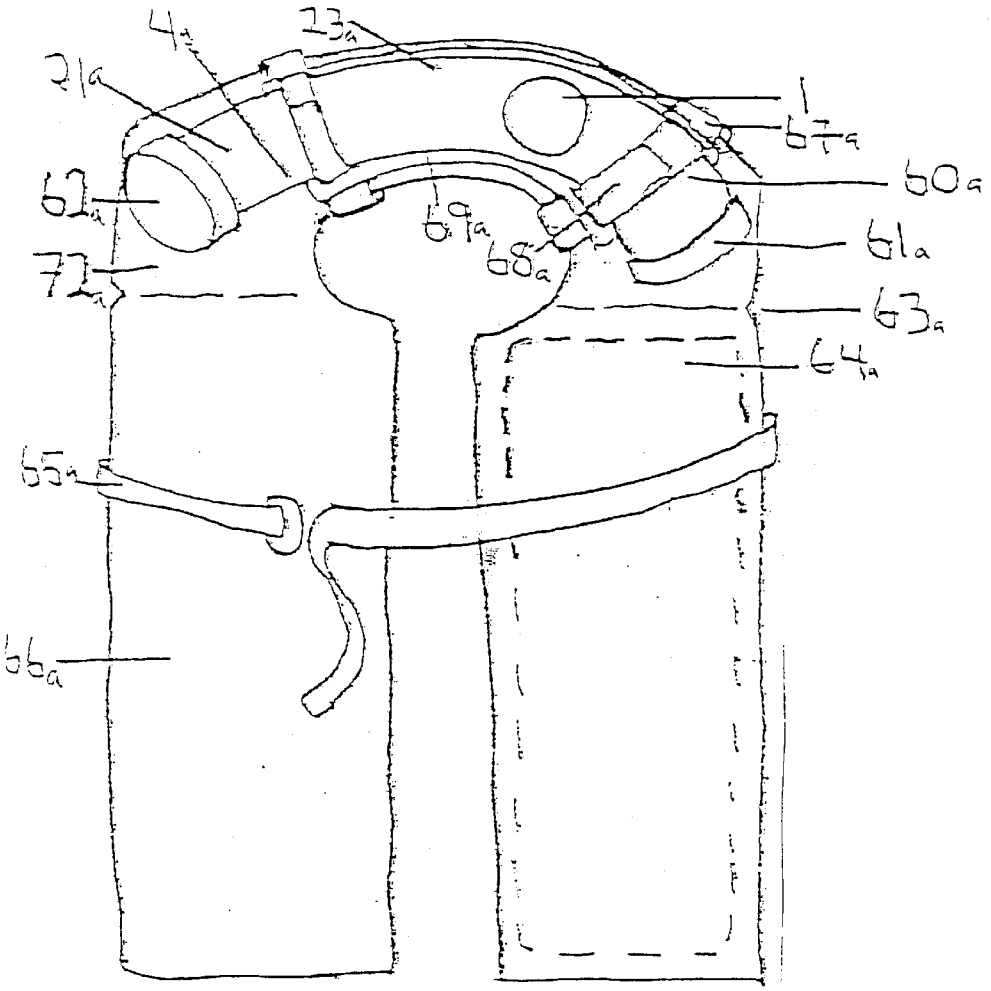
FIG. 9 is a posterior view of a yoke collar PFD with an attached mobile ballast contained in a sealed semi-circular container.
Figure 10:
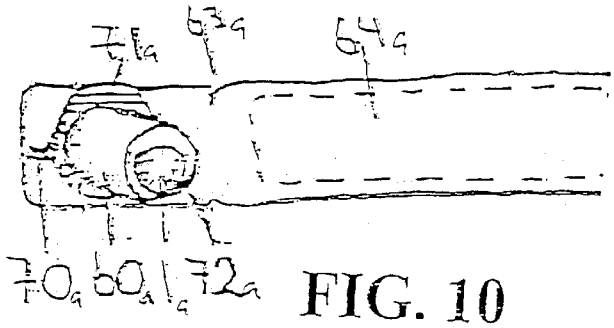
FIG. 10 is a lateral view of a yoke collar PFD illustrating a PFD in accordance with the present invention constructed to accommodate a recyclable contained mobile ballast member.

As seen in FIG. 9, another embodiment is shown where an exterior attachment of a semi-circular container 60*a* containing a mobile ballast 1*a* allows existing jackets to acquire active self-rescue. Container 60*a* and mobile ballast is of such a design that it can also be used within the cervical collar of a new stackable PFD. Container 23 and ballast 1 have a longer useful life expectancy than the fabric lives of several current PFDs. This recyclable feature allows the cost to be spread out over many jackets and minimizes the disposal problems presented by high-density metals such as lead. Furthermore, the stackable PFD 66*a* of FIG. 11 shows a straight container means 87*a* within a fabric sleeve 83*a* attached to a fabric hood 80*a* secured to stackable PFD 66*a* by attachment means 81*a* allowing an in field fix of an existing stackable PFD. One advantage of straight container means 87*a* is it allows the use of one, two, as well as three or more mobile ballast elements 1*a* since they all stack up the same corner of the PFD. With semicircular 60*a* containment means 23*a*, mobile ballast 1*a* elements are preferably provided in an odd number (i.e. 1, 3, 5 . . . ) to prevent an even distribution of the ballast elements. With only two elements one could be located at each end effectively balancing each other out leaving the victim floating face down. The advantage to multiple elements is that the container diameter can be reduced allowing easier manipulation as well as comporting with the size restrictions of infant or children's PFDs.

The stacking linear containment means finds slightly divergent applications in other PFD designs. The multiple stacking of the ballast elements moves and facilitates container 23*a* relocation as is necessary in effecting the first phase of active self rescue (i.e. zero (0°) to ninety (90°) degrees), then the ballast must relocate to the other end to optimally facilitate phase two of the active self rescue roll (i.e. ninety (90°) to one hundred eighty (180°) degrees.

While cervical container means 60*a* and 87*a* benefit from being closed in that they contribute displacement in the critical cephalic area, helping to maintain freeboard, the distance measured from the corner of the mouth to the water's surface, when used within the back of a vest style PFD, perforated end caps 101*a* allow the air to exhaust so that the container's displacement does not oppose the containers relocation during the conversion from phase one to phase two of the active self rescue roll.

Some of the advantages achieved with and/or features of one or more of the embodiments illustrated in FIGS. 9 through 15 include, but are not limited to, the following: (1) Eccentric Single or Multiple ballasting means, Attached to Inherently buoyant, Inflatable buoyant, or Hybrid buoyant, Personal Flotation device; (2) Fixed Eccentric ballast means; (3) (New Construction) Internal or external Integrated Fixed eccentric ballast member Accessible for placement and or removal, Inaccessible, combination of partially inaccessible with the option to add additional ballasting elements; (4) (Fix of in existing products) Externally Attached eccentric ballast member, with independent reversible or Permanent attachment means, accessible, inaccessible, mixed; (5) Ballast Means, cylindrical or spherical for use in fixed and mobile ballast systems; (6) Mobile ballast member integrated into the buoyant means of a personal flotation device; (7) mobile ballast member attached to life jacket by flexible means; (8) mobile ballast member attachable at variable positions to the life jacket by flexible means; (9) Mobile ballast member attached to life jacket by flexible means held in inactive position until released; (10) Mobile ballast attached midline; (11) Eccentric mobile ballast member attached at point off midline; (12) Flexible means connected through swivel to ballast member; (13) Flexible means connected through quick release coupler to ballast member; (14) Mobile ballast member attached to life jacket by rigid means; (15) Rigid means connected through swivel to ballast member; (16) Rigid means connected through quick release coupler to ballast member; (17) Ballast member of spherical configuration to facilitate movement along arc; (18) Rigid convex surface over which ballast member rolls throughout the arc of rotation determined by attachment means; (19) Rigid convex surface integrated with displacement foam of life jacket; (20) Rigid cover limiting range of motion of ballast member; (21) Flexible cover limiting range of motion of ballast member; (22) Enclosed container restricting range of motion of ballast member; (23) Enclosed container with convex surface—with second intersecting surface angled caudally—with third intersecting surface angled dorsally; (24) Enclosed container permanently sealed off to create buoyant means, less than, equal to or greater than ballasting means; (25) Enclosed container reversibly sealed off to create buoyant means, less than, equal to or greater than ballasting means; (26) Vented non-buoyant container for mobile ballast; (27) pivoting straight container attached at laterally, swinging cephalo-caudal; (28) container and/or ballast means coated with sound absorbing material Inflatable; (29) stiffener means; (30) asymmetric buoyant means; and (31) mobile buoyant means.

Figure 16:
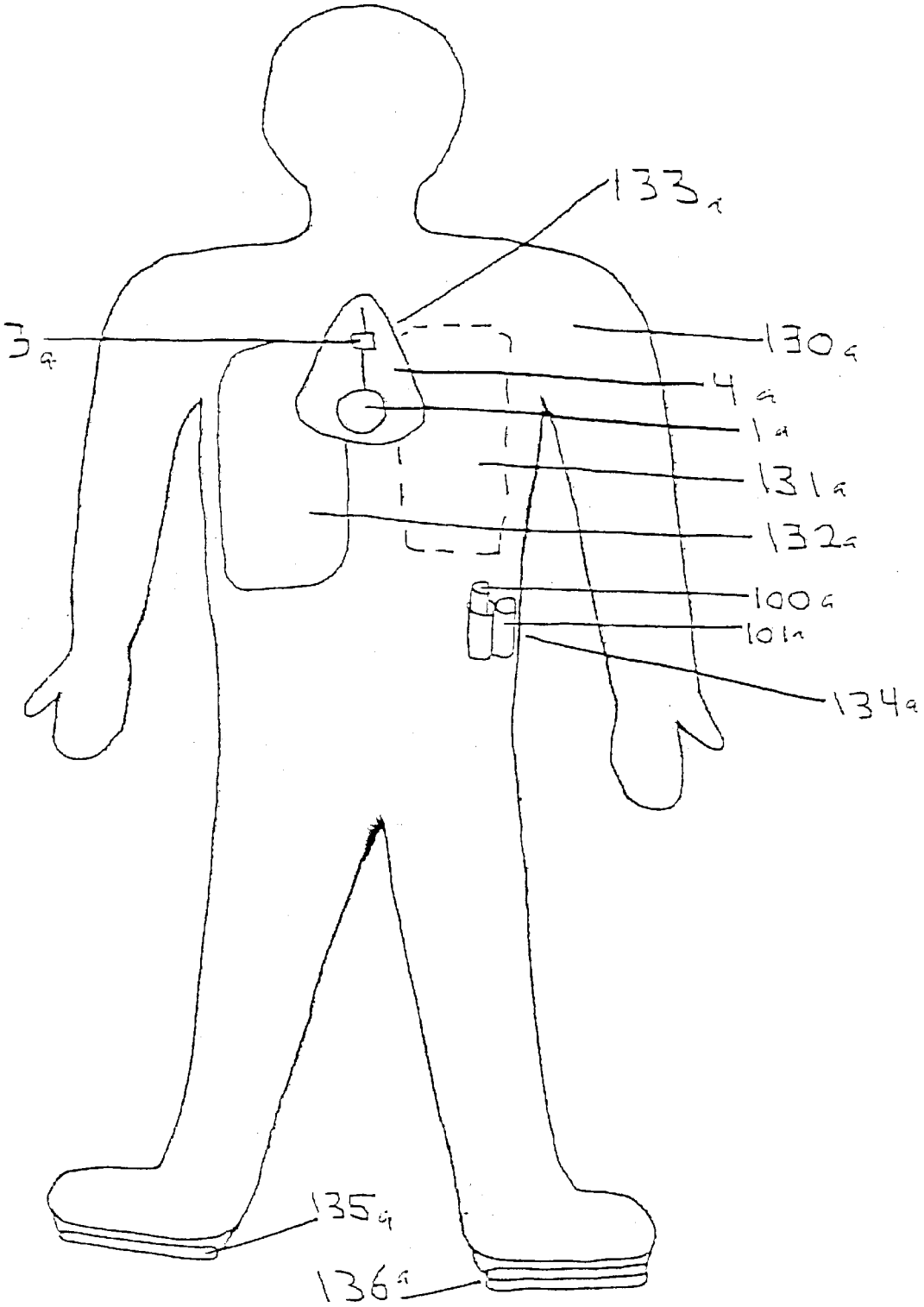
FIG. 16 is a posterior view of a thermal protective suit illustrating multiple fixed and mobile ballast and buoyant members.

Individuals employed offshore are often supplied with whole body thermal protective garments 130*a* as seen in FIG. 16. Currently despite the garments massive buoyant moment such individuals are also required to wear a life jacket. The inclusion of eccentric fixed and mobile ballast and buoyant means of the present invention allows the buoyancy inherent in the thermal protective garment 130*a* to fulfill the dual purposes of warmth and surface support. FIG. 16 is a posterior view of one such exposure suit or thermal protective garment 130*a*. The traditional neoprene suit of a wind surfer or water enthusiast is likewise capable of protecting core temperature as well and is also considered with the scope of the invention. A ventral eccentric buoyant means 131*a* combines with a posterior eccentric buoyant means 132*a* to help destabilize the face down position. The addition of multiple ballast members such as a midline mobile ballast system 133*a* with an eccentric fixed ballast system maybe sufficient for a tight fitting neoprene protective garment. In the exposure suits designed for North Sea offshore oilrigs there is a need for peripheral ballast members, 135*a* and 136*a* to assure the victim will maintain a heads up position. Preferably, the identified direction of turning is reinforced by the placement of eccentric ballast such that there is sufficient energy to initiate the first phase of self-rescue, i.e. the size of 136*a* exceeds 135*a*. In the vertical position this difference is negligible.

Some of the advantages achieved with and/or features of the embodiments illustrated in FIG. 16 include, but are not limited to the following: (1) Thermal protective gear with one or more eccentric fixed buoyant means; (2) Thermal protective gear with one or more eccentric mobile buoyant means; (3) Thermal protective gear with one or more eccentric fixed ballast means; (4) Thermal protective gear with one or more quick release eccentric fixed ballast means; (5) Thermal protective gear with one or more eccentric mobile ballast means; and (6) Thermal protective gear with one or more quick release eccentric mobile ballast means.

Figure 17:
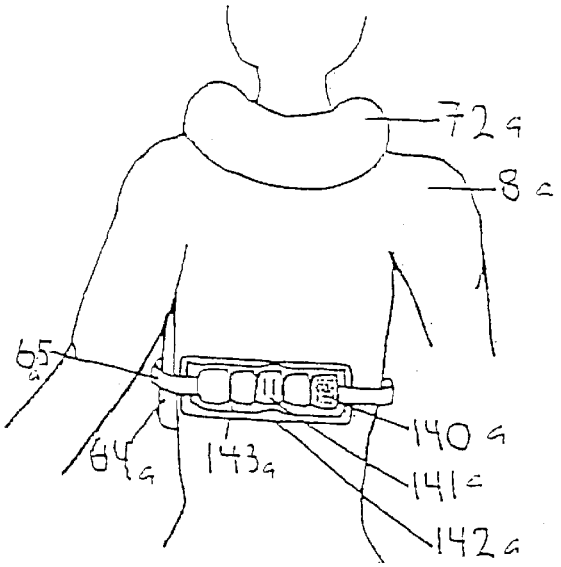
FIG. 17 is a posterior view of a yoke collar style PFD illustrating a fixed hemi-circumferential ballasting member.

FIG. 17 illustrates a PFD Strap ballast embodiment in accordance with the present invention. One PFD design that is popular in children is a yoke type collar PFD or stackable PFD. The children's PFD does not lend it self to the same solution as the adult, i.e. the eccentric fixed ballast locate along the lateral cervical area. The combination of the child's body density, narrow pulmonary fields and predominance of mass in the cephalic area makes them resistant to the lateral ballast moment. FIG. 17 shows the wearer 8*a* wearing a stackable PFD 72*a* held by strap 65*a*. The ballast moment is spread by attachment means 142*a* along the posterior width of the individual. The ballast may be a lead shot 140*a*, though such is not limiting. Lead shot 140*a*, in a soft coating, preferably conforms to the body's surface. Alternatively, lead shot 140*a* may be comprised of small rigid blocks of ballast such as 141*a*. The posterior horizontal distributed ballast means 142*a* is located upon the back of the wearer 8*a* and held in place from slippage there from by a stiffener that conforms to the wearer 143*a*.

Figure 18:
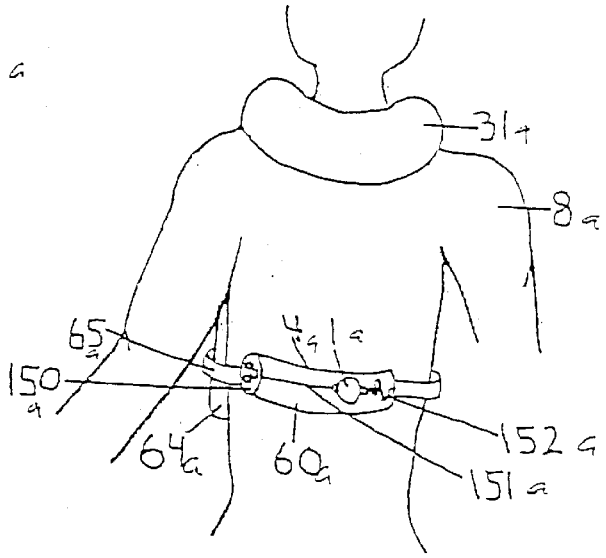
FIG. 18 is a posterior view of a yoke collar style PFD illustrating a mobile ballast secured via multiple attachment points crossing a victim's midline within a ventilated container.
Figure 19:
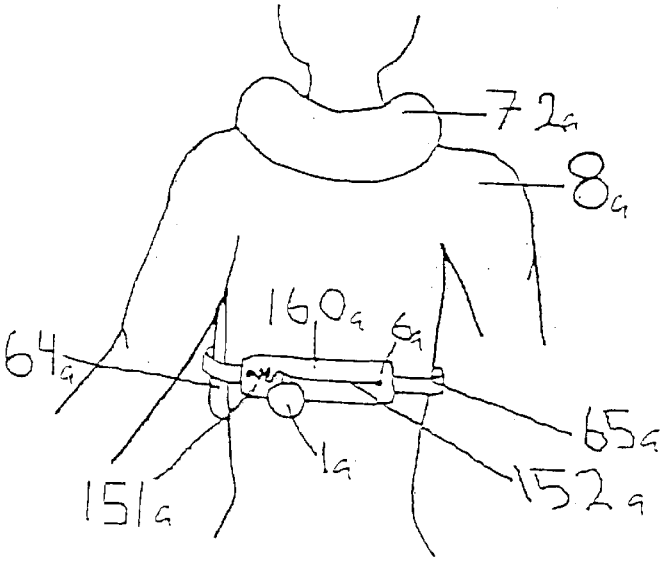
FIG. 19 is a posterior view of a yoke collar style PFD illustrating a mobile ballast secured via multiple attachment points crossing a victim's midline secured to a PFD strap but otherwise open for unlimited range of motion.

Alternatively, in FIG. 18 the child 8*a* wearing an inflatable PFD 31*a* achieves the keeling action from mobile ballast contained within a container 60*a* with curved surface 4*a*. The mobile ballast 1*a* is preferably attached to both ends ventilated end caps 150*a*, which allow water end thereby avoiding placement of a counterproductive buoyant moment low on the victim's back. Mobile ballast 1*a* is suspended from diametric points via left flexible means 151*a* and a right flexible means 152*a*. This dual suspension transfers across the midline of the victim to the opposite side of the ballast's location. FIG. 19 adapts this dual suspension to a strap attachment means 160*a* that can be added or built into the PFD strap 65*a*. Unrestrained mobile ballast 1*a* is free to roll to either side yet when it reaches the end of its flexible arm 151*a* or 152*a* it exerts a turning force across the midline. As the self-rescue roll nears the end of the second phase, the mobile ballast is suspended from both arms and is located in the midline, swung away from the victim, stabilizing them in the safe zone. Due to the lack of a container that invariably restricts motion and consequently location, the open device can be of smaller size for a given rate of turning.

Some of the advantages achieved with and/or features of the embodiments illustrated in FIGS. 17 through 19 include, but are not limited to, the following: (1) Horizontal band of ballast, fixed or mobile along PFD Strap or belt or back of vest; (2) Body Stiffener conforming sized and conforming to the wearer; (3) Mobile ballast suspend from left and right arms; (4) Attached to PFD Strap; (5) Contained in ventilated means—With curved surface beneath mobile ballast

ECCENTRIC AND MOBILE BALLAST AND BOUYANCY PARTS LIST (FIGS. 1 through 19)

1*a* Mobile Ballast Member
2*a* Flexible Arm
3*a* Swivel
4*a* Curved Surface
5*a* Flexible Retaining Cover
6*a* Arm Attachment Point
7*a* Life Jacket
8*a* Wearer of PFD
9*a* Lower Edge of PFD Fabric Back Panel Covering Ballast Components
10*a* Pivoting Attachment Point
11*a* Rigid Arm
12*a* Quick Release Coupler
13*a* Rigid Retaining Cover
14*a* Conical Mobile Ballast
20*a* Container for Mobile Ballast Member
21*a* Lateral Gully Low Point
22*a* Caudal Gully Low Point
23*a* Posterior Gully Low Point
24*a* Airtight Lid for placing/servicing mobile ballast member
25*a* Sound Reducing Coating of inside of Container
26*a* Sound Reducing Coating of Mobile Ballast Member
27*a* Surrounding Foam of PFD
30*a* Stowed Inflatable PFD
31*a* Inflated PFD
32*a* Deflated PFD Retaining Cover
40*a* Secure belt
41*a* Inactive Immobilized Ballast Member
42*a* Quick Release Retainer Means
43*a* Quick Release Activation Means—Pull Cord
44*a* Activated—Mobile Ballast Member
50*a* Continuation of Outer Shell of PFD
51*a* Loop Portion of Hook and Loop Fastening Member/Quick Release Means
52*a* Hook Portion of Hook and Loop Fastening Member/Quick Release Means
53*a* Crotch Strap
60*a* Semi-Circular Container
61*a* Foam Pad insulating end cap
62*a* Resealable End Cap
63*a* Flexible Fabric Joint between Thoracic-Ventral and Cervical-Dorsal
64*a* Ventral Buoyant Means
65*a* PFD Strap
66*a* Yoke Collar Style or Stackable PFD
67*a* Resealable Closure for container
68*a* Cervical Foam Pad
69*a* Semicircular Fabric Hood
70*a* Resealable Closure Means
71*a* Layers of closed cell foam
72*a* Cervical collar of stackable PFD
80*a* Fabric Hood
81*a* Hood Attachment means
82*a* Tube Cap
83*a* Tube Sleeve Cover
84*a* Tube Sleeve Cover Opening
85*a* Tube Sleeve Closure Means, Loop Portion of Hook and Loop Fastening Member
86*a* Tube Sleeve Closure Means, Hook Portion of Hook and Loop Fastening Member
87*a* Straight tube Containing Mobile Ballast

88*a* Second Mobile Ballast Element
90*a* Ventral Surface of PFD
91*a* Posterior Surface of PFD
92*a* Cervical Buoyant Means Embedding Container means
93*a* Posterior-Medical End of Container Means
94*a* Ventral-Lateral End of Container Means
100*a* Eccentric Fixed Ballast Means
101*a* Ballast Container Means
102*a* Sealable Container Cover
110*a* Eccentrc Inaccessible Mobile Ballast Element
111*a* Eccentric Accessible Mobile Ballast Element
120*a* Mounting Means for addition of Ballast, Strap
121*a* Attachment Point of Ballast Belt
122*a* Secure Closure Means
123*a* Safety Cover for termination of Ballast Belt
124*a* Ballast Belt for secure mounting of eccentric ballast
125*a* Stiffener Means
126*a* Eccentric Ballast Attachment Means
130*a* Thermal Protection Garment
131*a* Ventral Eccentric Buoyant Means
132*a* Posterior Eccentric Buoyant Means
133*a* Midline Mobile Ballast System
134*a* Eccentric Fixed Ballast System
135*a* Single Eccentric Peripheral Ballast Means
136*a* Multiple Eccentric Peripheral Ballast Means
140*a* Shot Ballast
141*a* Solid Block Ballast
142*a* Posterior horizontal distributed ballast means
143*a* Stiffener sized to conform to wearer
150*a* Ventilated End Cap
151*a* Left Flexible Arm
152*a* Right Flexible Arm
160*a* Attachment means for multiple suspended mobile ballast As seen in FIGS. 20 through 38 a combined ballast and signaling device which is neutralized by attachment to an eccentrically buoyant PFD is disclosed and generally designated as reference numeral lb. It is recognized that the role of the eccentric or midline, fixed or mobile, ballast or buoyant moment confers improved airway protection upon personal flotation devices ("PFDs"), which have been defined above. It is disclosed herein that the ballast associated with certain required attachments when appropriately sized, located and if required, minimally augmented, can confer a synergistic dual advantage enhancing airway protection as well as enhancing visibility to search and rescue efforts.

Standards agencies have not only approved but require that certain types of PFDs particularly commercial Safety Of Life At Sea ("SOLAS"), Off-Shore Type 1 Life Jackets carry a lighting or illumination means 2*b* for assisting in the night time search and rescue efforts of individuals lost at sea. Other individuals making passage on lightly crewed vessels carry telemetry devices 40*b* that awaken sleeping crew alerting them to a man over board situation as well as demarcating their position on an electronic locating device aboard the vessel. Others advise carrying personal EPIRBS 25*b* (a signaling device) for assisting their being located day or night while adrift. These and other devices routinely attached to the PFD when specifically sized and located can supply the ballast that is critical in order to replace PFD stabilized airway submersion with active self it rescue. I.e. a PFD that is capable of reliably rolling an unconscious victim's face out of the water without their assistance or reliance upon sea state to initiate the Life Jackets turning.

Since every PFD requires a different ballasting arrangement as previously disclosed, certain PFD designs may require the ballasting/powering element 24*b*, 37*b* to be connected to the light, strobe, transmitter, etc., preferably via a conductive cable 23*b*. Other PFDs, because of their design, lend themselves to a easier solution in which the batteries, case and appliance are all contained at a solitary site, where the mass of the device confers enhanced airway protection while concurrently providing wearer operable access to the signaling device. If necessary, an additional battery 11*b* or batteries can be added to assure that the requisite ballast requirement is met for active self-rescue. Additionally, the materials for the container 12*b* might be selected to help fulfill a portion of the ballast requirements of a particular PFD, i.e. steel or lead instead of plastic. Further, as some devices exposed to moisture are packed in petroleum jelly 14*b* to decrease detrimental effects of water within the device, the packaging medium can be selected to meet or exceed the specific gravity of water so that the entire volume of the containment means contributes positively to the ballasting moment rather than sealing in air which would reduce the net ballast moment. A variably sized high density plug 13*b* can be attached as required by the individual PFD to meet the PFD's specific ballast needs, i.e. the remainder of the ballast and signaling device remains constant but if a particular brand PFD requires 2 lbs. instead of 1 lb., a different plug 13*b* can be attached. Attachment means 16*b* allows quick and secure retrofitting of PFDs in the field. Attachment means 16*b* can be an arm member, preferably rigid, whose distance from the PFD can be varied allowing the attached appliance increased range of motion and therefore increased efficacy in imparted rotational energy per unit mass of the combined ballast and appliance.

A new PFD would locate grommets to specify the exact location of existing ballasted appliance identifying where a ballasted appliance needs to be attached in order to assure ballast mediated airway protection. O-ring sealed switch 17*b* allows operation by the wearer. Alternately, the appliance device may be water activated in the event of unconscious water entry.

Ballasted signaling device 1*b* can be instantly mounted such as by a locking hook and loop fastening strap member 5*b* or safety pins 16 onto PFDs currently in the field allowing a fix to airway submersion that does not result in the attachment of yet another device to the PFD where it not only clutters the appearance but may confuse an obtunded individual seeking to differentiate their strobe light from their ballast fix (i.e. in the event of hearing a search and rescue vehicle approaching at night). Given the difficulty associated with trying to change regulatory standards to allow the attachment of a purely ballasting member to a PFD with its concomitant reduction in the net buoyancy of a life jacket, a combined ballast appliance device 1*b* of the present invention, only slightly augmented with additional ballast if necessary, can be immediately shepherded into the field without the paper work and time required to change international standards to accommodate the consequential reduction in the net buoyancy that would occur upon attachment of ballast on PFDs in the field. With newly constructed PFDs, the placement of the additional eccentric displacement means 101*b* on the ventral leg opposite the side where the ballast moment is attached 100*b* will neutralize any effective net loss of buoyancy.

Additionally, the intentional placement of a buoyant member 2*b*, 34*b* on the PFD can supplant or complement the need for a ballasting member in order to achieve active self-rescue. Buoyancy can be located in several places such as along the ventral midline of the victim 34*b*, where it alone or in combination destabilizes the airway-submerged face down position. As previously disclosed a midline buoyant bubble wants to rise to the surface, shifting the wearer sufficiently off center so that the main buoyant elements of the PFD, with or without attached ballasting means, can come into play and thereby roll the victim over into an airway protected position.

Furthermore, an eccentric placement of a buoyant member 34*b*, 2*b* may take advantage of the differences of the right pulmonary fields preponderance of displacement versus the left lung field, which is reduced by the volume of the intrusion of the pericardial sac with its fluid and muscular contents. While there is a predictable incidence in which the location of the heart is reversed, it typically is not a factor to be ignored in positioning.

Any container sized, sealed and or selected so as to be sufficiently buoyant, such as the device purely for displacement 34*b* or one with alternate function such as a means of illumination 2*b*, can be located in either a midline or eccentric position and if of sufficient buoyancy it alone can shift the victim out of the zero (0°) degree face down position. Obviously, separation of a products buoyant moment from its ballasting moment and thereby positioned to optimize turning, could combine in a synergistic fashion to accomplish enhanced airway protection while assisting in search and rescue. If additional batteries are needed for ballast purposed, they can also provide for extended operation or increased brilliance and range of signaling devices, that may also prove life saving.

Figure 24:
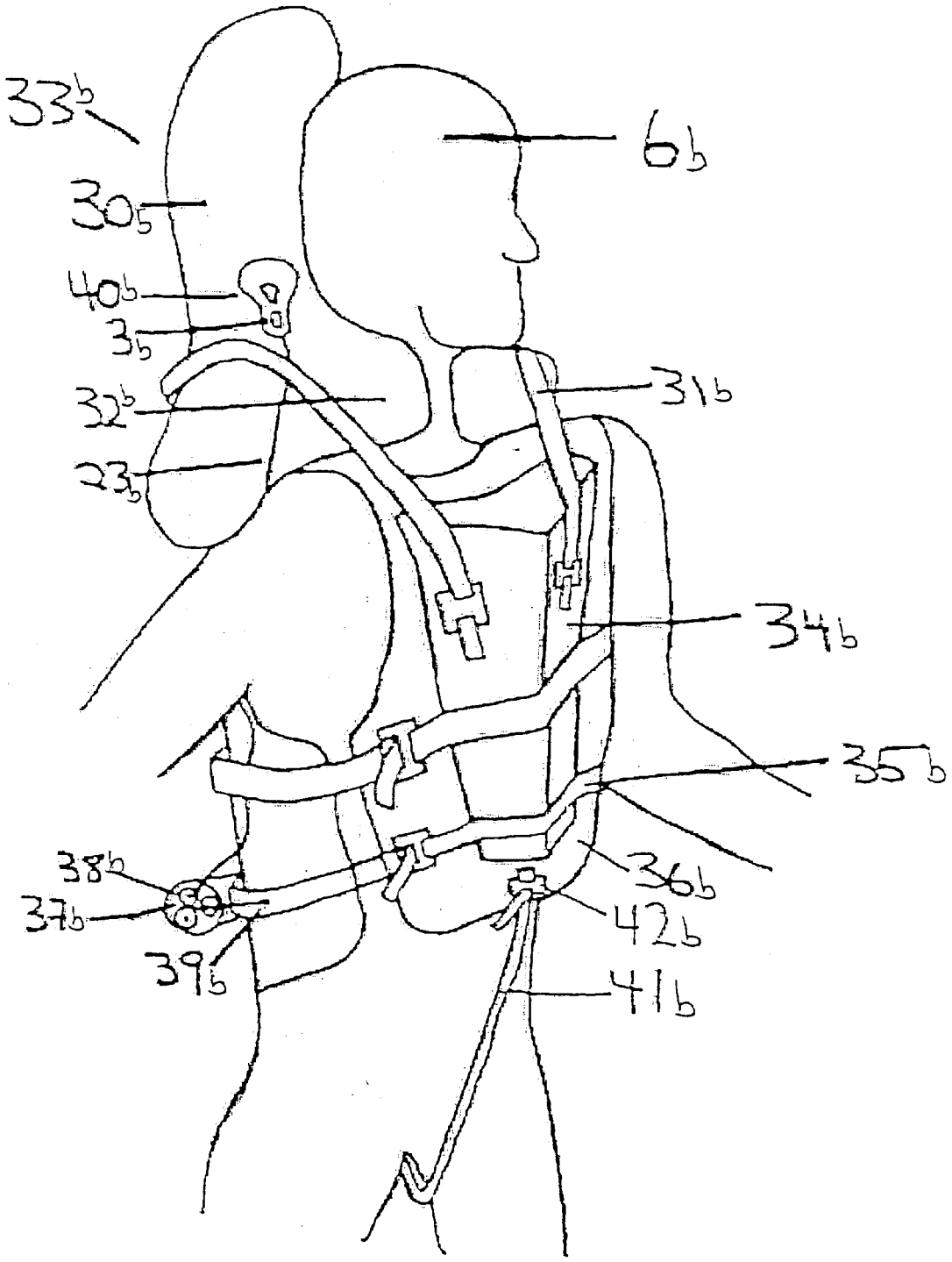
FIG. 24 is a left anterio-lateral view illustrating a two-part PFD with eccentric central anterior buoyant means and second cephalo-cervical buoyant means with dual arm mobile ballasting battery means.

As part of the responsibility for turning over the unconscious victim is borne by ballast, the buoyant means can be redistributed to where more of its displacement is located about the head and neck 33*b*. In this place, increased freeboard is achieved for a given displacement PFD. A side entry PFD as seen in FIG. 24 allows the central ventral position to be occupied by an asymmetric ventral buoyant means 34*b* where the displacement mimics a horse collar life jacket. The central preponderance creates an instability of the face down position and drives the first phase of self-rescue, 0° to 90° degrees. The lateral ventral component only has to be sufficient to power the rescue through phase 2, 90° to 180° degrees. Complementing this is the dual arm mobile ballast battery means 37*b*, which is attached across the victim's midline so that the rotational energy will be applied past 90° degrees. The mobile ballast comes back to a central position once the victim reaches 180° degrees or face up. The cephalo-cervical cradle 33 can be securely snugged up by the wearer operating straps 31*b* locking the head from rolling off to the side. Secure and correctly positioned straps and fasteners are preferably provided to prevent the wearer from slipping down in the PFD. Furthermore, a crotch strap 41*b* with secure fastener means 42*b* is also preferably provided for keeping the buoyant moments in their correct position on the flaccid victim.

Figure 20:
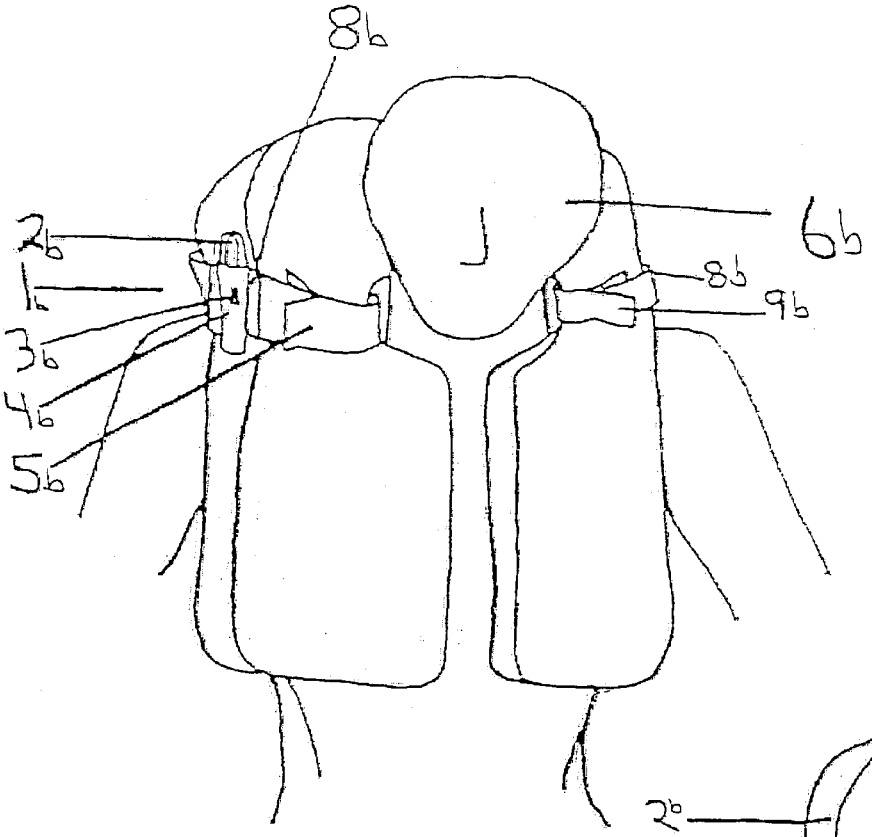
FIG. 20 is an anterior view of an individual wearing a yoke collar style PFD, illustrating an eccentric, fixed combined illumination and ballast means.
Figure 25:
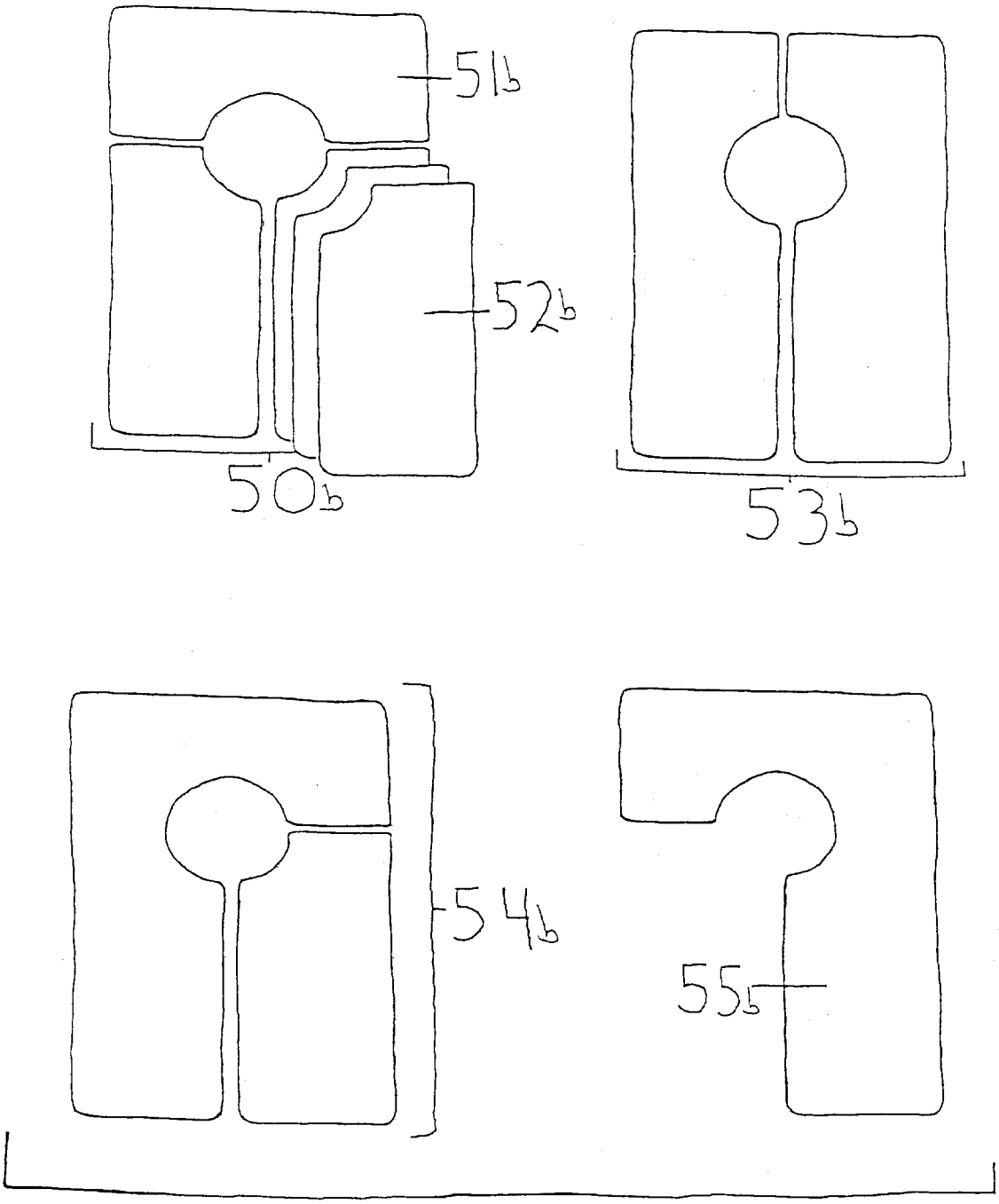
FIG. 25 is a frontal view of yoke collar style PFD foam members showing existing and disclosed alternate configurations for internal foam layers.
Figure 26:
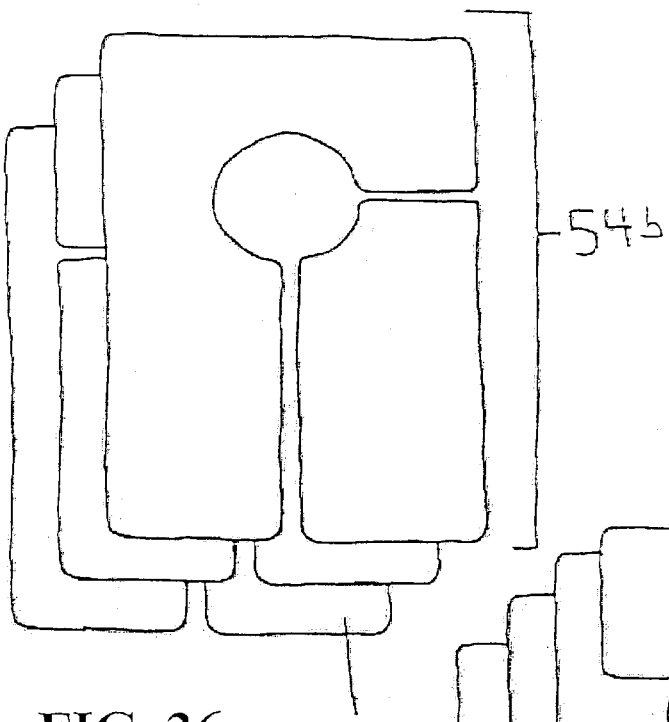
FIG. 26 is an anterior view of stacked foam layers preserving uniform foam thickness throughout the PFD.
Figure 35:
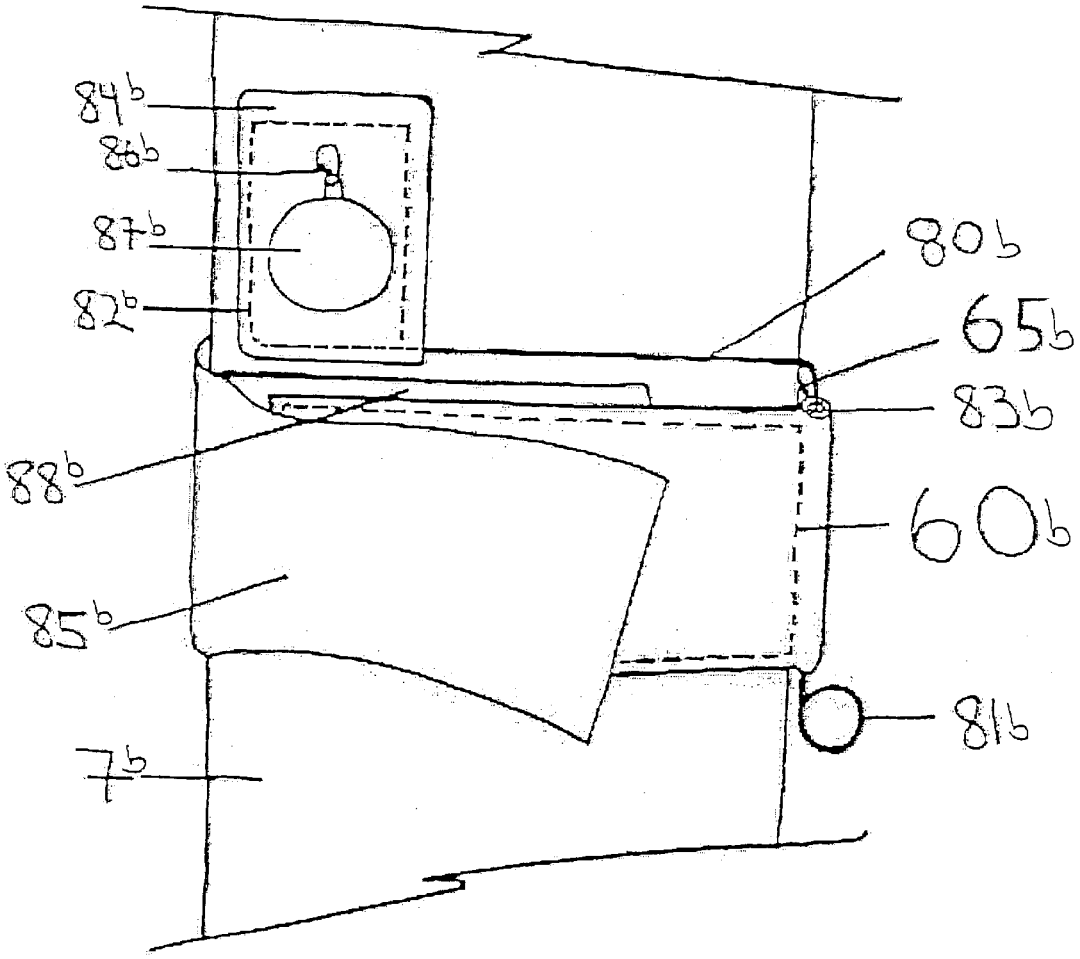
FIG. 35 is an enlarged view of a cervical-ventral joint of a yoke collar style PFD illustrating an externally attached rigid swing arm attachment of eccentric mobile ballast.

FIG. 25 shows a current configuration for a yoke collar style PFD, generally designated as reference numeral 50*b*, which includes three pieces of foam that currently comprise each layer, one cervical piece 51*b* and two ventral pieces 52*b*. This configuration has been grand fathered in to its current position as an industry standard based on ease of sewing and assembly. Configuration 50*b* stacks all the foam joints bilaterally in the lateral cervical area. In FIG. 20, the locking attachment means 5*b* not only secures the combined ballast and appliance device and stiffener to the outside perimeter where it prevents the ballast and combined signaling devices migration from the ideal point of attachment, the stiffener also preferably structurally ties together the ventral and cervical foam of the PFD. As seen in FIG. 35 the stiffener can be shaped as a right angle where the anterior stiffener 65*b* can be neutrally buoyant while the lateral stiffener 60*b* can be constructed out of a high-density material and thereby comprise an internal fixed ballast. The combination of stiffeners on two sides preferably locks the combined ballast and signaling device securely to the PFD.

FIG. 25 illustrates a relatively simple solution for a newly constructed PFD, which preferably includes additional units of ventral foam piece 52*b*. In a SOLAS grade PFD, depending on the thickness of foam selected by the manufacturer, as little as two additional pieces of foam on top of the usual 8*b* piece construction produces enough of a difference in the left versus right ventral buoyant members to shift the flaccid victim off center and thus initiate phase one of active self rescue.

Figure 32:
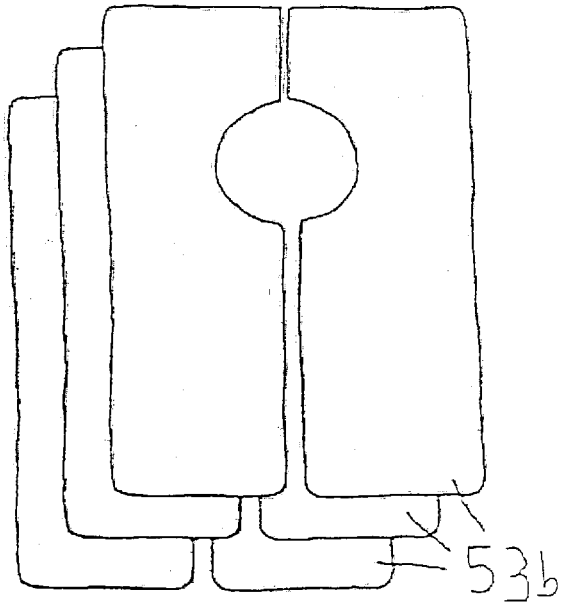
FIG. 32 is a frontal view of a PFD stack comprised solely of two-piece layers with the joints located at the posterior cervical midline.

Another cost effective configuration for a newly constructed PFD is a PFD built from a simple two-piece foam layer arrangement 53*b* then stacked as in FIG. 32. This eliminates the lateral joint and thereby allows the attachment of the lateral ballast a more complete purchase on the ventral and a portion of the cervical displacement means.

Figure 30:
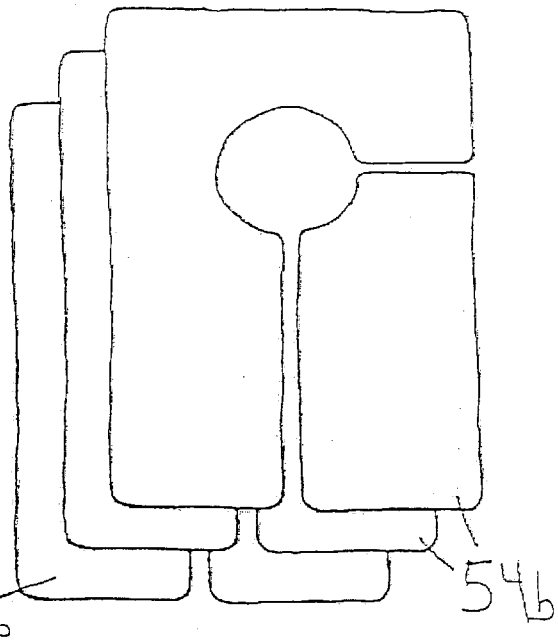
FIG. 30 is a frontal view of a PFD stack comprised of a single piece over sized base layer with the balance being two piece layers with the joints all on one side opposite the ballast.
Figure 31:
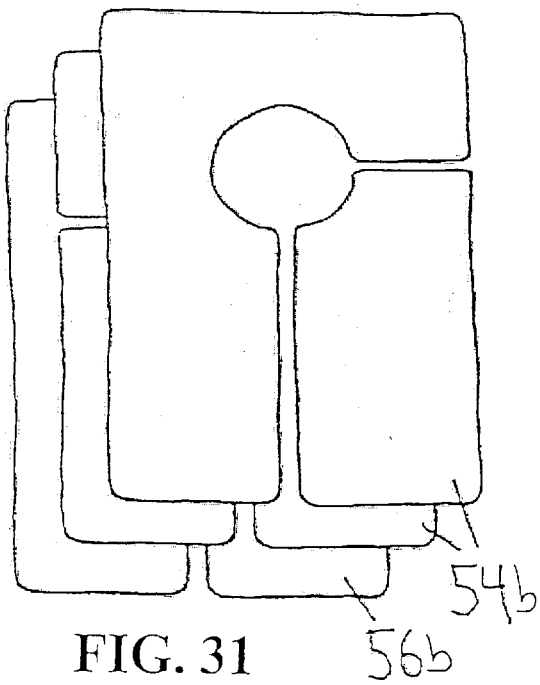
FIG. 31 is a frontal view of a PFD stack comprised of single piece over sized base layer two-piece layers with the joints on alternating sides.
Figure 33:
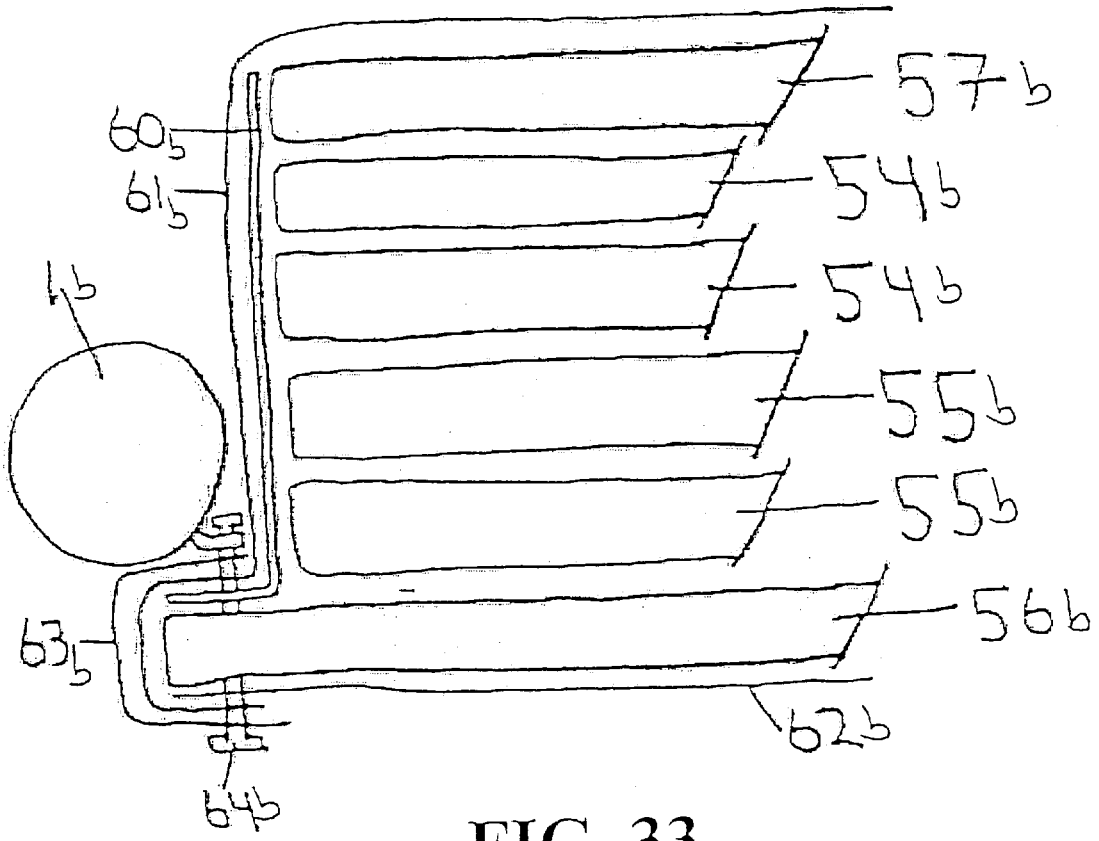
FIG. 33 is a cross sectional view of a cervical area of a yoke collar style PFD illustrating attachment of combined ballast and appliance to oversized foam base, coated fabric shell and 90 degree two part stiffener means the lateral component of which may be constructed of high density material.

Adding considerably to the complexity of sewing the fabric shell and then stuffing that fabric shell with the foam layers, are the foam layer stacking arrangements as shown in FIGS. 30 and 31. An oversized base layer 56*b* as seen in FIG. 33 allows the anterior coated fabric shell 61*b* and the posterior coated fabric shell 62*b* to be sewn through the foam base layer integrating the PFD structurally. Currently PFD fabric is uncoated allowing it to stretch and loosen resulting in increased laxity of the cervical—ventral joint. A coated one side fabric can greatly extend the life of the PFD and if the applied SOLAS tape were sufficient and the coating was placed outside there can be fabric protection form UV, petroleum products, salt water, etc. Depending on whether the PFD is designed to be classified as a PFD that will be required to carry a signaling device, the stiffener can be in part or completely comprised of high density ballasting means 60*b* which can be joined to the fabric and foam at the peripheral seam or encased in a pocket along the side of the PFD. A binding tape 61*b* covers and reinforces the joint. The combined ballast and signaling means 1*b* is secured via fastener means 64*b* at the ideal site as determined by the arrangement of buoyant means in a particular PFD.

Compliance from a child asked to wear a PFD all day long may necessitate greater flexibility of the lateral cervical joint as in the alternating stacking arrangement of FIG. 31, yet the base layer and alternating layers supply improved structural integrity to the foam elements that must effectively receive and transfer the rotational energy from the ballast means to the victim. FIG. 30 shows a stacking arrangement, which will confer even greater rigidity on the ballasted side since there are no lateral cervical joints. While this results in less flexibility and comfort it increases efficacy per unit mass of ballast. On the opposite side of FIG. 82 all the joints lie in a line conferring greatest flexibility for ease of entry allowing the PFD to flex about this joint while donning the device. PFDs constructed as in FIGS. 30 and 31, as do all PFDs, benefit from the inclusion of an eccentric fixed buoyant moment in the side opposite from the side carrying the ballast moment. This can be achieved through the use of foam pieces such as 52*b* or 55*b* as sown in FIG. 25.

Figure 29:
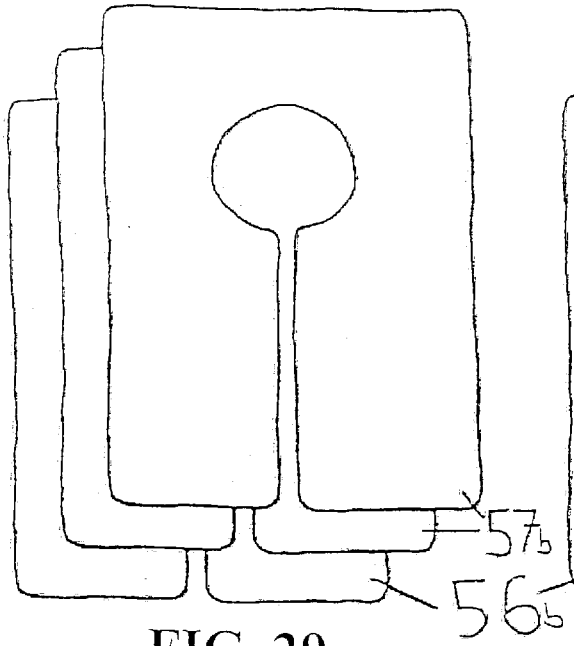
FIG. 29 is a frontal view of PFD stack layers comprised entirely from continuous single piece layers.

Certain Types of PFDs designed for commercial cold-water use where the wearer is likely to be wearing thermal protective clothing can include the foam layer stacking arrangement. FIG. 29 is comprised of solid single pieces 57*b* resting upon an oversized base layer 56*b* and sometimes capped by another oversized layer conferring the greatest PFD structural rigidity short of solid foam. The use of layers confers a real advantage in conforming the PFD to the wearer and in adjusting to movement by the wearer as the PFD is bent over the wearer and as the wearer bends, twists etc. Ideally such a stacking arrangement includes the minimum buoyant offset such as foam piece 55*b*, to assure minimal performance under ideal conditions, i.e. tester wearing only a bathing suit as it currently is the sole testing standard despite its shortcomings when mapped to a real world disaster in the open ocean.

The reduction or elimination of the lateral cervical joint allows the rotational energy of the combined ballast and appliance to more fully applied to rolling the PFD and wearer into a face up position. In current PFDs a lot of the energy is used to deform the fabric shell twisting the lateral cervical joint. The energy that is transferred impacts. primarily either the posterior cervical part 51*b* or the ventral foam part 52*b* where it acts independently and if the ballast is insufficient to the PFD inadequately attached to the wearer, the ballast will be suspended below the buoyant component allowing the airway to remain submerged. Current PFD foam layer structure requires unnecessarily excessive ballast to be attached in order for the PFD shell to first be twisted, next the ventral component moved then the cervical before the victim can be rolled into an airway protective position.

Figure 27:
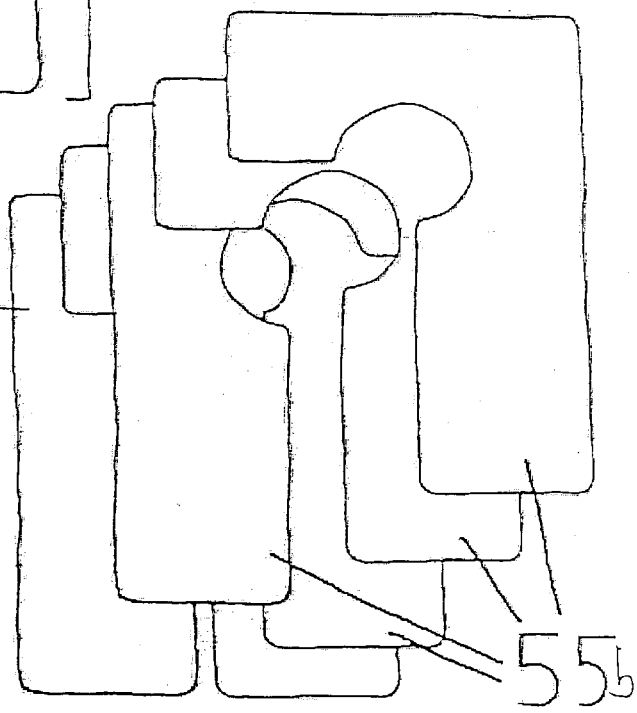
FIG. 27 is an anterior view of stacked foam layers with interlocking layers, which result in an increased cervical displacement relative to ventral component.
Figure 28:
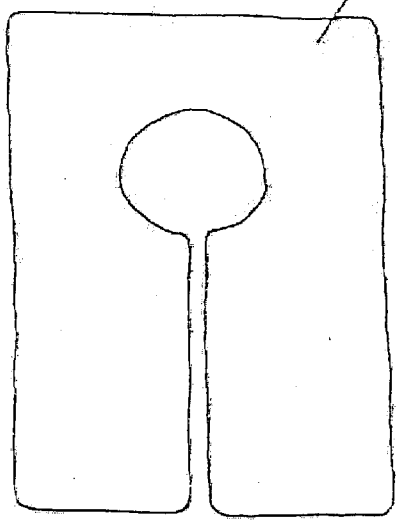
FIG. 28 is a frontal view of a yoke collar style PFD oversized and complete single piece base foam layer.
Figure 34:
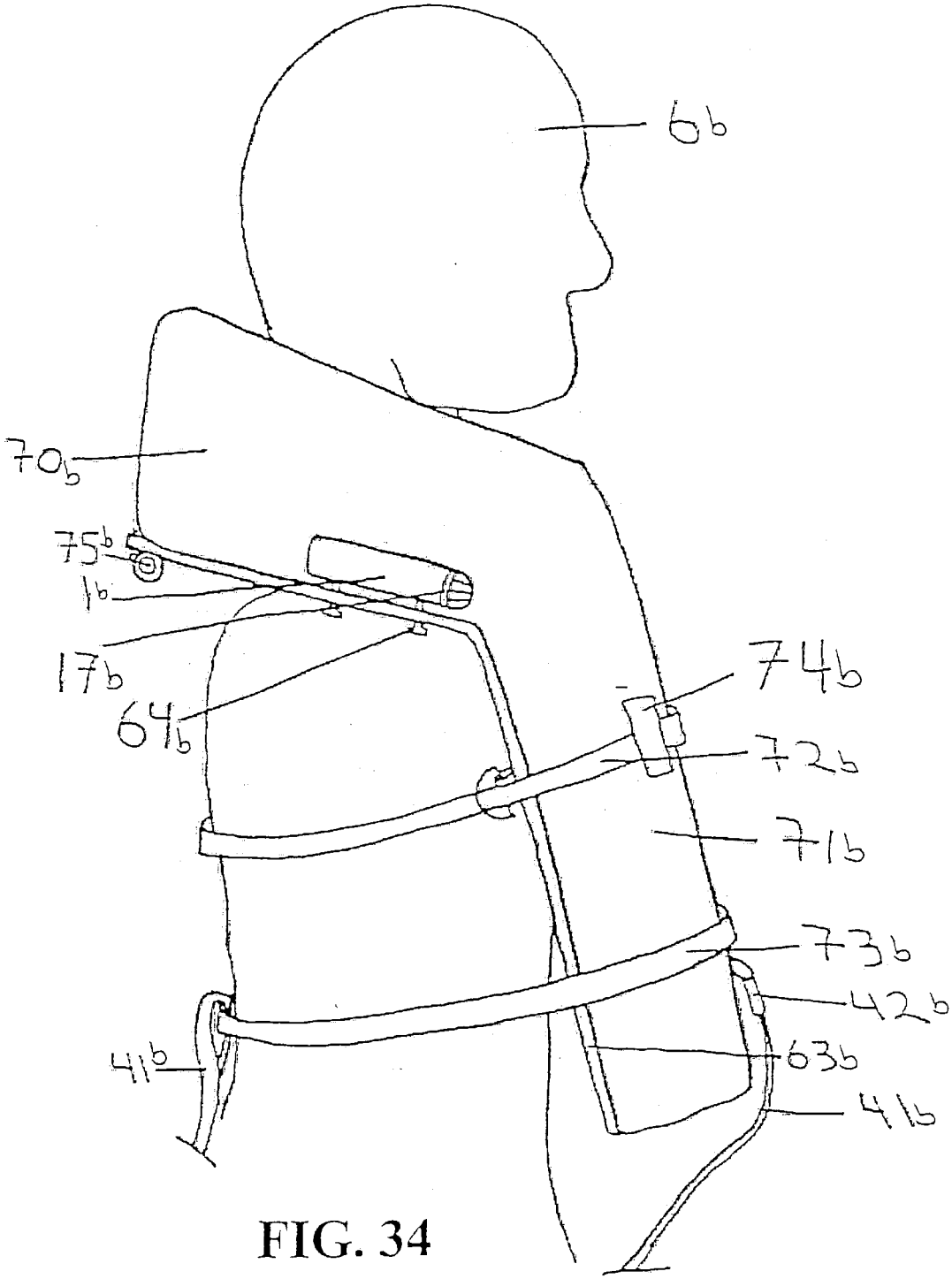
FIG. 34 is a left lateral view of a yoke collar style PFD illustrating amplified cervical displacement means relative to reduced ventral means and attachment of combined ballast and appliance member to oversized foam base/fabric shell held securely by foam layer compressing chest strap(s).

Ideally, the yoke collar style PFD shape can be retained yet free board optimized while keeping the ballasting appliance to a minimum by using a stacking arrangement as shown in FIG. 27. As shown, the PFDs foam layers build upon an oversized base layer 56*b*. Succeeding layers then alternate partial single piece layers 55*b* such that there is a preferential building up of displacement behind the head and neck of the wearer. Depending on how many layers are stacked, this can result in an effective conversion of ventral displacement means toward the neck where it can now be used to enhance free board rather than sit out of water upon the chest of the victim where the majority of the ventral foam can be found and where it does not contribute to displacement or free board. This stacking arrangement in a finished PFD is shown in FIG. 34. The inclusion of two additional ventral elements on one side relative to the other incorporates the fixed eccentric buoyant means necessary and sufficient to meet minimal turning performance. Positioning the combined ballast and signaling device on a vertical pivoting attachment along the opposite ventral buoyant means improves the aggressiveness of the airway protective turning moment of such a PFD.

The efficacy of the PFD, as measured by its airway protection, is enhanced if the buoyant ventral means 100*b*, which in FIG. 34 is shown as the right side of the PFD, is constructed with enhanced displacement relative to the left side or ballasted ventral means 101*b*. This creates an eccentric fixed buoyant means that destabilizes the face down position. If the PFD's differential ventral buoyant means are adequately designed and constructed, an eccentric inherently buoyant PFD can be sufficient to provide airway protection. Ideally, the combination of a ventral buoyant discrepancy combined with a correctly located and attached combined ballast and signaling device provides the PFD with a brisk and reliable rotation of the victim out of the face down position and into the face up position with the least amount of physical divergence from the currently configured PFD as stowed aboard many commercial vessels.

The above advantages as detailed in the PFD constructed from foam layers applies to the solid foam PFD. The enhanced ventral buoyant moment complements the correctly positioned ballast or combined ballast and appliance. That combined efficacy allows for a shift of some of the displacement towards the head and neck where it increases the distance from the waters surface to the victim's airway.

Towards further securing the effective application of energy per unit of ballast 1*b* towards effective self-rescue rotation, is clinching strap 72*b*, which encircles the ventral stacked foam layers on the ballasted side of the PFD. Once the PFD is placed on the wearer the foam layers slide into their final position at which time strap 72*b* is now tightened, compressing the foam layers. Once the strap is tightened it connects the stacked layers to the oversized base layer where they connect to the fabric shell and combined ballistic and signaling means. A second strap 73*b* can also be provided and encircles the opposite ventral stack further unifying the PFD structurally. Certain body types and or use of thermal protective clothing, make the in water vertical position markedly stable and may require an additional posterior cervical mobile or fixed ballast device 75*b*, similarly attached to the base foam layer and fabric shell of the PFD.

For an individual working in foul weather wearing significant amounts of clothing it can be important to further amplify the rotational energy supplied per unit mass of a ballast regardless of its source. FIG. 35 illustrates an externally applied rigid lever arm 80*b* with an attached 90° degree stop 81*b* that prevents the ballast from swinging past the 90° degree point. In the active position the ballast is moved away from the victim's axis of rotation and held in this position of greatest rotational impact on the face down victim. A second significant advantage of amplifying the ballast's impact by moving it outboard is that it lengthens the lever arm from the vertical axis, generating the additional leverage needed to pry the flaccid victim out of the face forward slump. When the victim is vertical in the water column in what is called the 'PFD Dangerous Zone', i.e. 0° to 20° degrees from vertical, just before losing consciousness there is a strong tendency for the victim to slump forward when they pass out. If the victim slumps forward he or she may hang from their PFD, airway crimped and face in the water, where he or she may quickly drown. With the swing ballast at its greatest distance from the victim's vertical axis, the victim is rocked off to the side where the ventral buoyancy is now free to rise towards the surface, swinging the person on their back, airway protected.

Figure 21:
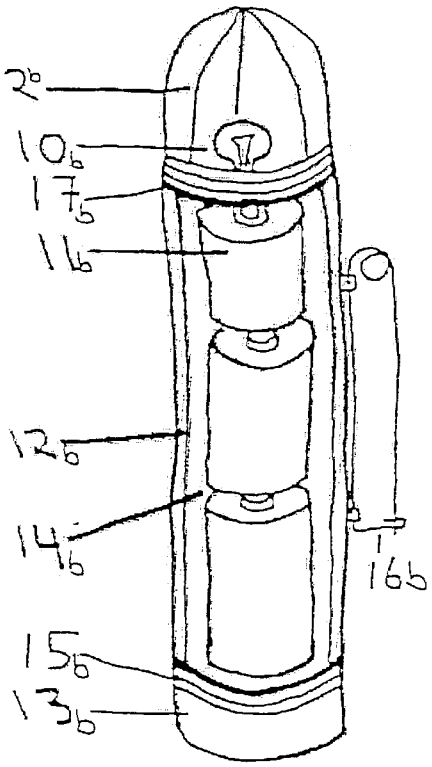
FIG. 21 is an enlarged view of a combined illumination and ballast means showing thickened high density walls, extra batteries, variably sized high density solid base plug and neutrally buoyant packing material.
Figure 22:
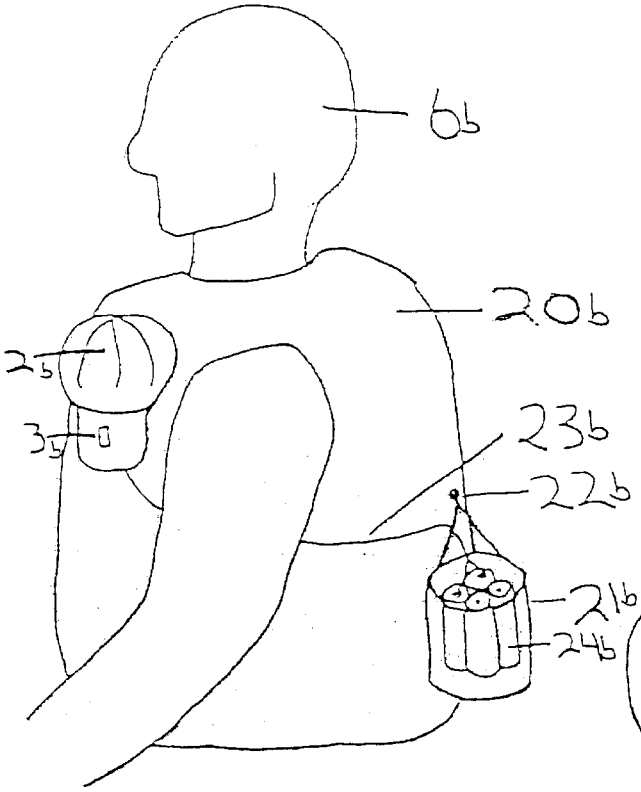
FIG. 22 is a left lateral view of a vest style PFD illustrating left anterior buoyant globe appliance and posterior mobile ballast power means.
Figure 23:
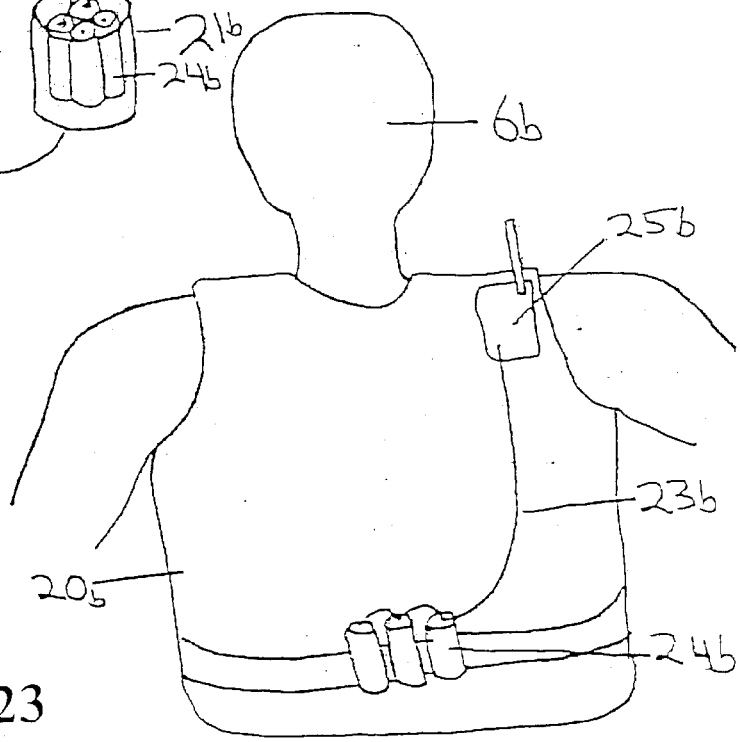
FIG. 23 is a posterior view of a vest style PFD illustrating fixed horizontal ballasting batteries connected to eccentric transmitter means.
Figure 36:
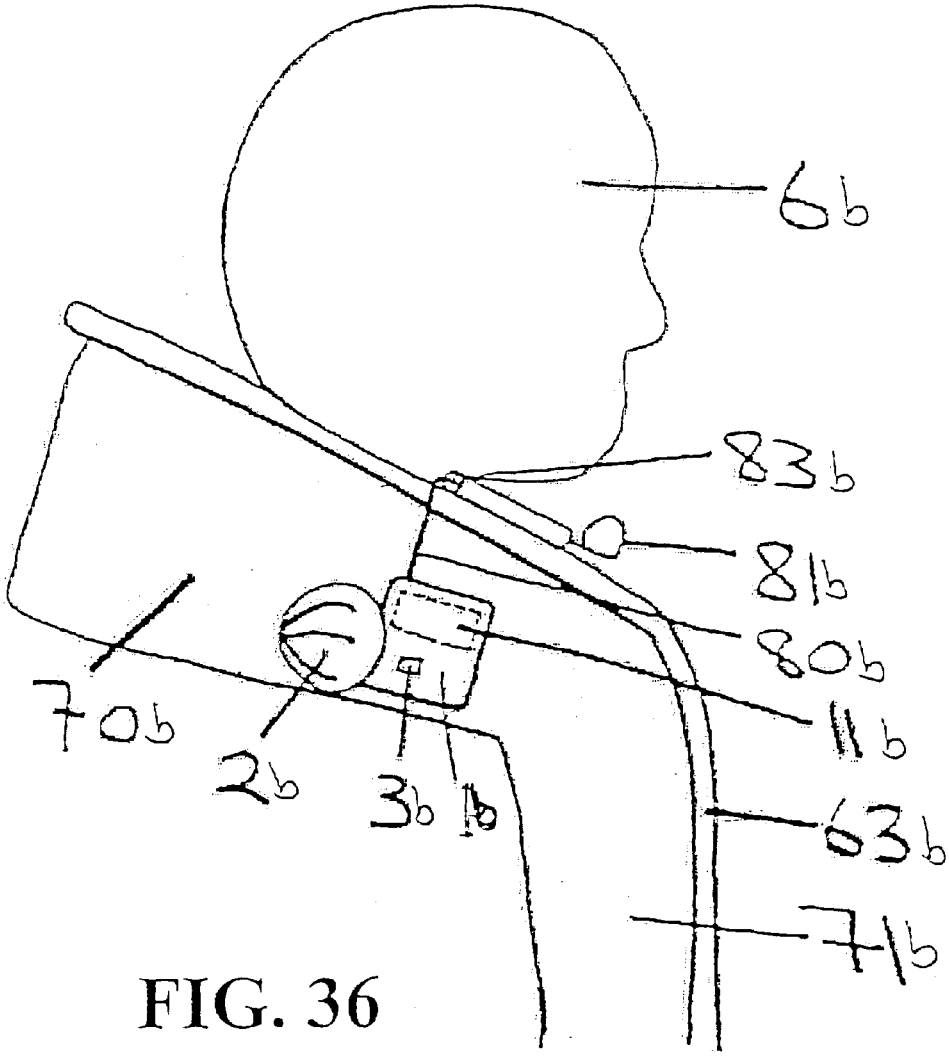
FIG. 36 is a left lateral view of a yoke collar style PFD with combined ballast and signaling device attached via an integrated 90-degree swing arm.

Arm 80*b* and stop 81*b* are preferably connected to a ballast plate 82*b* upon which can be mounted an attachment cover supporting a range of additional ballasting devices via a quick release attachment means 86*b* for securing a simple ballast 87*b* or a combined ballast and appliance such as is shown in FIG. 21. The swing arm is attached by a secure locking means such as might be comprised of an outer jaw 85*b* and inner jaw 88*b*. A stiffener of ballasting stiffener 60*b* improves the conversion of the torque applied to the tubular arm guide 83*b* into rotation of the wearer rather than into deformation of the PFD. FIG. 36 shows an integrated eccentric mobile swing arm with a combined ballast and appliance device 1*b* with additional ballasting power supply 11*b*, regulated by switch 3*b* power signaling/illumination device 2*b*. The tubular hinge 83*b* is preferably secured to the over sized top layer of foam further improving the transfer of the kinetic energy of the ballast into rotation of PFD buoyant means. As the efficacy per unit mass is advanced the buoyant means of the PFD can be reallocated from subserving the responsibility of rolling over the obtunded victim to support the flaccid victim's head and neck, i.e. buoyancy can be removed from ventral means 71*b* and placed behind the head and neck 70*b* conferring increased freeboard or distance of the victim's nose and mouth from the water line.

Figure 37:
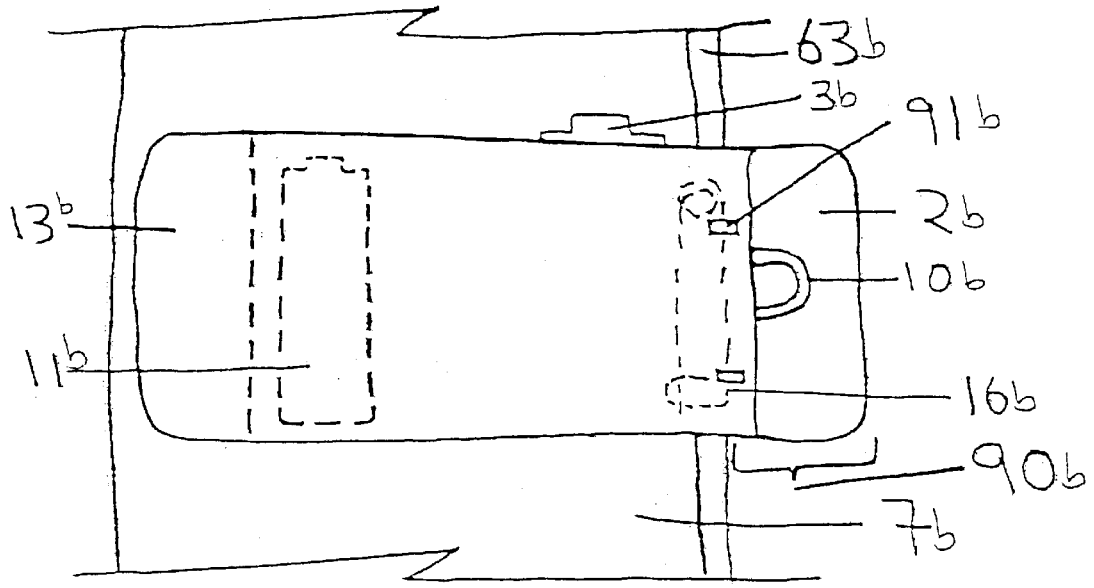
FIG. 37 is an enlarged view of a left lateral cervical-ventral joint illustrating the location of buoyant stop and ballasting swing ends of combined ballast and signaling device with pivoting attachment means parallel to the anterior face of the PFD.
Figure 90:
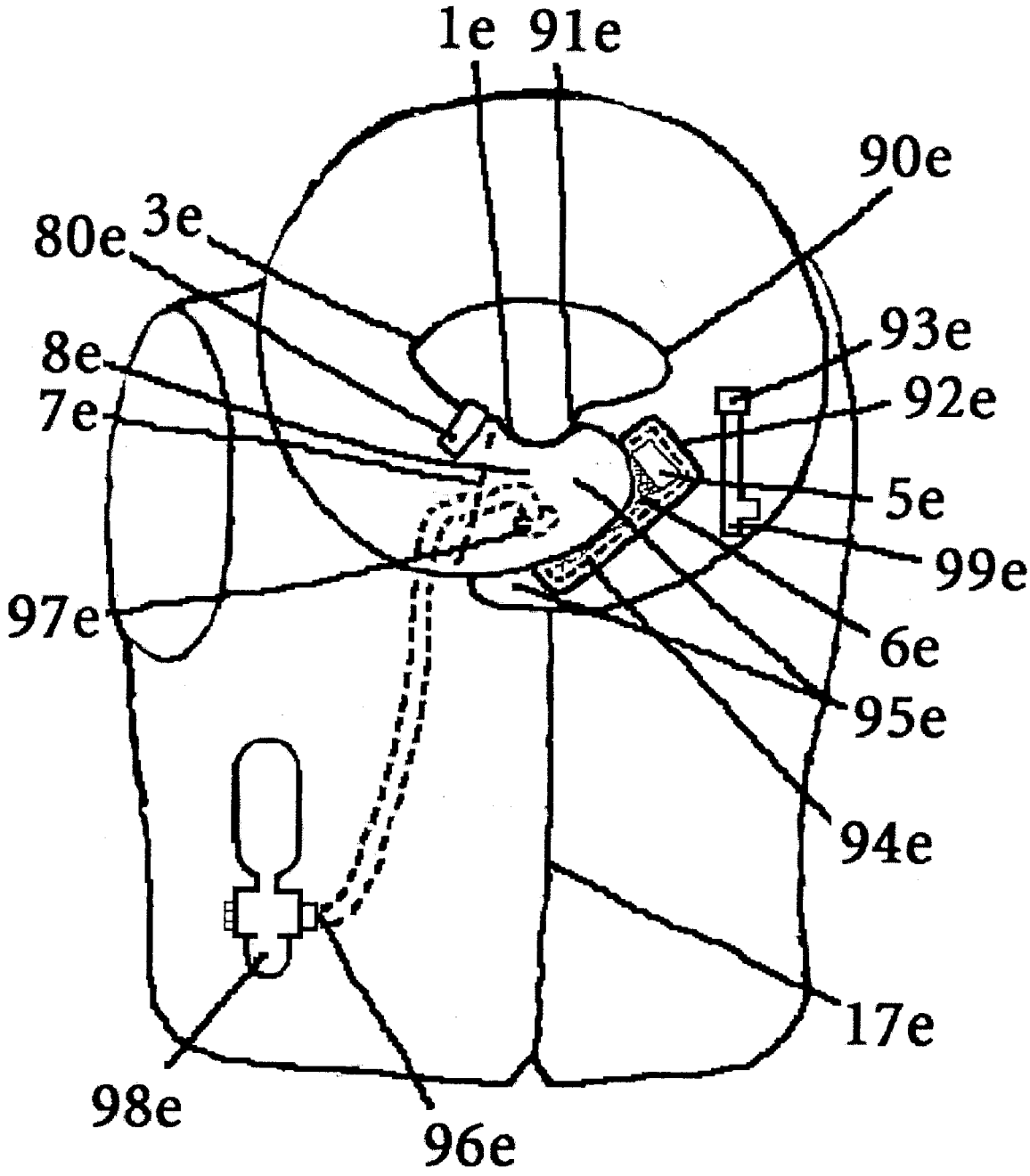
FIG. 90 is an anterior view illustrating a recreational low to medium displacement PFD with bilateral flexion angles that bring both anterior arms across the midline. The self-closing arms create a self-adjusting complete perimeter mandibular splint. Bilateral crico-thyroid relief cams wrap around the voice box without compressing the airway. A remote power inflator reduces bulk and ensures rapid exposure of the automatic inflation mechanism to water or hydrostatic pressure. Placement of an over-pressure relief valve combined with a vent/oral inflator opposite point of inflation facilitates complete removal of all entrapped air bulk during compression.

SOLAS Life Jackets when used commercially are required to carry an illumination or signaling device, a preferred embodiment of such is shown in FIG. 37 demonstrates how the combined ballast and signaling means is divided into a long arm that extends towards the rear of the wearer. At the extreme end of the long arm is located the highest density ballast so that when the combined ballast and signaling device swings about attachment means 16*b* that pivots freely through mounting means 91*b*, the ballasted end is moved laterally to the point furthest from the axis of rotation. Alternatively, when the victim is floating face up, the long arm of the ballast end swings the device back adjacent the lateral edge of the PFD which now positions the short buoyant arm straight up so that the illumination means 2*b* is out of the water and visible from 360° degrees. If the victim enters the water face down or is rolled over onto their face by a wave, the long arm of the device, swings out approximately 90° degrees moving the ballast to its optimal position of approximately 90° degrees to the victim's axis of rotation. In this position, the ballast is maximally effective at applying torque to the victim and their PFD in order to rotate their face out of the water. As the long arm of the ballasted end of the device approaches 90° degrees the short buoyant arm is simultaneously moved medially where the impact of the buoyancy is reduced to its minimum in terms of opposing active self-rescue. The short buoyant arm of the combined ballast and signaling device preferably acts as a 90° degree stop arresting the swing from perpendicular to horizontal relative to the ventral face of the PFD. In the stop position, the short buoyant arm of the device rests against the face of the PFD. FIG. 90 shows a preferred embodiment where the short arm buoyancy is reduced to its practical minimum thereby reducing the need for offsetting ballast. Once the victim is rolled over into a face up position, the ballast swings back in reducing the ballast's distance from the victim's axis of rotation thereby reducing the ballast's impact or lowering the corner of the mouth of the victim towards the water (i.e. thereby maintaining as much freeboard as possible).

Figure 38:
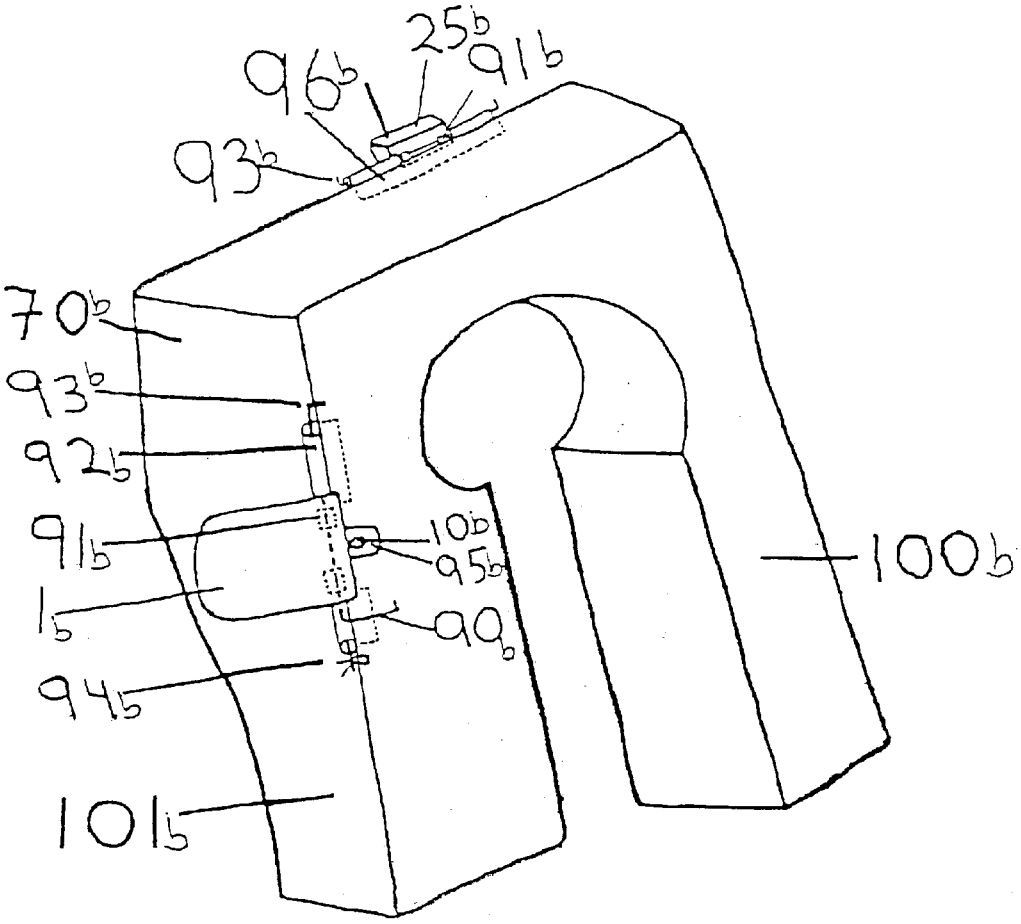
FIG. 38 is an enlarged anterio-lateral view of a yoke collar style PFD illustrating secure, rigidifying standardized integrated mounting means of combined ballast and appliance.
Figure 39:
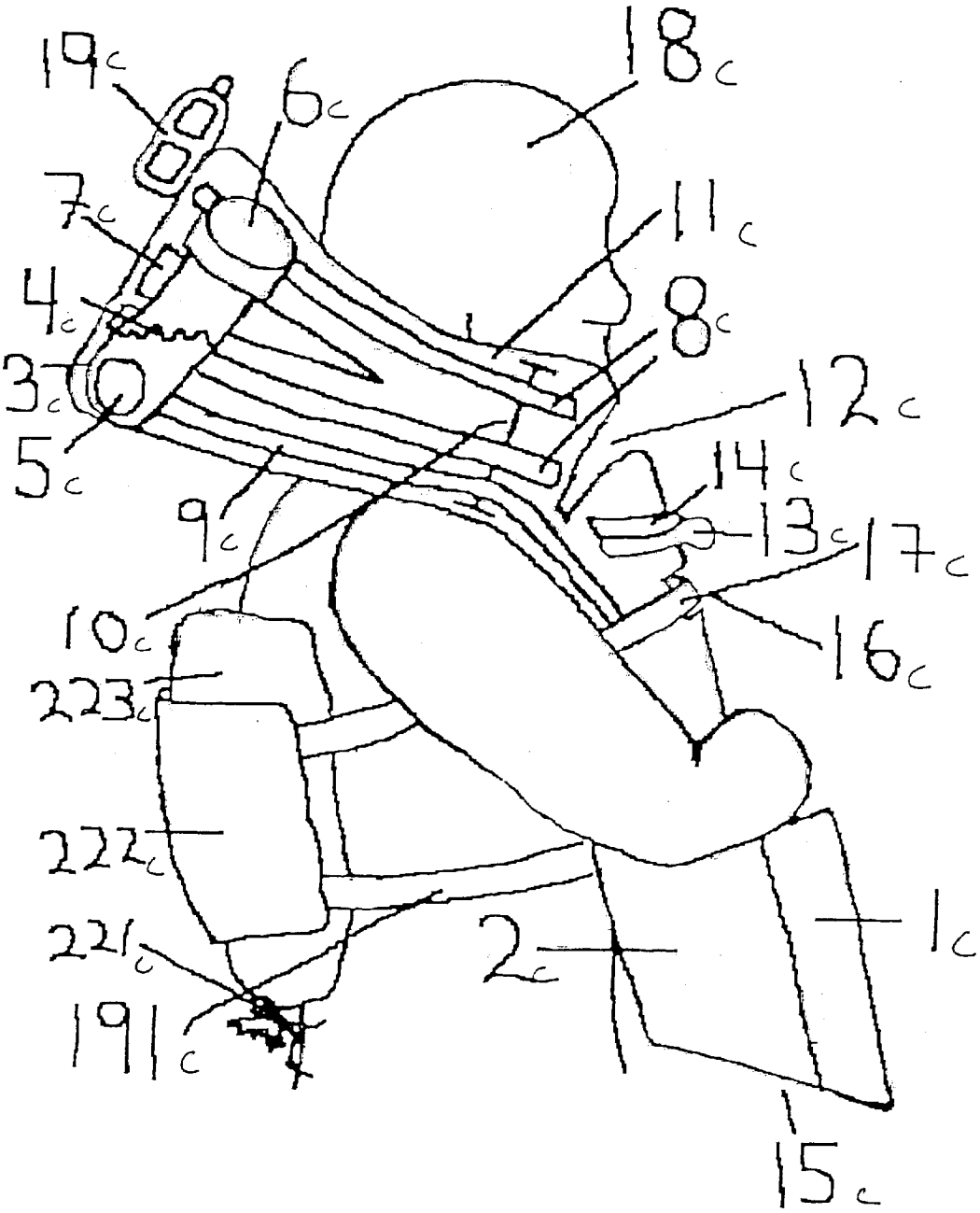
FIG. 39 is a right lateral view of an interior structure for a vertically eccentric Life Jacket in accordance with the present invention.
Figure 40:
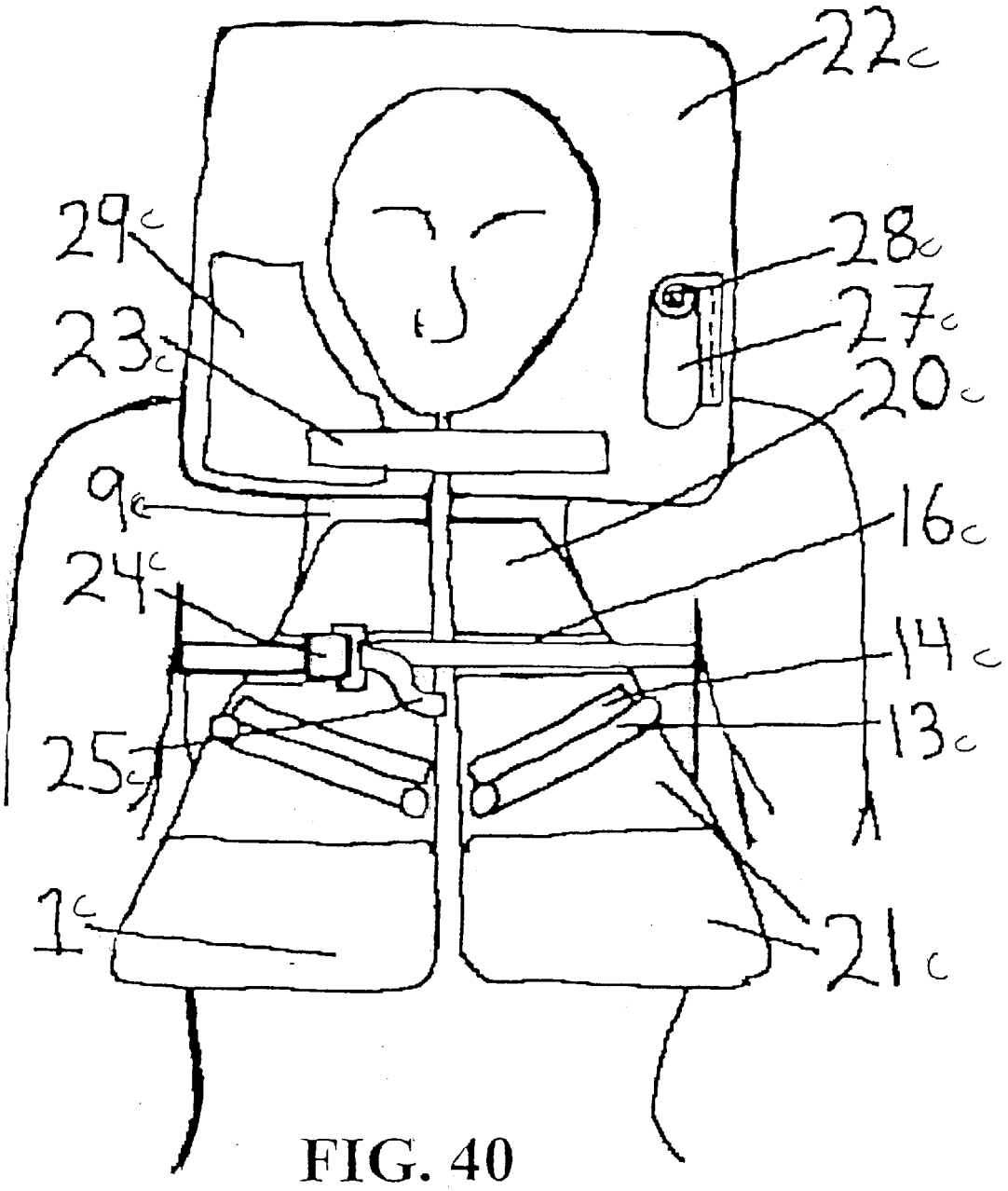
FIG. 40 is a frontal view of the bell-bottom ventral buoyant means of the vertically eccentric life jacket.
Figure 41:
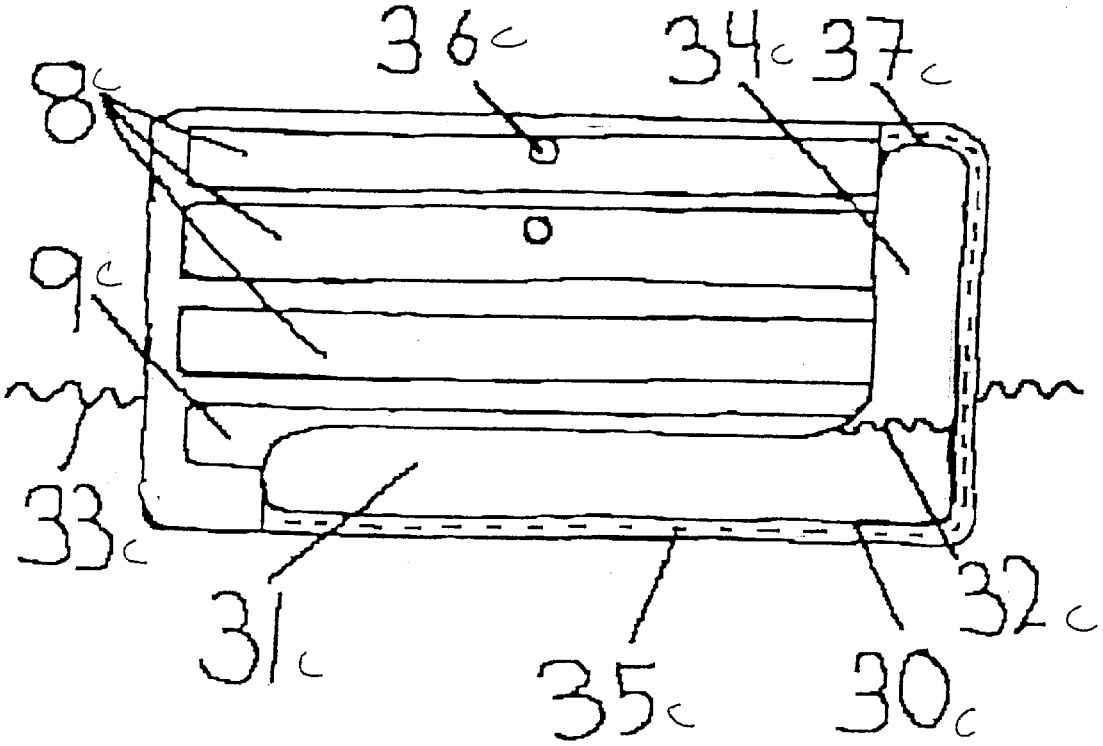
FIG. 41 is a superior view of the position of the gas liquid container within the posterior cervical layers of the adjustable collar.
Figure 42:
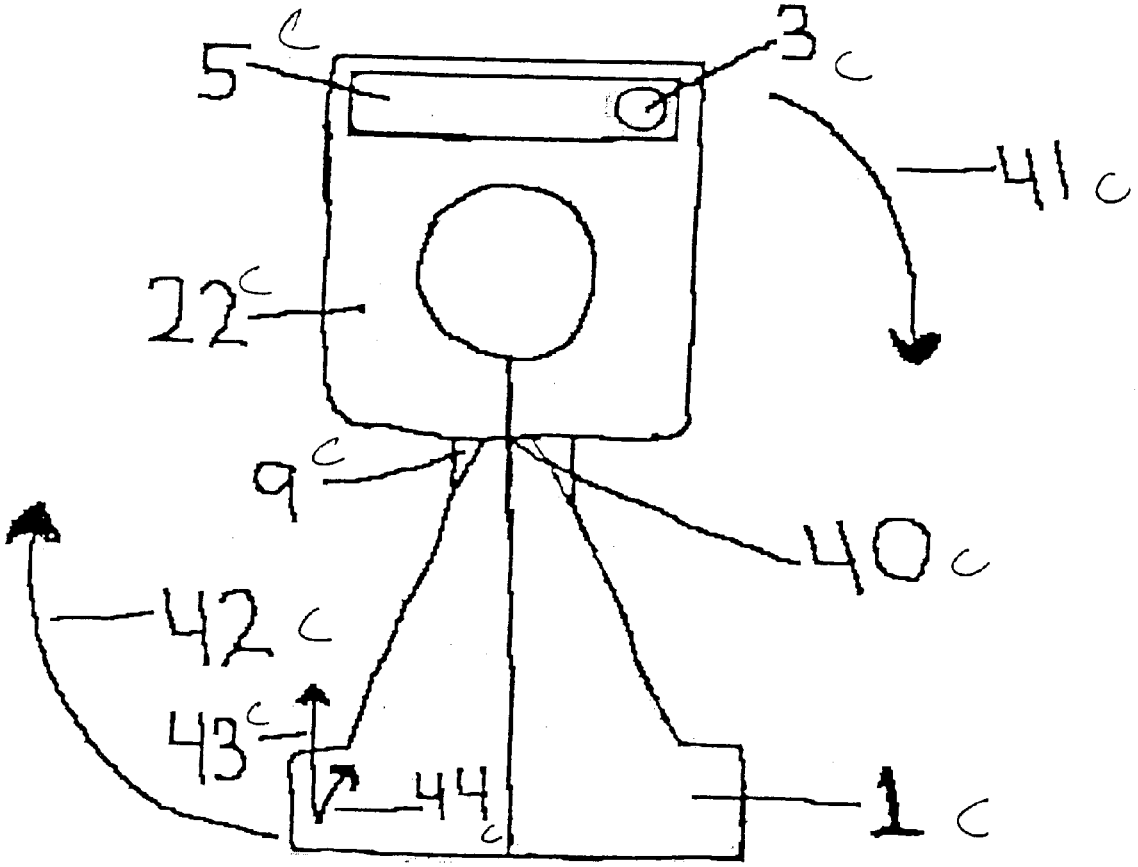
FIG. 42 is a frontal view of the vector analysis of the combined effects of contained mobile eccentric ballast and inverted ventral buoyant means.

FIG. 38, also illustrates a secure and simple mounting means for a combined ballast and appliance. Preferably, a sewable plastic piping 92*b* is integrated into the seam of the PFD spaced to accommodate the appliance's hinge means 91*b*. The section of tubing can be die cut to be removed leaving the sewable flange so that the space for the appliance can be consistently close for optimal support yet sufficient to allow easy assembly. Hinge pin 93*b* serves multiple functions; it secures combined ballast and signaling device 1*b* through the sleeve means integrated into the PFD 92*b* in a secure but preferably releasable manner. It rigidifies the cervical—ventral joint. The placement of multiple sewn in sleeves 92*b* which contain their hinge pin 93*b*, with or without a combined ballast and appliance device, can supply rigidification of the cervical—ventral joint complementing PFD turning due to ballast(s) at other locations. Furthermore, when sleeve means 92*b* is sewn onto the oversized foam layer 63*b* it further advances the transfer of the positional energy of the ballast into rotation of the PFD/victim reducing the amount of ballast required for reliable active self rescue.

PFD WITH ATTACHED COMBINED BALLAST AND SIGNALING PARTS LIST (FIGS. 20 through 38)

1*b* Combined ballast and signaling means
2*b* Continuous or stroboscopic illuminating means
3*b* Wearer operable appliance switch
4*b* Elongated battery containment means
5*b* Locking attachment means for securing ballasted signaling device
6*b* PFD wearer
7*b* Yoke Collar Style PFD
8*b* Cervical Side Joint stiffener
9*b* Cervical joint strap and stiffener for non-ballasted side
10*b* Light source
11*b* Additional ballasting batteries
12*b* Thickened high-density wall of container
13*b* Variably Sized High density plug
14*b* High-density water excluding packing medium
15*b* O-Ring sealed threaded connector
16*b* Secure attachment means
17*b* O-Ring Sealed Switch
20*b* Vest Style PFD
21*b* Mobile ballast battery container means
22*b* Single attachment point
23*b* Conductive cable connecting ballasting batteries to appliance
24*b* Additional parallel ballasting batteries
25*b* Signaling Device
30*b* Cephalic Cradle portion of second buoyant means
31*b* Dual securing straps for cephalo-cervical buoyant cradle
32*b* Cervical cradle portion of second buoyant means
33*b* Cephalo-Cervical Cradle
34*b* Asymmetric ventral buoyant means
35*b* Dual securing means for ventral buoyant means
36*b* Thermnal protective inner liner for two-part PFD
37*b* Dual arm mobile ballast battery means
38*b* Ballasting battery units
39*b* Right arm attachment point
40*b* Appliance
41*b* Crotch strap
42*b* Secure Fastener Means
50*b* Existing foam components for Yoke Collar Style PFD
51*b* Cervical foam component of a traditional Yoke Collar Style PFD
52*b* Ventral foam component of Yoke Collar Style PFD
53*b* Alternate configuration for foam layer showing Single Posterior-Cervical Joint
54*b* Alternate foam layer configuration showing two-piece layer with Single Side Cervical Joint
55*b* Alternate Single Piece layer combining cervical and ventral components
56*b* Over sized single piece base foam layer
57*b* Regular sized single piece foam layer
60*b* Combined Internal Ballast Component and lateral Stiffener
61*b* Ventral Coated Fabric Cover
62*b* Dorsal Coated Fabric Cover
63*b* Binding Tape
64*b* Combined Ballast and Appliance Fastener means
65*b* Anterior Stiffener
70*b* Amplified Cervical Displacement means
71*b* Relatively reduced ventral displacement means
72*b* Ballast attachment side, PFD Foam Layer Compressing chest strap
73*b* Alternate side PFD Foam Layer Compressing chest strap
74*b* Chest strap retainer guide
80*b* Rigid Swing Arm of mobile ballast
81*b* 90-degree Range of Motion Stop
82*b* Internal Ballast Plate
83*b* Tubular liner guide
84*b* Ballast Attachment cover

85*b* Locking Attachment means for mobile swing ballast and lever arm
86*b* Quick Release attachment means for ballast
87*b* Ballast means
88*b* Inner Locking Jaw
90*b* Buoyant arm of device
91*b* Hinge Pivot means of appliance
92*b* Sleeve means integrated into PFD
93*b* Hinge pin means
94*b* Hinge pin retainer means
95*b* Reduced Volume Buoyant Arm
96*b* Die cut sewable plastic sleeve means
100*b* Enhanced non-ballasted ventral component
101*b* Relatively diminished ballasted ventral component Some of the advantages achieved with and/or features of one or more of the embodiments illustrated in FIGS. 72 through 90 include the following: (1) Combined Rotational and Functional Ballast attached to Life Jacket; (2) Ballast that is comprised in total or part by power supply means; (3) Ballast that is comprised in total or part by signaling, illumination or appliance means; (4) Ballast that is comprised in total or in part by containment means; (5) Ballast that is comprised in total or in part by high density component to offset buoyant functional components; (6) Ballast that is comprised in total or in part by neutral or negative packing fluid/gel; (7) Ballast that is comprised in total or in part by high density stiffener/attachment means complementing functional ballast means; (8) Fixed midline functional ballast/power supply/appliance; (9) Fixed eccentric functional ballast/power supply/appliance; (10) Mobile midline functional ballast/power supply/appliance; (11) Mobile eccentric functional ballast/power supply/appliance; (12) Dual Arm Mobile functional ballast/power supply/appliance; (13) Ballast power supply. connected to remote appliance; (14) Attached buoyant device eccentric; (15) Attached buoyant device midline; (16) Eccentric shaped midline buoyant means; (17) Independent cephalo-cervical buoyant cradle means; (18) Buoyant thermally protective inner shell of PFD; (19) Rigid arm attachment means for mobile eccentric functional ballast/power supply/appliance; (20) Interchangeable variable rigid arm length of attachment means for mobile eccentric functional ballast/power supply/appliance; (21) Flexible arm attachment means for mobile eccentric functional ballast/power supply/appliance; (22) Neutrally buoyant ballast and foam means attached at opposite sides to PFD; (23) Placement of ballast offsetting foam in ventral leg opposite of site of ballast attachment; (24) Reduced single sided lateral cervical joints, through foam layer design(selection, construction); (25) Reduced bilateral cervical joints, through foam layer design; (26) Eliminates single sided lateral cervical joints, through foam layer design; (27) Eliminates bilateral cervical joints, through foam layer design; (28) Oversized foam base layer sewn into fabric shell of life jacket; (29) Oversized foam top layer sewn into fabric, shell of life jacket; (30) Alternating incomplete foam layers increasing cervical displacement relative to ventral displacement; (31) Alternating incomplete foam layers increasing the buoyant lateral ventral displacement relative to the opposite ballasted ventral side; (32) Alternating incomplete foam. layers increasing both cervical displacement means relative to ventral and increasing the buoyant lateral ventral displacement relative to the opposite ballasted ventral side; (33) PFD of solid foam construction with eccentric displacement means;

(34) PFD of solid foam construction with left right ventral components of unequal displacement means; (35) PFD of solid foam construction with cervical and ventral components of unequal thickness of displacement means; (36) PFD of solid foam construction with eccentric displacement means where side with attachment means for ballast or combined ballast and appliance device is reduced relative to the opposite ventral means; (37) PFD of solid foam construction with eccentric displacement means where side with attachment means for ballast or combined ballast and appliance device is reduced relative to width and or thickness and or length of the opposite ventral means; (38) PFD of solid foam construction with eccentric displacement means where side with attachment means for ballast or combined ballast and appliance device is reduced relative to wedge shaped opposite ventral buoyant means; (39) Ballast sided foam layer compressing strap means; (40) Bilateral foam layer compressing strap means; (41) Rigid swing arm with stop; (42) Rigid swing arm supported by tubular hinge; (43) Rigid swing arm with attached ballast component; (44) Fabric encased ballast plate; (45) Tubular fabric webbing encased ballast plate/framework; (46) Dual eye ballast attachment points for attaching ballasted signal device; (47) Stiffener attached to swing arm hinge; (48) Rigid swing arm with stop attached to inherent buoyant means; (49) Wearer operable ballasting appliance attached to rigid swing arm with stop; (50) Water activated ballasting appliance attached to rigid swing arm with stop; (51) Appliance housing with Horizontal mounting means; (52) Appliance housing with Horizontal mounting means paralleling illumination means; (53) Appliance housing with Hoizontal mounting means paralleling signaling means; (54) Appliance housing with Horizontal mounting means paralleling appliance means; (55) Mounting means of Ballasted signaling device separating housing into buoyant and ballasting sections; (56) Mounting means of Ballasted signaling device separating housing into short buoyant and long ballasting sections; (57) Container means of combined ballast and signaling device with reduced buoyant illumination component of short buoyant arm that stops against the anterior face of PFD; (58) Container means of combined ballast and signaling device with enhanced ballast at extreme end of long ballast arm that stops at the greatest distance from the PFD axis of rotation; (59) Pivot means dividing combined ballast and signaling device into buoyant anterior stop arm and ballasted rigid posterior swing arm; (60) Dual position ballasted signaling device, ballast lateral in prone position; (61) Dual position ballasted signaling device, ballast medial in supine position; (62) Buoyant signaling means forward of pivot means; (63) Buoyant signaling means forward of pivot means adapted to lie parallel to anterior face of PFD in active position; (64) Buoyant signaling means forward of pivot means adapted to extend perpendicular to PFD in face up position and lie along anterior face of PFD in ballast active face down position; (65) Dedicated ballast and Power located ballast posterior of pivot means; (66) Sewable plastic sleeve hinge component means; (67) Die cut sewable single piece hinge component; (68) PFD with integrated hinge means; (69) PFD with plastic sewn in hinge means; (70) PFD with multiple standardized hinge components; (71) PFD with ventral cervical hinge component with hinge pin; (72) PFD with ventral cervical hinge component with rigid hinge pin; (73) PFD with ventral cervical hinge component with semi-rigid hinge pin; (74) PFD with ventral cervical hinge component with hinge pin with combined ballast and appliance device; (75) Illumination or appliance strap means that splints one or both lateral cervical joints; (76) Stiffener means externally applied that splints one or both lateral cervical joints; (77) Stiffener means integrated during construction that splints one or both lateral cervical joints; (78)

Attachment means stiffener on both lateral and anterior sides; (79) Lateral attachment means stiffener constructed of high density material; (80) Anterior attachment means stiffener constructed of low density material; and (81) Non Inflatable PFD constructed of coated fabric.

FIGS. 39 through 65 illustrate further embodiments for ballast personal flotation devices and related accessories.

Figure 54:
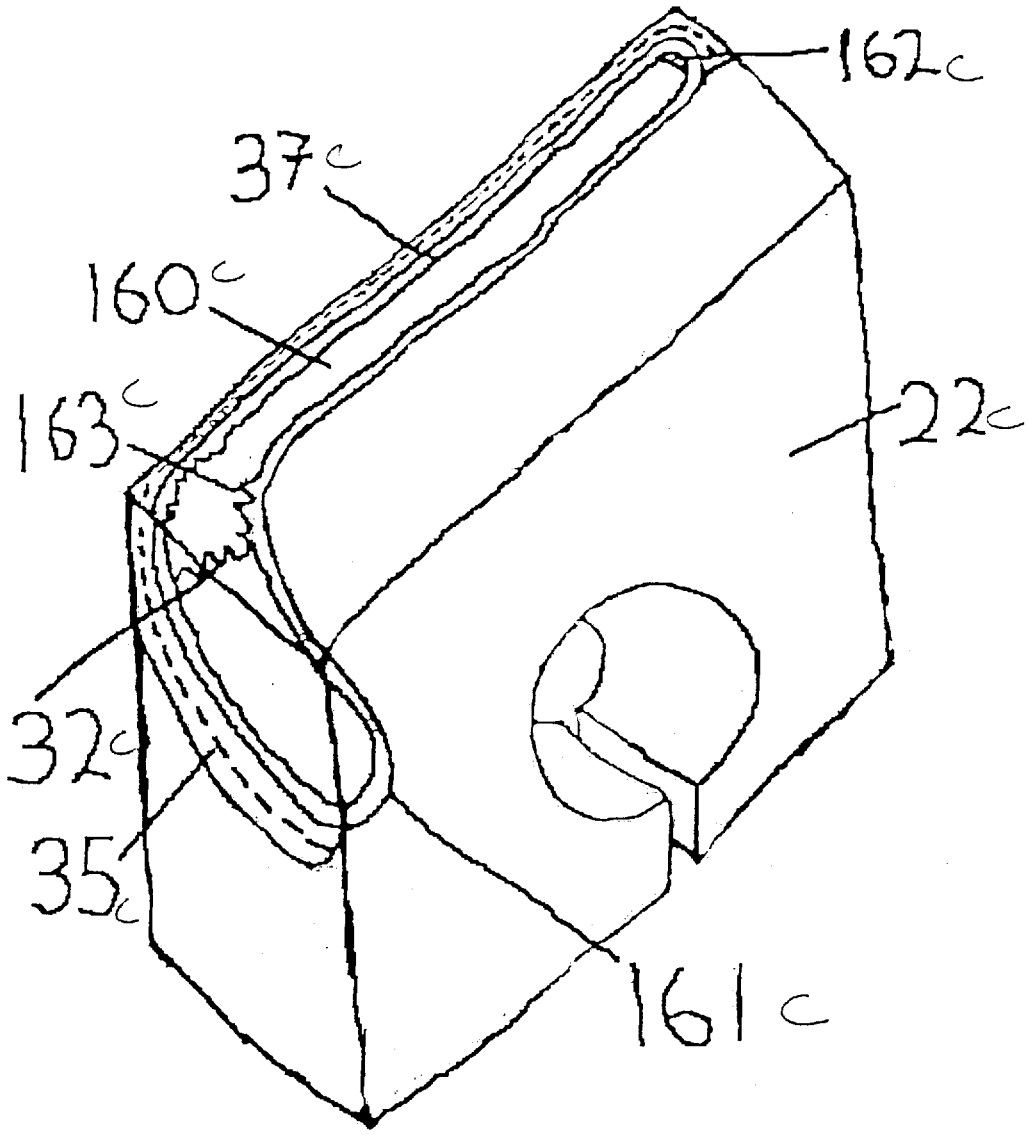
FIG. 54 is a superior three quarter view illustrating conformation of the inner welded container for a mobile liquid ballast to outer fabric tube cover directing shifts in ballast location within the adjustable cervical collar.
Figure 55:
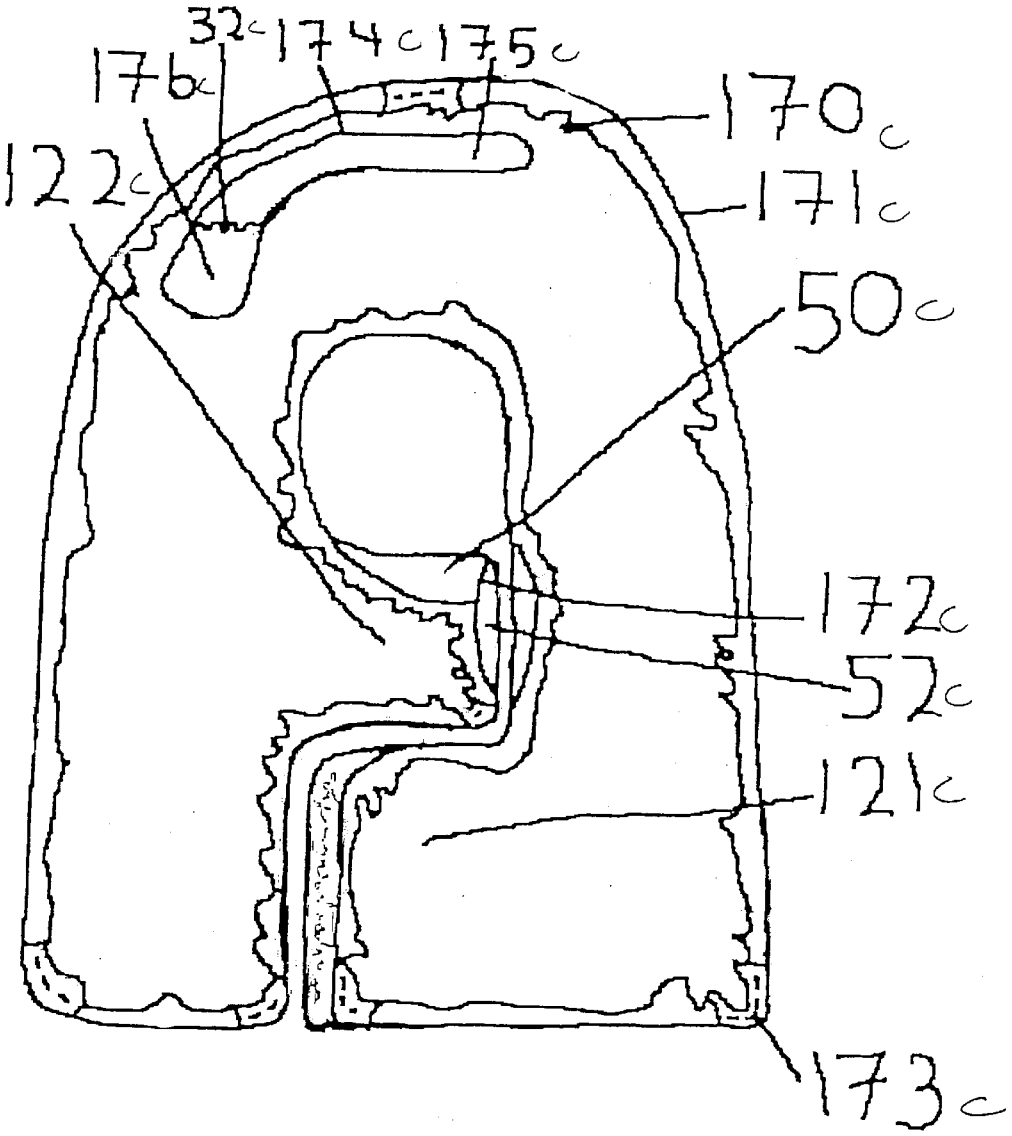
FIG. 55 is an anterior view illustrating the use of fabric outer shell to shape an over sized inner air retentive bladder. The sewn fabric shell allows the creation of shapes not easily accomplished by single walled inflatable jackets. In this particular application allows the creation of an effective cervical lock preventing the head from sliding down between the ventral buoyant arms on face first entry into the water.

The anterior buoyant means 1*c* and the ventral inferior buoyant means 2*c* shift the PFD center of buoyant down and anyway from the axis of rotation of the victim. This supplies the raw torque required to roll a flaccid diver. The anterior and lateral buoyant means has vectors that are not in line with the any structural members of the PFD; consequently the buoyant force of the anterior member rises straight up but through its attachment to the PFD and victim rocks the victim back. At the same time the posterior and superior positioning of the directed mobile ballast 3*c* shifts the center of gravity up and back. Under the force of gravity the ballast means pulls the victim back. This diametric positioning of the centers of gravity and centers of buoyancy creates a new corrective turning action heretofore unassessed during the testing and approval process. By moving the ballast and buoyant forces a greater distance from the axis of rotation you optimize the torque generated per unit mass or displacement. For a jacket of the same amount of displacement the foam means can be relocated into a triangular bell-bottom shape, see FIG. 40. From the frontal view the lateral extensions can be visualized as diagrammatically outlined in FIG. 42. At the lateral edge of the anterior buoyant means the vertical arm 43*c* of the buoyant force is unopposed and attempts to rise. The kinetic energy pivots about point 40*c* converting into a circular motion 42*c*. This is synergistically complemented by the solid ballast moving within the container 3*c* creating rotary motion 41*c* also about pivot point 40*c*. The ballast moment either fluid 31*c*, fluid 31*c* and solid 5*c*, or just solid, the fluid level 4*c* can interface with either a gas such as air or a collapsed space such as 34*c*. As the victim falls face first into the water the fluid 31*c* ballast relocates under the influence of gravity from the posterior position into an eccentric outboard lateral anterior position where it shifts the center of gravity 41*c*, freeing the ventral buoyant means to complete the corrective turning action. The fabric A container can be either single wall as in 51*c* or double wall as in 161*c*. In FIG. 54, the double wall construction with inner bladder 160*c* and outer fabric layer 161*c* allows the shifting fluid ballast 31*c* to be more accurately shaped and directed. The fluid ballast easily traverses surface irregularities 163*c* and allows rapid smooth transition from inactive to active. Notably, where the fluid is water based, it converts from a source of ballast when held aloft in the air behind the victim's head, to become neutral as the victim rolls from face down to face up.

Figure 48:
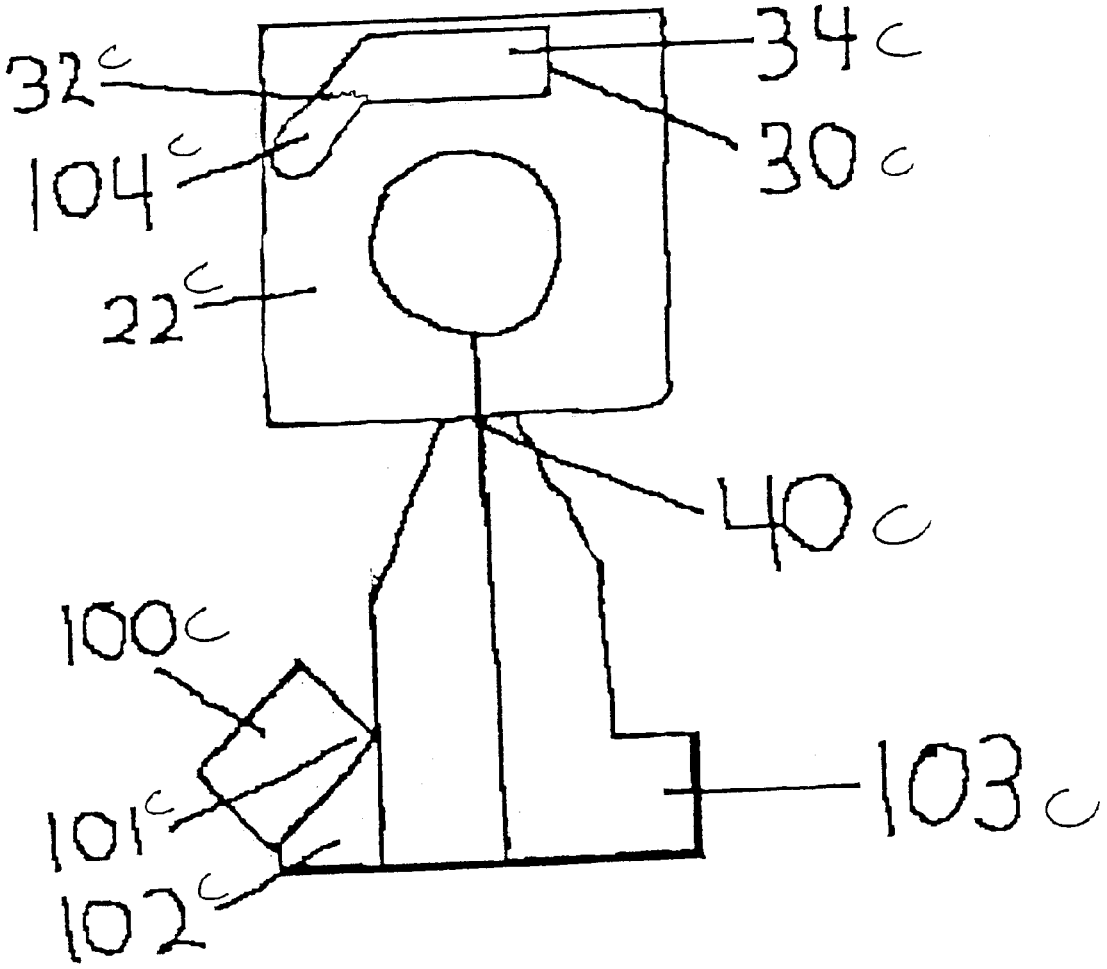
FIG. 48 is an anterior view illustrating the mobile eccentric buoyant means attached via flexible arm.
Figure 49:
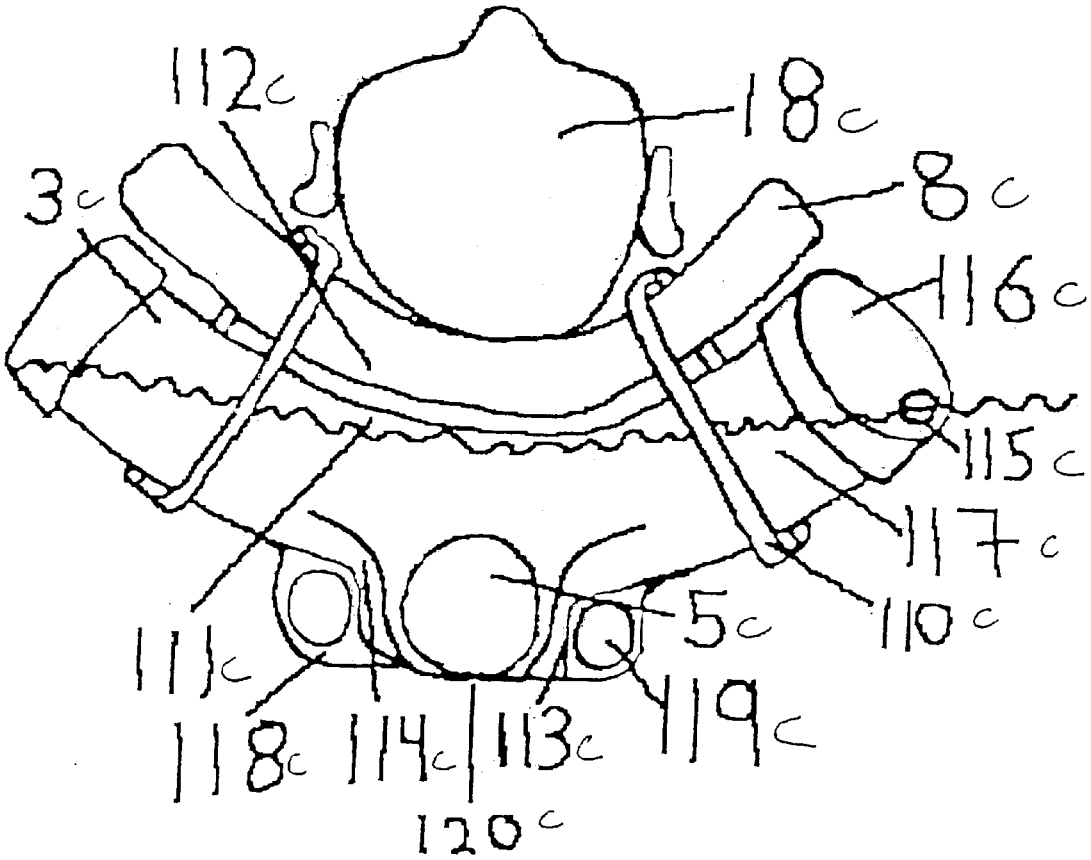
FIG. 49 is a superior view illustrating a rigid container combining fluid and solid ballast shaping the foam into a convexity cradling the head.
Figure 50:
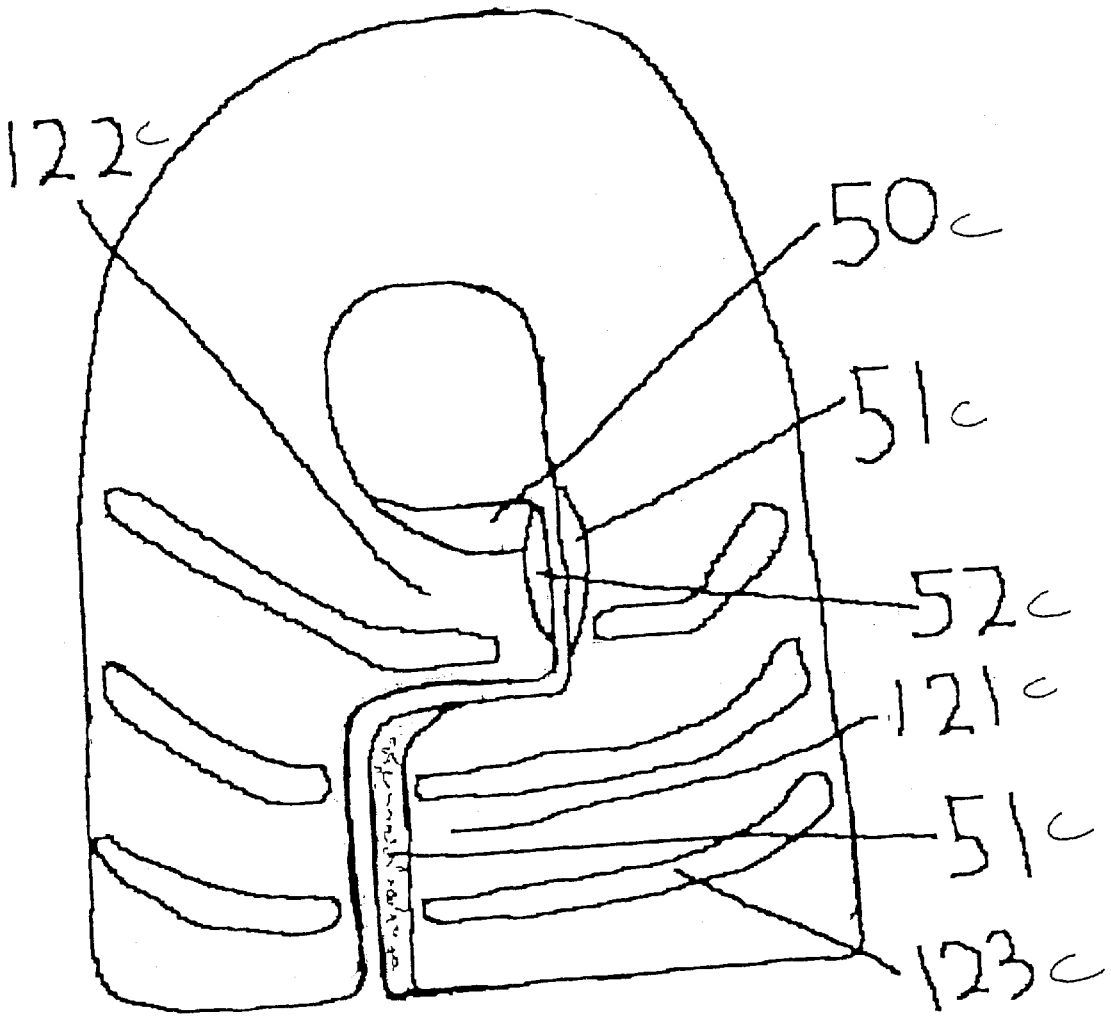
FIG. 50 is an anterior view illustrating an inflatable PFD or diver's jacket incorporating an overlapping inflatable lock and demonstrating oral nasal splash guards.
Figure 51:
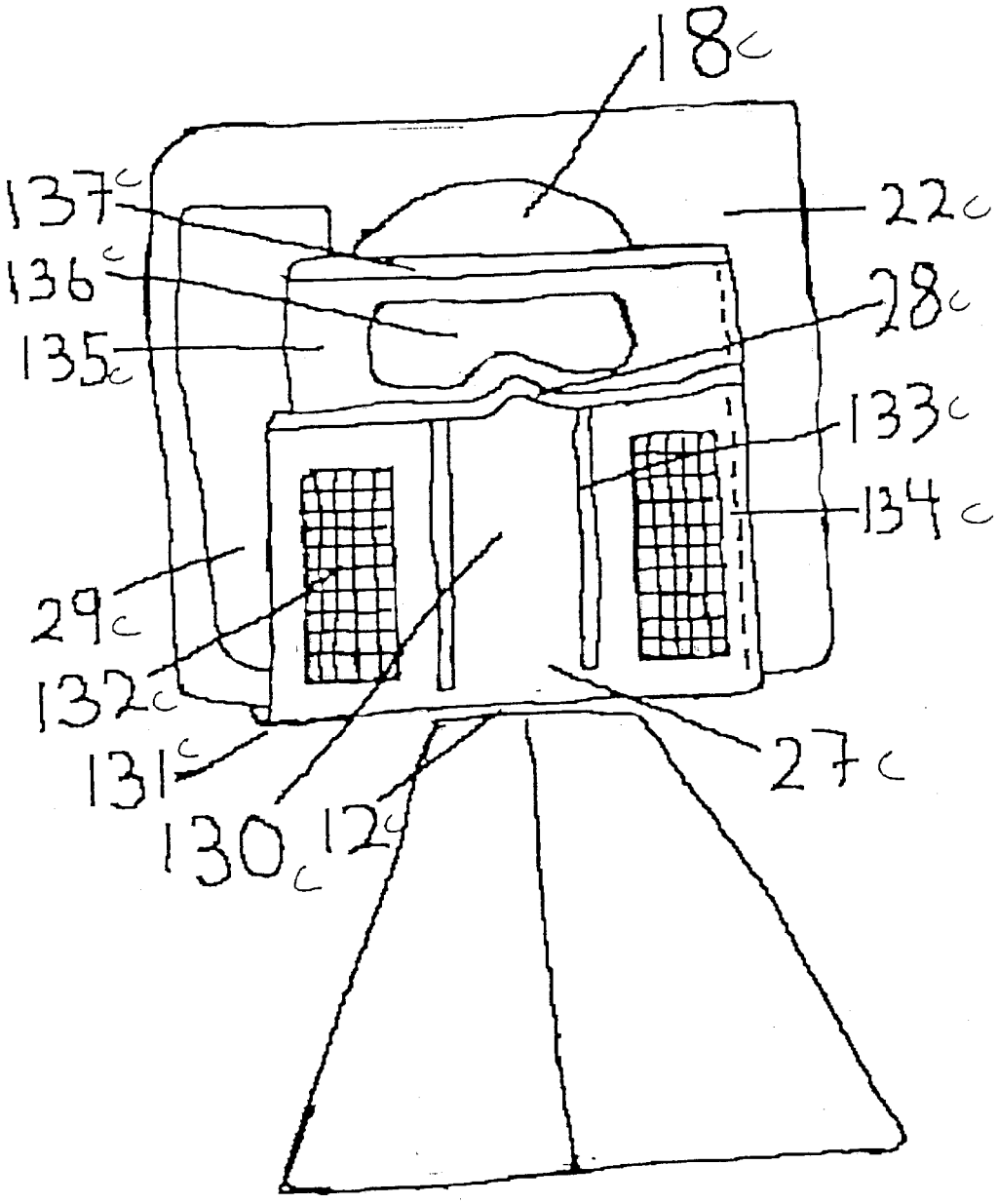
FIG. 51 is a superior view of the contained mobile eccentric ballast and fixed midline ballast elements conforming variably sized cervical foam collar.
Figure 52:
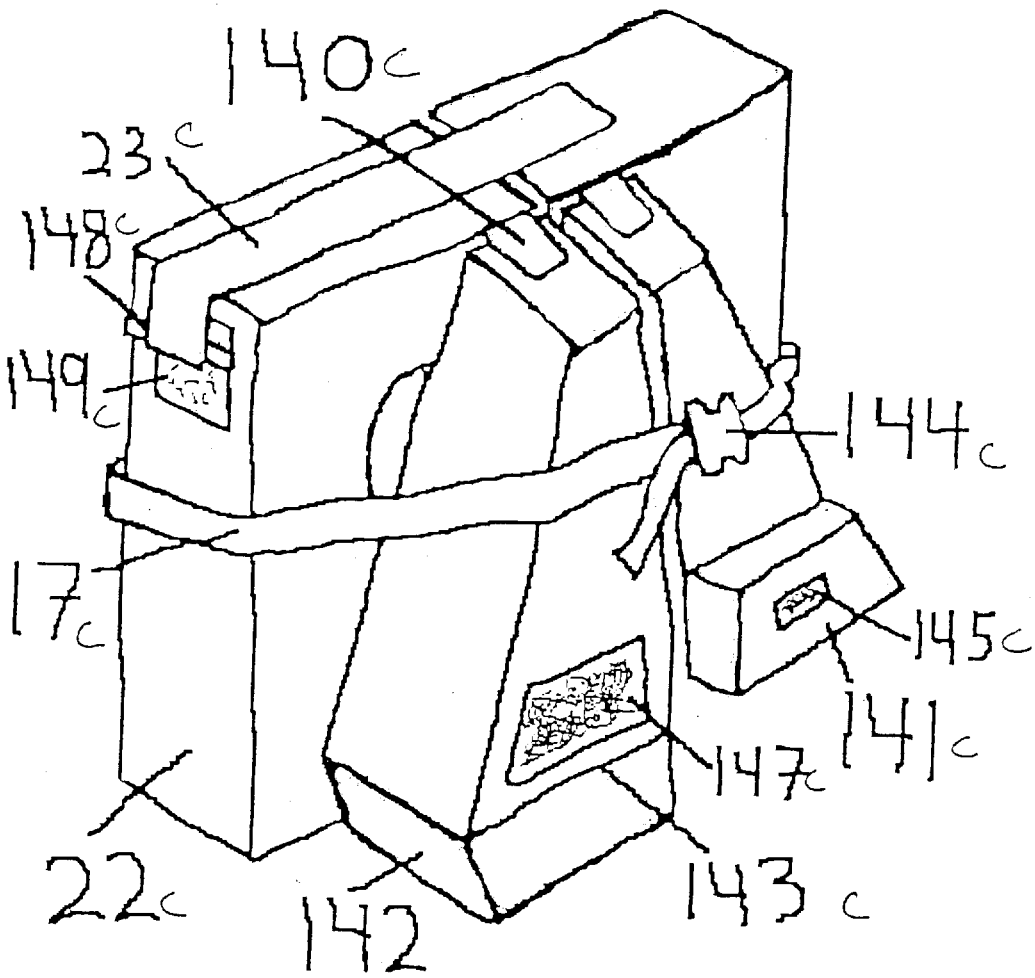
FIG. 52 is a superior three quarter view illustrating a folding PFD with dual position inferior stored and anterior active buoyant member.
Figure 53:
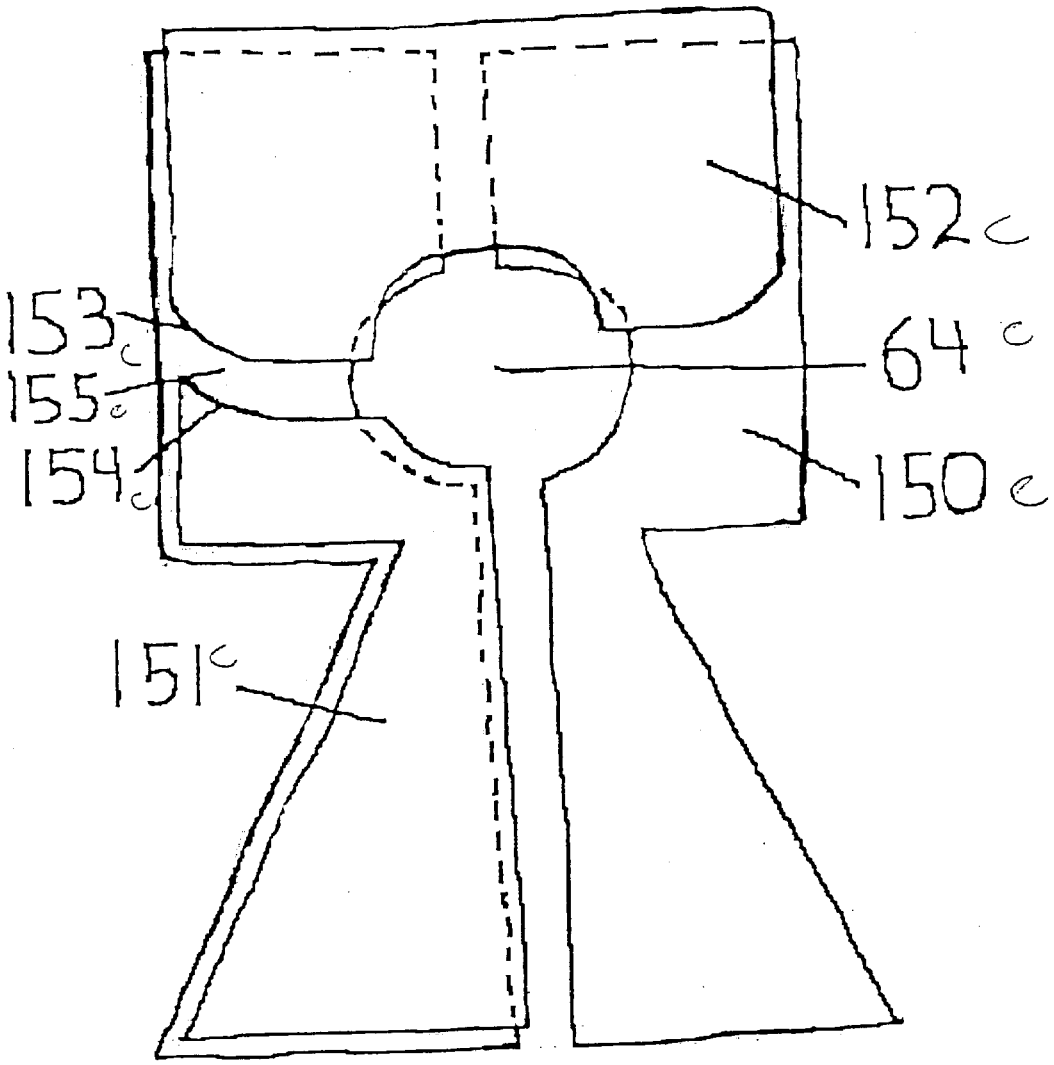
FIG. 53 is an anterior view illustrating an alternative adjustable collar that maintains the continuous base layer and allows for rotation of the ventral arms to for entry and adjusting the diameter of the neck opening to the wearer.
Figure 57:
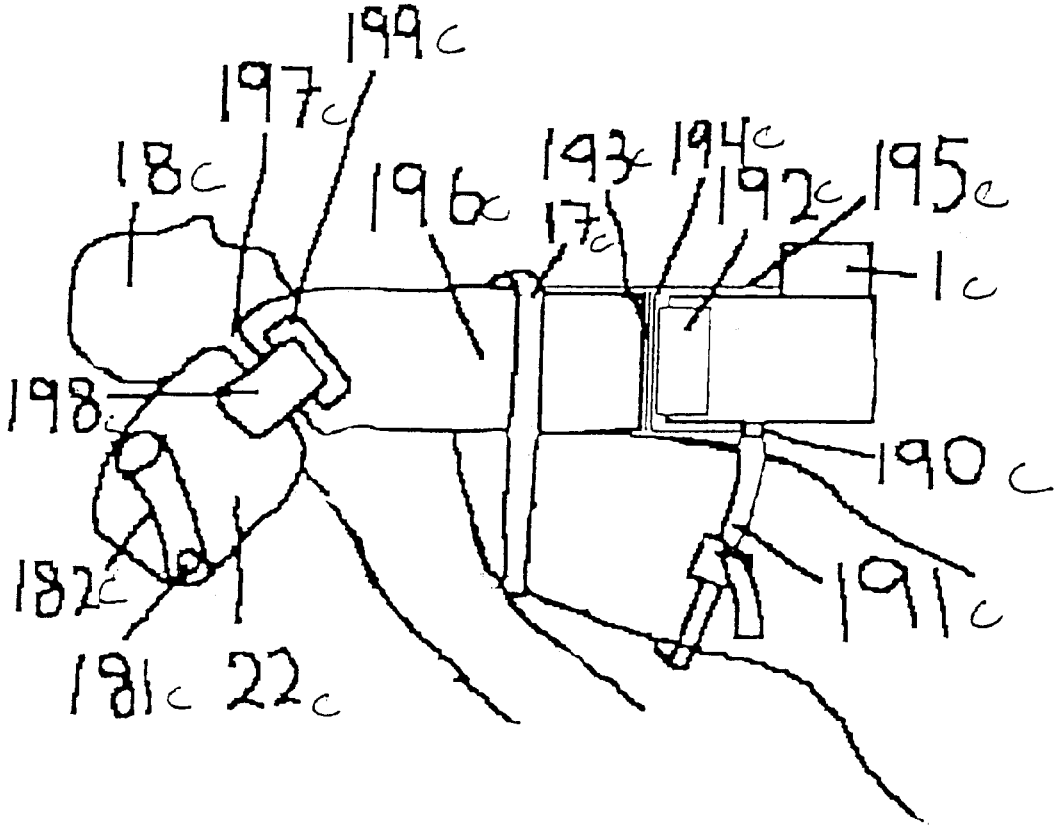
FIG. 57 is a lateral view illustrating the use of an inferior chest strap to retain but not restrict the motion of the lower mobile buoyant member. Rigid apical interface allows lower resistance to rotation of the apex of the lower unit about the upper ventral buoyant member. Lateral neck opening decreases chance of the neck moving forward and shifting the center of gravity into a face down position.

In FIG. 48 mobile buoyancy 100*c* turns about pivot point 101*c* shifting the center of buoyancy resulting in an imbalance contributing to the rotary motion 42*c*. In FIG. 57 the apex of inferior triangular buoyant member can be capped by a harder material 192*c* that pivots upon a stiff plate 193*c*. The fabric shell 195*c* forms a hinge 194*c* connecting, the mobile inferior buoyant means with the shortened main ventral buoyant means 196*c*. The mobility of the inferior buoyant means is enhanced by an inferior chest strap 191*c* that is attached at both sides by arm piece 190*c*. While the strap 191*c* can be tightened about the victim 18*c*, the arm 190*c* leaves in a degree of mobility that allows the lateral components to shift to the left or right supplying the initiating moment without which turning does not occur. The upper ventral means 196*c* are held tight against the chest by overriding chest strap means 17*c*. The use of an adjustable collar with side entrance 197*c* prevents the head and neck from being driven between the ventral arms where it shifts the distribution of ballast creating a stable face down position.

Figure 43:
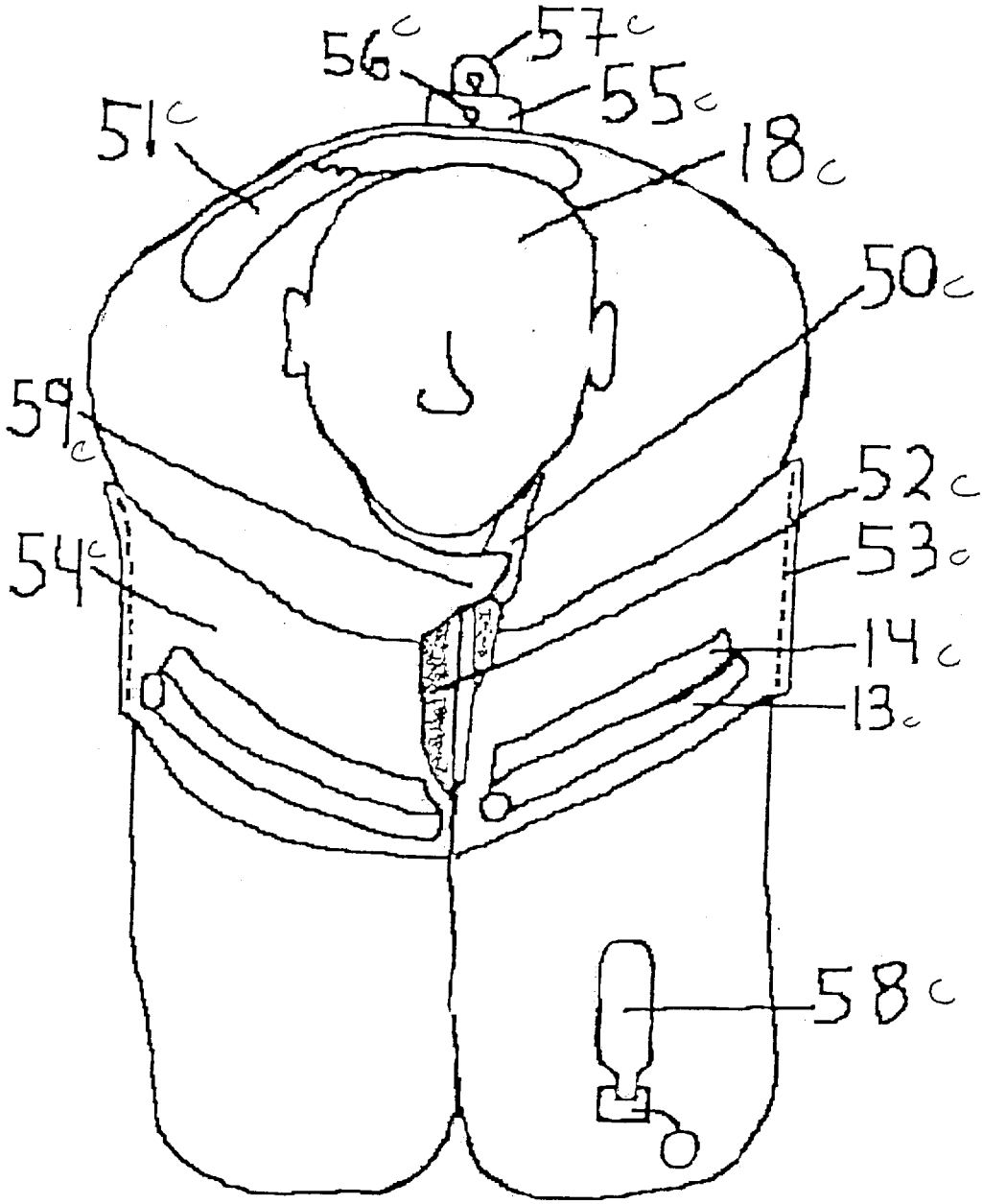
FIG. 43 is a frontal view of an inflatable PFD modified with mandibular shelf baffle and self-locking pneumatically compressed vertical baffle closure means with oral nasal splash diverter system.
Figure 44:
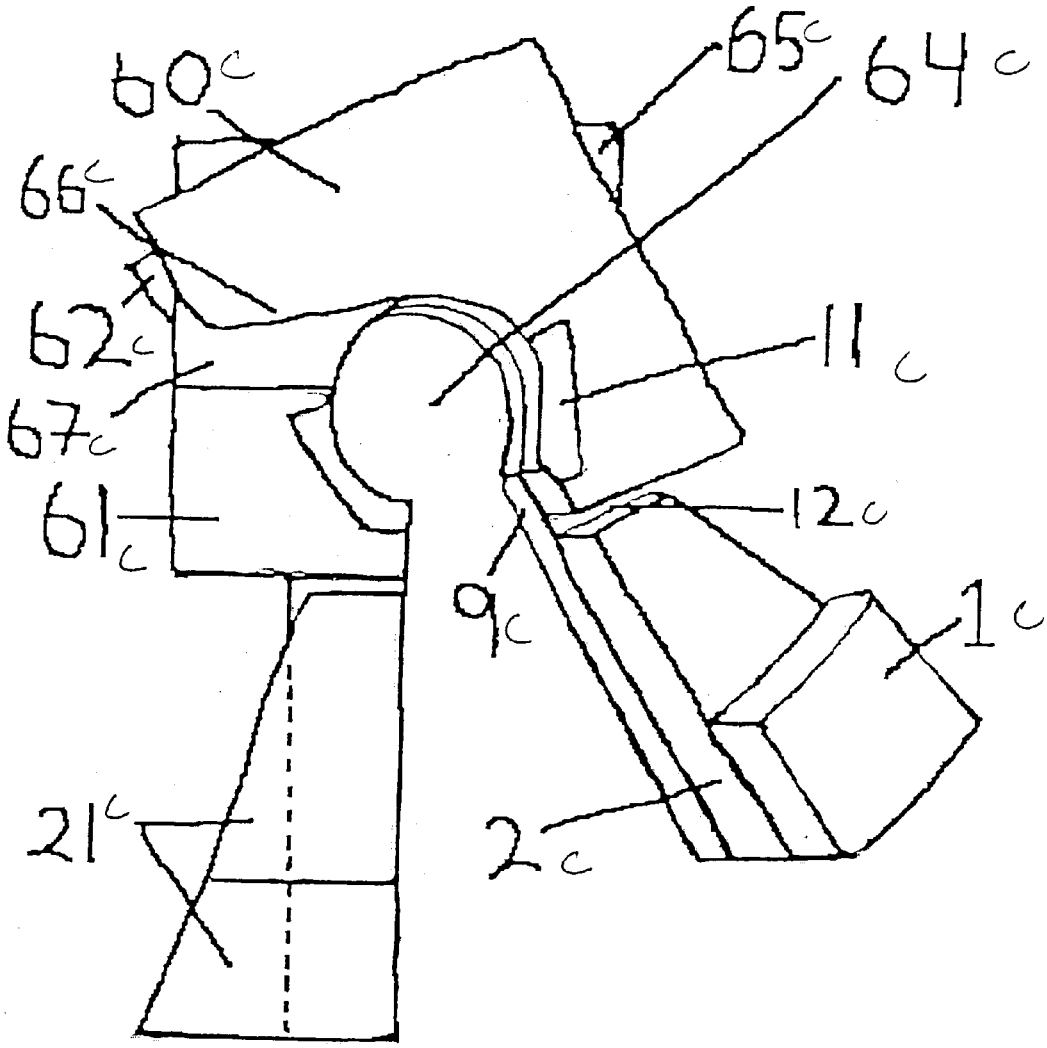
FIG. 44 is an anterio-lateral three quarter view of overlapping layers of adjustable cervical collar.
Figure 45:
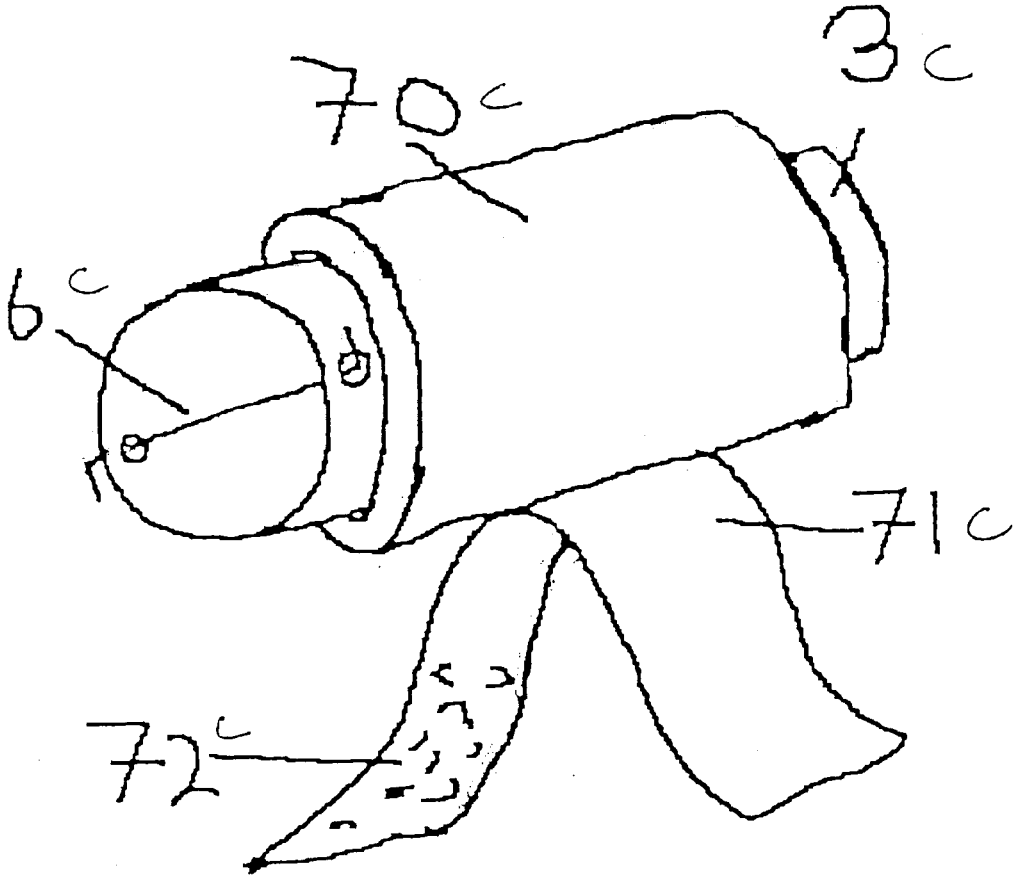
FIG. 45 is a superior view of a neutrally buoyantmobile solid and liquid ballast retrofit means.
Figure 46:
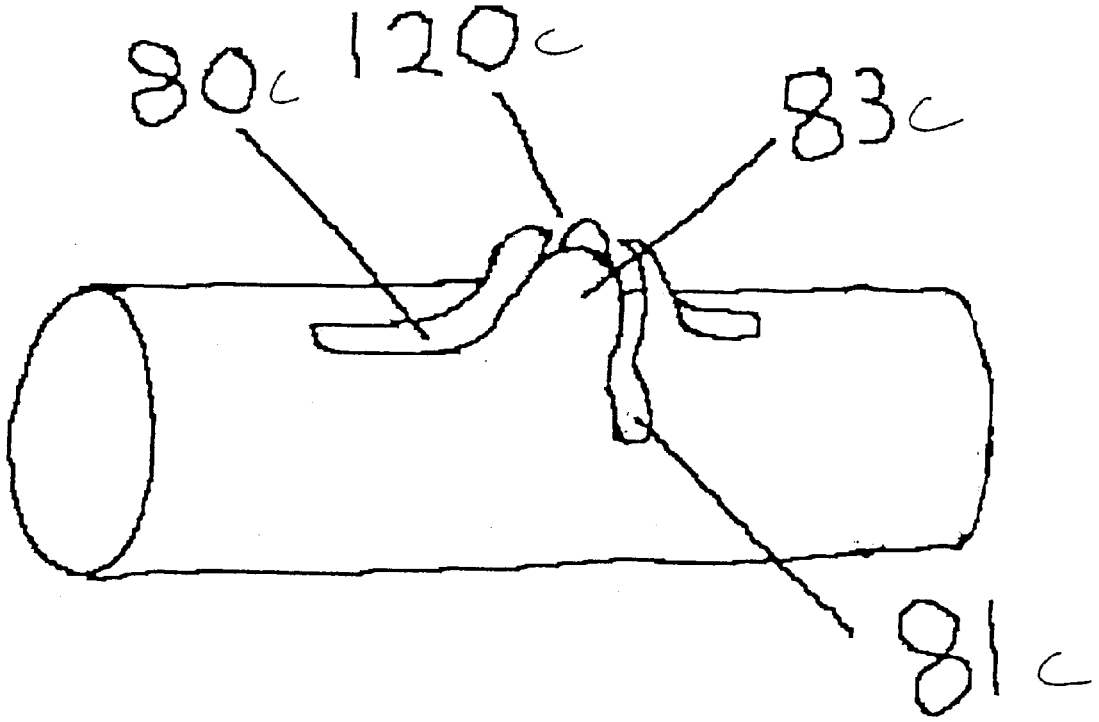
FIG. 46 is a superior view of a fabricated rigid container for mobile or mobile and liquid ballast means.
Figure 47:
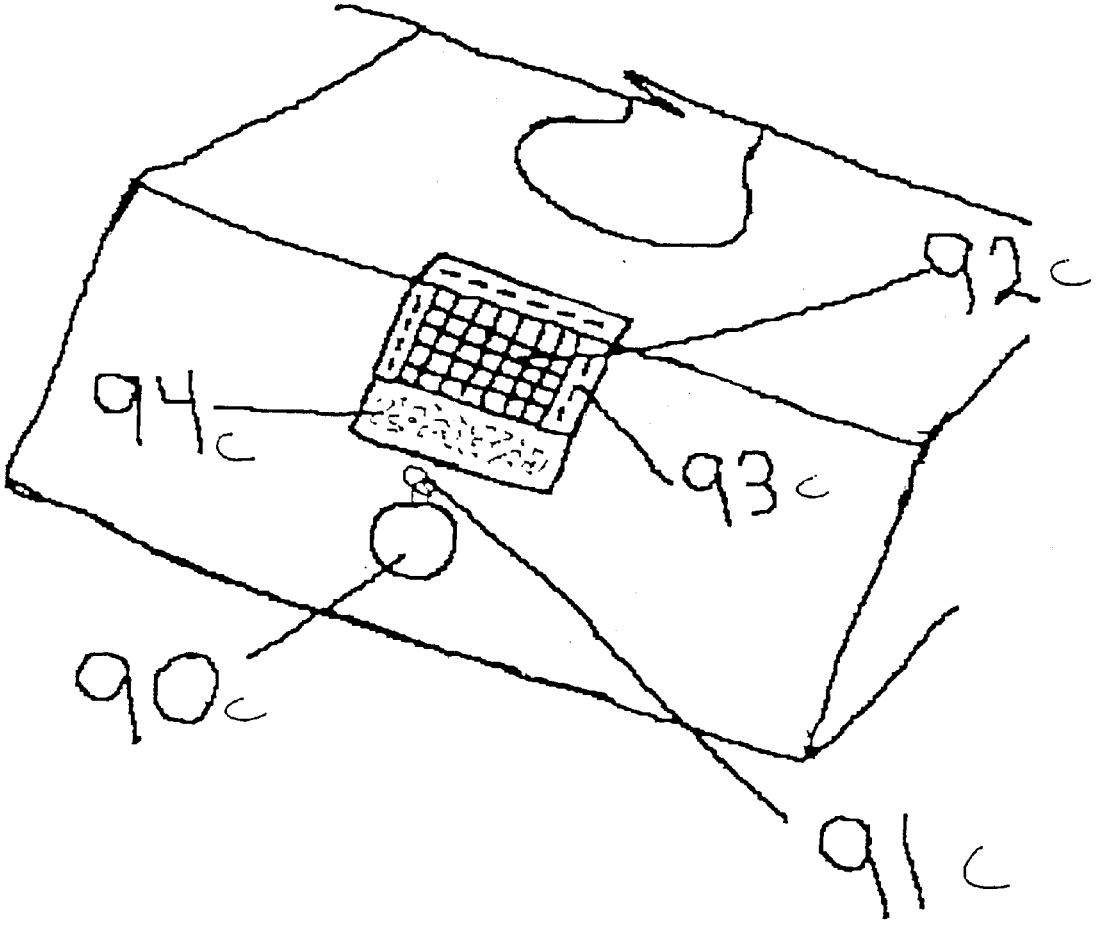
FIG. 47 is a superior exterior view of a PFD showing a vent means and mounting site for a combined ballast and battery means to reversibly replace fixed midline ballast means.

All current inflatable PFDs fail during face first entry because the ballast of the victim's head drives the neck between the ventral buoyant members into a stable airway submerged position. In FIG. 43 the inflatable PFD discloses overlapping tongue 59*c* that bridges the neck opening so that the neck cannot slide out of position. A superior baffle welded into the PFD also creates a mandibular shelf supporting the flaccid head and neck. Vertical baffles 52*c* covered by a fabric lock are compressed upon inflation further blocking the neck from sliding between the ventral arms on unconscious entry. With a double walled PFD shown in FIG. 55, the inner air bladder 170*c* is shaped by the sewn outer cover 171*c*. This construction method allows creation of very specific shapes and faces 172*c* for mounting fabric locks to automatically secure closure upon inflation. The pneumatic compression lock is a critical complement to the automatic inflation mechanism that actuates upon immersion. While mechanical ties are an alternative the pneumatic lock occurs without requiring any participation by the wearer. The inner bladder is held in place by perimeter attachment means 173*c*. The fluid ballast and fabric container 174*c* complements the soft storage of the inflatable PFD. The fabric container also allows very specific relocation of narrow diameter posterior container components 175*c* and upon active distribution the diameter increase consolidating the ballast 176*c* into a more active condensed mass. An alternative pneumatic fabric collar lock can be achieved by mounting the fabric lock on the external fabric cover. When the inflatable chamber opens upon detonation of the compressed gas cylinder, the bladder expands and rips open the outer cover. The hook and loop on complementary sides meets in the middle where continued expansion by the inner bladder compresses the lock together. The inflatable is promoted because of its convenient deflated profile; only fluid ballast in a fabric container can be transparently stored within the low profile cover.

Figure 56:
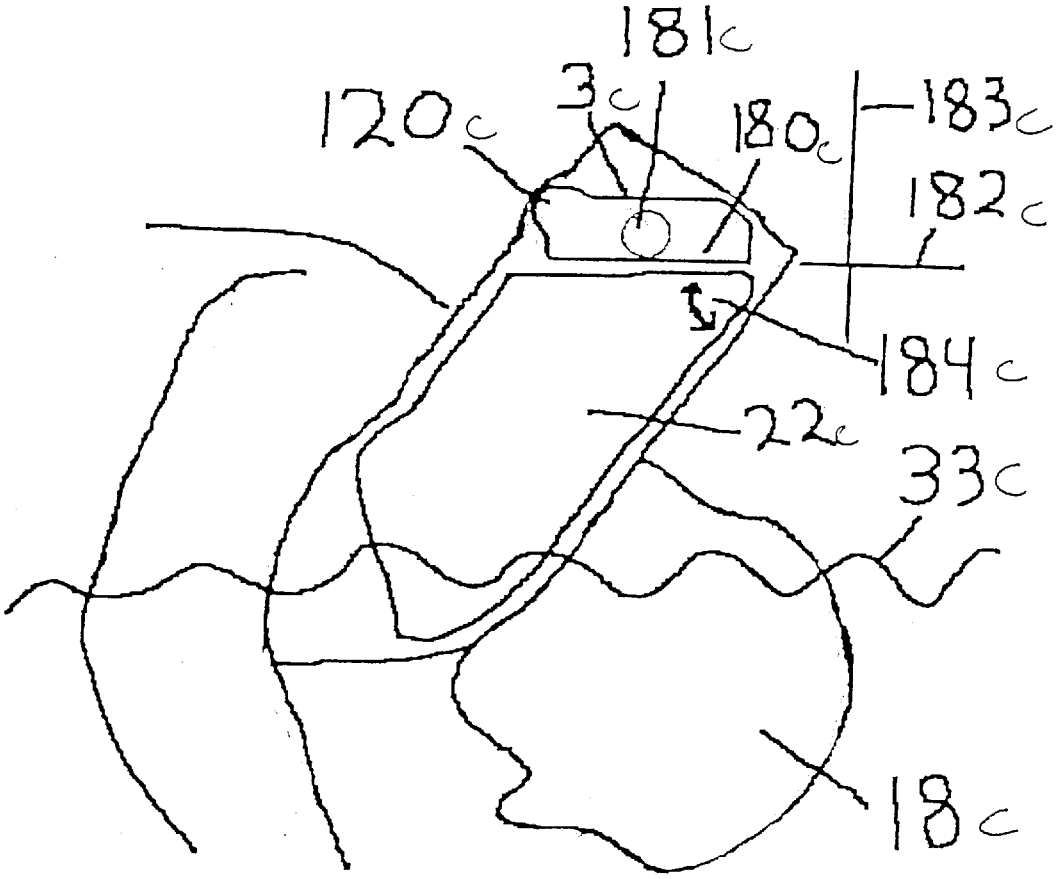
FIG. 56 is a lateral view illustrating the location of the mobile ballast container on a plane parallel with the water's surface. The cervical foam structure has a complementary angle specific to the particular PFD and the interaction of the displacement of the collar on a person in the water.

Some current inherently buoyant PFD designs require the concussive effect of solid mobile ballast. As seen in FIG. 56, the specific cervical collar angle determines the horizontal plane angle 184*c* when floating face down. The planar surface 180*c* of the ballast container 3*c* allows rigid ballast 181*c* to move quickly and freely in response to whatever lead is demonstrated by the victim. In the face up position mobile ballast trap 120*c* fixes the ballast midline where it stabilizes the victim as a keel.

Mobile ballasts either fluid 31*c* or solid 181*c* or combined benefits from concurrent fixed midline ballast 19*c*. Integration of mounting means 36*c* at the most beneficial posterior superior position assures that any attached ballast contribute to airway protection rather than opposing the jackets efforts at corrective turning action.

Figure 58:
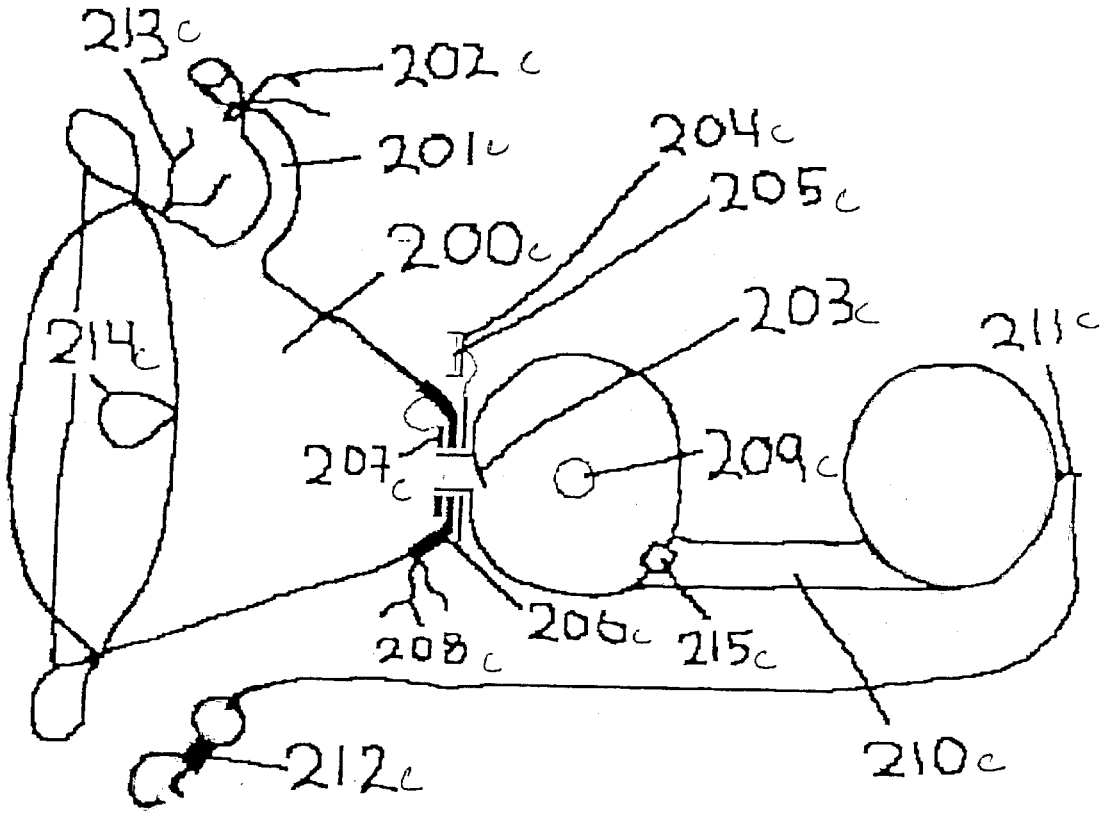
FIG. 58 is a lateral view of a life raft in accordance with the present invention illustrating a windsock inflation means releasably secured to life raft. Wrist and body lanyards keep the raft from blowing away during inflation before the sea anchor is filled.
Figure 59:
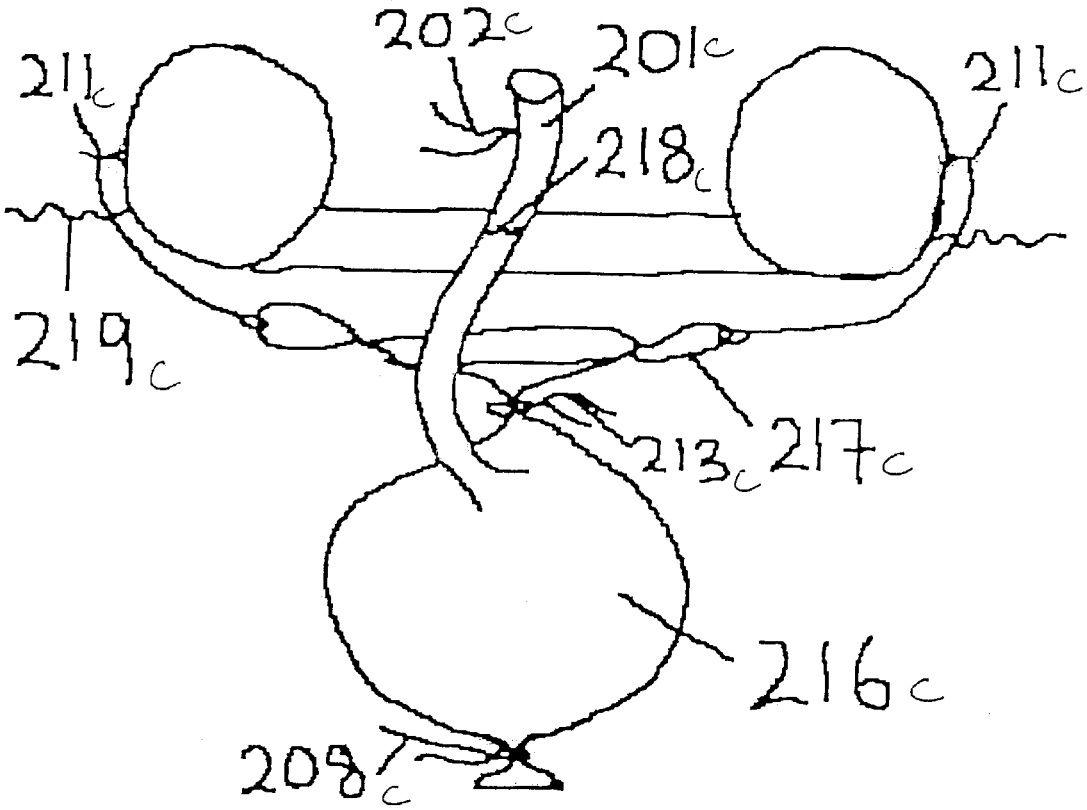
FIG. 59 is a lateral view illustrating use of windsock inflation means as sea ballast for the life raft connected by windsock wrist lanyards.

Once the victim survives the initial shock of entry they must focus on rapidly removing themselves from the water to avoid hypothermia. As seen in FIG. 58, a windsock 200*c* gathers the wind, with sufficient wind velocity such that it will blow through the flapper valve 203*c*. If the wind is not strong enough to open the flapper valve 203*c* then the windsock is used to scoop up the air and the opening is closed by one hand while the other hand slides down the windsock transferring the air through a one-way valve 203*c* into the raft. As the pressure mounts in the first chamber a medium pressure valve 209*c* opens into the adjacent raft tube in the bulkhead allowing air to fill both portions of the raft's perimeter tube. A wrist lanyard 214*c* helps the user keep hold of the raft in heavy winds. A body lanyard 212*c* attached at a reinforced seam grommet 211*c* provides a backup means for securing the raft to the victim in case the raft is kiting.

Once the raft is inflated, the attached locking nut 207*c* is loosen, freeing the reinforced windsock gasket seal 206*c* and thus the windsock is now removed. Now the attached locking caps means 204*c* can cover the opening against passive air loss or water entry. At this point the windsock can be used as a sea ballast container means 216*c*, where the attachment lanyards 217*c* are used to connect the sea ballast container to the raft at the reinforced perimeter. The sea ballast fill tube 201*c* allows the sea ballast container to be completely filled from inside the raft and the sealed with closure means 202*c*.

Figure 60:
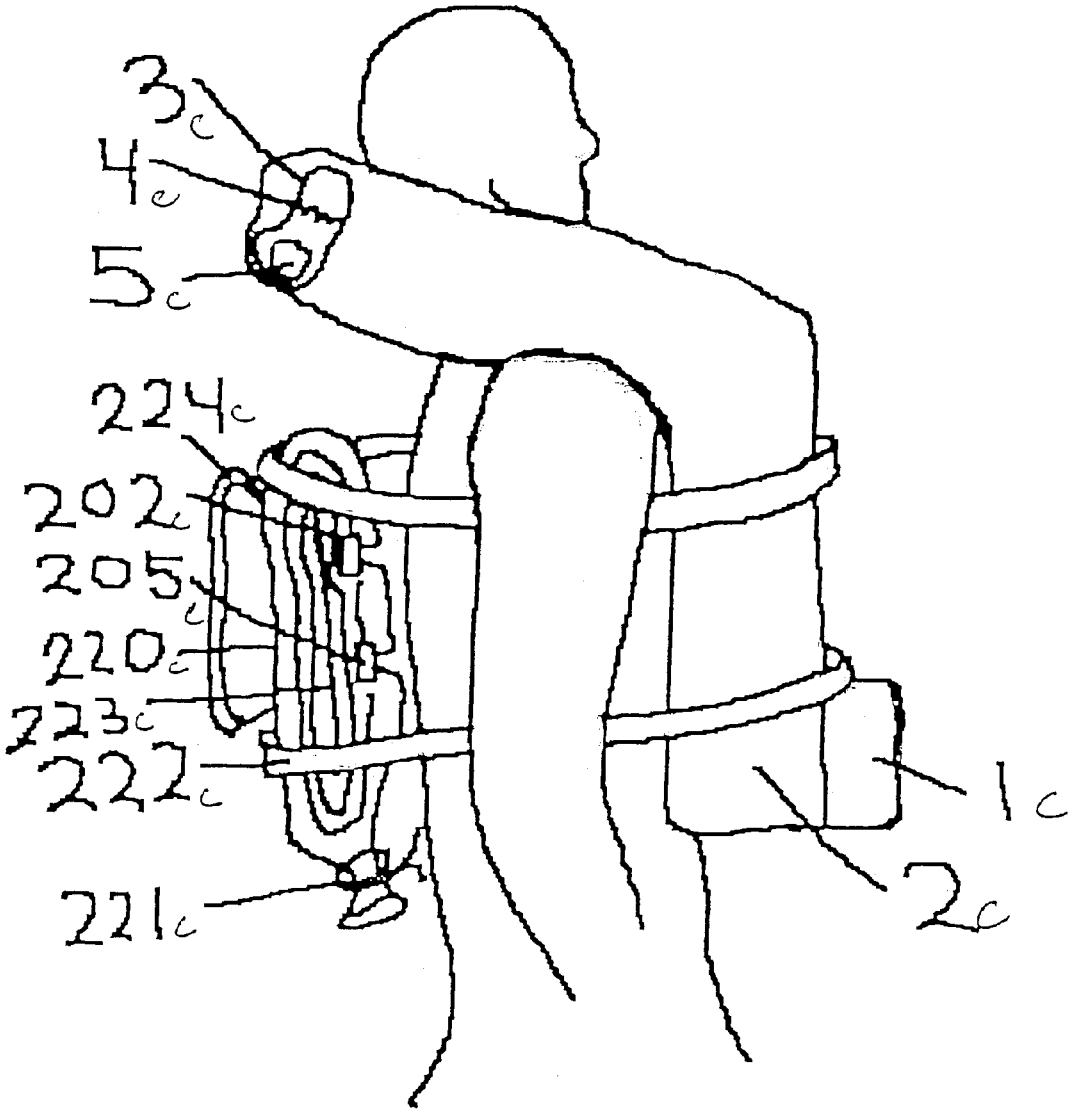
FIG. 60 is a lateral view illustrating the windsock means functioning as storage valise built into the cummerbund of the life jacket. Shoulder straps attached to valise allow independent usage of life raft.

In FIG. 60 the windsock acts a valise 220*c* for the raft 223*c* allowing it to be attached to the PFD serving as a cummerbund 222. Backpack straps 224 allow the valise to be transported separately.

Figure 61:
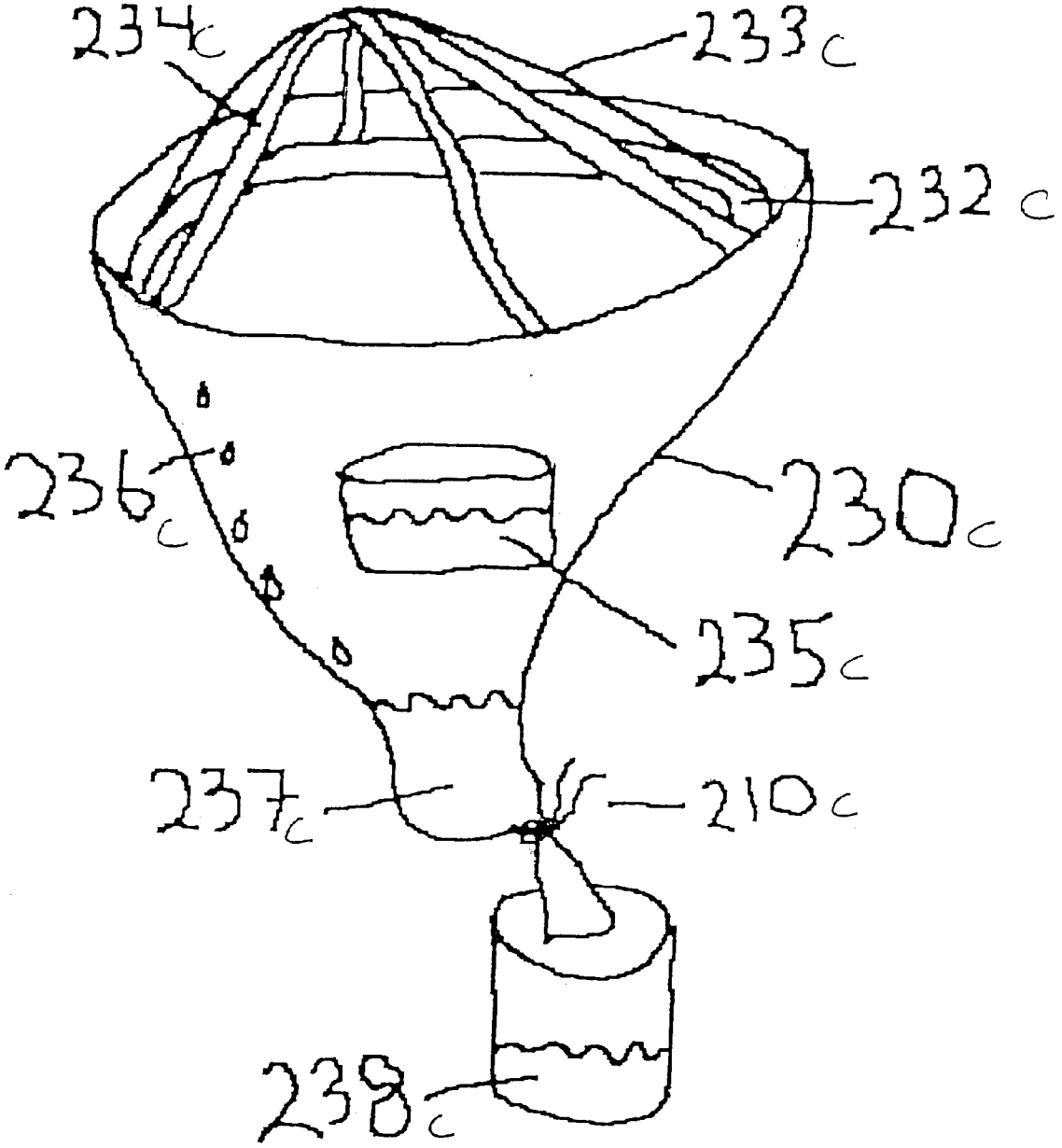
FIG. 61 is a lateral view illustrating use of the windsock as a funnel to collect and contain condensate from solar still.
Figure 62:
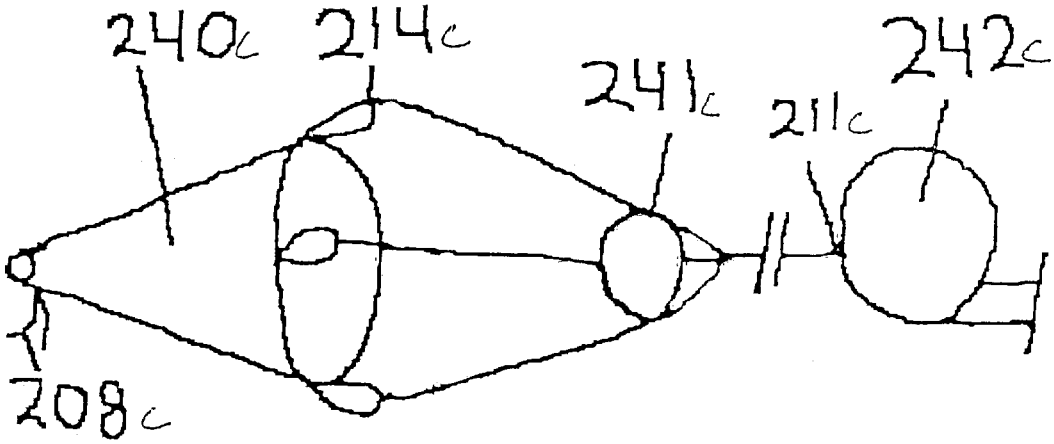
FIG. 62 is a lateral view illustrating the windsock disconnected as an inflation means and reconnected to the raft as a steering sea anchor.

FIG. 61 adapts the windsock 200*c* into a funnel 230*c* to collect and contain rain. The inclusion of a clear plastic cover 233*c* converts the windsock 200*c* into a solar still 231*c*. The clear cover can be sealed by fabric lock 232*c*. The clear cover can be held aloft by rigid supports 234*c*. The sun strikes a source of water 235*c*, which is evaporated and then condenses 236*c* on the windsock where it collects within the base of the windsock or ideally in an external container 238*c*. The windsock inflator 200*c* can be further adapted for use as a sea anchor windsock 240*c* as seen in FIG. 62. The wrist lanyards 214*c* that encircle the perimeter of the opening windsock opening are now attachment points for lines leading to the sea anchor spreading ring 241*c*. The lines after crossing the sea anchor spreading ring converge into a single line that runs forward to the rear of the raft 242*c*. The sea anchor scoops up the water and forces it through the windsock vent. This drag determines the rear of the boat and keeps the boat pointed in the same direction in mounting seas.

Figure 63:
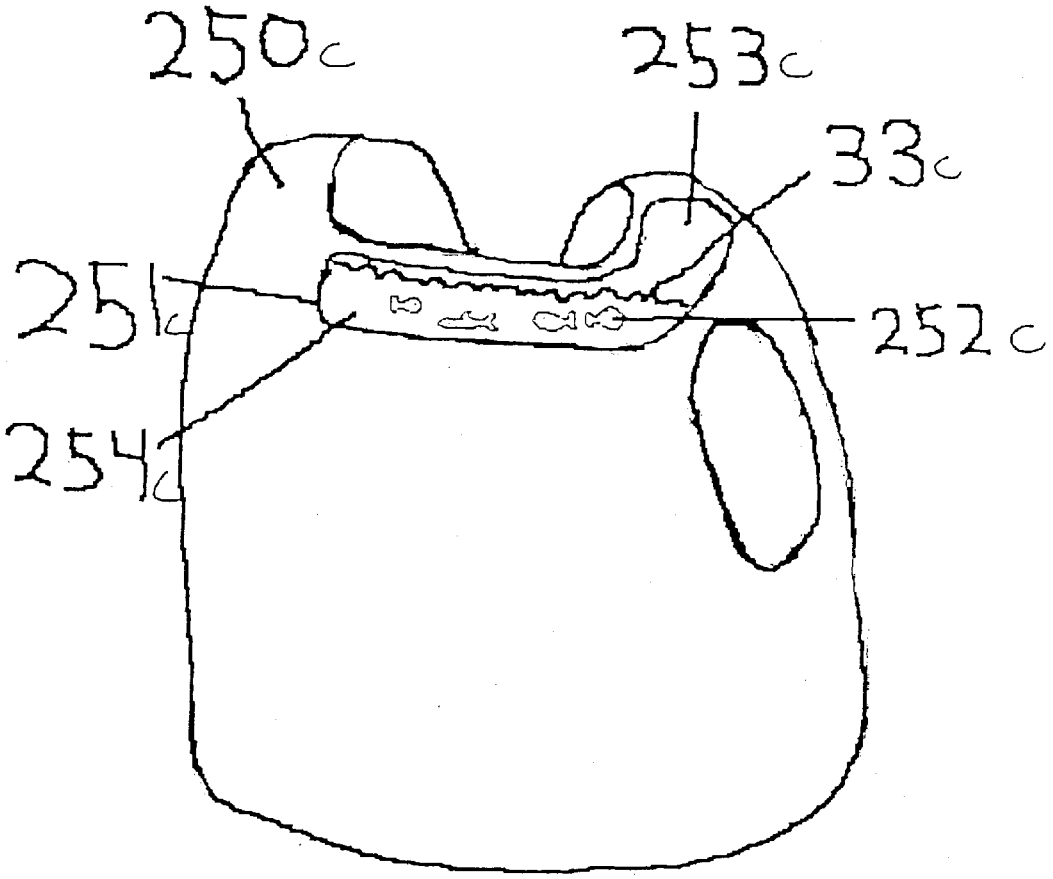
FIG. 63 is a posterior three quarter view of a child's vest style life jacket illustrating the use of a clear mobile fluid ballast container with brightly colored sea creatures in colored fluid.

As seen in FIG. 63, the mobile eccentric fluid ballast that shifts location as the child falls face forward results in the shift of the center of gravity the initiates the escape of the ventral buoyant means. When the mobile eccentric ballast container is clear 251*c* it allows the child to observe the brightly colored water 254*c* slosh back and forth. Mixing oil and water further increases the dramatic effect and the inclusion of two or more colored fluids. Given the very serious problem of willing compliance with wearing jackets the inclusion of brightly colored objects such as sea creatures or favorite cartoon characters may result in the jacket being worn home from the boat and to school as would be a welcome relief to the struggles traditional associated with wearing life jackets, which is currently not required by law in numerous states. A small pond of fish on their shoulder helps to localize the ballast thereby increasing its impact on corrective turning as is needed with vest style designs. The child's vest as well as the adults in addition benefits from the above-disclosed PFD embodiments in combination with mobile eccentric fluid ballast in order to achieve reliable airway protection.

It should be recognized that an alternative pneumatic compression lock for inflatable PFDs can also be provided and is within the scope of the invention. Some inflatable PFDs are stowed with an external fabric cover that separates upon detonation of the compressed gas inflation means. If the complementary fabric lock means were distributed on the opposite sides of the external cover, upon inflation as the cover is peeled back they brush against each other along the midline. If the hook and loop connect then as the volume first increase then the pressure builds the right and left halves of the front of the jacket compress the lock securely together. This lock is sufficient to prevent the ballast of the head from driving the neck down between the left and right buoyant means. If the neck does slide down, the victim ends up in a stable face down position if the pneumatic compression lock securely closes the vest then the inflatable PFD effects a strong righting moment because of its predominance of displacement and other than face first entry of an unconscious victim, good control of ballast of the head and neck.

The adjustable collar can be provided with either a certain degree of laxity in the outer fabric cover or a stretchable element interposed along the top and sides of the cover so that as the ventral arms are separated to allow entrance of the head and neck the overlapping layers of the cervical collar to extend temporarily beyond the perimeter. After the neck is in position and the ventral arms returned to their central position, the cervical collar perimeter is restored to its minimal footprint.

Some advantages and features of this alternative pneumatic compression lock include, but are not limited to: (1) fabric lock mounted on external cover while compression is supplied by the inflating inner bladder; and (2) stretchable element built into the fabric cover of the cervical collar to allow transient expansion when the jacket is being donned.

Figure 64:
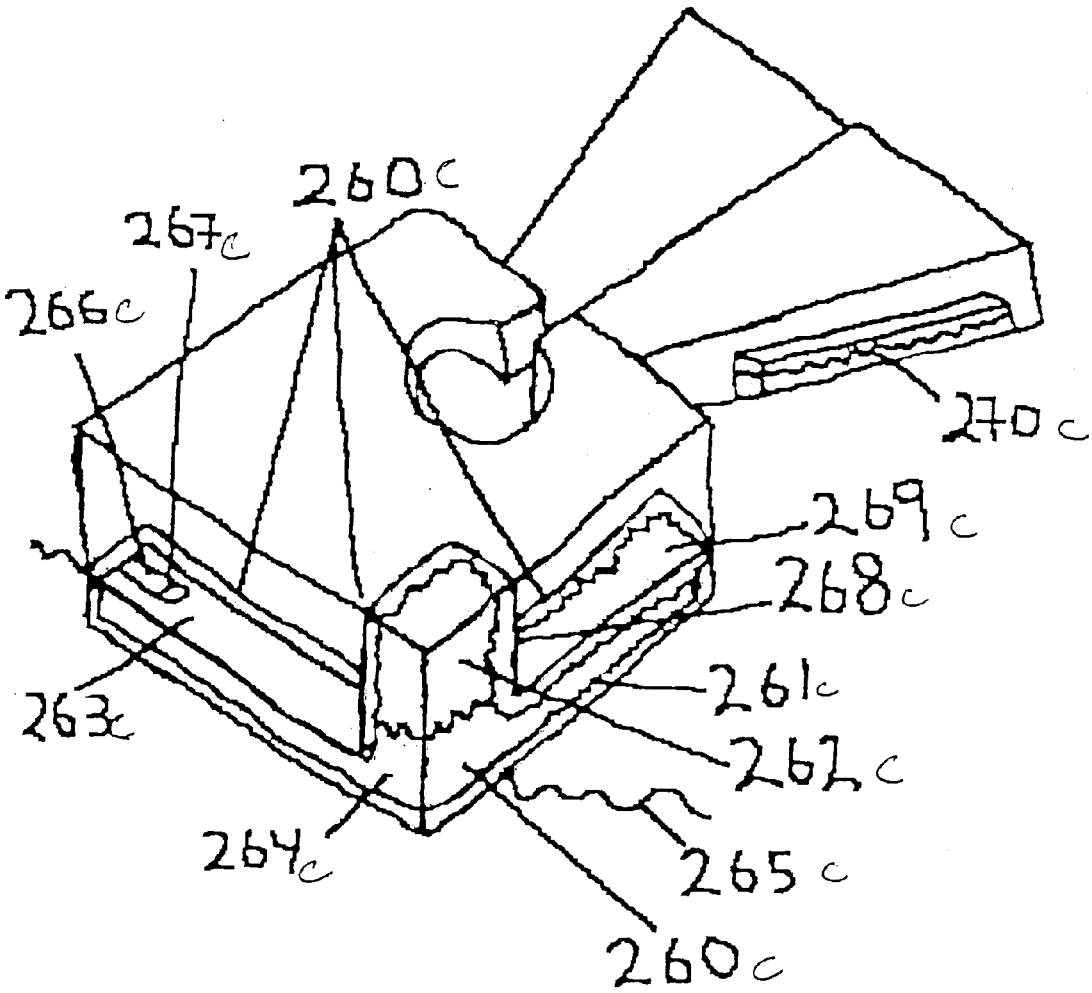
FIG. 64 is a superior lateral three quarter view illustrating the use of the cervical foam means to create a rigid container for an over sized inner bladder holding mobile eccentric liquid ballast along the perimeter.

As seen in FIG. 64, the use of a square container allows the shape of the fluid ballast to minimize the reduction in foam displacement. While the container can be made from rigid plastic ideally the container can be carved right out of the body of the cervical collar 260*c*. The flexible over sized fabric inner layer 261*c* conforms to the shape of the outer container. The use of a shallow container 263*c* along the posterior superior aspect of the collar allows the fluid to layer out below the water surface thereby neutralizing the ballast when floating face up. In this position the contained liquid acts as a sea ballast stabilizing the face up position. The gas in the container rise to the highest point available 262*c*. The lateral anterior extension of the rigid container can be enlarged 268*c* to hold more of the fluid ballast as far outboard complementing ballast shifted into the inferior lateral extension 269*c*. The combined shift from midline to lateral edge strongly initiates the corrective turning action moment. An additional mobile fluid ballast container can be located along the lateral posterior ventral buoyant means 270*c*.

Figure 65:
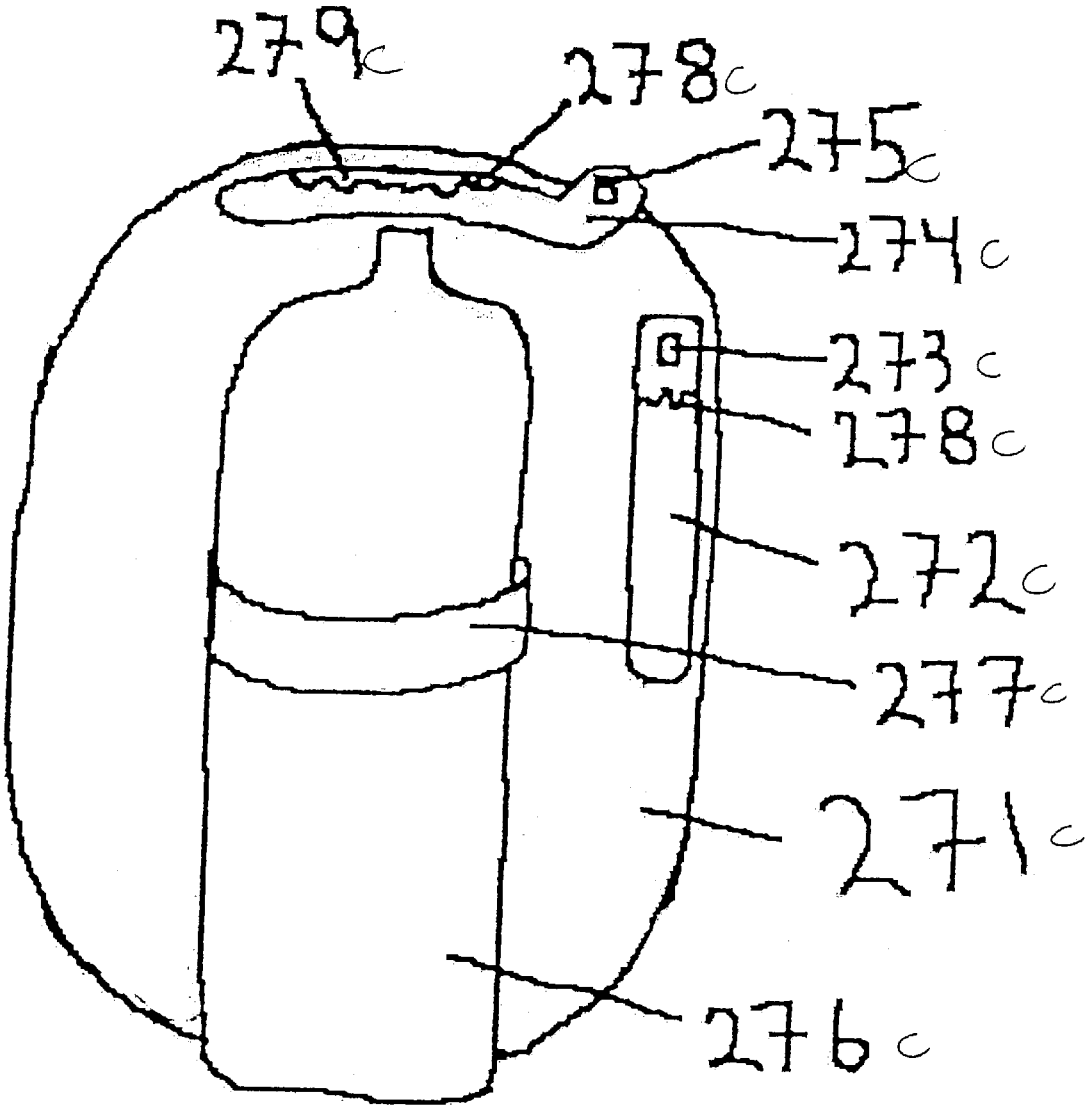
FIG. 65 is a posterior view of the diver's jacket illustrating the superior and lateral placement of mobile fluid ballast for improved corrective turning action.

FIG. 65 is a posterior view of the inflatable dive jacket or buoyancy compensator 271*c* attached to a diver's air cylinder 276*c* by means of a tank band 277*c*. The dive jacket has been constructed to include a posterior 274*c* and lateral 272*c* locations for mounting a fluid ballast container. The lateral filling valve 273*c* and the posterior filling valve 275*c* allow independent function or can be combined into a single mobile eccentric fluid ballast container. The valve allows the ballast to be left at the seashore after the end of the dive. The level of the fluid 278*c* within the fluid ballast container demonstrates residual air 279*c* above the mobile ballast this creates the space that allows the ballast to shift positions.

Certain advantages and/or features of the embodiment shown in FIGS. 64 and 65 include, but are not limited to: (1) Space defined by foam buoyant means to house mobile fluid ballast container; (2) Space defined by foam buoyant means to shape mobile fluid ballast container; (3) Space defined by foam buoyant means to direct mobile fluid ballast container; (4) Space defined by foam buoyant means to house, shape and direct mobile fluid ballast container; (5) Space defined by inflatable buoyant means to house mobile fluid ballast container; (6) Superior mobile fluid ballast; (7) Lateral fluid ballast; (8) Lateral mobile fluid ballast; (9) Superior and lateral mobile fluid ballast; (10) Sealed container for mobile fluid ballast; (11) Container for mobile fluid ballast with valve to fill before use drain after use; (12) Inflatable PFD modified with means to contain fluid *ballast; (13) Inflatable PFD modified with means to contain mobile fluid ballast; and (14) Inflatable PFD modified with means to contain eccentric mobile fluid ballast.

Parts List (FIGS. 39 through 65)

1*c* Anterior Buoyant Element
2*c* Ventral Inferior Buoyant Element
3*c* Posterior Superior Container for Directed Mobile Ballast means
4*c* Mobile Air Fluid Level
5*c* Combined High Density Directed Mobile Ballast and liquid ballast means
6*c* Cap to contain mobile ballast elements
7*c* Buoyant Means 30 degree Head Angle Wedge
8*c* Adjustable circumference buoyant collar layers
9*c* Cervical-Ventral Structurally continuous Foam Means
10*c* Cervical Foam Structural Tie—Hinge Means
11*c* Mandibular Shelf Inferior and Lateral Bracket
12*c* Anterior Cervical Splash Gutter
13*c* Oral-Nasal Splash Diverter
14*c* Stiff Hinge Diverter Arm means
15*c* Reverse Cant Leading Wave Break
16*c* Guide Notch locating Chest Strap Fulcrum
17*c* Chest Strap
18*c* PFD User/victim
19*c* External combined midline fixed ballast and signaling device
20*c* Apical extension of pyramidal anterior buoyant means
21*c* Lateral Extensions of Inferior and Anterior Buoyant Elements
22*c* Adjustable Sized Cervical Collar
23*c* Strap Securing Means for Adjustable Collar
24*c* Quick Release Buckle
25*c* Variable Length Chest Strap
26*c* Abutted Ventral and Cervical Joint in the vertical position
27*c* Oral Nasal splash cover
28*c* Moldable nasal bridge edge
29*c* Complementary attachment means for oral nasal splash cover and collar closure means
30*c* Flexible Liquid Ballast container
31*c* Submerged, potable, dyed, signaling liquid ballast means
32*c* Liquid level
33*c* Water's surface
34*c* Collapsed fabric container creating potential space means for alternate location of liquid ballast
35*c* Liquid ballast flexible container's perimeter attachment means establishing liquid ballast's course posterior midline to lateral
36*c* Combined Vent and locator means for combined ballast and signaling device
37*c* Coated fabric weld line
40*c* Frontal Plane Pivot Point
41*c* Direction of mobile ballast's contribution to frontal plane turning
42*c* Direction of Ventral Buoyant means escape
43*c* Unopposed vector component of inferior lateral and anterior buoyant means
44*c* Vector component acting at apex of inferior lateral and anterior buoyant means
50*c* Welded horizontal baffle Mandibular Shelf
51*c* Flexible integrated fluid ballast means
52*c* Right welded baffle face allowing flush mounting of complementary interlocking closure means
53*c* Excess weldable fabric welded or sewn to secure closure-mounting means
54*c* Alternative flexible mounting means for automatic secured neck closure and oral nasal splash diverter
55*c* Combined battery and fixed midline ballast
56*c* Locator grommet for attaching fixed ballast
57*c* Signaling device
58*c* Compressed air inflation means
59*c* Protruding and overlapping inflatable neck closure means
60*c* Anterior Right overlapping collar layer
61*c* Anterior Left:, stops for pivoting right collar and source of displacement
62*c* Posterior Right overlapping collar layer
64*c* Frontal plane pivot point
65*c* Anterior Left overlapping adjustable collar layer
66*c* Cam flare allowing selection of neck circumference
67*c* Void between pivoting posterior cervical collar and Stop means to allow for rotation
70*c* Foam displacement offset for mobile ballast to achieve neutrality or positive buoyancy
71*c* Strap means for securing retrofit container mobile eccentric ballast to PFD
72*c* Interlocking securing means for attachment strap
80*c* Rectangular opening along middle position of mobile ballast container
81*c* Perpendicular Rectangular cut at midline
83*c* Flared quadrant forming ballast trap
90*c* Midline fixed ballast means
91*c* Secure attachment means for fixed ballast
92*c* Open mesh vent and attachment means
93*c* Permanent attachment means for mesh
94*c* Secure reversible closure means
100*c* Mobile buoyant means
101*c* Flexible arm hinge means for mobile buoyant member
102*c* Continuation of base layer behind mobile buoyant member
103*c* Opposite lateral fixed or mobile buoyant extension
104*c* Gravity filled anterior-inferior aspect of flexible or rigid ballast container
110*c* Retainer Means for open or closed container means integrated into or added onto PFD collar.
111*c* Rigid Convexity Form
112*c* Flexible Buoyant Means Conformed to Rigid container
113*c* Bilateral Steep vertical wall of midline ballast trap
114*c* Smooth Inferior Sloping wall
115*c* Small fill opening in ballast container
116*c* Semi closed cap and ballast stop
117*c* Sea Water Anchor combined with mobile ballast container means
118*c* Sealable Container integrated into mobile ballast injection molded container for midline fixed combined battery-ballast means
119*c* Fixed midline ballast-battery means
120*c* Trap for solid mobile ballast means
121*c* Left overlapping inflatable midline lock
122*c* Right overlapping inflatable midline lock
123*c* Inflatable oral nasal splash diverters
130*c* Breathable water resistant fabric oral nasal cover means
131*c* Oral nasal flap folded into cervical gutter
132*c* Open mesh vent means
133*c* Vertical Moldable stiffeners means

134c Permanent Fastening Means
135c Ocular cover means
136c Flexible clear view port means
137c Cranial edge moldable stiffener means
140c Hinge means to ventral buoyant member
141c Anterior Inferior Buoyant means active position
142c Anterior Inferior Buoyant means stored position
143c Anterior Inferior Buoyant member hinge means
144c Quick release buckle for chest strap
145c One side of fabric lock for anterior inferior buoyant member in storage position
147c One side of fabric lock for anterior inferior buoyant member in active position
148c Handle of collar closure strap
149c One side of fabric lock for collar closure strap
150c Structurally continuous base layer
151c Lower cervical and ventral buoyant layers
152c Posterior cervical layers
153c Complementary curve in superior cervical layers allowing for rotation about center of neck opening
154c Complementary curve in inferior cervical layers allowing for rotation about center of neck opening
155c Void between superior and inferior cervical layers allowing for rotation and for individualized variation of PFD neck diameter
160c Flexible oversized inner welded bladder
161c External fabric perimeter constraining inner bladder
162c Welded closure means of fluid containing inner bladder
163c Excess inner bladder material allowing external fabric to bear strain and direct fluid
170c Over sized gas containing bladder means
171c Size restricting external fabric shell determining final shape and bearing pressure from inner bladder
172c Unusual faces and planes unobtainable with planar welded fabric and simple baffles
173c Perimeter attachment means
174c Single or double walled fluid ballast container means welded to inner bladder or sewn to outer bladder
175c Narrow diameter superior container
176c Large diameter anterior and inferior extension of bladder means
170c Over sized gas containing bladder means
171c Size restricting external fabric shell determining final shape and bearing pressure from inner bladder
172c Unusual faces and planes unobtainable with planar welded fabric and simple baffles
173c Perimeter attachment means
174c Single or double walled fluid ballast container means welded to inner bladder or sewn to outer bladder
175c Narrow diameter superior container
176c Large diameter anterior and inferior extension of bladder means
180c Planar platform for solid ballast parallel to water's surface
181c Solid ballast means in air filled buoyant enclosed container
182c Container for mobile ballast set at angle specific to the angle of the posterior cervical collar off of vertical
183c Vertical
184c Complementary angle of posterior foam establishing a structural surface parallel to the waters surface for mobile ballast element
190c Buoyant arm means
191c Inferior chest strap attached at lateral perimeter of mobile buoyant means
192c Hard plate cover to foam apex
193c Hard plate cover of inferior aspect of ventral foam member
194c Fabric hinge attaching mobile to fixed buoyant members
195c Fabric cover enclosing buoyant members
196c Shortened fixed ventral buoyant means
197c Lateral neck opening
198c Neck opening closure strap means
199c Lock closure means for neck strap
200c Windsock inflator
201c Fill Tube for sea ballast means
202c Fill Tube Closure means
203c Low-pressure one-way flapper valve means
204c Attached locking cap means
205c Air seal gasket means
206c Reinforced wind sock gasket seal
207c Attached locking nut
208c Windsock vent closure means for conversion to sea ballast
209c Low-pressure one-way check valve between raft chambers
210c Inflatable floor
211c Reinforced seam attachment grommet for lanyard
212c Quick release body or sea anchor lanyard
213c Windsock opening closure means
214c Wrist or sea anchor or sea ballast lanyards
215c Very Low pressure one way check valve to raft floor
216c Sea Ballast windsock container means
217c Sea ballast reinforced attachment lanyards
218c Sea ballast fluid level
219c Sea level
220c Life Raft Valise
221c Valise securing means
222c PFD Life Raft Cummerbund means
223c Stowed PFD Life Raft
224c Valise Back Pack Straps
230c Windsock adapted to function as funnel to capture and or contain solar condensate or clean rain water
231c Solar still funnel collecting condensate for solar evaporation
232c Fabric lock sealing clear cover to dark funnel
233c Clear cover of solar collector
234c Rigid supports for clear cover
235c Source of liquid for solar collector to generate condensation
236c Condensate
237c Collected condensate if no container is available
238c Condensate collection container
240c Sea Anchor windsock
241c Sea anchor spreader ring
242c Rear portion of Raft
250c Child's vest life jacket
251c Clear mobile eccentric ballast container
252c Brightly colored sea creatures
253c Enlarged active container means
254c Colored fluid
260c Carved foam mobile eccentric fluid ballast container
261c Flexible over sized inner sealed liner
262c Gas risen to -highest point
263c Shallow rectangle keeps fluid ballast at or below water surface
264c Fluid level within inner liner
265c Water's surface
266c Fabric extension fill tube
267c Welded seal after filling with fluid
268c Enlarged lateral component of fluid ballast container
269c Inferior lateral extension for eccentric mobile fluid ballast
270c Perimeter eccentric fluid ballast along ventral buoyant means

271*c* Inflatable Dive Jacket or buoyancy Compensator
272*c* Lateral Perimeter liquid ballast
273*c* Valve for filling or draining
274*c* Posterior cervical mobile eccentric fluid ballast container
275*c* Posterior cervical mobile eccentric fluid ballast container valve for draining or filling fluid ballast
276*c* Diver's air cylinder
277*c* Dive Jacket tank band
278*c* Fluid gas level in mobile ballast container
279*c* Gas means in mobile eccentric fluid ballast Some of the advantages and/or features of one or more of the embodiments shown in FIGS. 39 through 65, include, but are not limited to, the following: (1) Center of buoyancy shifted inferior and anterior; (2) Pyramidal shaped buoyant means with increased lever arm to axises of rotation; (3) Increased lateral buoyant means; (4) Increased anterior buoyant means; (5) Increased inferior buoyant means; (6) Decreased central medial buoyant means; (7) Flexible arm connecting distant buoyant and ballast means; (8) Marked flexibility in the posterior direction; (9) Flexibility bilaterally restricted by type of foam and width of the connection of the apex to the cervical collar; (10) Anterior flexibility blocked by the abutted walls of the apex and collar bodies; (11) Apical attachment point of inferior buoyant arm and superior ballast arm located adjacent the centroid of buoyancy for the wearer and their life jacket; (12) Foam or inflatable buoyant means; (13) Life jacket turning torque amplified by shifting the PFDs center of buoyancy and center of ballast maximum allowed distance from the axises of rotation by reconfiguring the structure; (14) Continuous base layer integrating effect of displaced inferio-anterio-lateral buoyant means with posterior superior displaced ballast means; (15) Variable diameter neck opening; (16) Two or more overlapping cam shaped collar layers; (17) Superior and or inferior foam surfaces bilaterally notched with threedimensional mandibular shelf variably positioned to bracket and splint the jaw; (18) Closure means to secure collar entry/exit; (19) Locking closure means; (20) Enhanced bilateral inferior displacement means; (21) Gas and Liquid ballasting means; (22) Flexible container means directing flow of liquid ballast; (23) Broad posterior and superior container means located at or beneath the water's surface to center and neutralize the fluid ballast; (24) Inferior anterior extension of container means liquid filled when upright or face down, gas filled when floating face up on the water Flexible container for liquid ballast sewn along superior and lateral fabric cover; (25) Flexible container for liquid ballast constructed of puncture proof ballistic fabric; (26) Flexible container for liquid ballast with over pressure valve; (27) Flexible weldable expandable fabric to tolerate freezing expansion; (28) Unsupported stretchable weldable fabric container for liquid ballast; (29) Rigid container means of same shape keeping the liquid centered and below the water when face up directing the fluid down and outboard when upright; (30) Liquid and Solid ballasting means; (31) High-density spherical mobile ballast means combined with fluid means; (32) Liquid, solid and gas ballasting means; (33) Combination of gas liquid and solid ballasting means; (34) Center trap in container means to convert the solid mobile ballast into fixed midline position; (35) Open rigid container for solid ballast means restricted for filling or emptying that convert container into a transient combined solid and fluid anchoring and ballasting means; (36) Offsetting buoyant covering of open rigid solid and fluid ballast container; (37) Liquid Sterile for consumption; (38) Liquid combined with potable food coloring to detect loss of ballast; (39) Liquid Search and Rescue Orange dye for signaling aerial rescue efforts from Life Raft; (40) Liquid chemically with lowered freezing point; (41) Potable liquid chemically with lowered freezing point; (42) Dyed, potable liquid with lowered freezing point; (43) Mobile buoyant means; (44) Eccentric mobile buoyant means; (45) Symmetric mobile buoyant means; (46) Laterally mobile buoyant means; (47) Anteriorly buoyant means; (48) Foam or inflatable; (49) Reverse face in the inferior end of the ventral arms redirecting wave away from victim; (50) One of more side to side oral nasal splash diverter; (51) Partially flexible arm connecting splash diverter elevating operational height; (52) Cervical Trough splash receiver; (53) Optional cover flap to cover nose and mouth; (54) Semi-rigid moldable nasal edge adjusted to shape of the bridge of the nose; (55) Securing means for attaching oral nasal cover flap; (56) Oral nasal cover flap water resistant breathable fabric-Gore-Tex™; (57) Oral nasal flap with open mesh off to sides to allow $CO_2$ to escape; (58) Oral nasal flap with stiffeners to support fabric means away from the face; (59) Oral nasal flap of stiff fabric to bridge facial features preventing occlusion; (60) Separate Ocular flap; (61) Ocular flap with moldable stiffener along superior and inferior edges; (62) Ocular flap of clear flexible means; (63) Combined Oral nasal ocular flap; (64) Combined Oral nasal ocular flap with moldable stiffeners along edge; (65) Combined Oral nasal ocular flap with moldable stiffeners along edge and through out the field; (66) Anterior inferior buoyant means attached via hinge means; (67) Dual position inferior anterior buoyant means positioned beneath ventral arm for stowage or for entry into life raft; (68) Active position of inferior anterior buoyant means attached to front face of PFD ventral arms; (69) Side entrance collar with over lapping layers for adjustability; (70) Dual bag PFD with oversized inner air-tight chamber contained within sewn fabric cover to allow creation of three-dimensional shapes required to create effective inflatable lock; (71) Fluid ballast container welded to bladder of inflatable PFD; (72) Fluid ballast container of enlarged diameter in forward anterior extension consolidating water ballast in active position; (73) Fluid ballast container of reduced diameter in the posterior superior extension distributing water ballast in resting position; (74) Container for mobile eccentric solid ballast with planar base parallel to water's surface; (75) Container for mobile eccentric solid ballast with non-directing linear leading edge; (76) Inferior plane of mobile ballast container mounted upon cervical foam of angle complementary to the angle of the foam to the water's surface; (77) Inferior chest strap suspending mobile buoyant means; (78) Inferior chest strap suspending mobile buoyant member from perimeter of buoyant member by arms of a length to allow mobility sufficient for escape; (79) Inferior buoyant member with rigid cap of apex riding on rigid base of superior buoyant member; (80) Fabric hinge at apex attaches inferior and superior buoyant members allowing for movement about hinge; (81) Manual Pneumatic compression lock; (82) Automatic pneumatic compression lock; (83) Fabric cover connecting welded seams mounting opposing interlocking means; (84) One or more baffles along cervical end of ventral arms; (85) Flat faced baffles covered in interlocking securing means; (86) Protruding inflatable means overlapping joint between ventral means; (87) Protruding inflatable means covered with pneumatically compressed interlocking means; (88) Superior baffle acting as mandibular shelf and splint; (89) Overlapping superior baffle acting as cover flap and mandibular shelf and splint; (90) Windsock structurally integrated into life raft; (91) Windsock structurally integrated into multiple structurally distinct buoyant chambers of raft; (92) Windsock reversibly attached to raft; (93) Sequential inflation via varied pressure relief fill valves; (94) Fill valves with optional lock caps; (95) Wind sock with attached wrist lanyard; (96) Wind Sock with attached body lanyard; (97) Wind sock with secure closure means to converting it into an Icelandic ballast means; (98) Wind sock with low strength fabric between wind sock and raft air chamber protecting raft from excessive pressure from Icelandic ballast; (99) Wind sock with fill tube to top off Icelandic Ballast while in raft; (100) Wind Sock that can be detached from raft and attached via wrist lanyard to raft body lanyard and thereby act as steering sea anchor; (101) Wind sock that can be turned inside out to protect the raft in storage acting as the raft's valise; (102) Windsock modified with shoulder straps converting it into backpack for independent raft carriage; (103) Wind sock modified with attachment means to convert PFD's chest straps into a cummerbund; (104) Windsock modified with receptacles for paddle handle to use windsock as an air scoop for propelling raft; (105) Windsock modified to become the funnel and to seal clear solar collector for generating drinking water; (106) Windsock seal to collect and store rain water; (107) Clear mobile eccentric fluid ballast container; (108) Colored fluid as mobile ballast; (109) Bright colored objects bobbing in fluid confirming presence of fluid and that it is not frozen and as visual stimulus to small children; (110) Life Raft with integrated windsock inflator; (111) Life Raft with releasable wind sock inflator; (112) Life Raft with low strength tear fabric between wind sock inflator and raft tube; (113) One way valve between wind sock and one or more chambers of raft; (114) Locking caps on inflation valves; (115) One way over pressure valve between windsock and raft chambers; (116) Differential inflation of chambers by varying strength of opening pressures of one way valve; (117) Sea Ballast container made from windsock means; (118) Sea ballast container with fill tube to allow filling while in the raft; (119) Sea ballast lanyard attached around reinforced perimeter of windsock; (120) Windsock with wrist lanyard attached at opening to prevent loss; (121) Wind sock with closure means; (122) Reinforced attachment of lanyard connecting raft to victim; (123) Sea Anchor created out of wind sock after raft is inflated; (124) Sea anchor connected by low strength fabric protecting raft tube from damage; (125) Life raft valise that functions as integrated inflator means; (126) Valise adapted to stow with cummerbund of PFD; (127) Valise with integrated shoulder straps for independent use; (128) Wind sock with dark interior coloration; (129) Windsock adapted to serve as solar still; and (130) Windsock adapted with fabric lock to seal clear cover.

The disclosed vertically eccentric Life Jacket strikes a new balance in the distribution of buoyancy and or ballast about the victim. The prevention of airway submersion is preferred to recovery of the victim after they become face down. Elimination of the danger Zone is the outcome of shifting the buoyant moment down and away and while the ballasted component is shift up and back relative to the PFD user. This separating of the centers of gravity and buoyancy in diametric opposed directions generates the greatest amount of torque per units of displacement and ballast. While buoyancy alone can create marked improvement in several characteristics of the PFD, the combination allows reduction in the amount of foam, which helps reduce size easing storage and improving mobility and comfort.

Additionally, in the event of face first entry of an unconscious user, the ballast is very active, concussing the container walls, imparting the kinetic energy to initiate corrective turning action by freeing the opposite inferior anterior buoyant means which is concurrently seeking to escape. The concurrence of two active synergistic moments markedly improves the frequency and rate of escape of the primary driving force to turning, the ventral buoyant means.

The bell-bottom shape places the majority of buoyant means below the chest strap. The disclosed inverted design is exactly contrary to common knowledge and practice, which advocates that buoyancy, must be located high on the chest.

With the predominance ventral displacement means being located low it remains submerged, and therefore active, as compared to designs in which some of the foam is out of the water and their for inactive.

One main advantage of a rigid inverted V is all the force is trying to balance at one point. The entire force is precariously balanced through the triangular apex and is transmitted via a variably flexible member to the cervical component of the Life Jacket. Physically the lateral and anterior extensions at the base shift the buoyant moment in the opposite direction of the mobile ballast element located at the most superior posterior edge of the PFD. The lateral and anterior extension of the bell bottom base, when poised in the vertical Dainger Zone, attempt to kick out to either side or to the front.

The base layer of foam runs continuously from the top of the cervical collar through to the base of the bell-bottom ventral buoyant means. While alternate layers can bee glued do to the extreme flexure at the apex of the thorax, the entire adjustable cervical collar can be mechanically fastened at the angle of the jaw with something as simple as an upholstery bottom with heavy gauge nylon line or a broad based rivet of plastic or stainless. The top to bottom continuous base layer can be capable of marked flexing to the back, limited flexion side to side, and can be rigid preventing any flexion forward. This range of motion accommodates several divergent uses required of the Life Jacket. For the conscious victim wishing to swim with their head up and back, the base layer flexes completely around the upper torso and down the chest by flaring open. This separates the variably sized buoyancy collar from the lower ventral means allowing the head to flex backward to facilitate swimming or scanning the horizon. A strictly rigid PFD opposes the extension of the neck. In the extreme one PFD unitizes a strut, which is mechanically fastened to the back of the PFD that continuously presses against the back of the head. The wearer is unable to straighten their neck yet alone extend the neck into a comfortable swimming or viewing angle.

When the user is upright in the water column the flat face of the lower ventral unit can abut against the lower flat face of the cervical collar so that the force is directed straight up creating the greatest freeboard. If the user has been in the water long enough that their core temperature is dropping they are at risk of losing consciousness. With the angulation introduced into the vertically eccentric Life Jacket the user must immerse their face before they can position the center of gravity above the center of buoyancy. Since it is unlikely that the person will intentionally immerse their face they remain out of balance. That is the center of gravity is to the rear and the center of buoyancy is forward. As the user loses control of their legs, which are critically involved in maintaining their vertical position, the jacket slowly pulls them backwards keeping their airway out of the water the entire time. The mechanical shift of the buoyant means down low will reinforce whatever direction is initiated by the victim. If they lean left, the bell-bottom kicks right. If they lean right, the buoyant means kicks left. In the center the anterior portion working with the rearward ballast simply pulls them back.

While numerous embodiments are obvious a continuous slope out from the front of the jacket while ascetically pleasing is more difficult to sew and stow. If the same amount of buoyancy is consolidated into the anterior inferior buoyant shelf it is simpler to build and a pair of jackets can stack in an overlapping fashion.

The Face First entry for the inherently buoyant, vertically eccentric, horizontally symmetric, Type A PFD consistently provides corrective turning action for several reasons. The adjustable collar with built in mandibular shelf brackets the jaw and holds the head erect. The collar encloses in front of the chin and securing means 23*c* secures the adjustable collar tightly about the neck.

Classically it was believed that the inflatable PFD because of it large size on inflation created huge displacements and therefore would always out perform the lower volume inherently buoyant PFD. The inflatable small size when deflated is a real advantage in assuring that the PFD is worn continuously so that it is on in the event of an emergency. PFDs are now approved that upon immersion activate the inflation device in an automatic fashion. Due to the design restriction of the inflatable PFD the cover is the source of attachment to the body. On detonation the cover is blown open and the PFD deploys around the neck. The pressure generated by inflated chamber is so tight around the neck that without restraint in design it can compress the neck to an alarming degree. The good side is that the collar firmly supports the head preventing it from flopping, which is why the inflatable has such a good reputation at turning. However in face first entry from a height as minimal as the edge of a pool the ballast of the head drives the neck as a wedge between the inflatable ventral arms. In this position the PFD floats most if not all testers face down every time. Applying the discoveries disclosed herein the inclusion of a baffle along both sides of the jacket below the neck provides two advantages. It creates a flat surface and by the selection of the size of the baffle can create a bulge that when covered by an interdigitating fabric lock creates a very secure closure.

The Posterior can turn around the apex because of the flexibility in the ventral cervical joint. It is now clear that the use of horizontally eccentric ballast or buoyancy while effective in contrived in line tests can be blocked if the individual falls off to the side. That corrective turning action must be able to occur to the right or left as directed by the vagaries of the victim and attached clothing. Thus the use of any fixed ballast is ideally located along the midline where it assists the completion of active self-rescue from the 90 to 180 degree position. If the ballast of an illumination device is placed off to the side it will detract from the rate or possibly prevent corrective turning.

The separation of the centers of gravity and center of buoyancy generates the torque needed to roll the diver into an airway-protected position. An overlapping posterior collar allows the adjustment for both entry and sizing. Individual specific sizing is critical because it keeps the individual secured to the jacket. In the event of loss of consciousness a marked flaccidity of the neck combines with wave action to work the victim out of the jacket, particularly a jacket with a fixed opening that must accommodate a wide range of adult neck sizes. 50% of the fatalities of the Sleipner were found hanging beneath the PFD from the straps. The cover fabric of the adjustable posterior collar needs to be either very loose or ideally constructed of a flexible material such as spandex which accommodates the circumferential expansion necessary to first enter the jacket then adjust the size to the individual's neck.

The lateral superior aspect of the PFD collar is further modified to include left and right mandibular shelves. A reversible PFD requires mandibular shelves on both sides in order to preserve the reversibility of the jacket, a requirement of SOLAS PFDs. The disclosed mandibular shelf not only places a mandibular splint beneath the chin and jaw, but also places vertical walls along both the left and right sides of the jaw that prevents side to side droop of the head. It is the side-to-side droop that allows the ballast of the head to shift the center of gravity creating a cant to the face plane or worse creates a side high position allowing the airway to partially drop beneath the water's edge.

Both USCG and international standards require a head angle of 30 degrees with out which approval will not be granted. Thus between the overlapping posterior cervical layers can e inserted foam shims to mechanically adjust the collar to the correct angle. In a single sided PFD the shims can be located beneath the top layer. In a reversible PFD the shims can be placed in the center thereby elevating both sides equally. A sculpted depression in the posterior collar, while it detracts from the both freeboard elevation above the waters surface and head angle, it cradles the head and neck reducing the incidence of the head falling to one side or the other. Once again when the head drop to the side it brings the mouth within dangerous proximity of the water's surface. Approximately 1" at the rear of the collar creates sufficient bevel to hold the head at the required angle to assist in the shedding of water off the face.

There are two broad categories of why a person would be unconscious in the water. First they enter the water unconscious or they become unconscious once in the water. Trauma is the most likely cause of entering the water unconscious, such as occurs when struck by the sailboats boom. Loss of body heat or hypothermia would be the leading cause of becoming unconscious after the victim has entered the water.

It has been proposed that PFD testing include an assessment of entering the water unconscious. The tester is to sit relaxed at the poolside breathing slowly then the tester is to fall face forward into the water with the arms, legs and neck limp. Such a simulation of unconscious entry is unexpectedly challenging to all existing PFDs whether high volume inflatable or low volume inherently buoyant. The present invention's use of contained mobile eccentric ballast creates repetitive concussive effects, as the ballast slams from side to side, end to end leading to a strong and rapid corrective turning action. Notably, the container is, preferably big enough to allow kinetic energy to develop, which is imparted upon impact to the structure of the PFD. The rigid structure transfers this energy expeditiously to the ventral arms, which supply the majority of the power required to actually roll a flaccid person off their face, and onto their back. This test of high displacement inflatables, as well as the low volume inherently buoyant PFDs, is to challenging to pass.

Limiting the size of the mobile eccentric ballast's container is the need to keep the ballast away from the edge where it can impact the face plane by creating a dip to one side. This position lowers the comer of the mouth educing measured freeboard another pass-fail criteria for USCG approval.

The individual that becomes unconscious once in the water secondary to hypothermia requires a different action from their PFD. While conscious the victim will be vigilant looking for fellow victims, passing ships, planes and hopefully one going rescue efforts. The best vantage point for observing then signaling help is vertical in the water column. The natural tendency is to balance on the PFD, which is achieved by legs hanging behind the jacket, arms in front, and head held straight up. In this position the center of gravity is directly above the center of buoyancy and the victim is balanced and therefore expending the least amount of energy. Any jacket that allows this positioning of the center of gravity directly above the center of buoyancy has a Danger Zone. That is defined as the vertical position that upon collapse allows the face to fall into the water. From this position 5-second corrective turning is required to prevent drowning, unfortunately a non-existent level of performance.

The present invention jacket through the use of ballast and buoyancy creates and axis through the thorax near where the PFD strap wraps around the chest. Placement of the ballast high for a reversible jacket and high and to the rear for a jacket that has a clearly identified front and optimally positions the ballast do that the conscious victim must place their face underwater in order to move their center of gravity far enough forward so that it can balance upon the center of buoyancy. This is so unlikely that when they are vertical in the water column there is an ever-present effort of the vest to pull them backward. As the victim's core temperature drops and they loose the ability of the legs to adjust their position in space as they become obtunded, the jacket gentle pulls them backward away from the water, preventing submersion of the airway. This obviates the need for the jacket to quickly roll their face out of the water. Even if a jacket could roll an unconscious victim reliably there would be some associated aspiration. Thus, the present invention PFD is the first life jacket that does not have a Danger Zone.

Once the victim is unconscious and positioned on their back by the PFD the airway remains in need of continued protection from aspiration leading to drowning. Wave tank tests disclose that the victim turns into the waves and gradually drifts backwards. As the waves mount they lap at the butt of the PFD. The USCG Reference Vest is a very sleek design that slopes up towards the face. While this places the foam high on the chest it creates a ramp that the waves slide up. Once the water passes the convexity of the USCG reference vest it rolls down a short slope into the nose and mouth. For a given wave height and frequency sensors typically on mannequins detect the beginning of water splashing against the airway.

The present invention discloses two different butt structures depending upon the type of jacket. For the non-reversible vest the but angles from the victim up and away. For the reversible PFD there is a V cut into the butt so that whichever side ends up being the top, one half of the jackets thickness remains angled against the oncoming waves where it serves to rebuff the waves. For the jacket used in the open sea the butt can be widened to increase its height above the water's surface. This bell-bottom shape serves two functions. It shifts the buoyant moment down and forward which complements the shift of the center of gravity up and back by positioning the ballast high and if possible to the rear if one exists i.e. in non-reversible jackets. The butt of the ventral arms is ideally covered by a course open weaving that serves two purposes. It breaks up the water and allows rapid drainage by replacing the grommets occasionally found in that position.

The reverse cant at the end of the jacket redirects the wave away from the oral-nasal area. Once wave height and or frequency cause waves to crest over the height of the butt it will roll along the superior face of the PFD towards the oral nasal area. At this juncture the jacket that is short but fat has a purported turning advantage but is more quickly over taken by the waves. That is the present invention jacket keeps a long ventral arm to establish a break water at some distance from the face.

Given the severity of the waves upon the victim bobbing at sea, the ventral arms can be partially cut below the chest strap. This creation of a hinge below the strap does two things. The flexibility about that joint assists the backward rescue of the victim complementing the bell-bottom shape and the posterior ballast moment to increase the torque applied to the vertical victim. The torque generated around the axis through the waist is critical in eliminating the danger zone from the design, thereby creating prevention as the primary response by the PFD to hypothermia leading to loss of consciousness.

Eventually, even with a ventral arm the entire length of the torso, mounting seas will eventually crest the butt then roll down the face of the PFD towards the victim's nose and mouth. At a distance of a few inches from the victim's mouth one or more ridges along the surface of the PFD redirects the water off to the side away from the oral nasal area. The second ridge catches the first water that rides over the first ridge and redirects that water away. With the present invention, the wave must be big enough to first rise above the but of PFD flexed up about the chest strap, then must be big enough that it doesn't break within the distance from the butt to the face where it would be redirected away. The wave must be big enough to crest all the way over the jacket and directly down onto the face before the victim would suffer from passive intrusion of breaking seas in their airway way.

Applied specifically to Inflatable Type I and SOLAS Type I, a fabric collar carrying the oral-nasal splash guards also serve to hold a fabric lock at the top of the ventral arms beneath the chin. As the bladder is inflated it jams the fabric lock together. The fabric lock is critical to the performance of the inflatable PFD because on unexpected water entry particularly when unconscious, the ballast of the head drives the neck like a wedge between the ventral arms. In this position the inflatable fails to provide airway protection. Uniquely the fabric lock is compatible with the automatic detonator in the sense that if the individual is knocked unconscious before entry after a few seconds the jacket will inflate automatically after exposure to water. The pressure of the inflating chambers first opposes than compresses the lock keeping the head from falling from position.

Figure 66:
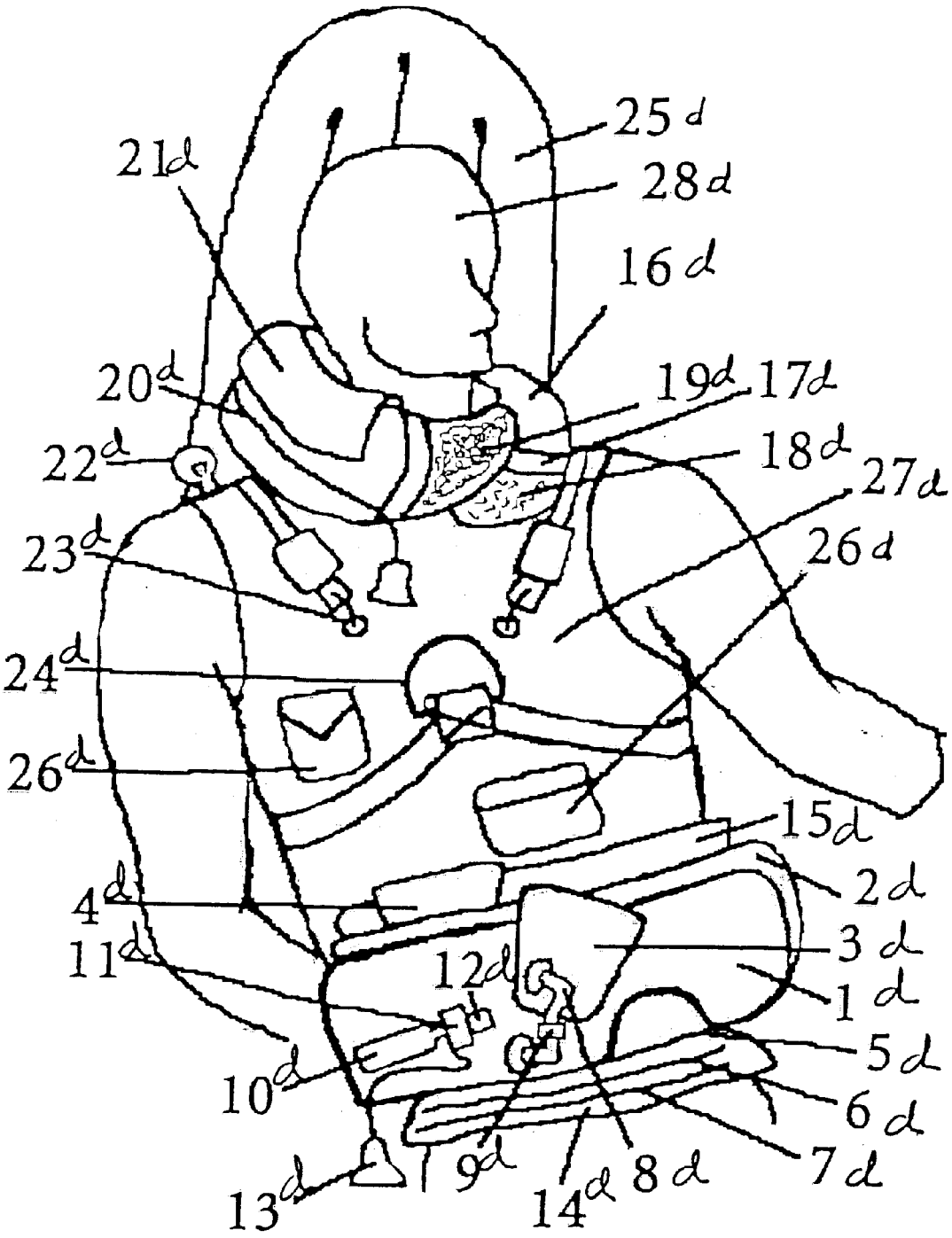
FIG. 66 is a three-quarter frontal view of a multi-chambered life jacket demonstrating dual lift chambers combined with dual mobile eccentric buoyant chambers.

FIGS. 66 through 81 illustrate the garment integrated multi-chambered personal flotation device, life jacket, and/or the like, embodiments of the present invention. The individual in FIG. 66 is wearing body armor as the garment to which the PFD is attached. The forward bladder 1*d* is referred to the inferior bladder due to its position when floating vertical in the water column. As seen in FIG. 66 the superior bladder 2*d* can be detached from the inferior bladder at the top creating a moderate amount of displacement in a relatively low profile for the victim carrying 19 lbs. of tactical plate. The offsetting buoyant displacement requires a mobile eccentric buoyant moment to initiate corrective turning. The use of buoyant chamber is so strong that it can trap the mobile element against the lower torso or legs depending on the resting location of the buoyant chambers against the flaccid victim. Consequently reliable turning requires mobile buoyant elements in both the inferior position 3*d* and superior position 4*d*. The inferior margin of bladder 1*d* can be attached by a reversible means such as zipper 5*d* to 14*d* to the bladder containment cover. For increasing amounts of buoyancy the attached edge of bladder 1*d* can be moved away from bladder 2*d* by affixing the bladder at zipper 6*d* or 7*d* depending on the amount of displacement required by the individual and their attached gear. Mobile buoyant bladder 3*d* can be attached to large volume displacement bladder 1*d* by way of flexible tube 8*d*, which can conduct inflation gas through quick release one way check valve 9*d*. The fixed bladders 1*d* and 2*d* and the mobile bladders 3*d* and 4*d* can be inflated by compressed gas cylinder 10*d* through detonator 11*d* which can be activated by water through optional device 12*d* or manually through pull cord means 13*d*. The inferior cover 14*d* and superior cover 15*d* can contain the stowed abdominal bladders in their deflated state.

The water-activated collar 16*d* can be released from cover 21*d* by automatic detonation in the event of unexpected water entry or manually via ripcord 21*d*. Illumination and signaling device 22*d* can be powered by combined battery ballast means located on the posterior centerline. The quick release means for the inflatable collar can be integrated into the quick release system 23*d* of the two part armored vest garment 27*d*. Heavy duty D-ring harness means 24*d* allows rescue and recovery of the armored water accident victim 28*d*. A water-activated detonator can release and inflate a raft 25*d* stowed in the back of the garment. An unpredictable wide variety of armaments can be located about the chest and waist further increasing the need for the disclosed high torque corrective turning created by the unique combination of fixed and mobile buoyant moments.

FIG. 67 is a close up of the side of the abdominal bladder system comprised of superior bladder 31*d* folded tight upon itself by connecting the lateral edge 35*d* to the back wall 14*d*, reducing available volume for inflation/displacement. Inferior bladder 31*d* can also be held in close quarter by attaching lateral edge 36*d* also to the back wall. The excess fabric noted at 33*d* and 34*d* accounts for the relative reduced volume of the mounting configuration depicted (FIG. 67). Oral inflation tube 38*d* can connect oral/overpressure valve 37*d* to bladder 31*d*. Bladders 31*d* can be continuous so that use of pressurized gas or oral inflation fills all chambers assembled. In the low volume configuration (FIG. 67) the inferior chamber 30*d* may not have the length of arm needed to trap mobile buoyant element 3*d* and so sufficient initiation force can be generated by a single mobile element in this configuration. In the reduced volume state (FIG. 67) any excess gas on inflation can be discharged through overpressure valve 37*d*.

Figure 68:
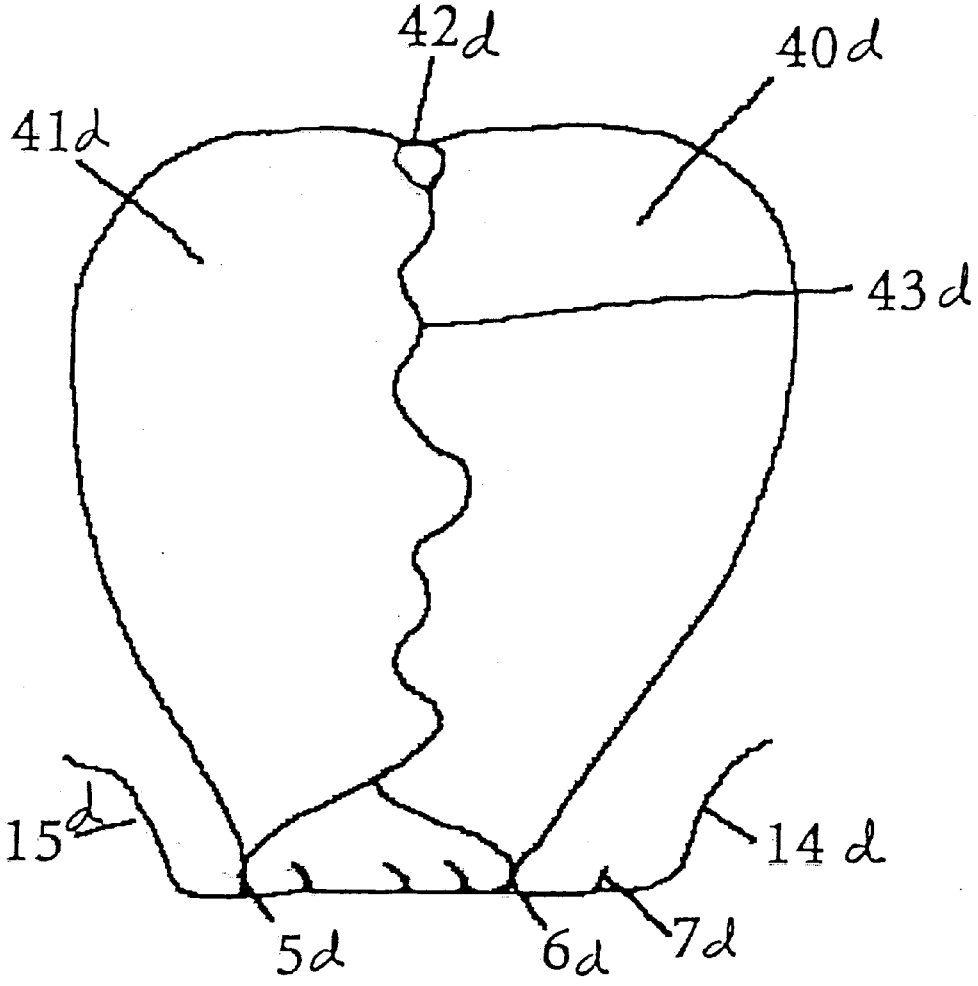
FIG. 68 is a side view of the abdominal chambers showing the inferior and superior bladders attached to the garment and to each other to produce the next lowest volume bladder.

FIG. 68 depicts the outcome of attaching the lateral edges of bladders 40*d* and 41*d* along the midline at 42*d*. This results in a moderate amount of excess fabric 43*d* reflecting the reduced volume achieved by joining the bladders in this fashion.

Figure 69:
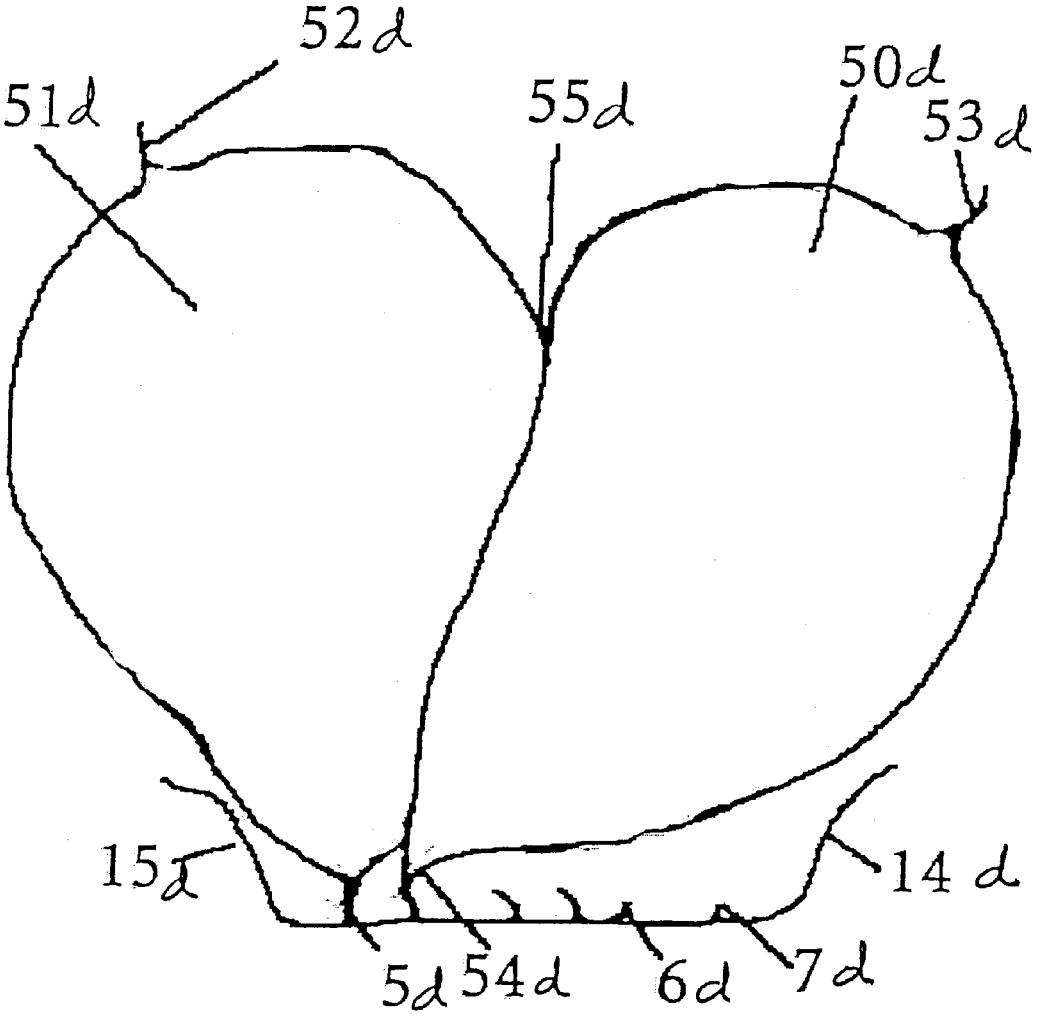
FIG. 69 is a side view of the abdominal chambers showing the inferior and superior bladders attached only at base allowing the bladders to increase their volume to near maximum.

In FIG. 69 the bladders are held to the garment wall at superior bladder junction 5*d* and inferior bladder attachment 54*d*. The lateral edge 2*d* of superior bladder 51*d* and the lateral edge 53*d* of inferior bladder 50*d* can flare apart allowing increased filling/displacement. The minimal reduction in full deployment can be achieved by closely attached medial edges at 5*d* and 54*d* as reflected in minimal compression along the midline 55*d*.

Figure 70:
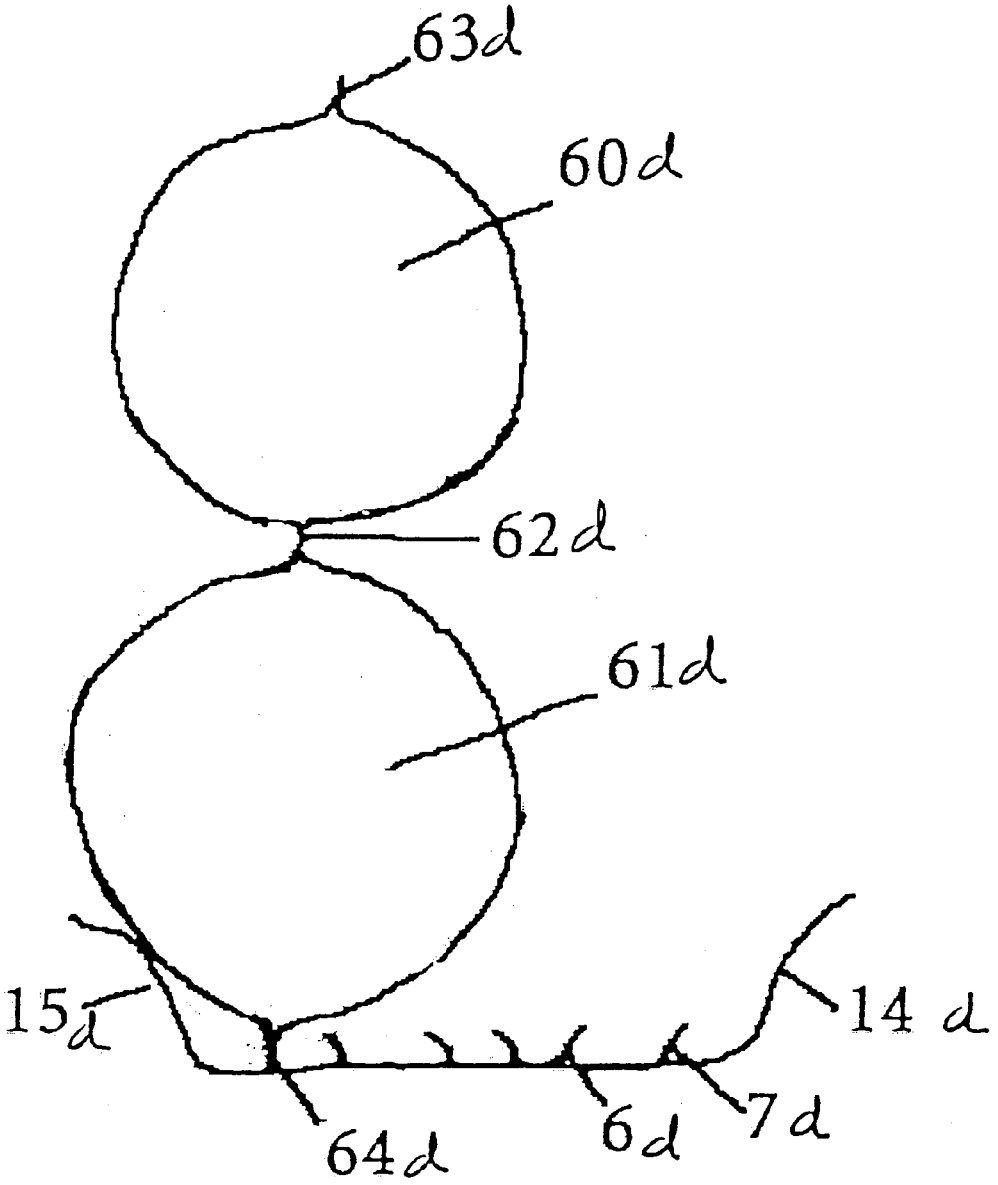
FIG. 70 is a side view of the abdominal chambers showing the inferior and superior bladders attached together with only the superior bladder attached to the garment, allowing complete inflation therefore maximum displacement.

FIG. 70 depicts both bladders unconstrained thereby producing the maximum displacement possible for their size. Inferior bladder 60*d* can float above formerly superior bladder 61*d*. The bladders can be joined at the middle 62*d* with the lateral edge 63*d* of the inferior bladder 60*d* free. The superior bladder 61*d* can attach both bladders to the garment wall, at 64*d*.

Figure 71:
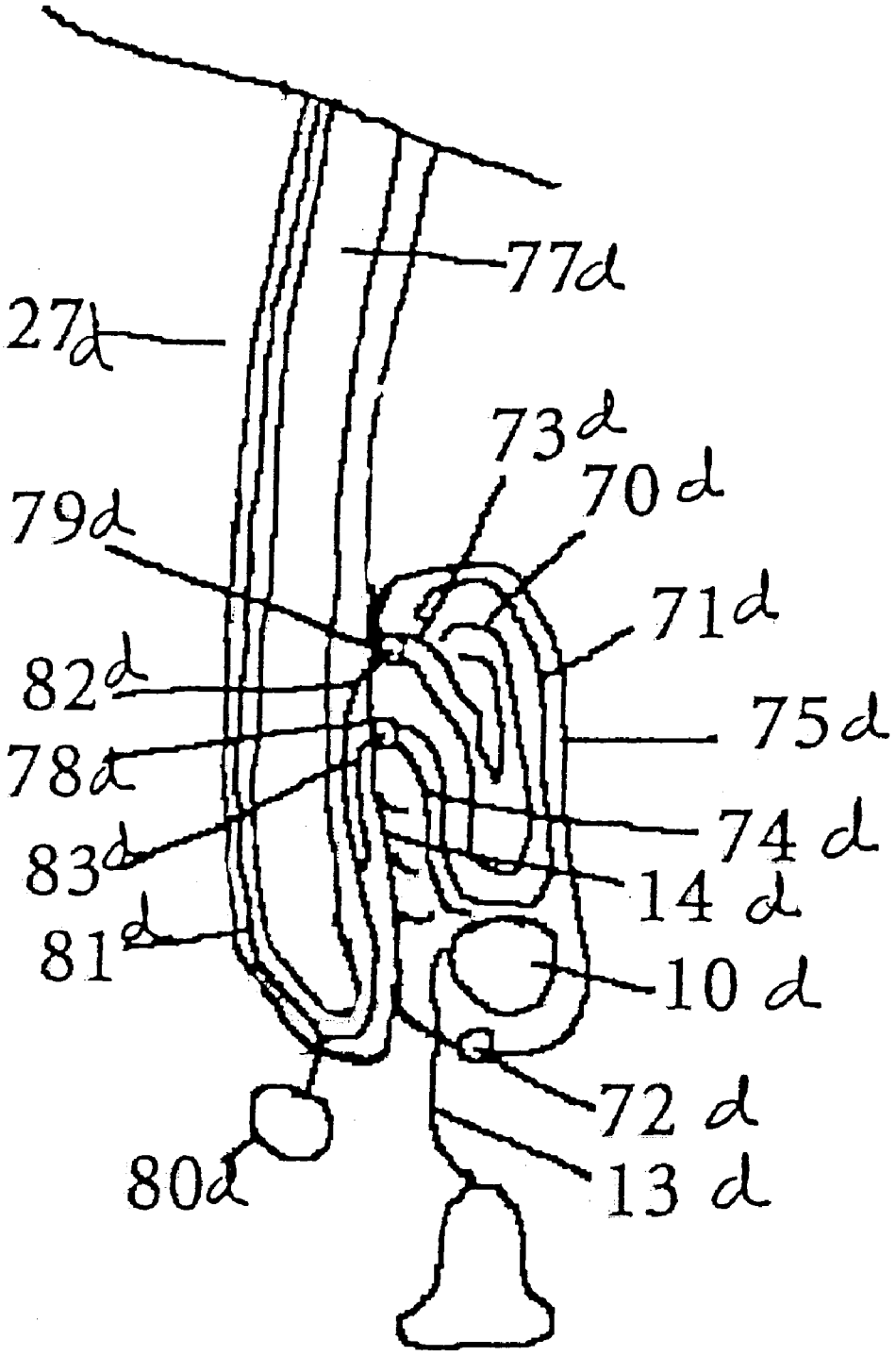
FIG. 71 is a side view of a stowed abdominal bladder demonstrating pneumatic release of the PFD from the stowed state as well as a quick release means for allowing the abdominal bladder upon release to be converted into a free standing Life Jacket. The PFD release mechanism is integrated into the armored vest quick release system.

FIG. 71 shows a quick release variable volume bladder system 75*d* stowed behind the Kevlar ballistics protection 77*d*, which can include a deflated inferior bladder 70*d* and deflated superior bladder 71*d*. The bladder container can be released when pressure is applied by detonation of cylinder 10*d* preferably by pulling lanyard 13*d* which activates the detonator. The expanding bladders can separate closure means 72*d*. Compressed gas can inflate fixed bladders 70*d*, 71*d* and mobile bladders 73*d* and 74*d*. In addition to the Kevlar fabric armor, garment 27*d* can also contain thick rigid armor 76*d* of considerable mass. Inferior quick release loops can hold the bladder to the garment preferably by ripcord 83*d*. The superior quick release means 79*d* can be secured preferably by ripcord 82*d*. When the wearer pulls on loop 80*d*, ripcords 81*d* release the shoulder and sides freeing the front and back panels to fall away. Simultaneously ripcords 82*d* and 83*d* can release the abdominal bladder to become an autonomous PFD.

Figure 72:
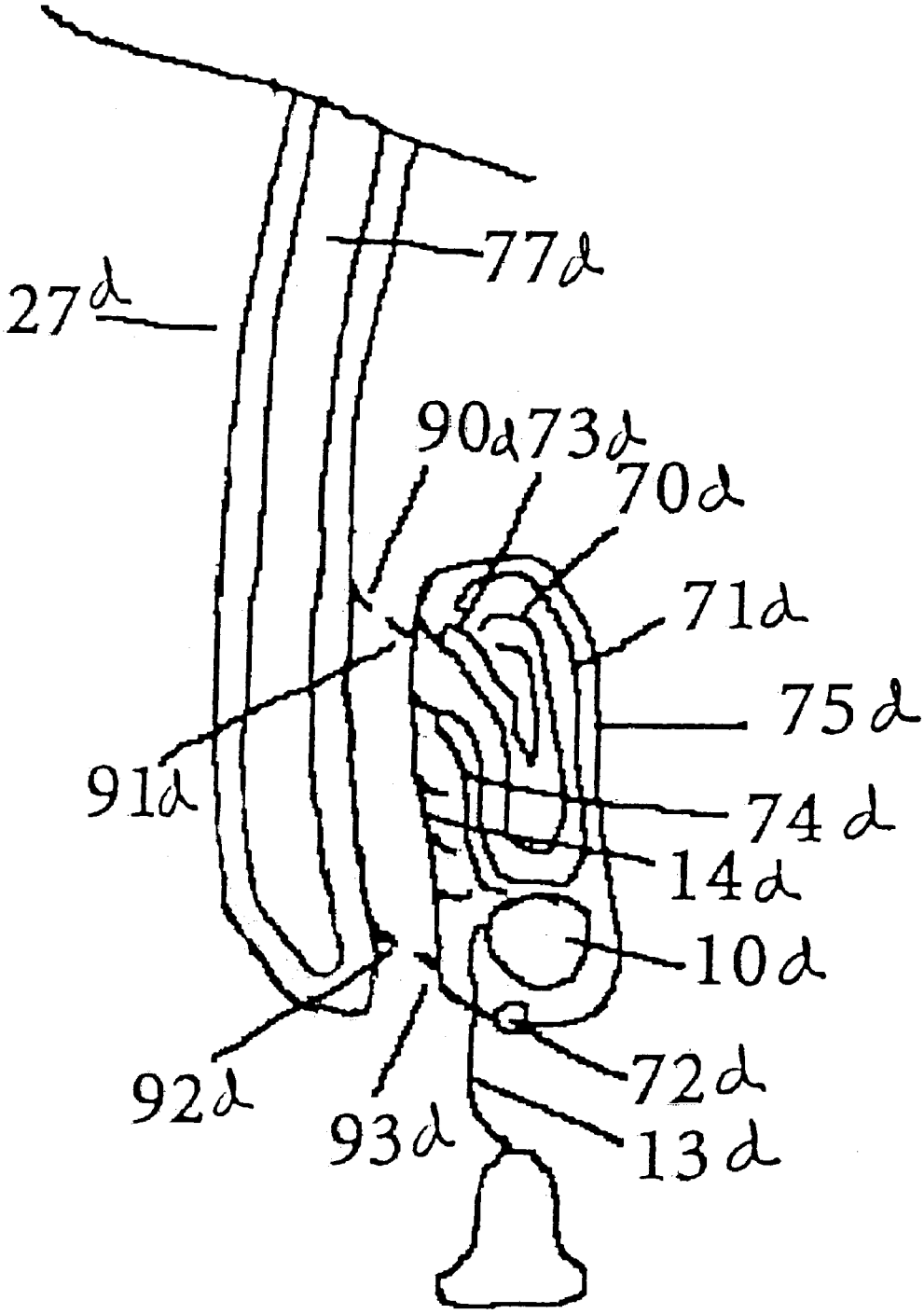
FIG. 72 is a side view of a stowed PFD ready ballistics vest demonstrating a removable abdominal bladder. The vest is constructed with complementary attachment means so that the vest can be upgraded to include the PFD means as an option at a latter date.

FIG. 72 Illustrates a contained variable volume bladder system that can be attached or removed from the garment 27*d* as indicated. In a desert operation a PFD would be needless. The safety of the same vest could be enhanced during a marine operation by the connection of complementary superior attachments means 90*d* and 91*d* and inferior attachments means 92*d* and 93*d* such as a zippers, snaps, hook and loop fasteners (i.e. VELCRO), buttons, and other conventional attachment mechanisms and assemblies.

Figure 73:
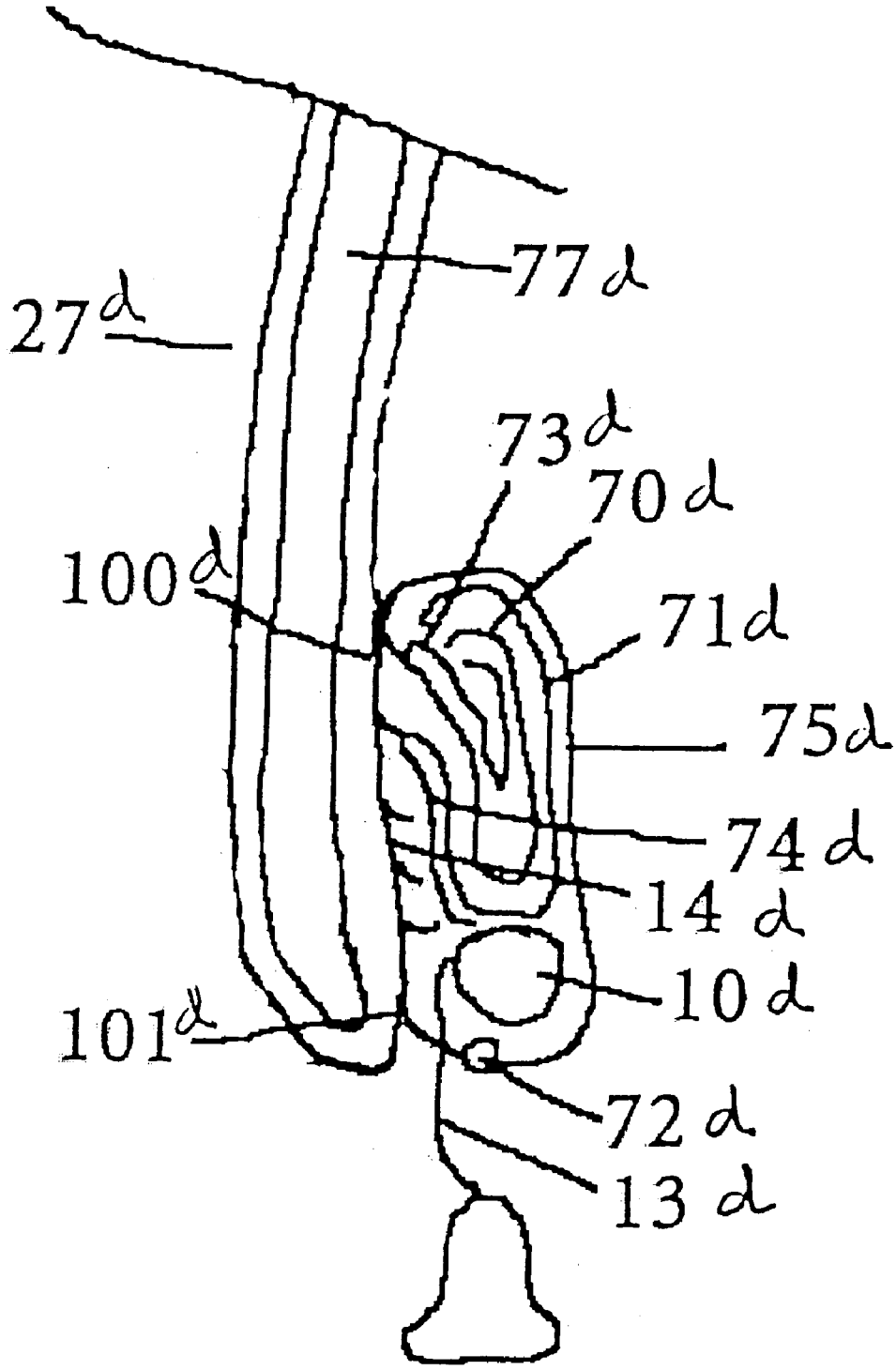
FIG. 73 is a garment with a built in variable volume abdominal bladder.

FIG. 73 demonstrates garment 27*d* with permanently attached variable volume abdominal bladder system 75*d* sewn along the superior edge at 100*d* and along the inferior edge 101*d*. Other attachment mechanisms and assemblies can also be used and are considered within the scope of the invention. Such a vest might be preferred by a maritime organization such as the USCG.

Figure 74:
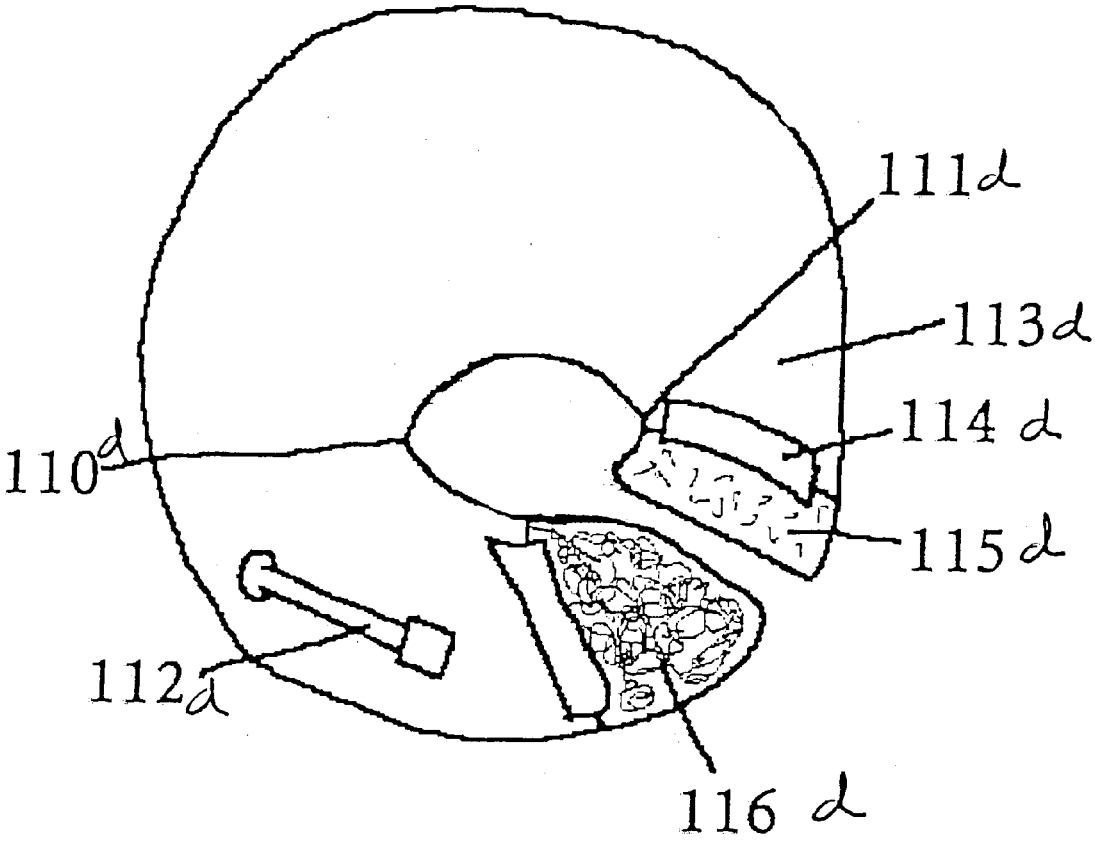
FIG. 74 is a superior view of an inflatable collar demonstrating an interior angle that upon inflation pulls arm across neck opening opposing complementary fabric lock securing the position of wearer's neck in the event of loss of consciousness.

FIG. 74 demonstrates a self-closing self-locking inflatable collar. The acute angle at 110*d* can convert the two-dimensional flat fabric into a marked flexure state when inflated into three dimensions. A similar flexure at 111*d* brings the opposite around so that the arms overlap, filling the void under the flaccid victim's chin. This single wall construction can benefit from using fabric coated on both sides preferably by film responsive to welding. The exterior coating allows direct attachment of flap 114*d* to the topside of the collar 113*d* allowing the complementary fabric lock system 115*d* and 116*d* to be secured along the entire perimeter. The efficacy of the cross arm flexure created by angle 110*d* relocates oral inflator and over pressure valve 112*d* towards the victims mouth to allow adjustments in pressure/flexion to further accommodate a wide range of neck diameters.

Figure 75:
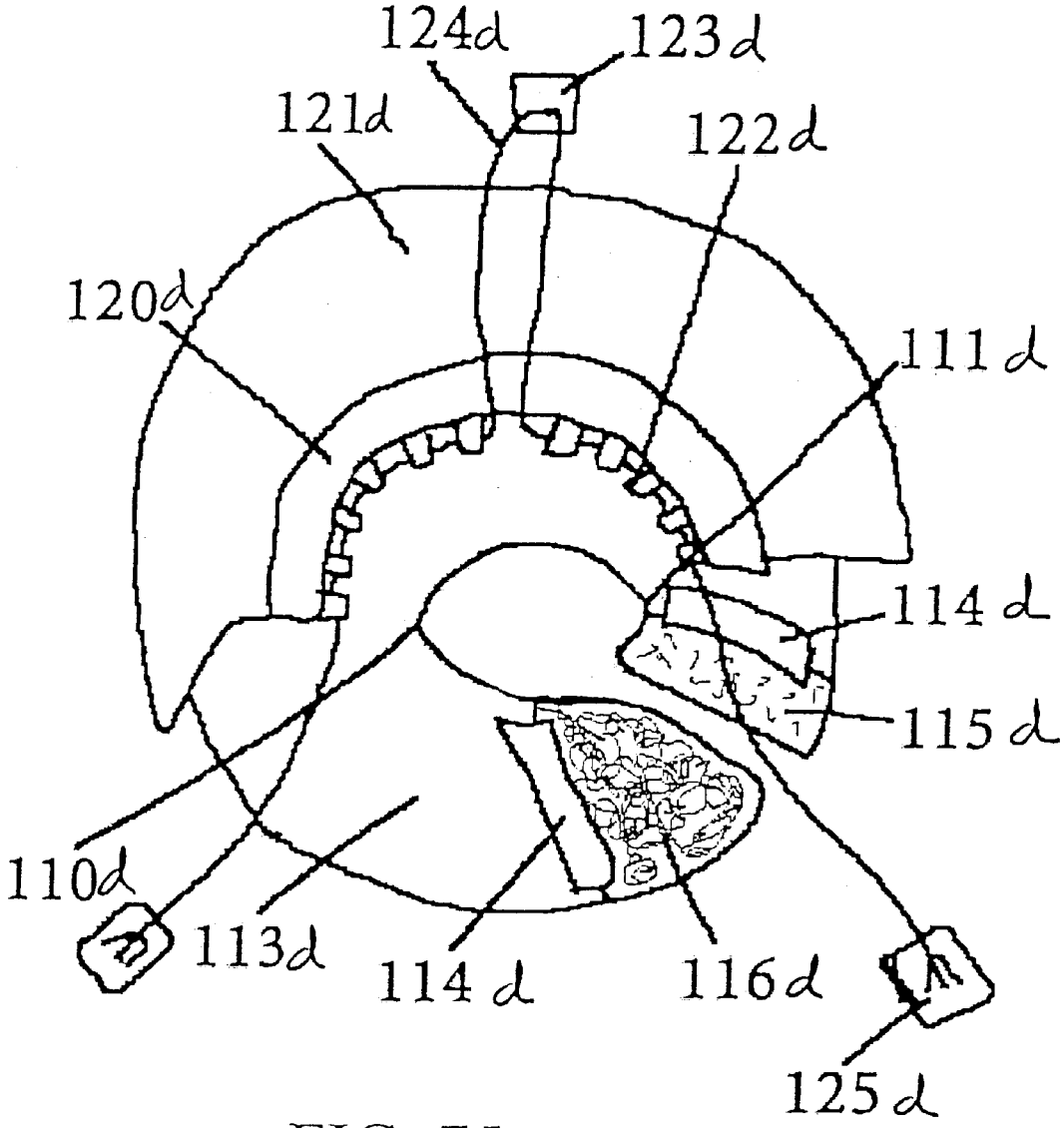
FIG. 75 is an inferior view of an automatic closing and locking inflatable collar showing quick release means.

FIG. 75 illustrates the inferior side of a quick release collar that ties into the quick release system for jettisoning the front and back panels of the armored vest. A flap of fabric 120*d*, preferably weldable, can be attached, such as by welding to collar 113, though such attachment method is not considered limiting. Retaining cover 121*d* can be attached to 120*d*, which is shown in the open position because collar 113*d* is fully inflated. Attachment means 123*d* secures ripcords 124*d* to the back of the vest. The anterior ends are secured at 125*d* on the front of the vest. In the event that the vest is released, the secured state at 125*d* is disconnected. As the rear panel of the vest falls away, the cord 124*d* can be removed from securing means 122*d* freeing the collar to remain around the victim's neck as the panel drops away.

Figure 76:
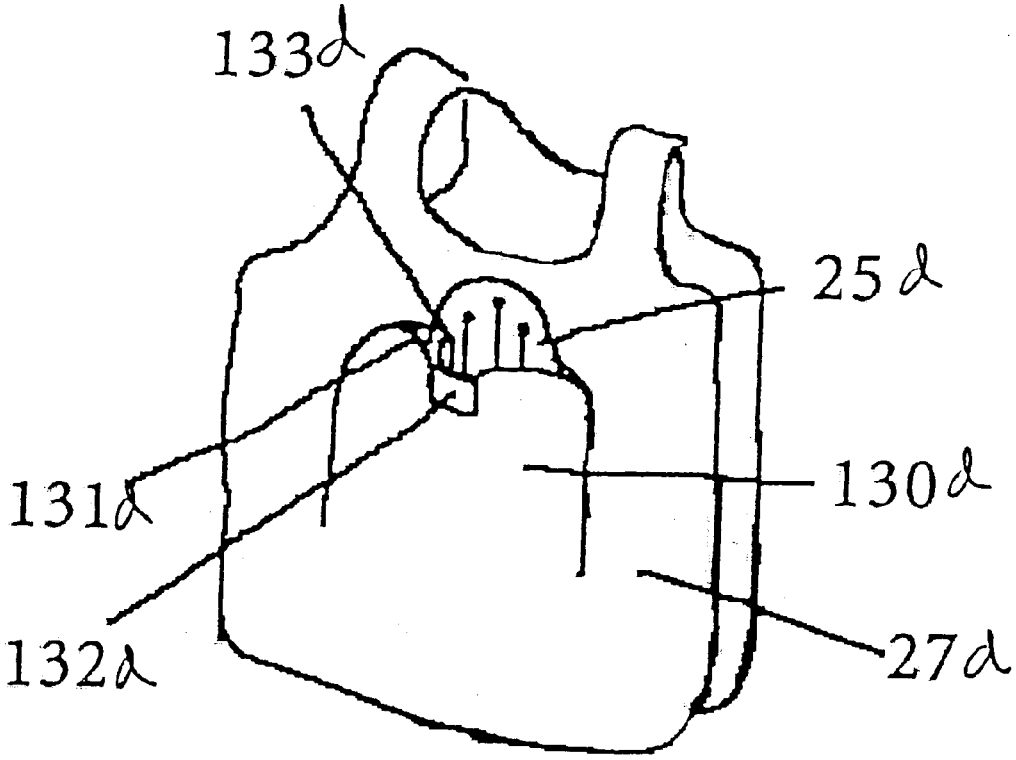
FIG. 76 is a posterior view of ballistics garment with water activated selfdeploying raft.

FIG. 76 is a posterior lateral view of the garment 27*d* with cover flap 130*d* stowing raft 25*d* that is inflating upon water activated release of gas from cylinder 133*d* peeling apart pressure sensitive securing means 131*d*. The initial detonation can release fabric lock 132*d* on cover flap 130*d* from the back of the garment 27*d* allowing the release of the expanding raft.

Figure 77:
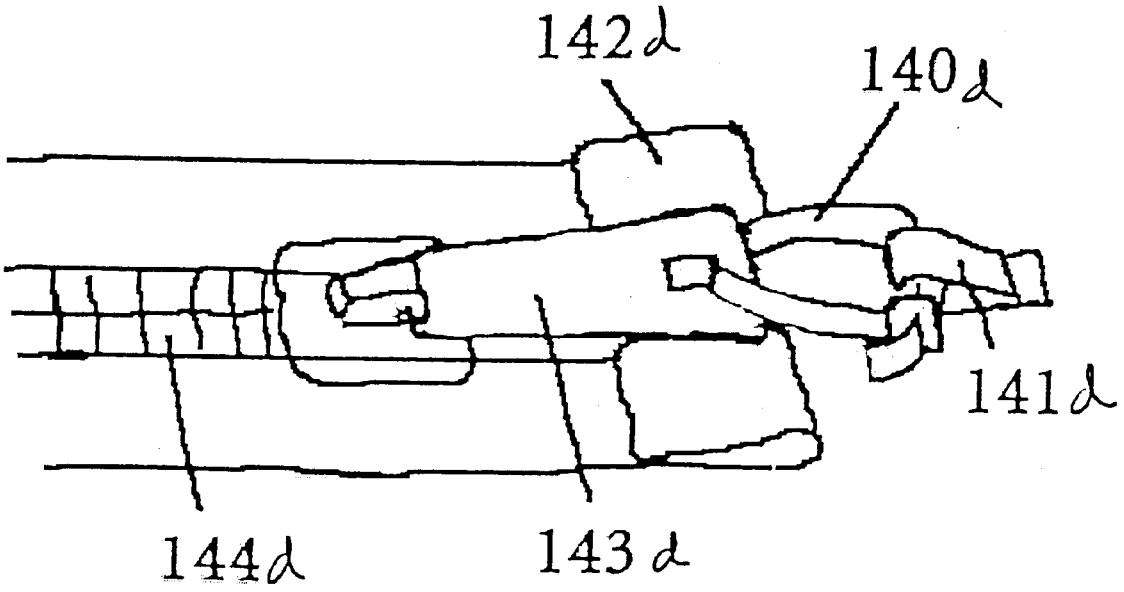
FIG. 77 is a three quarter superior view of secure means for locking zippers in the field. All zippers reversible affixing life saving devices to garment can be quickly secured in particular the zippers used to mount the PFD container to the vest and the buoyant bladders to the container.

In FIG. 77 a high strength nylon locking means 140*d* can secure the zipper pull 143*d* to the garment through loop

141*d*. Alternatively, the pull could be attached to a loop created by excess zipper fabric 142*d*. The mechanism is very secure preventing the separation of zipper 144*d* even when under the types of forces generated by a high lift bladder buffeted in a sea state. The locking means 140*d* is preferably used to mount the bladder to the housing as well as to the garment itself.

Figure 78:
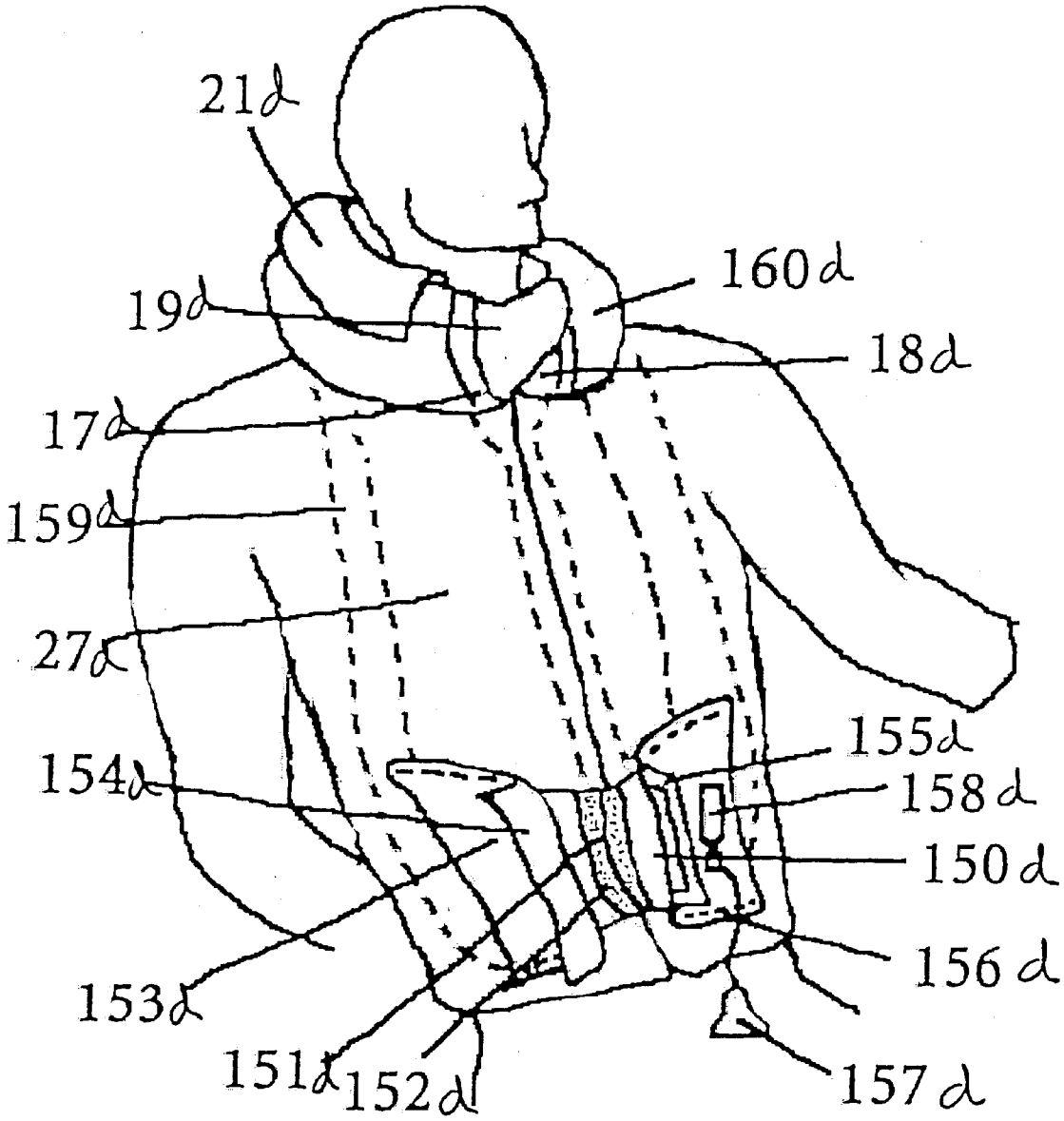
FIG. 78 is an anterior view of windbreaker garment with integrated single chamber low volume life jacket

FIG. 78 adapts the functional advantage of two chambers to a single chamber PFD for a garment that opens along the midline. The midline opening forces the abdominal bladder to be split. The left bladder 150*d* is seen extending from garment. Pocket cover 153*d* is peeled back at 154*d* showing the midline compression 511*d* of the complementary fabric lock 152*d*. The medial position of the cover can be held in place by attachment means 155*d*. The lateral margins of the pocket can be permanently sewn 156*d* to create a funnel device that directs the abdominal chambers out toward their midline union 151*d*. CO2 cylinder 158*d* can be manually activated preferably by pulling ripcord 157*d*. The abdominal 150*d* and cervical 160*d* chambers can be connected by conduit 159*d*.

Figure 79:
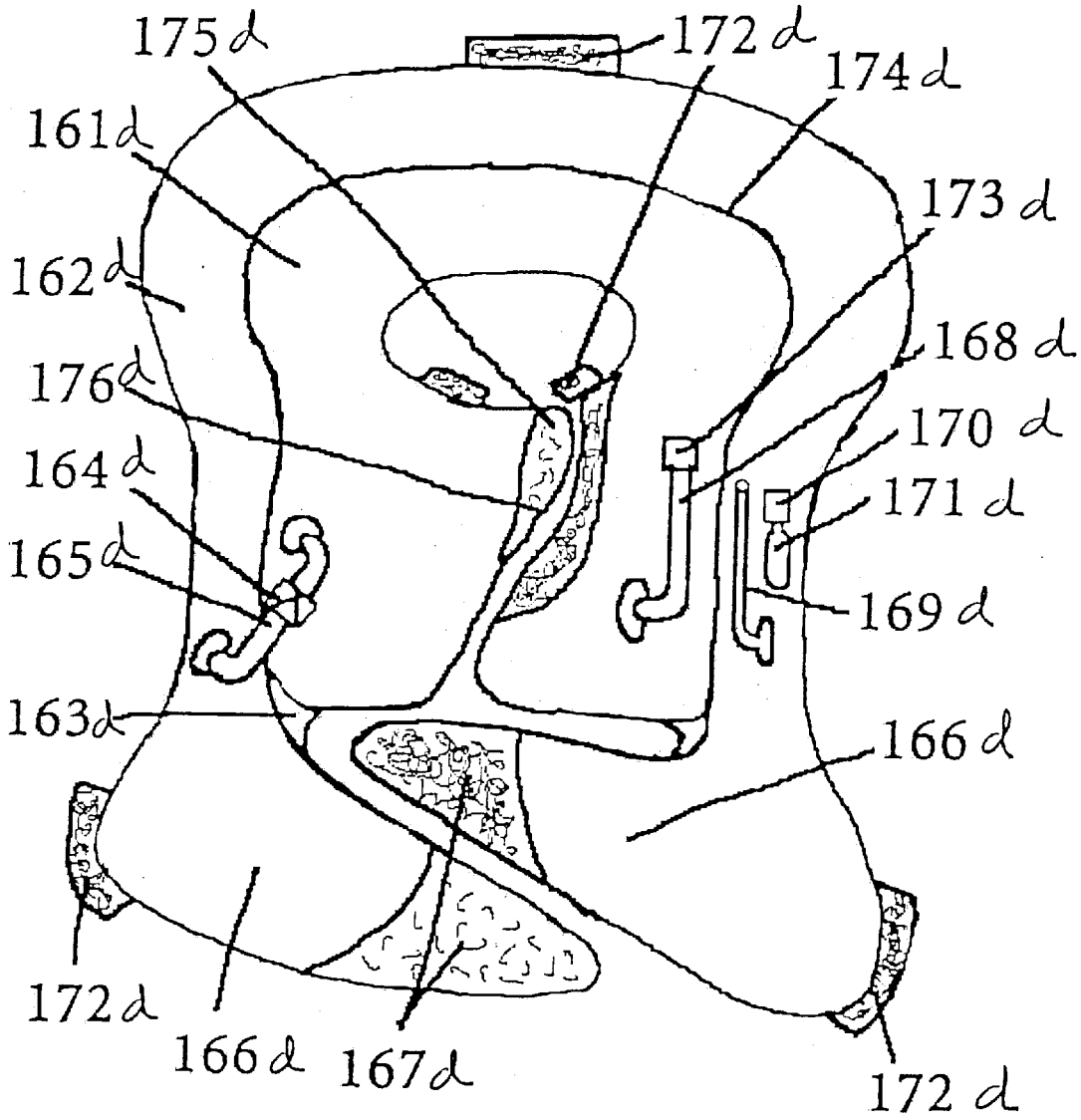
FIG. 79 is an anterior view of double layer bladder comprised of two bladders of different. volume different pressure and different inflation means allowing the use of a single low cost CO2 cylinder to provide some initial assistance while user completes oral inflation of the larger chamber. To minimize cost the chamber share a wall in common

FIG. 79 illustrates a triple layered dual chamber bladder that combines a low volume and pressure primarily oral inflated chamber and high-pressure gas inflated chamber. The construction preferably can include a middle layer 162*d* to be coated on both sides while the top layer 161*d* and bottom layer 163*d* can be coated on only the inner facing side. An over pressure relief valve 164*d* can be in line in the connecting conduit 165*d* between the high and low-pressure containers. Bilaterally abdominal bladders 166*d* can be connected by fabric lock 167*d*. While both chambers can be inflated orally, the large bore inflator 168*d* can go to the smaller of the two, while the high-pressure chamber can have a small reserve oral inflator 169*d*. Both chambers can be protected from over inflation by the same over pressure relief valve 173*d*. CO2 cylinder 171*d* and detonator 170*d* can be connected to the larger chamber. The bladder can be held in place in the garment by fabric fasteners 172*d*. A weld line 14*d* can separate the two chambers. The collar can be enhanced by an overlapping mechanical component 176*d* preferably covered by complementary fabric lock 175*d*.

Figure 80:
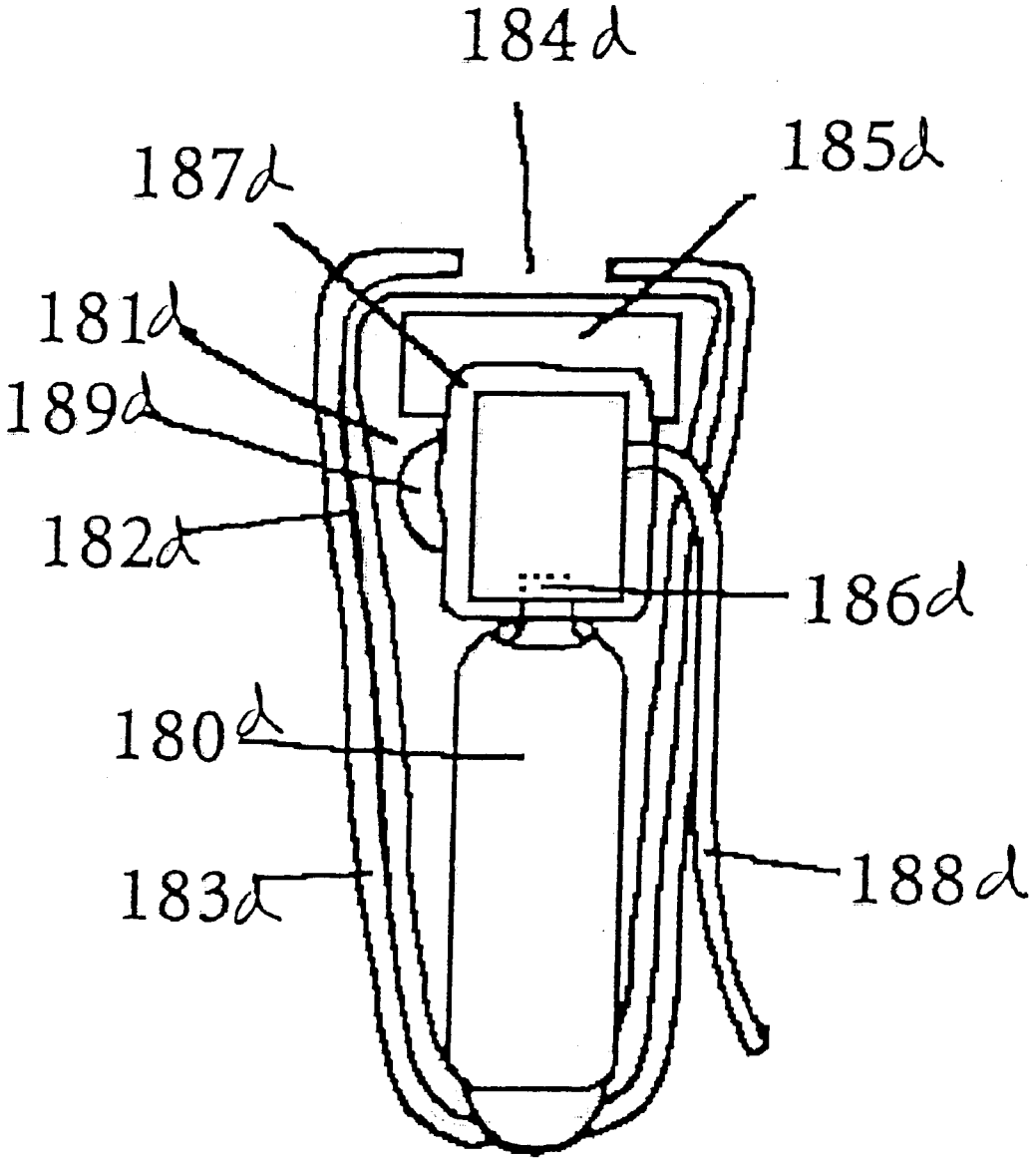
FIG. 80 is a superior view illustrating internally mounted CO2 in a single use bladder that can be replaced within the garment. Protected from water and corrosion chemically and inaccessible so that cylinder will not be accidentally removed and connected with detonator so that it will not loosen prior to use. Actuated by squeezing or striking the detonator through the bladder wall.

The compressed gas cylinder 180*d* seen in FIG. 80 can be located within the bladder. Its detonator can be radio frequency welded 189*d* to the inner bladder. A foam shelf 181*d* can protect the rear bladder wall from the cylinder. This foam can be housed 182*d* and secured to the bladder wall 183*d*. An opening 184*d* can be provided in the housing for inserting the foam. Incorporation of a desiccant reduces corrosion. The CO2 cylinder can be permanently attached at 186*d* to the detonator so that it will not become inoperable due to loosening. The superior bladder wall can also be protected from puncture by covering it with fabric 187*d*. The CO2 detonator can be actuated by squeezing or striking.

Figure 81:
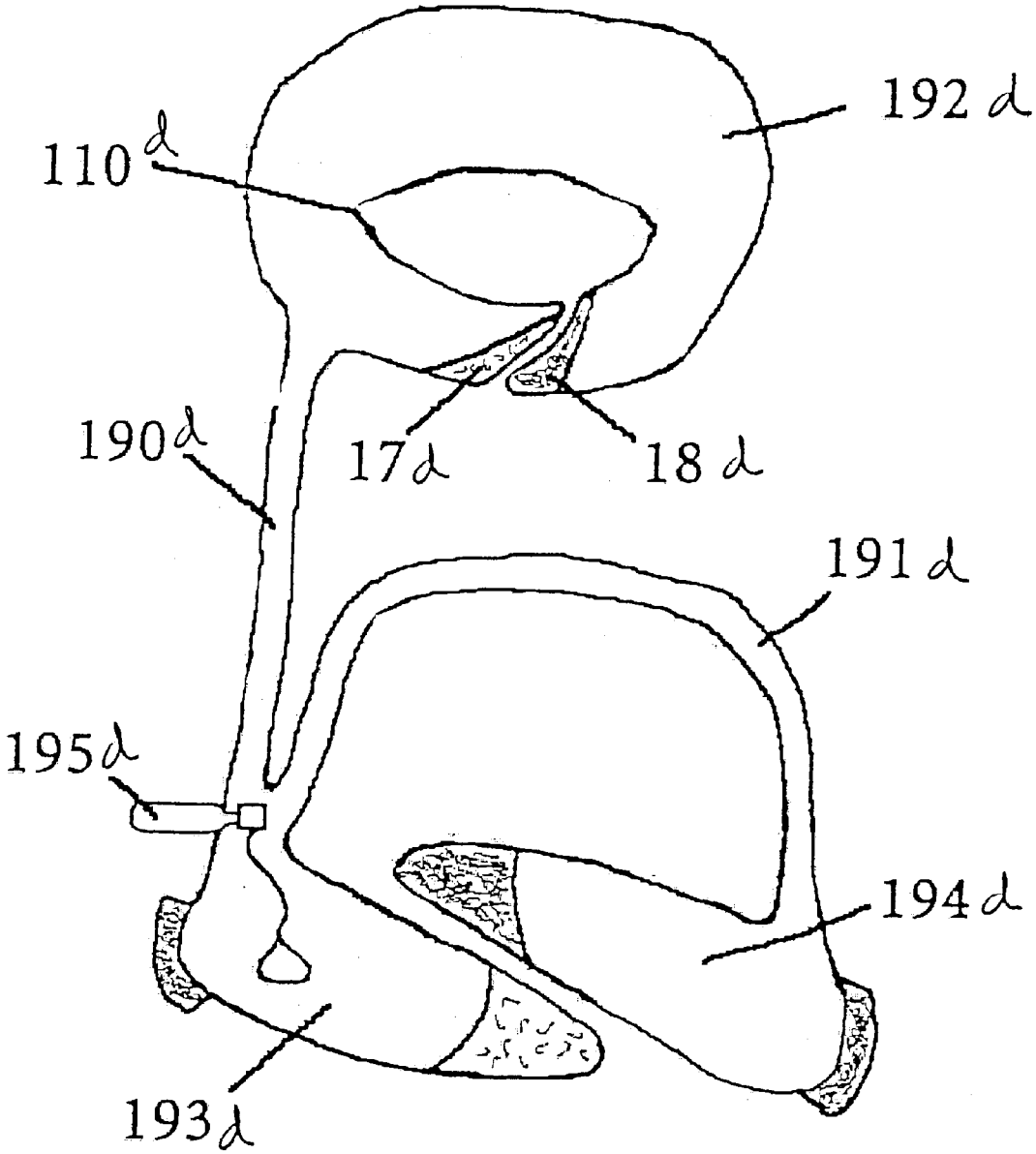
FIG. 81 is an anterior view illustrating an extremely low profile PFD to be stowed in the waistband of shorts or to be cosmetically invisible within boating garment such as a shirt.

In FIG. 81 a very low profile bladder allows use with the waistband of shorts or pants. The bilateral abdominal bladders 193*d* and 194*d* compress and lock in the midline. The attenuated abdominal bladders communicate through conduit 190*d* to the attenuated cervical collar 192*d*.

Certain advantages and/or features of the garment integrated multi-chambered embodiments shown in FIGS. 66 through 81 include, but are not limited to:

(1) A bladder whose volume can be varied as needed to supply a range of displacements; (2) A variable volume bladder which can be permanently attached; (3) A variable volume. bladder whose attachment can be varied prior to use; (4) A variable volume bladder whose attachment can be varied while in use; (5) A variable volume bladder whose attachment can be quickly released while in use; (6) A bladder whose volume can be varied as needed to supply a range of displacements; (7) A variable volume bladder which can be permanently attached to the underlying garment; (8) A variable volume bladder whose attachment to the underlying garment can be varied prior to use; (9) A variable volume bladder whose attachment to the underlying garment can be varied while in use; (10) A variable volume bladder whose attachment to the underlying garment can be quickly released while in use; (11) Variable volume abdominal bladder, which is configured to provide airway protection independently once, separated; (12) A variable volume; bladder contained within a pneumatically released stowage container capable of being reversibly affixed to the garment; (13) One or more buoyant bladders that have attachment means on both sides of bladder; (14) Bladder containment means having two or more complementary attachment means for securing said bladder in more than one position; (15) Multiple attachment points allowing the displacement volume of the bladder(s) to be decreased or increased according to need; (16) Distinct mobile eccentric buoyant bladder means; (17) Distinct mobile eccentric buoyant bladder attached to the inferior aspect of the primary displacement means; (18) Distinct mobile eccentric buoyant bladder attached to the superior aspect of the primary displacement means; (19) Distinct mobile eccentric buoyant bladders attached to the inferior and superior aspects of the primary displacement means; (20) Mobile eccentric buoyant bladders connected pneumatically to the main displacement bladder; (21) Mobile eccentric buoyant bladders connected pneumatically with check valve between the main displacement bladder; (22) Mobile eccentric buoyant bladders connected pneumatically with quick release check valve between the main displacement bladder; (23) Mobile eccentric bladder connected to garment; (24) Mobile eccentric bladder connected to bladder; (25) Mobile eccentric bladder connected to strain relief means; (26) High volume bladder connected to garment by functional arm so that it serves as mobile buoyant moment; (27) Self closing pneumatic inflatable collar; (28) Self locking pneumatic inflatable collar; (29) Quick release collar allowing separation from garment; (30) Sewable plastic piping and tightly conforming stiff plastic cord creating shear to prevent quick release means unintentionally activating; (31) Collar constructed from fabric coated on both sides allowing welding flanges to the surface for attaching fabric lock and attaching to container and or garment; (32) CO2 cylinder attached on posterior center as fixed midline ballast; (33) Mounting means for attaching ballast power supply midline; (34) Garment integrated multi-chambered PFD system in which one of the chambers is a raft; (35) Garment integrated multi-chambered PFD system in which one of the chambers is a raft inflated automatically upon sudden water entry; (36) Locking means for securing zipper pull to prevent separation of mounting zipper; (37) Locking means for securing zipper pull to prevent separation of mounting zipper using fabric loop attached to garment; (38) Locking means for securing zipper pull to prevent separation of mounting zipper using fabric loop constructed from excess zipper material; (39) Single chamber functioning as three chambers; (40) Bilateral abdominal chambers directed by fabric funnel to directional inflated towards midline; (41) Bilateral abdominal chambers that compress along the midline converting the two chambers into a functional single chamber; (42) Bilateral abdominal chambers stowed beneath pneumatically released covers; (43) Bilateral abdominal chambers in connection with self closing self locking pneumatic collar; (44) Triple layered chamber constructing two functional chambers allowing for a combination of low pressure and high-pressure chambers to increase net displacement above 16-gram standard cylinders; (45) Two functional chambers that share a wall in common connected by one way check valve; (46) Diagonal front entry allowing mechanical obstruction of neck opening such that downward pressure compresses fabric valve preventing shifts of the heads ballast; (47) High-pressure chamber leading to low pressure chamber where over pressure relief protection of both chambers is accomplished with a single pressure relief valve; (48) Single use PFD chamber in which the detonator and cylinder are permanently attached and sealed within bladder increased chances that all parts will be tight and present upon use; (49) PFD chamber containing desiccant; (50) PFD chamber with internal fabric means protecting both bladder walls; (51) Detonator welded to wall for support and localization; (52) Detonator activated by impact or compression; (53) Extremely low profile PFD bladder for cosmetic inclusion in routine clothing; and (54) Multiple self-closing and self-locking chambers optimize turning and surface position.

Parts List (FIGS. 66 through 81)

Manual Override CO2 Detonation Ripcord of Water Activated Collar Inflation System

1*d* Inflated inferior chamber means detached at along upper edge;

2*d* Inflated superior chamber means detached at along upper edge

3*d* Inferior mobile eccentric buoyant means

4*d* Superior mobile eccentric buoyant means

5*d* Complementary bladder container mounted attachment means configuring bladder for smallest volume

6*d* Complementary bladder container mounted attachment for configuring bladder for medium volume

7*d* Complementary bladder container mounted attachment means for configuring bladder for largest volume

8*d* Pliable connection means for inflation serving as flexible arm for mobile eccentric buoyant means

9*d* Check valve combined with quick release disconnect means

10*d* Compressed gas cylinder

11*d* Compressed gas cylinder detonation means

12*d* Optional water activated compressed gas cylinder detonation means

13*d* Ripcord for manual activation of compressed gas detonation means

14*d* Variable bladder mounting means

15*d* Superior pneumatically released bladder cover flap in the open position

16*d* Water activated compressed gas inflated self locking quick release collar

17*d* Welded tab allowing secure lateral attachment of pneumatically located and compressed interlocking fabric means

18*d* Left complementary automatic fabric lock

19*d* Right overlapping inflated arm means supplying cervical positioning means and mechanical lock means covered with complementary automatic fabric lock means

20*d* Ripcord for manual activation override of water activated detonation means for actuating inflation means

21*d* Pneumatically released inflatable collar containing flap in the open position

22*d* Remote illumination or signaling strobe connected to posterior fixed midline ballasting power supply

23*d* Quick release means for collar bladder integrated into quick release means for vest

24*d* Integrated harness and over sized lifting D-ring means for aerial extraction

25*d* Water or manually activated pneumatically released raft means integrated into garment

26*d* Variably sized and eccentrically located ballasting armament pockets

27*d* Garment

28*d* Sudden water entry victim

30*d* Inferior, structurally or functionally distinct or structurally and functionally continuous bladder configured to provide lowest profile lowest, volume lift bladder.

31*d* Superior, structurally or functionally distinct or structurally and functionally continuous bladder configured to provide lowest profile lowest, volume lift bladder.

32*d* Excess bladder inferior and superior fabric equivalent to the amount the inferior and superior bladders are reduced in volume by conjoint compression

33*d* Excess fabric equivalent to the amount the superior bladder is reduced in volume by close attachment of both inner and outer edges of bladder in closest configuration

34*d* Excess fabric equivalent to the amount the inferior bladder is reduced in volume by close attachment of both inner and outer edges of bladder in closest configuration

35*d* Outer edge of the superior bladder attached to bladder mounting means affixed to the garment

36*d* Outer edge of the inferior bladder attached to bladder mounting means admixed to the garment

37*d* Over pressure oral inflator valve

38*d* Oral inflation tube

40*d* Inferior bladder compressed along midline

41*d* Superior bladder compressed along midline

42*d* Outer edges of inferior and superior bladders joined to limit volume of buoyancy system

43*d* Excess fabric from inferior and superior bladder equivalent to the amount the inferior and superior bladders are reduced in volume by constrained conjoint compression

50*d* Inferior bladder partially constrained from maximum displacement by close attachment at base

51*d* Superior bladder partially constrained from maximum displacement by close attachment at base

52*d* Detached inner edge of superior bladder

53*d* Detached inner edge of inferior bladder

54*d* Closely contiguous base attachment of inferior bladder to base of superior bladder limiting inflation/displacement of bladder

55*d* Minimal midline compression of contiguous bladders

60*d* Inferior bladder fully inflated providing maximum displacement

61*d* Superior bladder fully inflated providing maximum displacement

63*d* Attached inner edges of inferior and superior bladders

64*d* Single attachment of superior bladder to mounting container means

70*d* Deflated and stowed inferior bladder

71*d* Deflated and stowed superior bladder

72*d* Pressure actuated bladder container release means

73*d* Deflate inferior mobile eccentric bladders means

74*d* Deflate superior mobile eccentric bladders means

75*d* Bladder stowed in protected position behind ballistics components of garment

76*d* Rigid armor protecting from rifle shot

77*d* Kevlar panel protecting from pistol shot

78*d* Inferior quick release means for mounting stowed variable volume and mobile eccentric buoyant bladders

79*d* Superior bladder quick release means for mounting stowed variable volume and mobile eccentric buoyant bladders to garment

80*d* Quick release pull ring

81*d* Quick release wires to ballistic vest shoulder release means

Figure 107:
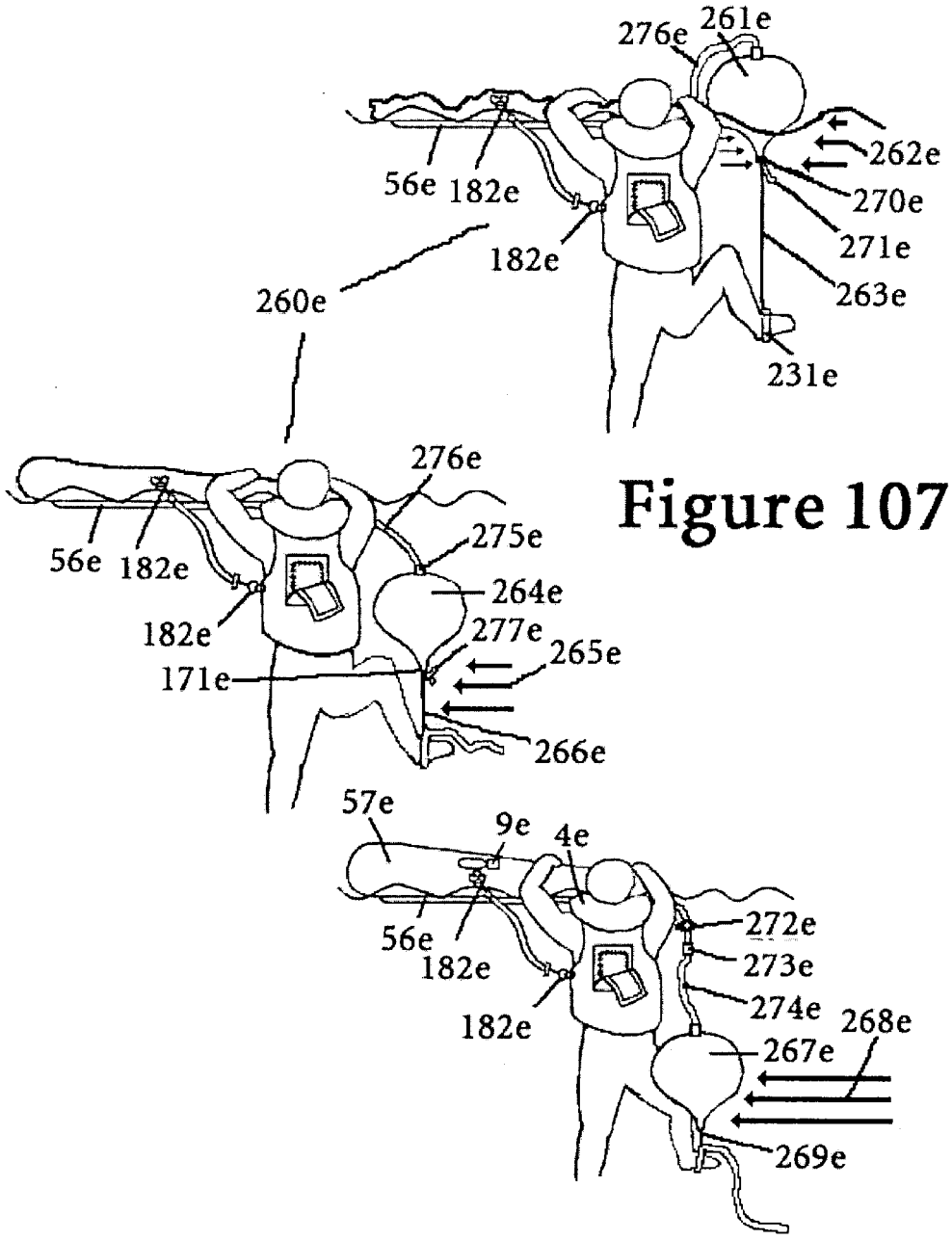
FIG. 107 is a composite sequence viewed from the side illustrating the role of the variable arm in changing the output pressure of the hydrostatic pump. Shortening the pump arm length results in the collector being exposed to increasing hydrostatic pressure conditions, a single cycle of which rapidly brings the raft to an optimal 2.5 psi well in excess of oral inflation, though such value is not considered limiting. Both hands are free for controlling the raft as it inflates in gusting wind and heavy seas. The raft can be packed with a long pump arm, which allows the leg to be used in optimal position for rapid installations of low-pressure air into the deflated raft. As the raft becomes fully inflated, the pump arm is shortened which forces the pumps collector to increased depths, bringing the raft up to the higher pressures associated with the structural rigidity of the life rafts perimeter tube. A rigid raft will not bend in the middle keeping the occupant from having to sit sloshing hypothermic water. The elongated conduit between the collector and raft allows the collector to be swung freely to assure the collector is fully inflated so that water exit is rapid.

82*d* Superior wire cable to quick release means for securing buoyant bladder to garment
83*d* Inferior wire cable to quick release means for securing buoyant bladder to garment
90*d* Superior garment attachment means integrated during construction allowing option of abdominal PFD
91*d* Superior PFD attachment means integrated during construction of variable bladder mounting means allowing option of abdominal PFD
92*d* Inferior garment attachment means integrated during construction allowing option of abdominal PFD
93*d* Inferior PFD attachment means integrated during construction of variable bladder mounting means allowing option of abdominal PFD
100*d* Superior permanent attachment means securing variable volume abdominal bladder to garment
101*d* Inferior perimeter of permanent attachment means securing variable volume abdominal bladder to garment
110*d* Acute angle on left side of neck opening sets degree of retraction of collar arm across throat of wearer
111*d* Acute angle on right side of neck opening sets degree of retraction of collar arm across throat of wearer
112*d* Angle of oral inflator such that conversion from 2 dimension into 3 dimension reorients oral inflator towards victim's mouth
113*d* Fabric coated with weldable film on both sides allows attachment of sewing tabs directly to collar
114*d* Sewing tab for lateral edge of fabric lock welded to surface of inflatable collar
115*d* Complementary hook fabric relocated and compressed upon inflation
116*d* Complementary loop fabric relocated and compressed upon inflation
120*d* Flange welded to inflatable PFD collar for securing to garment
121*d* Inflatable collar stowage cover
122*d* Collar's complementary quick release means
123*d* Posterior garment attachment means securing quick release cable to ballasted vest
124*d* Quick release cable
125*d* Anterior garment attachment locking means interfacing with vest quick release system
130*d* Cover flap containing raft
131*d* Pneumatically driven release means
132*d* Locking means reducing accidental deployment
133*d* Compressed gas cylinder water activated
140*d* Field locking means
141*d* Loop sewn to garment
142*d* Loop sewn from extra cloth at end of zipper
143*d* Zipper pull
144*d* Zipper locked in closed position
150*d* Left abdominal bladder
151*d* Midline compression of right and left abdominal bladders
152*d* Complementary pneumatically compressed fabric lock
153*d* Pocket cover flap
154*d* Portion of flap peeled back by expanded abdominal bladder
155*d* Complementary fabric lock formerly sealing pocket flap closed
156*d* Permanent stitching securing back half of pocket creating a funnel directing the expansion of the abdominal bladder toward the midline to compress the fabric lock
157*d* Ripcord
158*d* Compressed gas cylinder
159*d* conduit for transferring gas from cylinder to other chambers in low volume PFD
160*d* Compressed gas inflated self-closing and self-locking inflatable collar
161*d* Top layer coated on inferior or inner facing side
162*d* Middle layer, coated with weldable plastic on both superior and inferior sides
163*d* Bottom Layer coated on superior or inner facing side
164*d* Over pressure relief valve between top bladder and bottom bladder
165*d* Conduit connecting high pressure and low-pressure chambers
166*d* Bilateral abdominal bladder means
167*d* Complementary fabric lock elements such as hook and loop
168*d* Large Bore inflation tube with over pressure oral inflation valve
169*d* Small bore emergency back up oral inflator
170*d* External detonator either manual or water activated
171*d* Cylinder selected to either inflate only high-pressure chamber or high and low pressure
172*d* Bladder half of fabric lock for accurately securing bladder displacement means from migrating from operational position within garment upon impact
173*d* Combined oral inflation valve and over pressure relief valve for both the high and low-pressure chambers
174*d* Weld line separating high and low pressure bladders
175*d* Overlapping Midline Pneumatic Fabric Lock
176*d* Diagonal mechanical jam lock
180*d* CO2 Cylinder Retaining Sleeve
181*d* Compressible foam shelf elevates the cylinder and handle from the posterior bladder wall
182*d* Foam shelf housing
183*d* Foam shelf housing perimeter attachment means
184*d* Opening in foam shelf housing for inserting foam shelf and desiccant means
185*d* Desiccant mean
186*d* CO2 cylinder permanently affixed to detonator means
187*d* Fabric protector enveloping sharp detonator surfaces and edges
188*d* CO2 detonator handle actuated through bladder wall
189*d* RF Welded mount for detonator
190*d* Vertical conduit for expanding gas between abdominal and cervical displacement means
191*d* Circumferential waist conduit for expanding gas connecting bilateral abdominal bladders
192*d* Reduced size cervical collar
193*d* Reduced left abdominal bladder
194*d* Reduced right abdominal bladder
195*d* Water activated and manual activated CO2 detonator and cylinder assembly FIGS. 182 through 107 illustrate a reversible, cervical compression PFD preferably with complementary universally mounted, operation specific, field interchangeable, redundant rescue PFD and a utility transport craft, subsurface aerial and surface markings and equipment recovery bladder system.

The eccentric anterior cam shaped notch 1*e* prevents the self-closing arm from compressing the crico-thyroid cartilage. The cam shaped crico-thyroid notch 1*e* as demonstrated in the anterior mandibulo-thoracic bladder arm creates comfortable and complete cephalo-mandibular support. The absence of the second portion of the crico-thyroid notch indicated at 20*e* eliminates an aggravating protrusion without diminishing mandibular support. A more predictable symmetric shaped notch as indicated at 2*e* on the posterior side creates a protrusion that limits usefulness for larger diameter necks without providing any meaningful mandibular support for the side of the jaw opposite the tensioning angle 3*e*. The posterior crico-thyroid relief 3*e* reduces compression of the voice box when the collar is turned around as might be done for long distance swimming or when combined with an abdominal bladder as demonstrated at 55*e* in FIG. 85. The self-closing mandibular support arm of the life jacket shown in FIG. 82 depends upon the angular tension generated by acute angle 3*e* as the bladder inflates. As the bladder fills and pressure begins to increase the flexion angle 3*e*, at the side of the victim's neck develops mounting tension in the fabric. This tension pulls the arm across the midline, beneath the unconscious victim's mandible forcing the head up and back. Simultaneously posterior arm 4*e* acting under the tension generated by angle 3*e* swings closed behind the head of the unconscious victim. A front opening garment or ballistics vest 17*e* with tactical plate 10*e* in place may require that the larger anterior bladder be moved to the rear. In order to conserve that both bladder and jacket open from the same side the cervical bladder can be remounted upside down preferably utilizing reversible attachment means 11*e* to accomplish this conversion. With a side-opening vest the self-closing cervical compression can be simply rotated about the garment's neck opening and re-secured from the same inferior side.

Fold line 7*e* guides creation of a functionally distinct portion of the bladder indicated at 8*e*. It is shown more clearly in the deflated state from the backside as 37*e* in FIG. 84. Crease 38*e* in the bladder created by folding at 7*e* transiently loculates the rapidly released air upon manual or automatic detonation of compressed gas and inflator means 9*e*. The loculated deployment bladder 37*e* rapidly expands during compressed gas inflation further compressing the fold 38*e* focusing the initial expansion of bladder on the blow apart cover at the critical two-part break point shown as 39*e* and 40*e* of FIG. 84. Crease 38*e* created by folding at 7*e* keeps the gas from insinuating along the entire length where it would otherwise be capable of ripping under the heavy corduroy fabric cover Radio frequency welded or sewn complementary fabric locks 6*e* on opposing bladder arms can be adjusted by covering over the amount and location of exposed fabric lock by moveable complementary pieces 5*e*. By such adjustment the wearer before, donning can limit the extent the swing arms close, creating a large, medium or small neck opening. After the fabric lock 6*e* engages to arrest closure at a certain size, the lack then serves to secure the victim with the PFD.

To attain a low profile for the stowed cervical PFD, lightweight fabric can be used but due to the considerable forces generated by closing angle 3*e*, a strain relief sleeve 19*e* or cover can be provided to dissipate some of the force to increase durability. Alternatively, over-pressure relief valve 16*e* can be provided to protect an orally inflated bladder from the destructive pressures generated by inadvertent detonation of compressed gas within a bladder that is already fully inflated. A compressive over pressure valve cap 13*e* prevents air from entering a deflated bladder during the manipulations that generate a vacuum as occurs during storage. This cap must be capable of being automatically blown off by the force generated upon relief of the over pressure valve. Cap 13*e* keeps out debris as well as air.

When used with ballistics vests carrying 30 lbs. of ballast in the form of tactical plates 10*e*, the high displacement anterior portion of the cervical collar can be optionally connected by strap means 12*e* through quick release buckle 18*e* to the lower part of the garment transferring a portion of the buoyant force toward the victim's waist for improved comfort and body angle.

Figure 91:
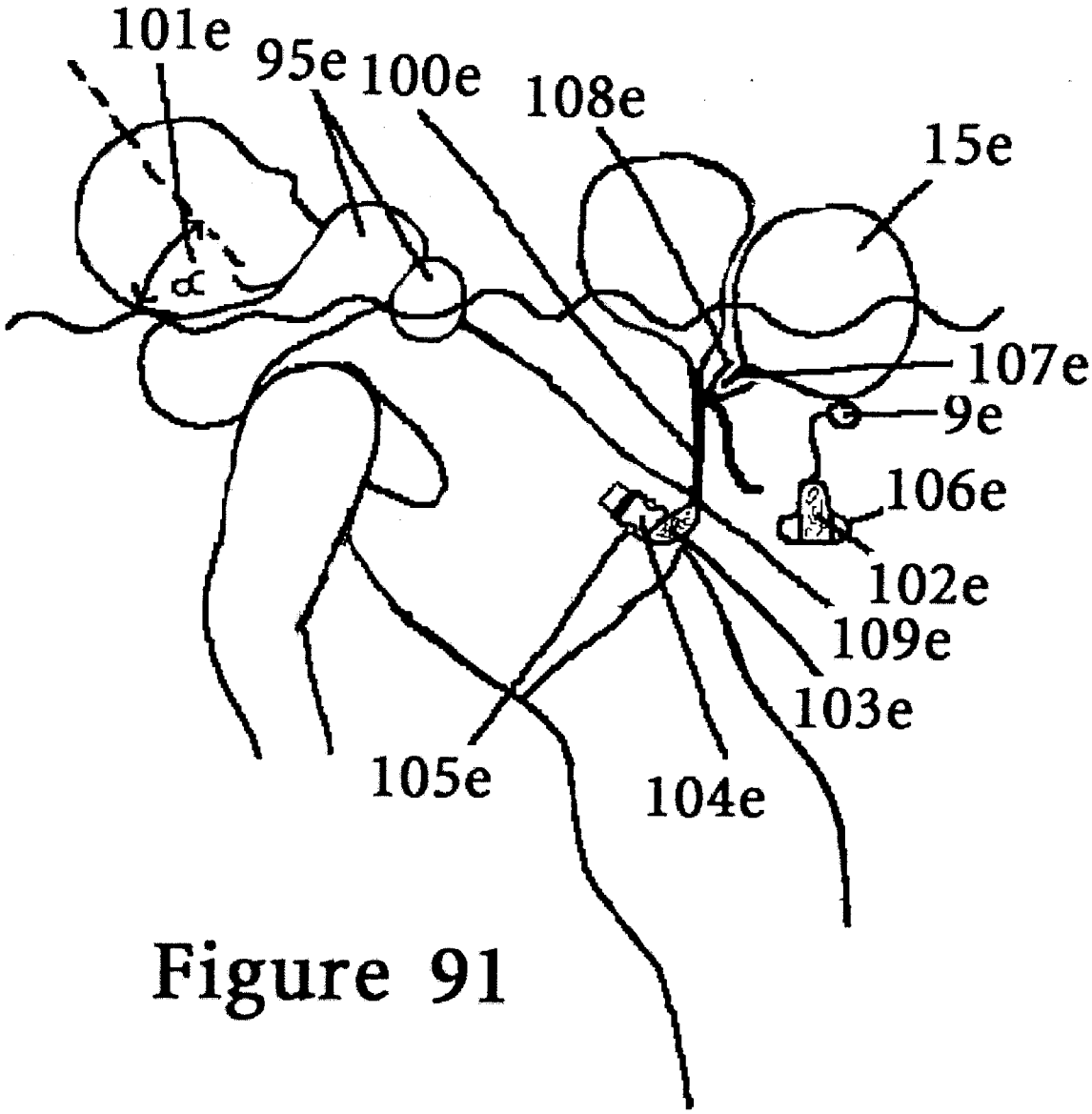
FIG. 91 is a lateral view illustrating how the abdominal bladder's body angle arm places the victim within a mandated range. A dual abdominal handle allows independent or concurrent operation of the bladder inflation ripcord and/or the quick-release locking bladder mounting means. Simultaneous single-handed use of both handles allows the abdominal bladder to be removed and deflated and accurately tossed as a high-density rescue product/PFD.

An optional abdominal bladder 15*e* can be manually inflated by pulling apart the two-part handle 14*e* if the victim desires increased freeboard. The two-part handle as detailed in FIG. 91 shows the independent operation of two-part handle 14*e*. The manual inflation rip cord 106*e* is shown pulled off the quick release locking portion of handle 104*e* which can remain secured to the garment by its complement 105*e*. If there is a need for an emergency rescue device, quick release of locking handle 104*e* from its garment mounted component 105*e* allows simultaneous manipulation of 106*e* which is mounted by way of reversible locking means 102*e* upon complementary locking means 103*e* found on handle 104*e*. Simultaneous operation 104*e* and 106*e* allows the abdominal bladder to be quickly removed deflated so that it can be tossed to a distressed victim where upon water automatically initiates inflation. Alternatively, the removed abdominal bladder 15*e* can be inflated for use as a redundant PFD such as 51*e* shown in FIG. 85.

Figure 83:
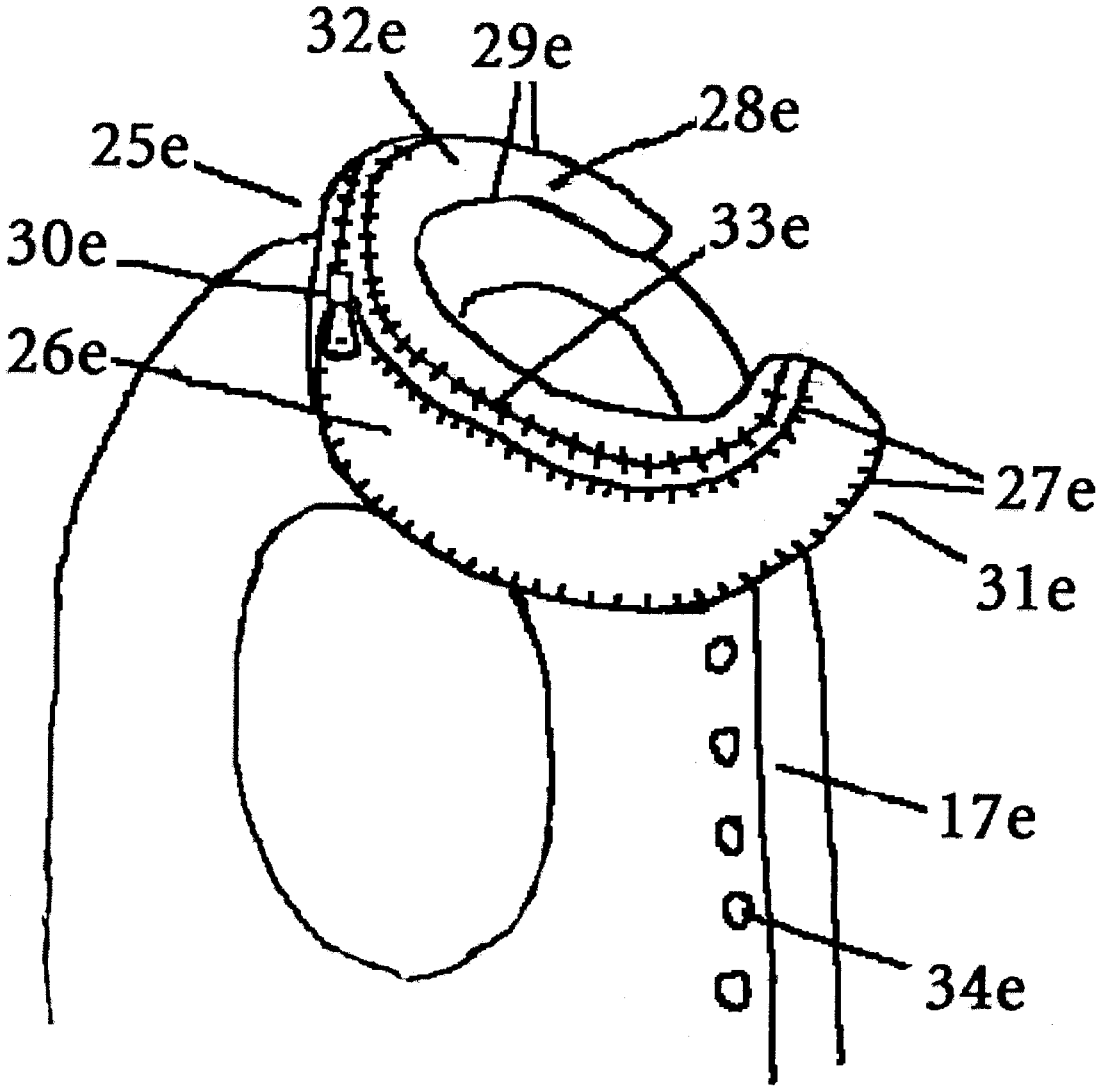
FIG. 83 is a superior lateral view illustrating a dual zipper container that allows the bulky bladder to be first quickly enclosed with a high volume cover by a blow apart zipper. Secondary the bladder and cover can be compressed to a very low profile, final volume by a non-blow-apart high strength compression zipper.

As seen in FIG. 83 number 25*e* generally indicates a two-step inflatable bladder compression system for reducing the initial high volume 31*e* to its lowest profile size shown as 32*e*. The dual closure cover is comprised of a primary reversible pressure actuated release means 33*e* combined with secondary high compression closure means 30*e*. Together the dual closure cover allows the easy and quick high compression storage, which results in a very low profile appearance 32*e*. A low profile PFD 32*e* is cooler, more comfortable resulting in increased compliance improving the ultimate goal of a life jacket to be worn before it is needed to prevent drowning from unexpected water entry. After the bladder is deflated and the blow apart zipper 33*e* is first opened then closed the bladder is loosely contained within the high volume cover means 31*e*. As the second closure means 30*e* is closed the light weight vertical wall 26*e* which connects identical length superior and inferior circumferential complementary closure means 27*e* is enclosed within the cover and the internal volume is drastically reduced from the initially high volume enclosure indicated at 31*e* to the low volume enclosure indicated at 32*e*. The percent reduction in internal volume is limited only by the stiffness of the bladder material. It is notable that the superior face 28*e* has internal and external circumferences that differ markedly and thus cannot be reduced by a compression zipper as can a vertical wall like 26*e* which has identical lengths at top and bottom as indicated at 27*e*. The pressures generated by this two step process are incompatible with prior blow apart designs because the tension generated in the wall exceeds the fabric break point previously used as the site for initial rupture of the blow apart zipper 33*e*. This collar can be mounted upon a center opening garment 17*e* closed at the midline by fasteners 34*e*.

Figure 84:
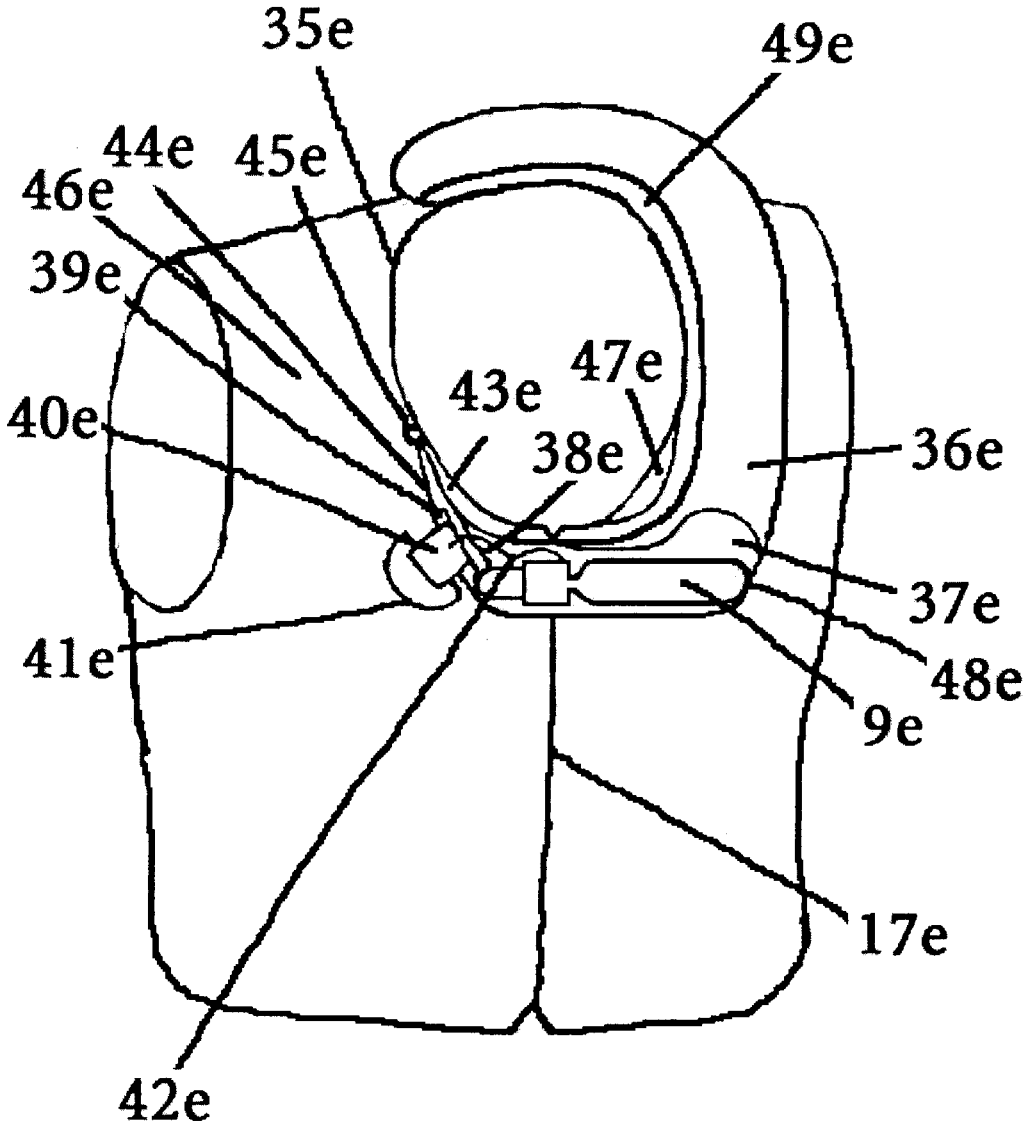
FIG. 84 is an anterior view illustrating a preferred mechanism for achieving the focused localized expansion of a functionally located bladder required to blow apart the cover's reversible break point, which then allows the blow apart zipper to begin to open, which sequentially leads to the rapid deployment of the high-torque high volume PFD from within its tightly compressed stowage state.

FIG. 84 shows a novel system for keeping the high-tension cover from accidentally opening secondary to the cover fabric tension generated by the compression means 30*e* of FIG. 83. The primary portion of the inflatable collar 36*e* is covered by a portion of the collar 37*e* folded back on itself at fold line 38*e*. Crease 38*e* functionally separates the small detonation bladder 37*e*, which is the first recipient of the rapidly expanding compressed gas. Inflation mechanism 9*e* is either manually activated by pulling D-ring 41*e* which separates a double sided fabric lock plug 40*e* from its position of closing the end by adhering to complementary locking means 39*e* built into the cover. The force applied to the D-Ring continues along ripcord 42*e* until it pulls on the lever arm of 9*e* piercing the compressed gas cylinder. As the air rapidly enters 37*e* it is momentarily contained by the fold at 38*e*. The entrapped air rapidly expands 37*e*, which stretches the opening of the cover breakpoint comprise of complementary fabric lock 39*e* and 40*e*. Upon opening of the break point the blow apart zipper begins to open in response to the swelling bladder. Likewise water or hydrostatic activation of 9*e* results in localized expansion of the cover, which leads to release of the tension under arrest by the blow apart zipper 33*e* seen in FIG. 83. Of note is the placement of the Velcro break point at an angle 38*e* to the blow apart zipper 33*e*. The tension across the diameter of the cover is less than the tension contained within the fabric around the circumference. Traditionally the Velcro was placed side by side with the blow apart zipper but the tension generated by the dual zipper closure of FIG. 83 exceeds the tear strength of the Velcro leading to unintentional premature release of the bladder from its cover. The break point is also leveraged over the end of the compressed gas system giving it a mechanical advantage in controlling the tension found along the sides of the cover. If the same amount of Velcro was located along the sidewall of the cover the tension in the cover is sufficient to open it without the need for additional pneumatic force from the wateractivated puncture of the compressed gas cylinder. The need for considerable airway protective buoyancy sufficient to raise the soldier carrying 30 lbs. of ballast and the need to keep the gun butt area of the vest 44*e* clear of bulky additions requires that the large anterior bladder 36*e* and 37*e* be stowed across the midline-opening vest 17*e*. To prevent the anterior bladder from inflating along side the unconscious victim's neck a midline crossing swing arm attachment flange 43*e* is reversible secured by locking means 45*e*. To further reduce intrusion of the PFD into the zone where the rifle is shouldered, the cover and its contents are angled away from the gun butt zone 44*e*. This angle allows more ergonomic force to be applied to D-ring 41*e*. Further facilitating the need to shift the bulk to the left side the cover is extended at 48*e* creating a portion of the cover at 47*e* that is devoid of stowed bladder contents.

Figure 85:
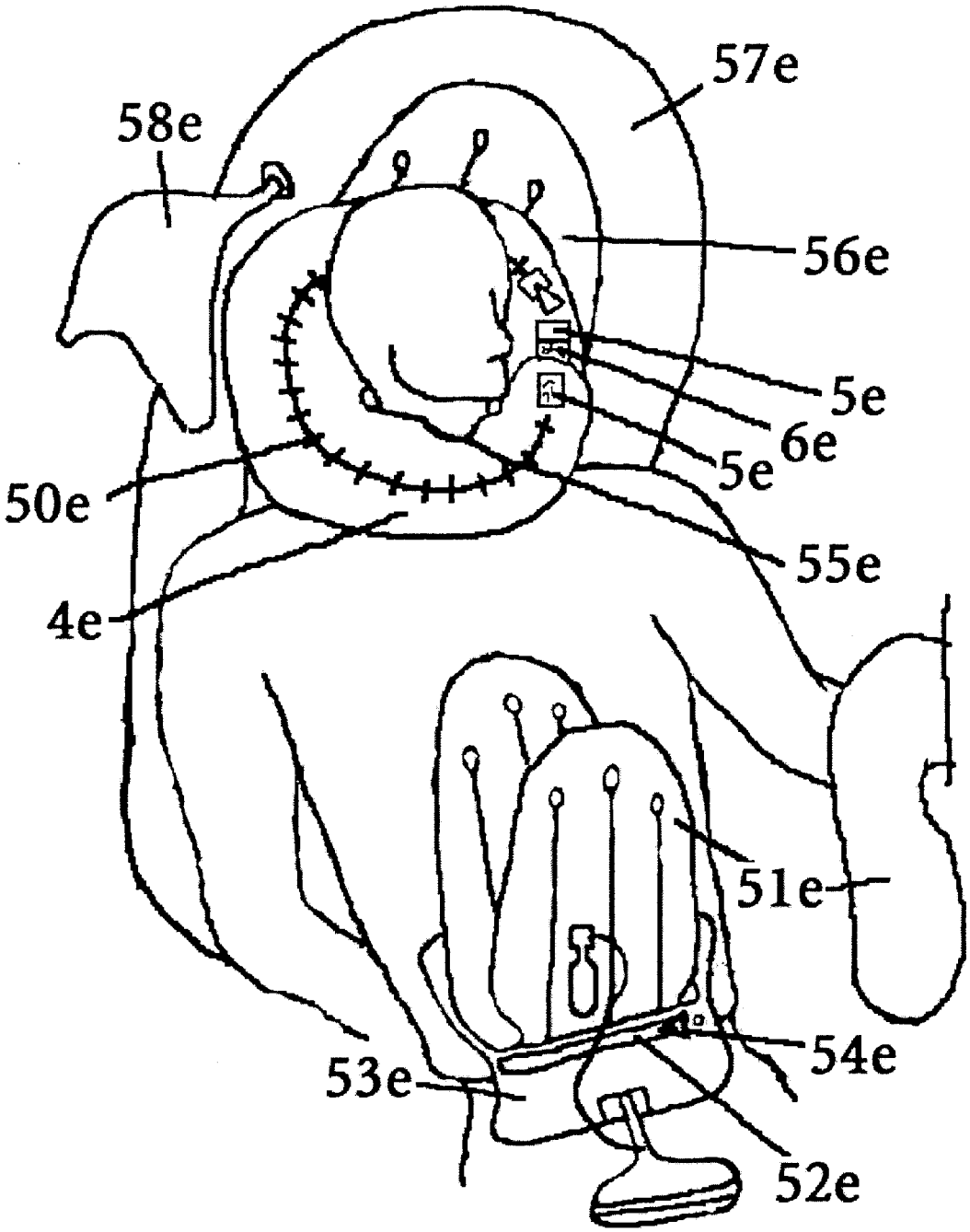
FIG. 85 is a three quarter frontal view illustrating posterior-anterior reversal of the cervical collar buoyancy moment to offset the buoyancy of an abdominal bladder. A two sided reversible collar mounting system allows the displacement bladder to be interchanged in field while keeping the gun butt zone free of intrusive bulk, thus, allowing the wearer to make adjustments to meet the immediate needs for rescue of self, self and equipment, rescue of another and or for the marking and recovery of valued gear.

While the cervical collar is designed to utilize the largest ⅜ inch diameter neck CO2 cylinder and is capable of providing corrective turning action to an unconscious victim wearing 30 lbs. of armor protection and gear as might be worn on a recognizance mission the concurrent attachment of additional gear may require supplemental displacement 51*e* as shown in FIG. 85. A variety of abdominal bladder configurations can be selected to match the needs of a specific operation. Universal bladder mounting means 54*e* built into the bladder cover allows quick exchange between redundant PFD and utility float. Either bladder is released upon detonation of the compressed gas cylinder by pneumatically released cover flap 53*e*. Any bladder mounted on the universal bladder mount means 54*e* can be set to deploy manually, upon contact with water or upon submersion to a particular depth as would occur only if the collar's buoyancy was overwhelmed by excessive attached ballast. Concurrent use of an abdominal bladder is enhanced by reversal of the cervical collar. What is nominally called the posterior arm 4*e* is now moved into the anterior position by releasing reversible attachment means 50*e* and remounting with attachment means 2*e* shown in FIG. 82. The posterior crico-thyroid notch now the anterior crico-thyroid notch 55*e* as shown in FIG. 85 is now in the active position where it allows the compression collar to secure the head and neck in the axis of airway protective rotation without inadvertently choking the wearer's airway. In the event of continued submersion and increasing hydrostatic pressure the posterior bladder is finally released automatically once the victim passes a certain depth by inflating the high-pressure raft floor 56*e*. The low-pressure but high volume raft perimeter tube 57*e* can be inflated with the windsock 58*e*, or orally.

Figure 82:
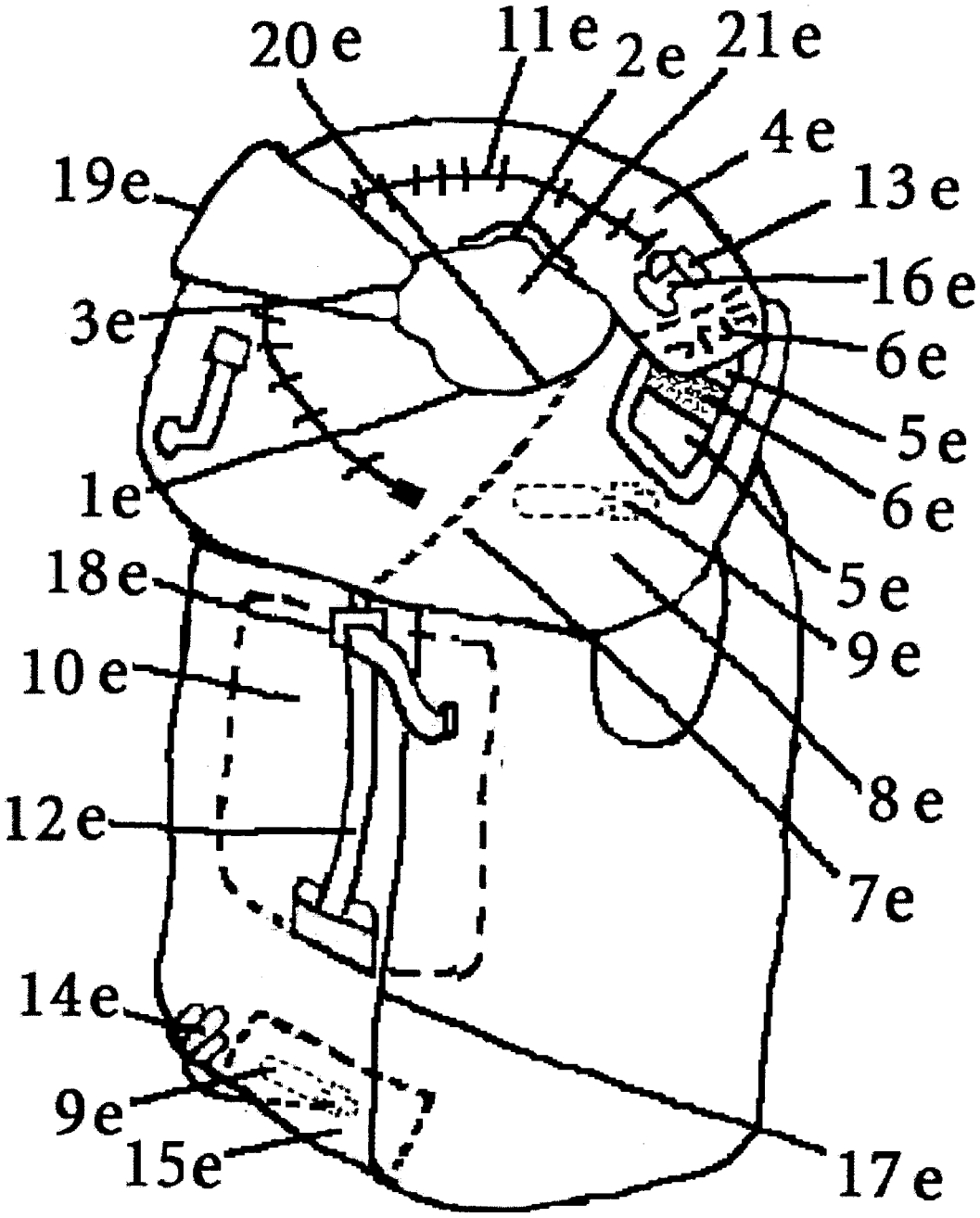
FIG. 82 is a three-quarter frontal view illustrating a cephalo-mandibular supportive life jacket with crico-thyroid protective enclosure. The life jacket can be high torque and can include the following characteristics adjustable diameter neck opening, midline crossing, self-closing, posterior-anterior reversible, self-locking, cervical compression. Integrated high-torque secondary abdominal bladder can also be provided and functions as a quick release redundant life jacket, or water activated throw-able rescue inflatable/PFD.
Figure 86:
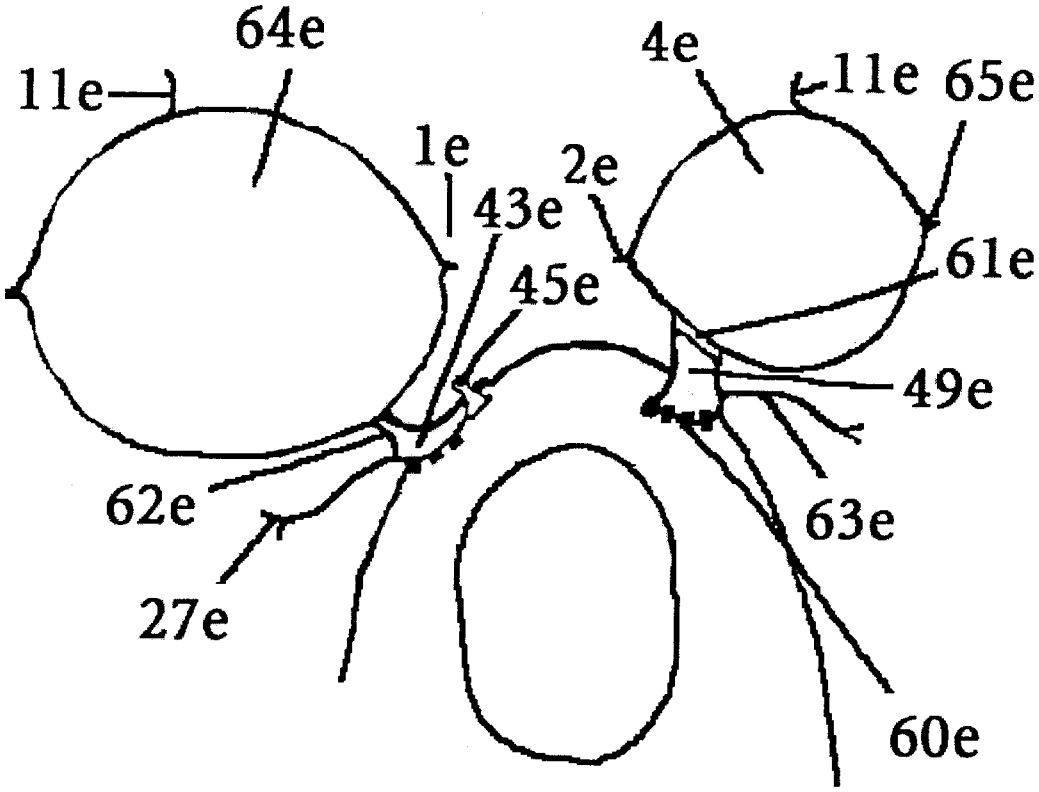
FIG. 86 is a left lateral view illustrating inferior and superior flanges secured to a bladder. A garment specific neck diameter reducing-tensioning sleeve adapts the larger diameter of the garment neck opening to the smaller diameter of the PFD collar. The flange concurrently applies the buoyant force generated by the bladder to the garment. For specific garments such as ballistics vests the shoulder must remain free of bulky intrusion in order to shoulder the rifle. In such instance the flange can provide a third function, allowing the deflated collar to be pulled aside during storage but upon inflation as the bladder swells the flange tenses and pulls the bladder across the midline beneath the mandible. For the victim at risk of drowning airway protection is as important as the unimpeded ability to shoot.

As shown in FIG. 86 a semi-closed sleeve 49*e* connects the three dimensional larger garment neck opening 35*e* as shown in FIG. 84 to the smaller cephalomandibular support collar opening 21*e* shown in FIG. 82. Either the inferior reversible connection means 60*e* or the superior reversible connection means 11*e* transfer the buoyant force generated by the anterior bladder arm 64*e* and posterior bladder arm 4*e* to the garment and thus onto the victim's torso. Pneumatically release closure means 27*e* secures exteriorlstowage cover 63*e* about the bladder when in the stowed position. Swing arm flange 49*e* is attached to flange 61*e* welded directly to laminate coated outside of the collar. Anterior aspect of the size reduction tension coupling sleeve 62*e* tapers into the midline cross over flange 43*e*. Crossover flange 43*e* is reversibly secured to the garment at 45*e*. Neither the anterior or posterior weld seam 65*e* are reasonable sites for securing the bladder displacement force to the garment. The ideal sleeve attachment site is at the bottom of the bladder as identified at 61*e*.

Figure 87:
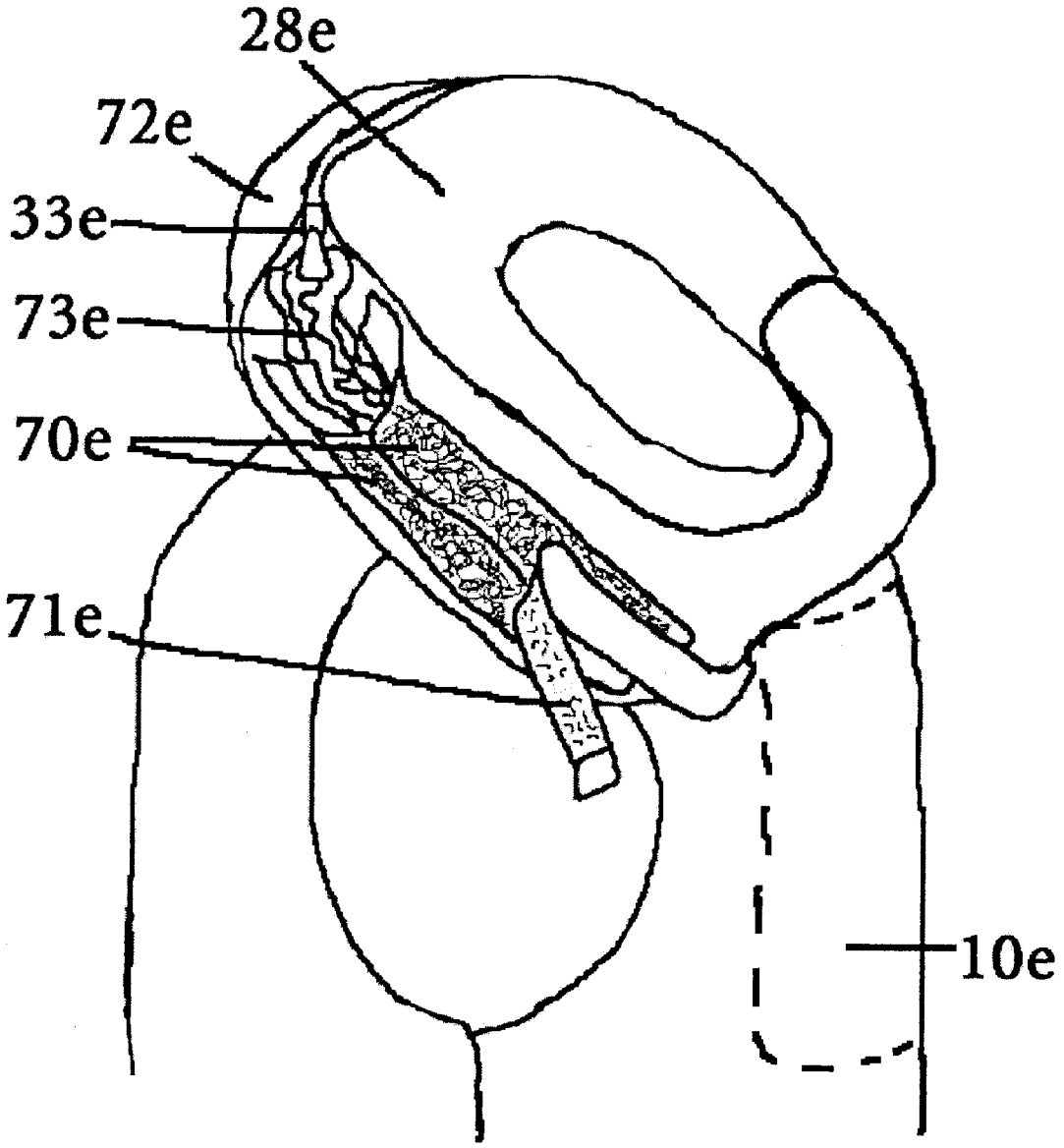
FIG. 87 is a three-quarter right lateral view illustrating an alternative bladder compression means to facilitate the compression of the bladder before closure of the pneumatic released cover means

Airway protective benefit only accrues with increased compliance which is enhanced by the provision of improvements in ease of packing a low profile stowed PFD as demonstrated in FIG. 87. A Velcro sleeve 70*e* can be temporarily held closed by complementary fabric lock 71*e* retaining the compressed bladder 73*e* while pneumatically released closure means 33*e* is closed opposing the forward cover 28*e* and rear cover 72*e*. It is critical that the temporary closure means be removed as the final closure is made. This is assured by the impossibility of final closure of 33*e* until fabric lock 71*e* is out of the way.

Figure 88:
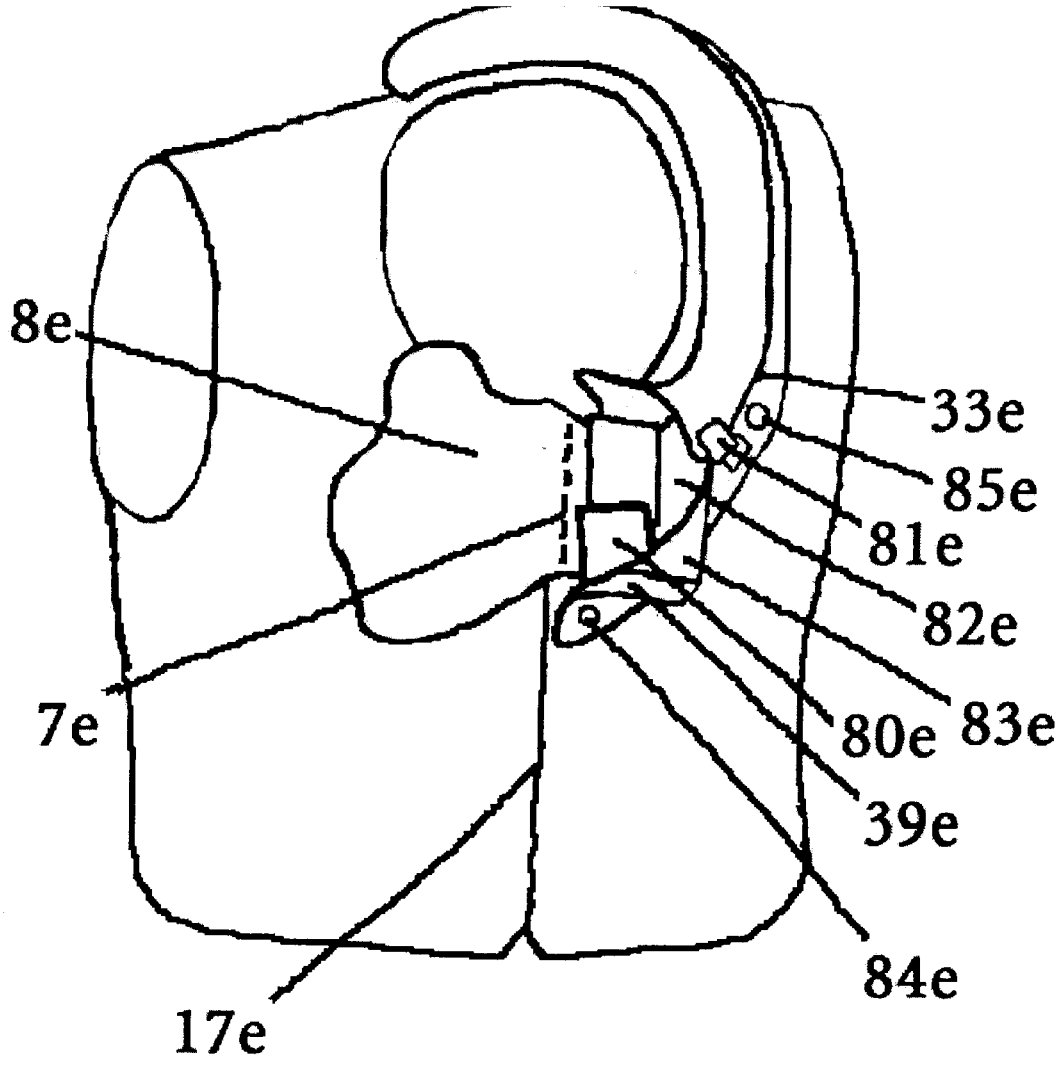
FIG. 88 is an anterior view of a three-step blow apart containment means to control the sequence of inflation. First the loculated chamber is rapidly inflated localizing its expansive force on the break point opening of the cover. Once opened the loculated bladder is preferably constricted by a secondary blow apart means within the cover that creates the pivot point for the loculated bladders defining crease. The volume then pressure continue to develop increasing loculated bladders rigidity, which forces the unsupported bladder to cross the midline. A third blow apart restriction out side the cover assures that the bladder is beneath the mandible and across the midline before gas proceeds to inflate the balance of the PFD. Such directed deployment reduces the need for mechanical crossover means constricting the garments frontal neck opening particularly for low to medium torque PFDs.
Figure 89:
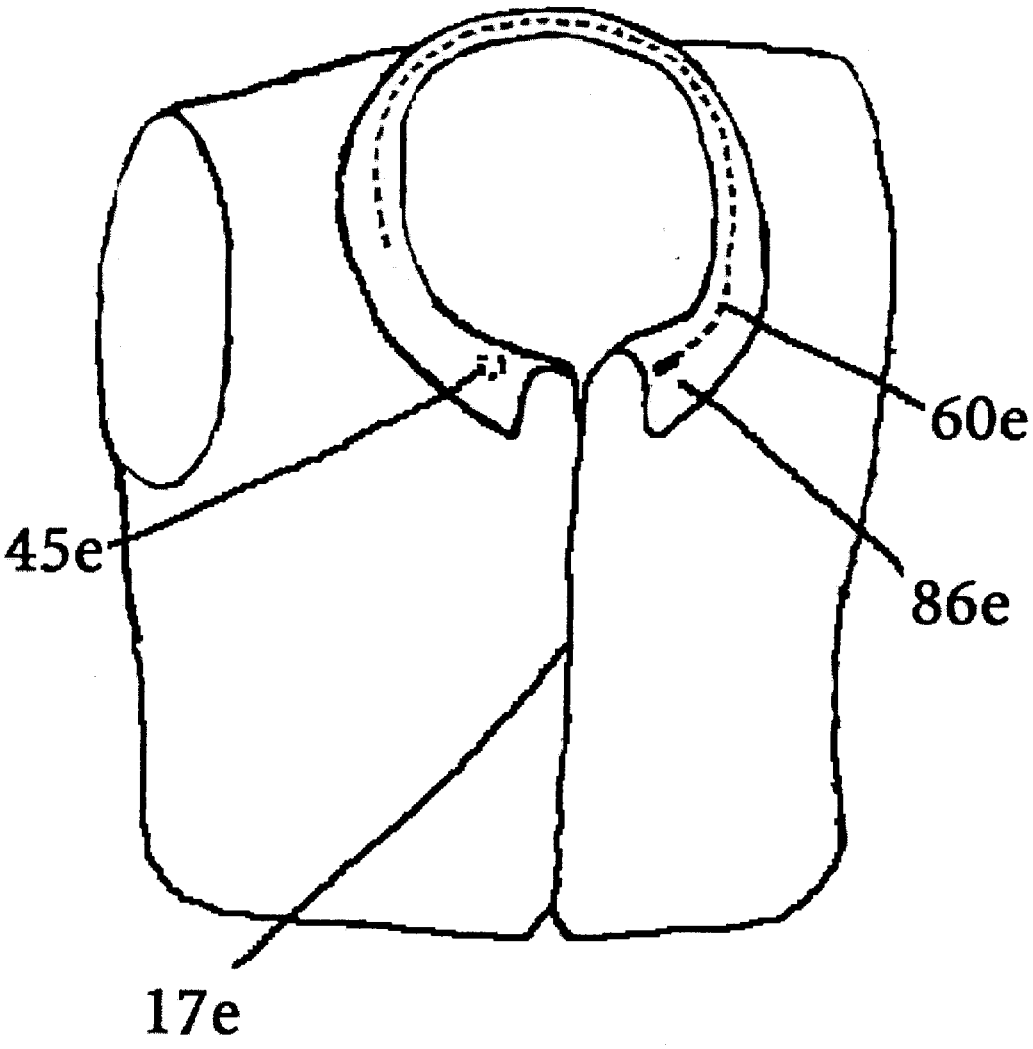
FIG. 89 is an anterior view of a garment illustrating an external universal bladder cover mounting means. Reversible attachment of the bladder and cover allows the garment to be readily converted into a life jacket when the garment is going to be worn on or near the water yet easily removed for land use, cleaning of the garment, bladder maintenance, repair or replacement, etc. A single large midline-crossing bladder requires a cross over flange attachment means to assure the bladder deploys in front rather than beside the head of the unconscious wearer.

For the wearer not carrying considerable ballistic a smaller mandibulo-thoracic bladder is sufficient for corrective turning. This smaller bladder is less likely to inflate along the side of the neck if it can unfold and develop pressure before the cover opens completely as shown in FIG. 88. The loculated bladder 8*e* created by folding back along guideline 7*e* is still responsible for opening the break point. The introduction of a secondary blow apart restriction 80*e* encourages loculated bladder 8*e* to continue filling before sufficient pressure is generate to bow apart the restriction and expand deflated portion 82*e*. The initial opening as evidenced by splayed cover 83*e* is arrested from opening any further by a tertiary blow apart restriction 81*e* restricts the blow apart zipper from opening until pressure is generated in loculated bladder 8*e*. With a tightly compressed cover a water intrusion system is critical to assure the automatic water inflation means gains access to water so that inflation creates the corrective turning action within the allotted 5 seconds. Inferior vent 84*e* is located beneath superior vent 85*e* so that trapped air has a clear route of escape around the tightly compressed, coated fabric. Large vents become a potential means of egress through which the bladder attempts to deploy during high-pressure inflation.

The garment integrated PFD mounting means 60*e* demonstrated on the body armor vest in FIG. 86 allows the PFD to be removed when the ballistics vest is used in the desert. In the recreational garment shown in FIG. 89, the reversible PFD mounting means 60*e* can be hidden beneath the garment's collar, as would be the attached highly compressed PFD. The same PFD can be removed so it can be used with either a heavy weather coat or raincoat or windbreaker.

For the non-military user they are unlikely to attach 20 to 30 lbs. of solid ballistics plates and so their displacement needs are left. If the gun butt zone does not need to be kept clear the cephalo-mandibular collar can be evenly distributed on both sides. As shown in FIG. 90 the cross over arms 95*e* can minimized to those sufficient to support the chin and head in an upright position. With greatly reduced cross over arms such as 95*e* defective deployment along the side of the neck is prevented. Bilateral cross over arms 95*e* depend upon flexion angles 3*e* and 90*e* on both sides of the neck to generate the fabric tension required to close the arms beneath the mandible in front of the throat. Mirror image eccentric crico-thyroid notches 1*e* and 91*e* protect the voice box from compression by either arm. In addition to smaller bladder requirements because of the lack of 30 lbs. of attached ballast, the use of fabric coated on both sides can be replaced by fabric only coated on the inside that reduces the weight and stiffness of the fabric preferably by 3 ounces per yard, though such number is not considered limiting. The need for attaching a component of the self locking fabric to the top of the bladder can be accomplished by through sewing the fabric lock 94*e* then welding 92*e* a laminate patch on the inside. The presence of bladder on both sides of the mouth 95*e* allows the use of a combined oral inflation 93*e* over pressure valve 99*e* on the side opposite the side where inflation is initiated. The orientation of the compression zipper 30*e* away from the site of inflation milks any residual entrapped air to the opposite side where it can be vented as the next to last step prior to completely closing compression zipper 30*e*. To keep the bulk of the collar PFD to an aesthetically acceptable minimum the bulk and rigidity of the cylinder and inflator can be remotely mounted 98*e*. A special coupler and conduit 96*e* connects the compressed gas to the loculated bladder 8*e* created by folding at indicator line 7*e* at connector 97*e*.

As shown in FIG. 91 the body plane angle 101*e* is measured between the spinal axis of the body and the water surface is mandated by Federal regulatory agencies. The length of the suspension arm 100*e* which suspends the body of the flaccid victim from the abdominal bladder 15*e* at the required distance beneath the water establishes the mandated body angle. The two part handle 14*e* shown in FIG. 82 is separated into the compressed gas handle 106*e* which was attached by reversible locking means 102*e* previously attached complementary locking means 103*e* located on the quick-releasable handle 104*e*. The garment mounted quick release locking handle 105*e* is permanently attached to the garment. The releasable component 104*e* is attached via a lanyard to the abdominal bladder 15*e* mounting means 109*e* attached along the inferior edge of the garment. Simultaneous operation of both the quick release abdominal bladder mounting handle 104*e* and the compressed gas manual ripcord 106*e* it allows the deflated bladder to be quickly removed with a single hand. Once removed the deflated abdominal bladder is very dense and so can be accurately thrown a considerable distance as a rescue product to assist a distressed victim. Immediately upon landing the water inflates the PFD for use as a float. The right ventral arm is attached via interlocking member 107*e* to the left ventral arm prefereably by 'alligator jaws' 108*e*, release of 107*e* from 108*e* converts the float into a Life Jacket. Alternatively the abdominal bladder can be orally inflated then used as a stand alone back up Life Jacket.

Figure 92:
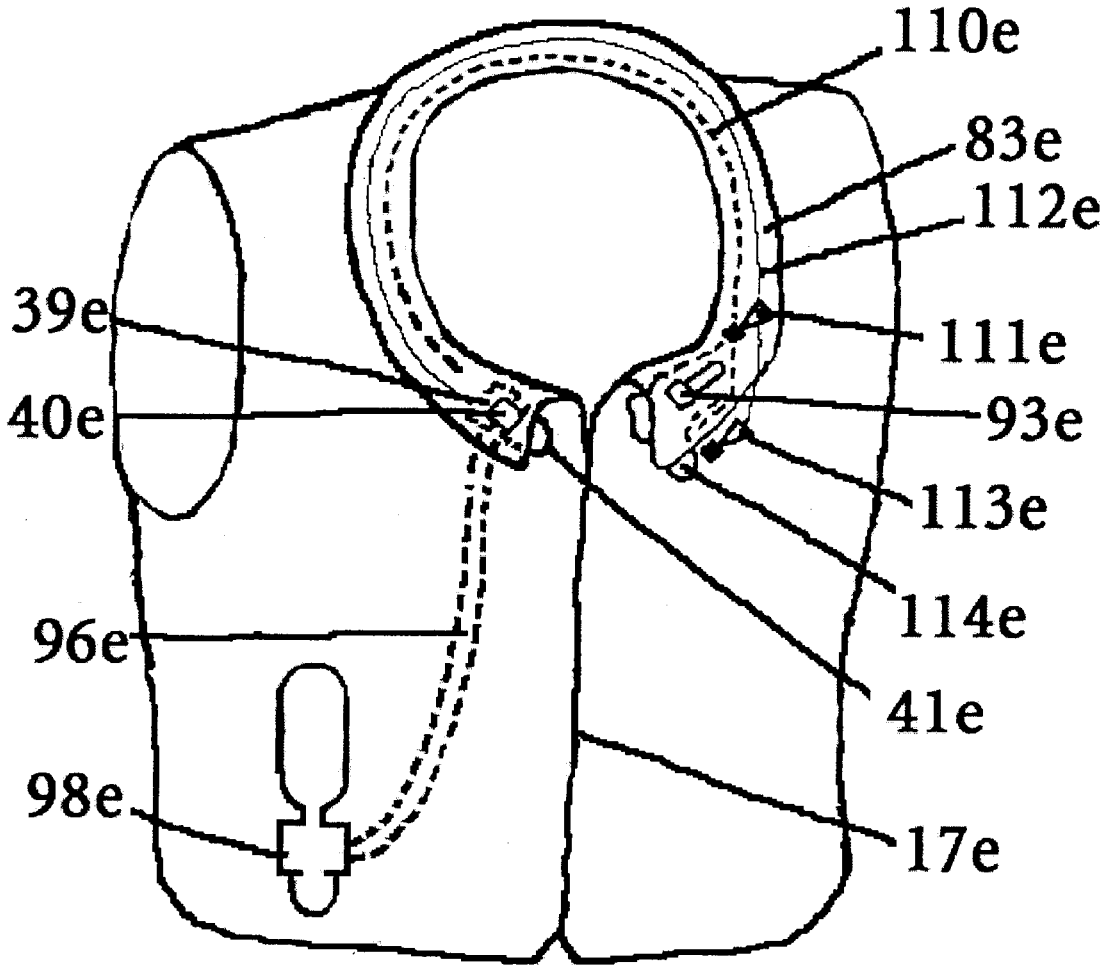
FIG. 92 is an anterior view illustrating garment integrated dual zipper compression of a bilateral midline crossing PFD. Preferably remote compressed gas means removes rigid bulk from the low profile recreational collar. The remote inflator can be immersed before the head and neck and submerges more deeply for improved hydrostatic activation or water saturation of the water activated inflators, thus, leading to decreased time for airway protective corrective turning. Bladder deflation vent for evacuating air from bladder can be on the side opposite from entry of the compressed gas. The compression zipper can operate in the direction from the compressed gas side or the side of the covers blowout break point towards the bladder vent side forcing any residual air towards then out the vent. Complete removal of any residual air is preferred, as any residual air may prevent compact stowage.
Figure 93:
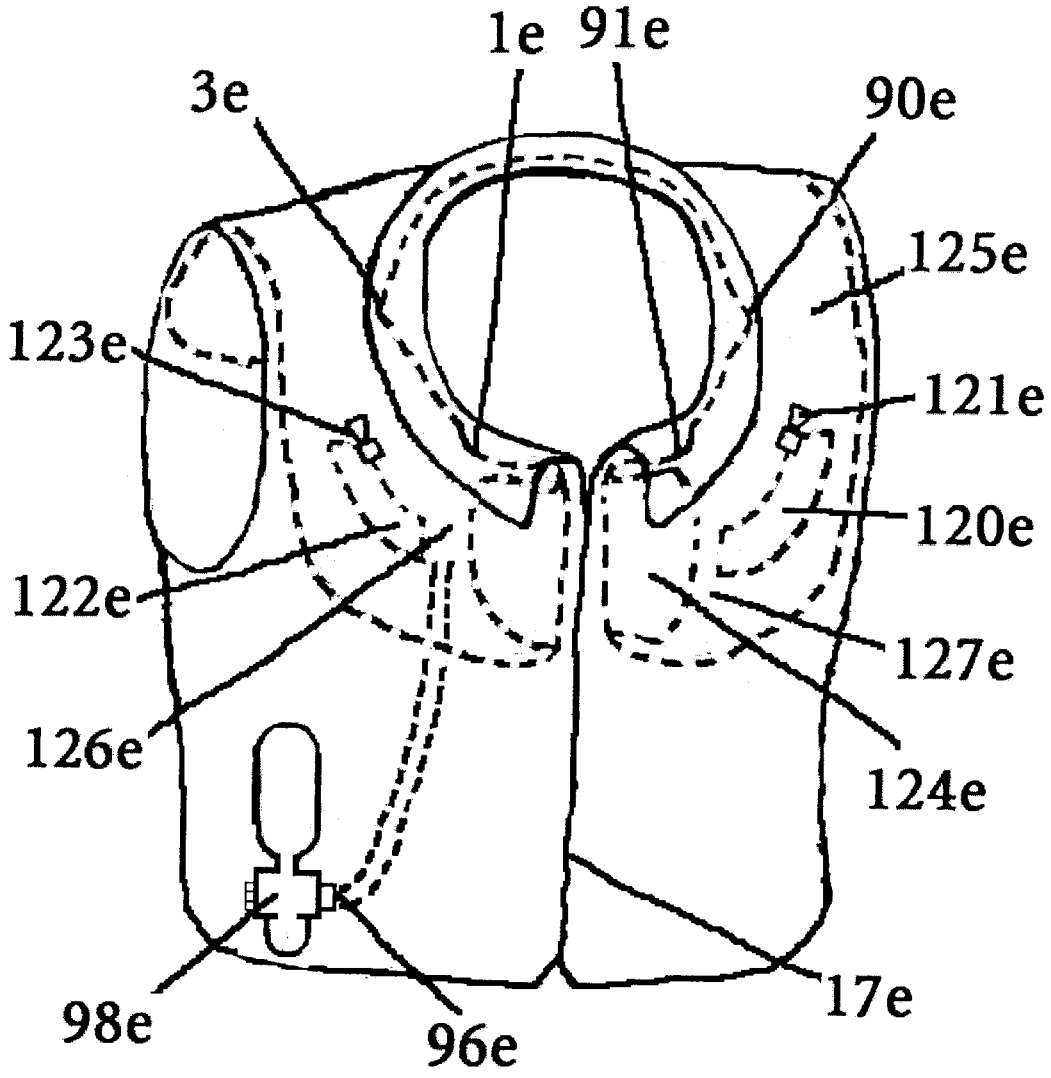
FIG. 93 is an anterior view illustrating a recreational jacket with an inner and outer shell that contains a deflated bladder that lies loosely within the garment. The bladder neck opening can be considerably smaller than the garment, such that it can flare out to allow it to fit within the garment with its preferred much larger neck opening. The bladder can be Mounted on bilateral swing arms connecting the smaller bladder to the larger garment. On inflation the swing arms can allow the bladder to swing up towards the neck and cross midline if a blow-out means is incorporated in the garment midline. Otherwise the bladders arms can compress at the midline. Both designs create the critical mandibular and cephalic shelf in order to hold the flaccid head and neck of an unconscious victim in the axis of corrective rotation. If the swing arms are reversibly mounted the bladder can be removed when washing the garment or for maintenance, repair, replacement, etc.

Rather than attaching the cephalo-mandibular PFD and its cover to the outside of the garment the cover can be integrated into fabric of the garment as shown in FIG. 92 which demonstrates the final step of stowing the bladder. The small amount of residual air 114*e* has collected at the right side as compression zipper pull 111*e* meets the vent valve 93*e* whose operation allows the residual air to be expelled before garment integrated compression closure means 110*e* can be completely closed. The blow apart zipper pull 113*e* can already be in final position indicating that the garment integrated blow apart zipper 112*e* is set for operation before the compression closure is operated. The inflation break point 39*e* and 40*e* and the remote compressed gas source can be on the opposite side and that the garment integrated compression closure pull 111*e* begins from the same side as the inflation break point.

For a bulky duck hunting or cold weather marine jacket the cephalo-mandibular collar with midline closing means can be stowed loosely within the garment. The right flexible flange 120*e* is reversibly attached to the garment at 121*e*. The left flexible flange 122*e* is attached to the garment at 123*e*. The reversible attachment of the cephalomandibular bladder 125*e* allows the bladder to be removed for repair or cleaning of the garment. Additional bladder 124*e* is stored near the midline. Upon inflation 124*e* despite contraction that occurs during inflation has sufficient reserve to move to the midline when the bilateral arms compress creating a shelf to keep the chin from being able to fall forward. Bilateral crico-thyroid notches 1*e* and 91*e* prevent the bilateral closure of the left 126*e* and right 127*e* mandibulo-thoracic arms from compressing the windpipe.

Figure 94:
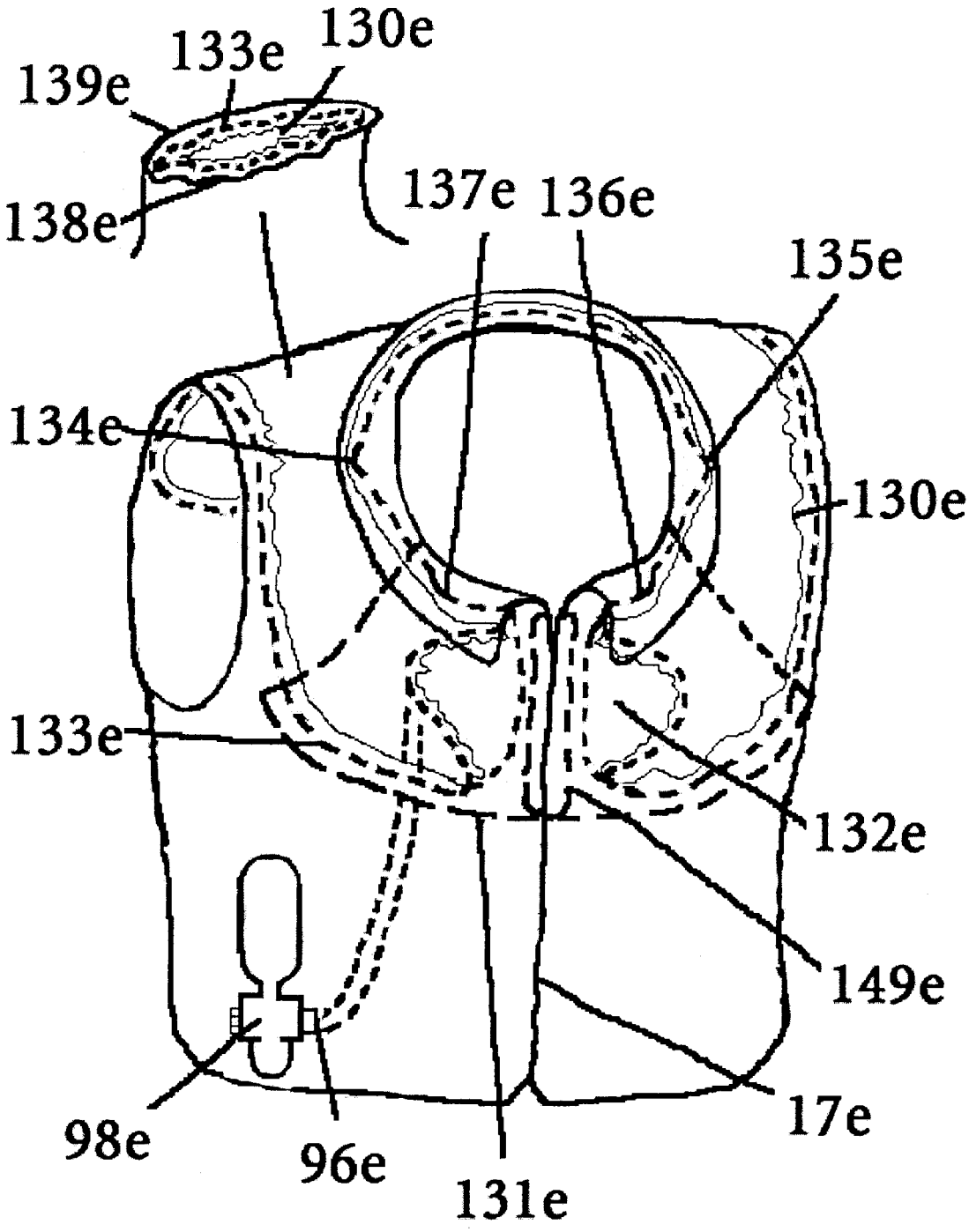
FIG. 94 is an anterior view illustrating a garment enclosed dual wall Life Jacket. A loose inner bladder can be constructed longer than in a single wall PFD, creating longer pneumatic rams which are more capable of extended midline crossing as they blow open the bilateral midline pneumatic seams. For the completely garment enclosed inflatable as seen in FIG. 93, the dual wall design results in stronger midline compression. Dual wall construction assures midline closure will not fail during water entry from any height such as from cruise ship deck. The exterior wall constrains inflation of the over sized inner bladder bearing the structural strain from pressurized inflation. The outer bladder can be constructed to allow any degree of midline overlapping arms. The exterior wall supplies the structure needed to convert the linear inner cylindrical bladder into the final three-dimensional crico-thyroid enclosing, self closing, locking mandibular shelf. The dual wall can also protect the bladder from exposure to abrasion or puncture. In a garment mounted PFD the exterior wall can protect the inner bladder from ultraviolet and chemical deterioration.

The dual wall cephalo-mandibular PFD disclosed in FIG. 94 brings significant advantages at the expense of a minimal increase in bulk. When the PFD is enclosed within a garment the additional bulk is negligible. The inner air retentive bladder 130*e* is oversized. Since the pressure generated within the inner bladder 130*e* is transferred to the outer wall 133*e* the inner bladder 130*e* can be constructed from lighter weight coated fabric or unsupported film. The outer wall 133*e* determines the final shape of the cephalo-mandibular PFD allowing shapes to be achieved that cannot be achieved from single wall construction. The outer wall includes the angular flexion elements 134*e* and 135*e* that swing the arms across the midline creating a mandibular shelf. The outer wall 133*e* also includes right crico-thyroid notch 136*e* and left crico-thyroid notch 137*e* that combine to bracket the voice box from compression while providing support for the right and left sides of jaw without compressing the voice box. One alternative construction shown leaves the end of the outer wall open 131*e* so that additional inner bladder 132*e* can extend upon inflation to create a strong midline compression closure. The inset detail of the shoulder distinguishes the upper outer wall 139*e* from the larger differentially cut lower outer wall 138*e*. This excess fabric in the lower outer wall 138*e* allows expansion upon inflation. Additional fabric is pulled up from the lower garment during inflation.

Figure 95:
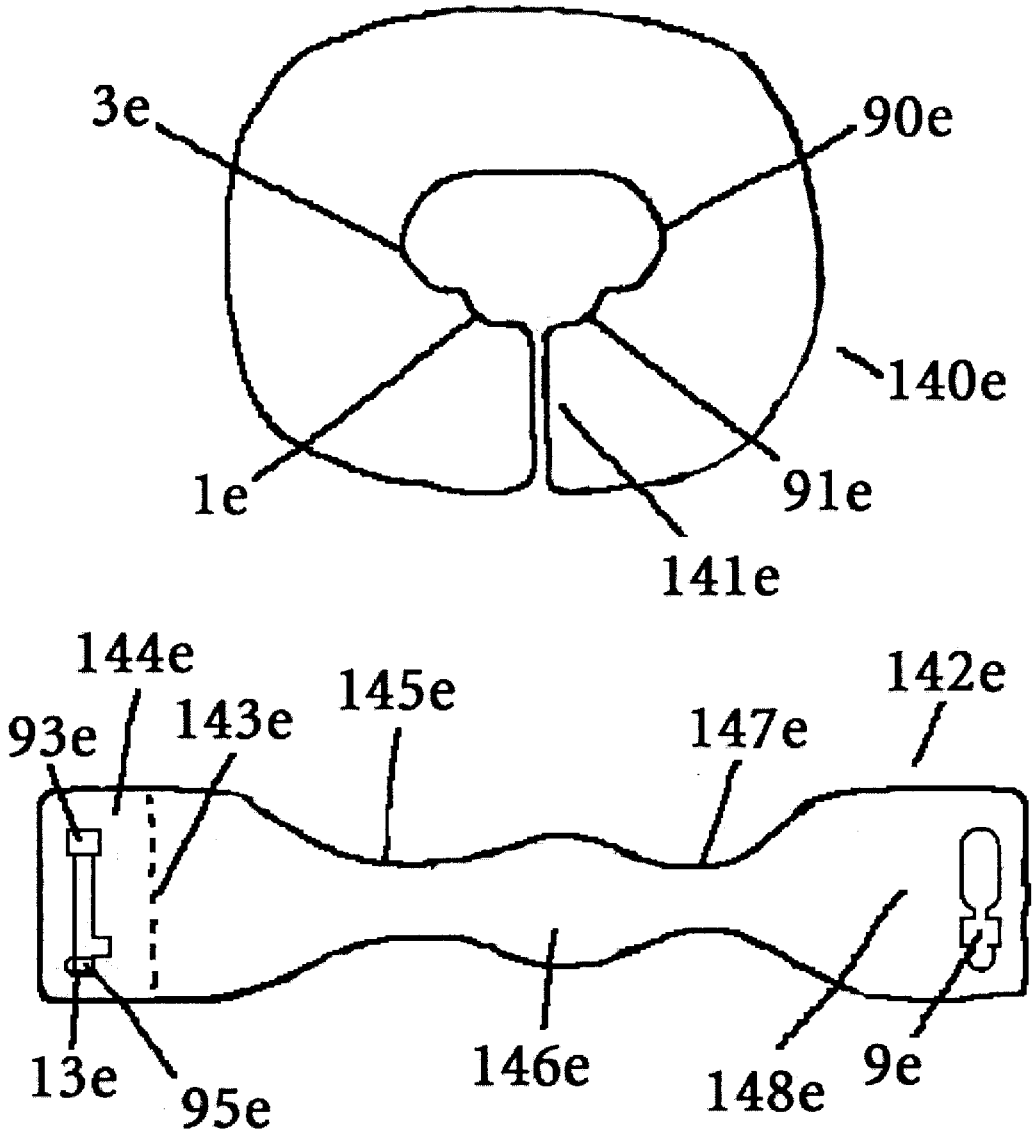
FIG. 95 is a superior view illustrating the differences between the amount of material available for midline crossing or compression. The upper drawing depicts the single wall PFD that lacks the weldable fabric for strong midline crossing or compression. Use of an over sized linear inner bladder conformed by an external skin, assures life saving closure of the midline opening. Extended cross arms uniquely manage face first entry from any height, preventing the ballast of the head swung about on a flaccid neck from slicing through the minor obstruction offered by current PFDs. Midline failure results in a lethal shift in balance of ballast and buoyancy that leaves the victim floating face down. It is believed that midline failure impacts every current midline opening inflatable PFD.

FIG. 95 compares a single wall collar PFD 140*e* with the inner bladder of a PFD constructed from two walls. When the PFD is constructed from two layers of welded fabric places severe restriction upon the amount of fabric 141*e* available for bridging the midline with either cross over arms or compression closure. Use of dual wall construction allows the inner bladder to exceed the lengths available when utilizing single wall construction. The limitation of the single wall pneumatic ram length is indicated at 143*e*. The additional bladder available to create a longer midline ram 144*e* allows more complete midline closure. A linear over sized inner bladder can be restricted at the right shoulder 145*e* and left shoulder 147*e* for increased flexibility. A cephalic pillow 146*e* provides additional displacement to support the head. The mandibulo-thoracic bladders 148*e* can be expanded to supply whatever degree of displacement that is required for timely corrective turning given consideration for anticipated additional ballast. Separation of compressed gas inflation 9*e* from the over pressure valve 95*e* allows rapid and complete pressurized deployment yet provide protection to the light weight inner bladder from the excessive pressure associated with accidental compressed gas inflation after the bladder was already inflated orally.

Figure 96:
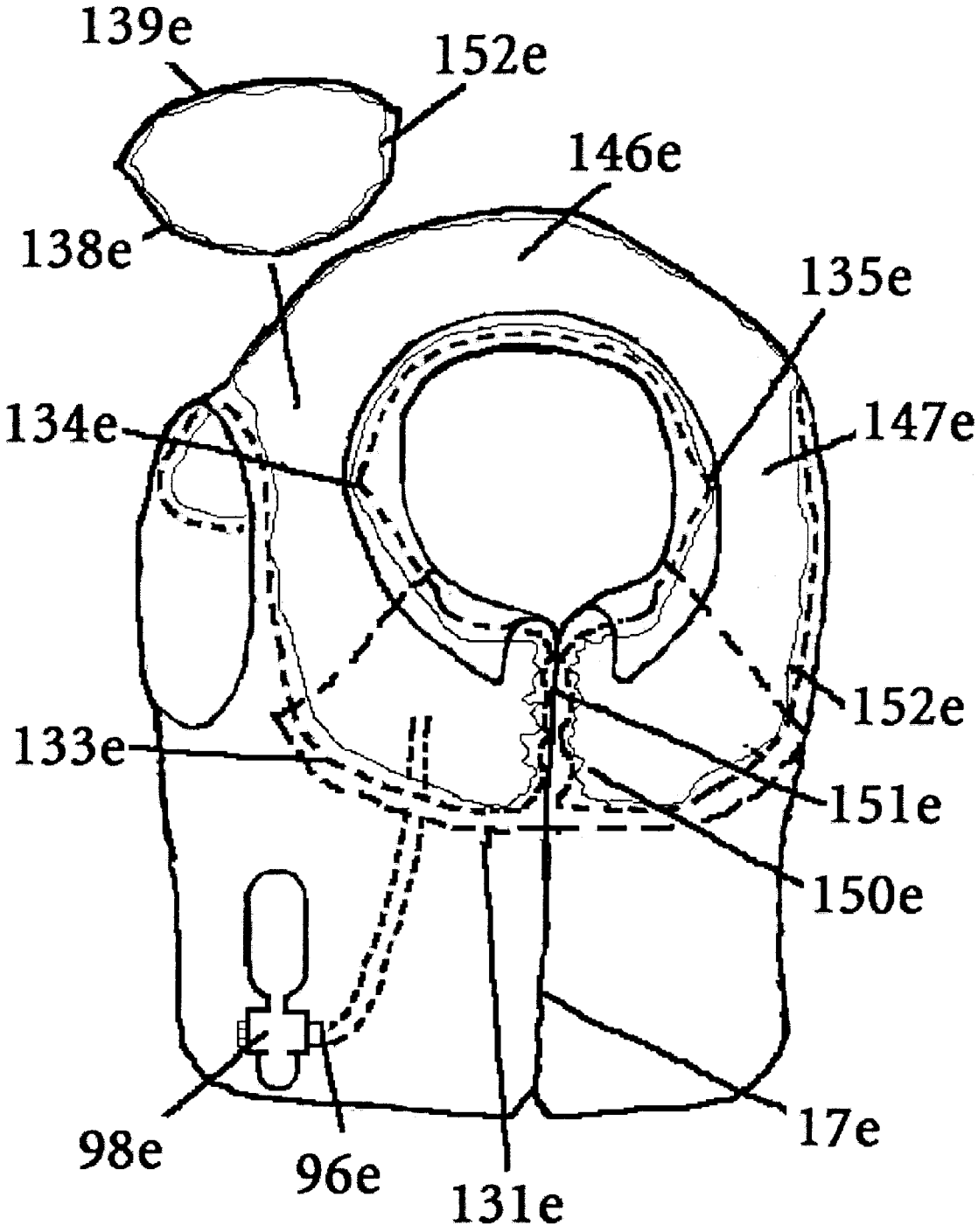
FIG. 96 is are anterior and cross sectional views of a dual wall PFD inflated within an enclosing garment. The dual wall arms compress at the midline preventing the flaccid head and neck from falling away from the axis of corrective rotation

FIG. 96 illustrates an inflated dual wall cephalo-mandibular garment enclosed PFD. The additional bladder 144*e* shown in FIG. 95 is now inflated as 150*e* and has pushed through the blow apart fabric closure 152*e* to meet and compress against the opposite mandibular arm at the midline preventing the head and mandible from falling away from the axis of rotation. The inflated inner bladder 153*e* presses against the outer wall 133*e*. In a cross section of the shoulder the upper outer wall 139*e* and the lower outer wall 138*e* are distended under pressure from the inflated inner bladder 153*e*. The cephalic pillow 146*e* is also shown distended.

Figure 97:
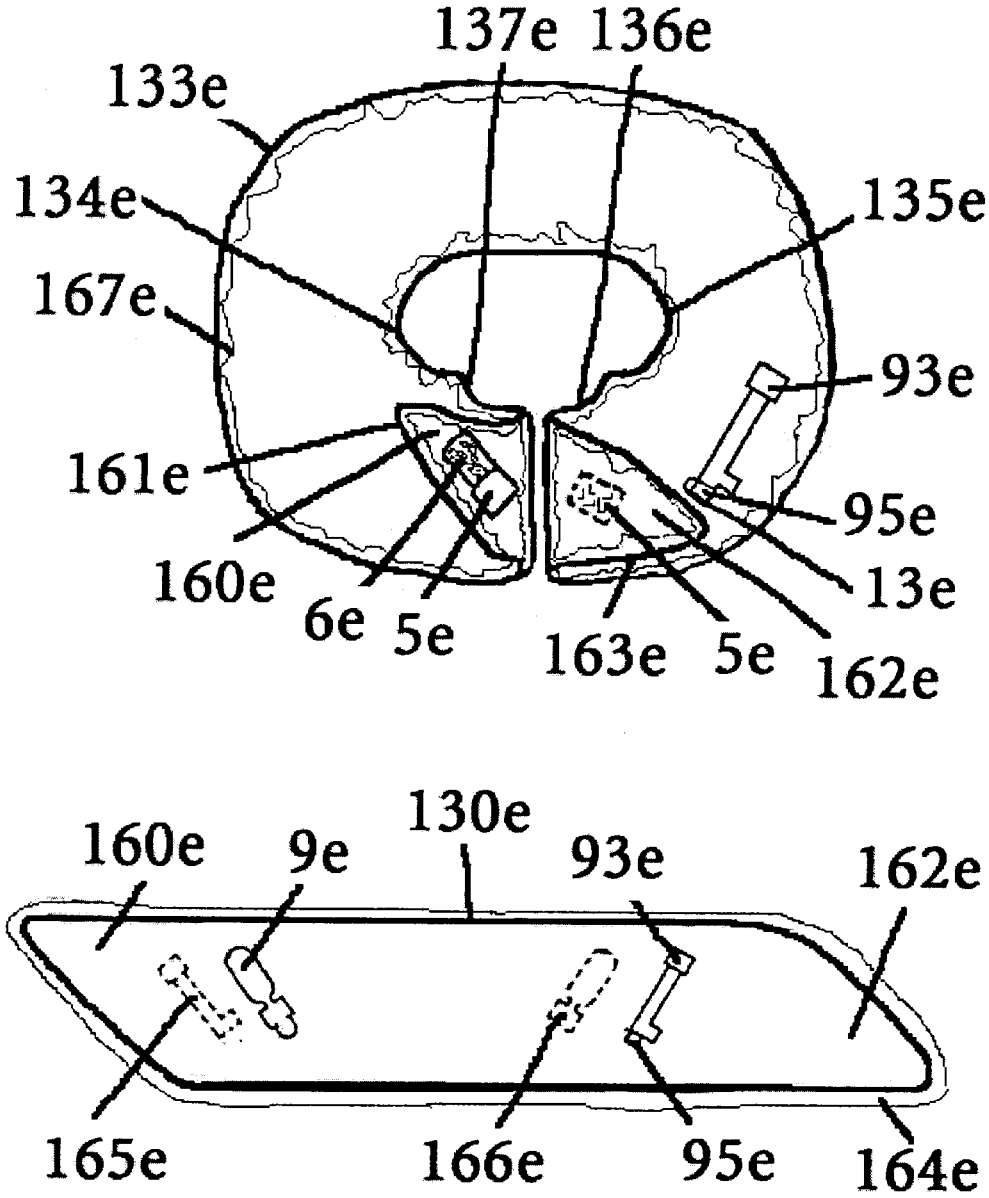
FIG. 97 is an anterior view of identical redundant inner bladders with extended cross over and cross under arms creating reliable mandibular support. The outer fabric wall can create the crico-thyroid enclosure and midline crossing self-closing arms upon inflation of the over sized dual internal bladder system. One internal bladder can have only a manual compressed gas inflator while the other chamber can have a water activated inflator, which can be allowed to incorporate an over-pressure valve in accordance with current USCG and Safety Of Life At Sea ("SOLAS") standards.

FIG. 97 shows the high level of redundancy required by international SOLAS class PFDs. In there are redundant inflatable chambers with only the secondary chamber being allowed to have an over pressure relief valve. This over sized dual chambered inflatable 167*e* is housed within a fabric cover 133*e*, which confers angle means 134*e* and 135*e* so that the bilateral midline crossing arms 161*e*, 163*e*, self-close, self adjust. The outer fabric housing 133*e* serves mount the complementary self locking means 5*e*, 6*e* which limits the closure establishing the pre-set size then secures the selected neck opening against accidental opening if tossed about in a sea state. This triple wall SOLAS PFD confers redundant mandibular support while simultaneously creating the crico-thyroid protection 136*e* and 137*e* that prevents the self-closing arms 160*e*, 161*e* and 162*e*, 163*e* from pressing on the airway. One of the bladders can have a less expensive manual inflator 166*e* and oral inflator 165*e* without an over pressure relief valve 95*e*.

Figure 98:
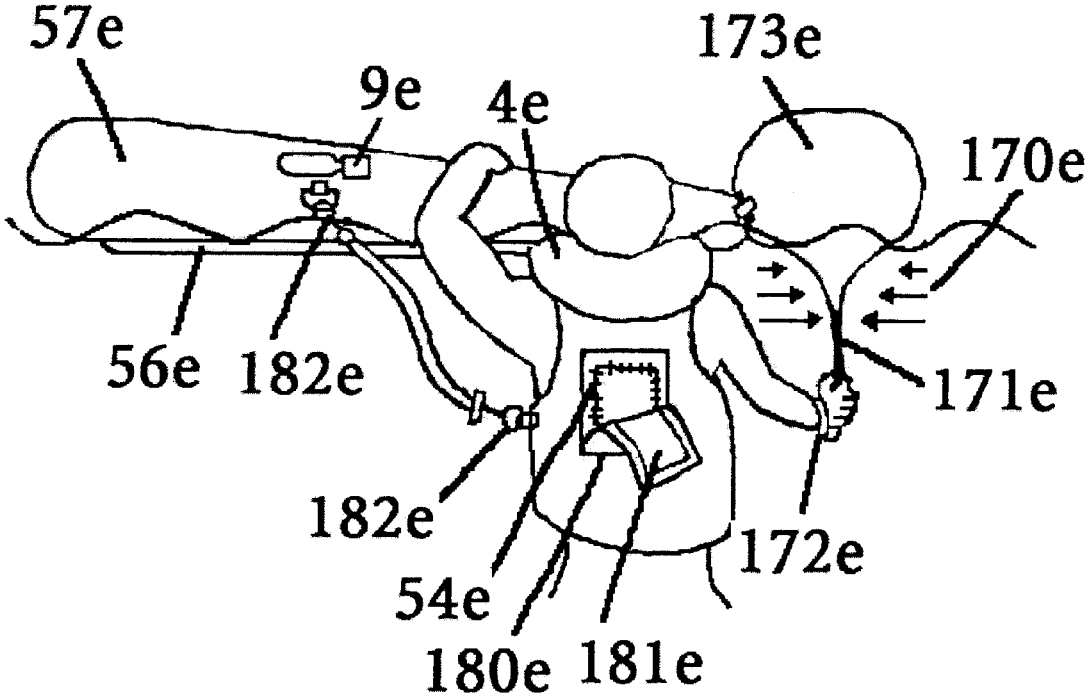
FIG. 98 is a lateral view of a life raft partially inflated by compressed gas being fully inflated by use of a manual hydrostatic pump. The lower drawing illustrates incorporation of a fabric weldable nut that secures the air collector which can be modified to have an elongated axis, stiffened base finger grips at right angles to the stiffened base for improved air capture by a victim floating in water over their head. The hydrostatic pump allows single-handed operation leaving one hand free for securing the light inflatable in high winds. As the victim shifts their weight onto bag the air squeezes out by mounting hydrostatic pressure. A one-way valve can trap the pumped air within the high volume bladder of the PFD integrated dual inflation personal life raft.
Figure 98:
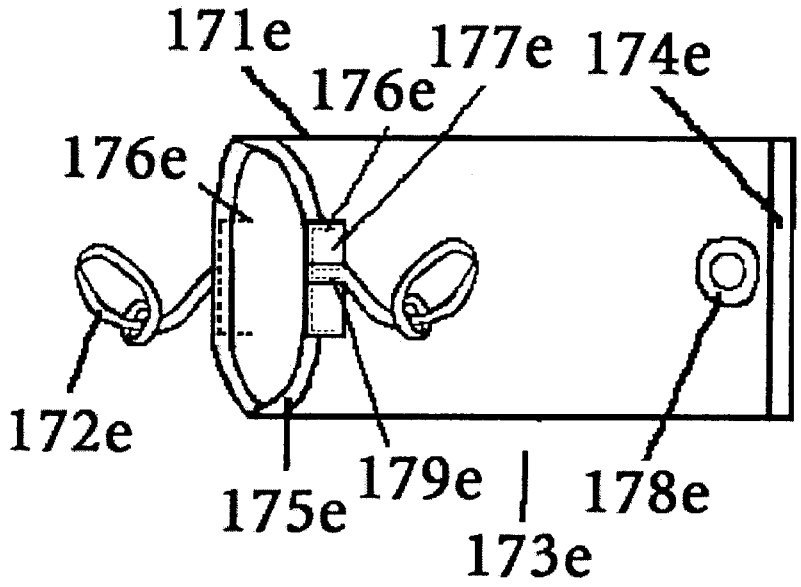

Water safety and survival in cold water requires that in the few minutes of consciousness provided by the victim's airway protective PFD that the PFD integrated personal life raft with be fully inflated to escape the hypothermic waters. The floor 156*e* can be inflated by compressed gas to give a platform from which to work to inflate the high volume perimeter 57*e* manually. FIG. 98 shows the victim hanging onto the raft with one arm while operating a hydrostatic pump 173*e*. The stiffener 174*e* is perpendicular to the finger grip pocket 177*e* attached about it perimeter 176*e* to the collector. This finger grip pocket directs the victim's hands to the position at right angles to the stiffener allowing the collector to open to facilitate easy air capture. Elongated axis creates neck 171*e* which allows closure after capture of air without loosing such a significant percentage of the initially captured air. The opening perimeter is stiffened by perimeter means 175*e* to which the finger grip 177*e* is attached. A weldable fabric nut 178*e* is welded into the windsock. This weldable nut allows the windsock to be securely screwed onto the boat valve. The locking lanyard 172*e* is secured about the wrist; the victim grasps the elongated neck 171*e* and pulls the windsock beneath the surface where the hydrostatic water pressure expresses the contents into the raft. The raft had blown open the cover 181*e* of the universally mounted base 180*e*. Within the raft container the universal raft mounting means 54*e* can be reserved for equipment recovery. The raft can be accessibly attached by quick release means 182*e* at the lanyard's attachment to the raft and garment. The lanyard keeps the raft from inadvertently being blown across the waves by gusting winds during the initial moments of deployment when then the victim maybe unconscious or startled.

Figure 99:
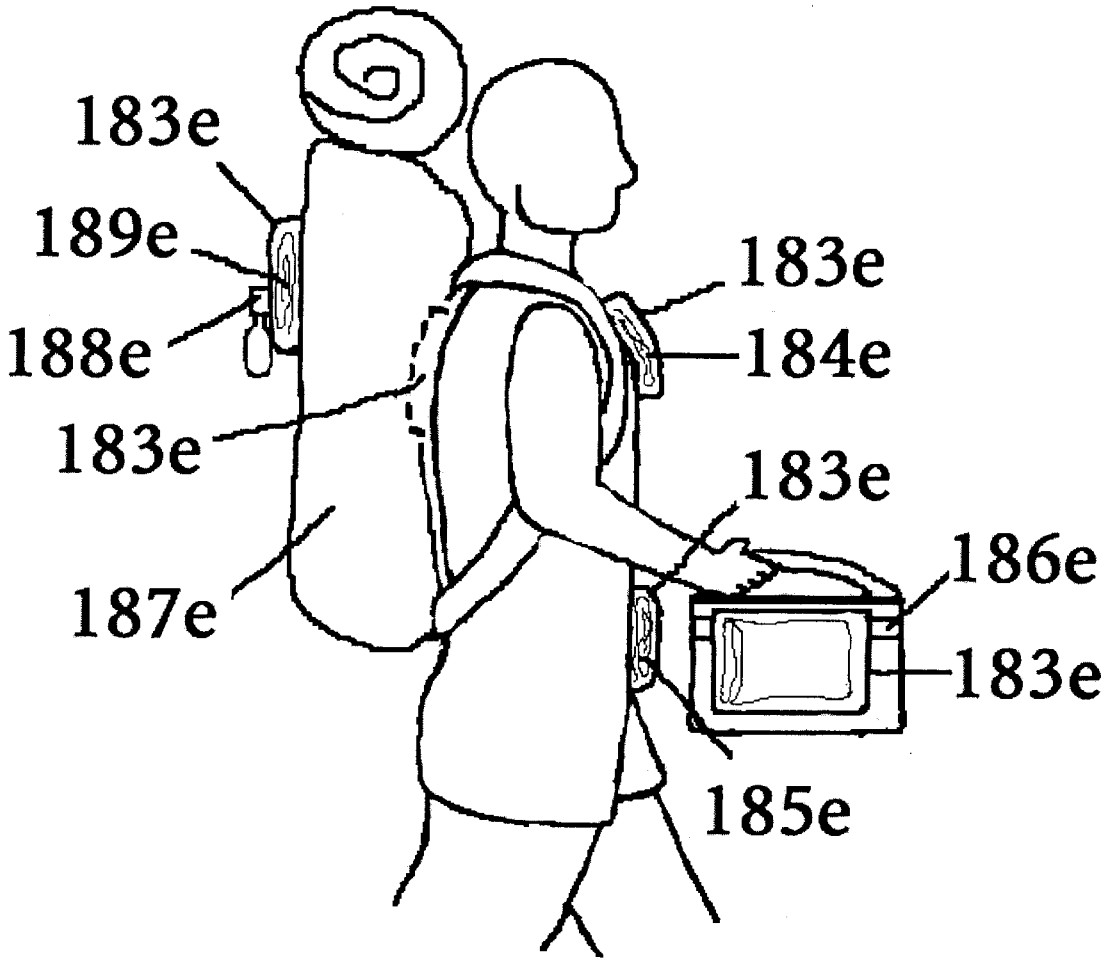
FIG. 99 is a lateral view illustrating the structural and functional flexibility of a universal inflatable bladder mounting means allowing in field relocation of bladders according to shifting amounts and location of attached ballast. The transferable positioning of moments of buoyant displacement can be modified by changing size and location of attached bladders. The sequence of inflation of the buoyant system can be rearranged by modification of the means of compressed gas inflation. Use of automatic, manual and hydrostatic inflators that can be recombined assure safe deployment of secondary bladders. Advent of the adjustable hydrostatic inflator will allow secondary posterior bladders to deploy only after they detect failure of net positive buoyancy by the cervical, thoracic and abdominal bladders.
Figure 100:
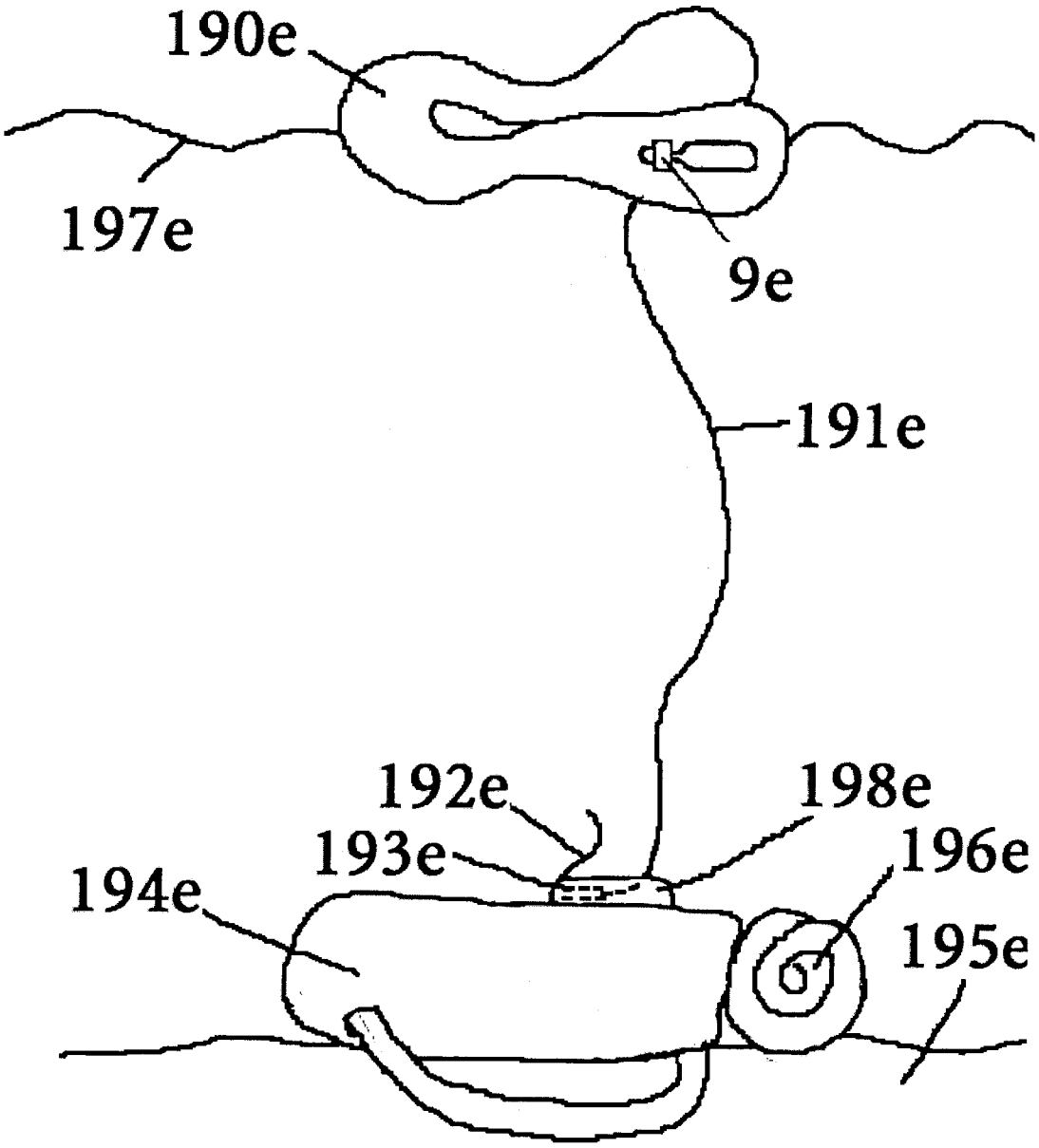
FIG. 100 is a lateral view illustrating use of a universally mounted self-releasing bladder, which can be connected by spool of high strength cable, marking the location and allowing recovery of submerged, valued equipment.
Figure 101:
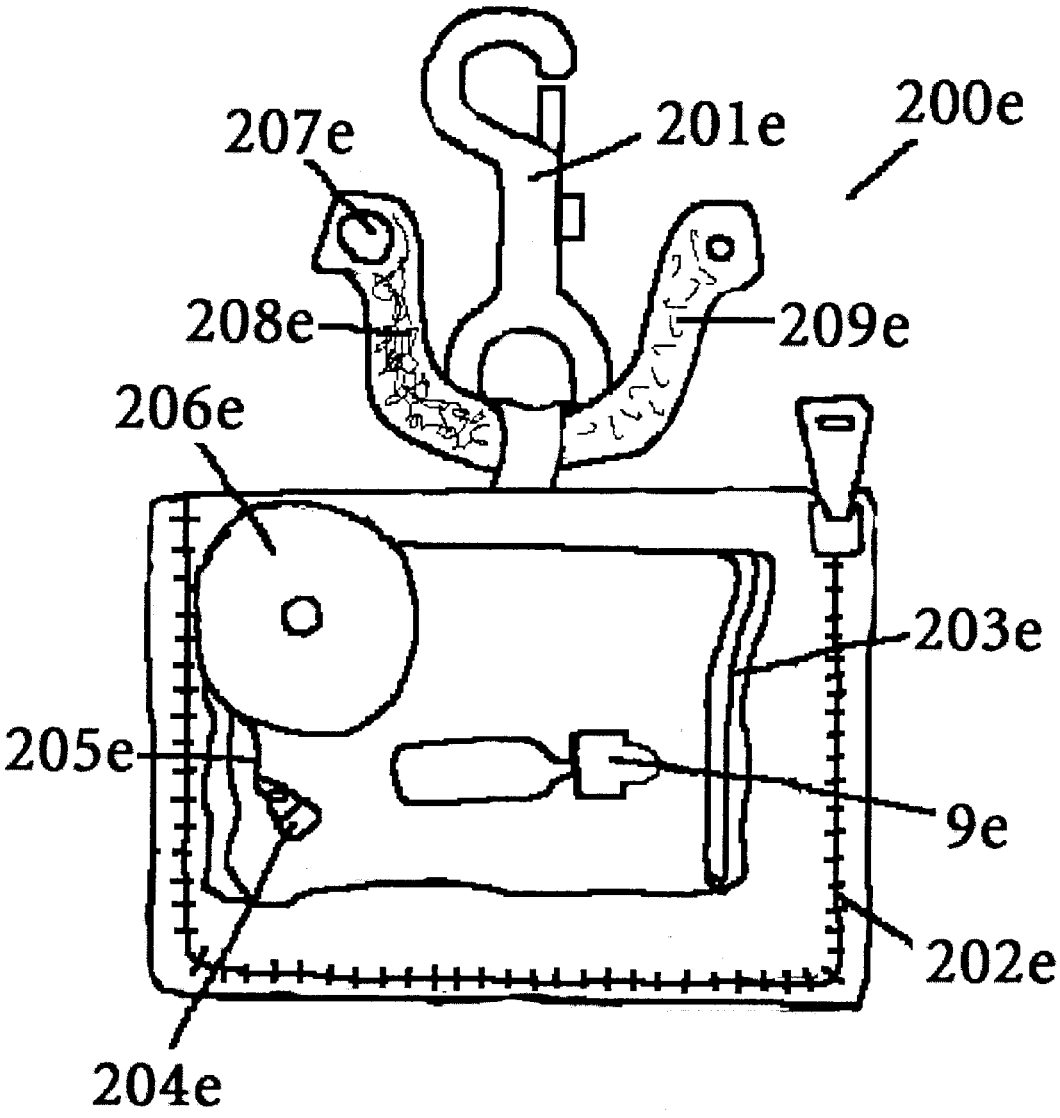
FIG. 101 is a lateral view illustrating a miniature universal equipment marking and recovery system. An eight (8 g) gram CO2 in-water activated inflator can pneumatically open the cover deploying the inflated bladder which ascends to surface at the end of a high strength marking-recovery tether which is secured to the bladder container/equipment. A variety of attachment means, male and female snap, hook and loop, straps and locking hook allow secure and quick transfer and attachment to valued equipment assuring recovery in the event of sudden water entry.

The flexibility of integrating a universal mounting means for pneumatically released bladders is demonstrated in FIG. 99. With universal mounting the same bladder container can be removed from the back of the garment and transferred to the outside of the backpack. Or that same posterior bladder 189*e* can become the thoracic bladder 184*e* or the abdominal bladder 185*e*. The same bladder can serve to provide equipment recovery when adapted to attach via snaps, straps or cord to any valued piece of equipment 186*e*, which has to be carried near or over water. A depth adjustable compressed gas inflation mechanism 188*e* allows back pack bladder to not inflate until the others have already inflated and proven insufficient to create net positive buoyancy as evidenced by mounting hydrostatic pressure associated with increasing depth if the victim continues to sink despite the automatic deployment of both the thoracic 184*e* and abdominal bladders 185*e*.

In the event that the soldier finds them self without a large displacement bladder any bladder 190*e* can deployed on contact with water by use of water activated automatic inflator 9*e*. Inflation opens pneumatically released cover flap 192*e* allowing bladder 190*e* to rise to the water's surface 197*e* trailing high strength line 191*e* fed off spool 193*e* can mark the location of the back pack 194*e* and sleeping bag 196*e* on the lake floor 195*e*. The line 191*e* can then be used to recover the valuable survival gear 194*e*.

Given the rapidly changing configurations of military equipment carried in on an operation or recovered during an operation, a miniature self deploying equipment marking system 200*e* can be instantly adapted to a wide variety of equipment by locking hook 201*e*. Hook 209*e* and loop 208*e* can be attached directly to a garment or to each other around a point of attachment. Many military garment surfaces are covered with male snaps to which female snap 207*e* can be directly attached or to the male on the other strap. Exposure to water or manual activation of inflator 9*e* distends marking bladder 203*e* which blows open closure means 202*e* allowing bladder to ascend while connected at point 204*e* to high strength line 205*e* then is released from cover mounted spool 206*e*.

Figure 102:
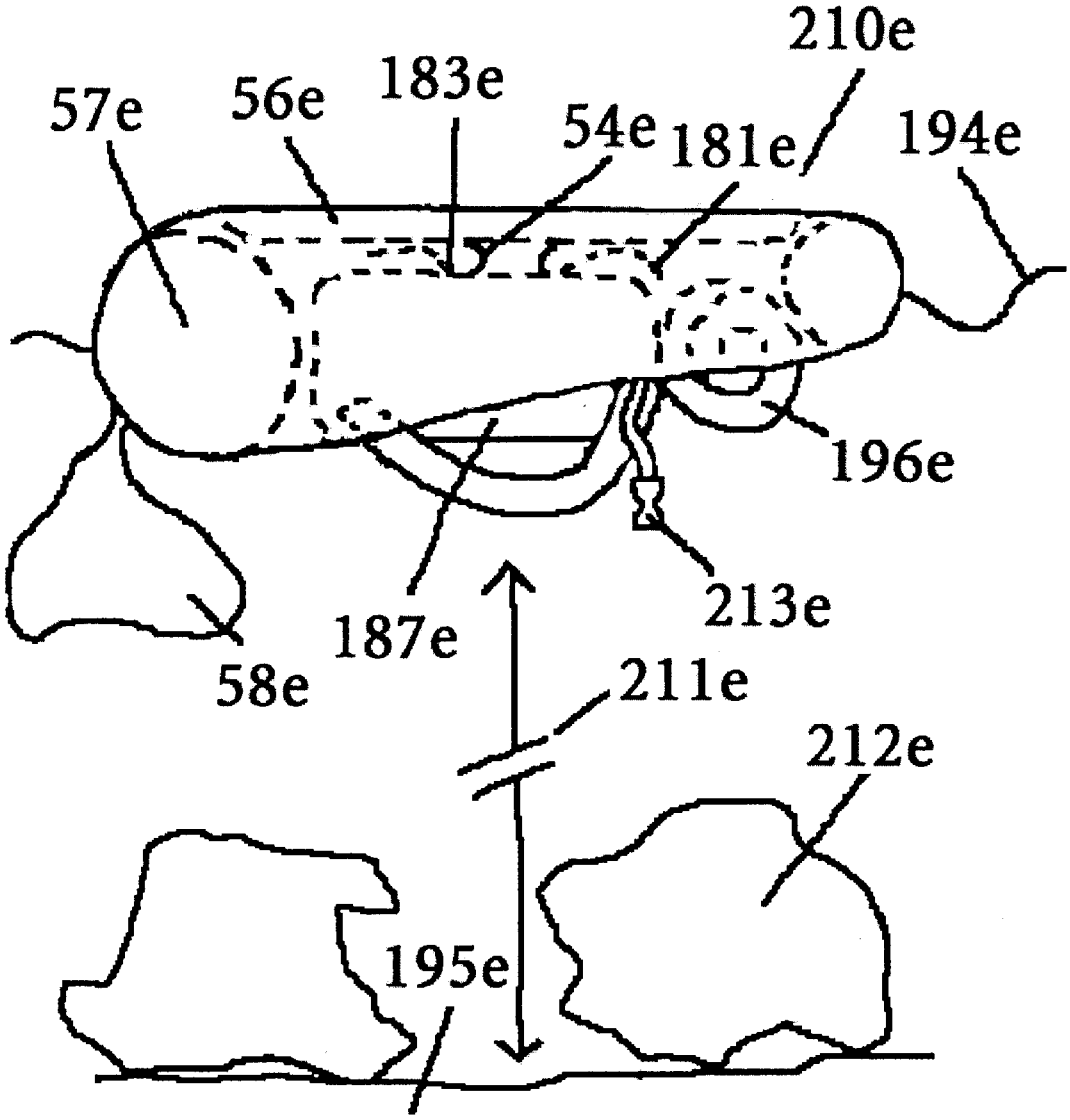
FIG. 102 is a lateral view illustrating a personal life raft adapted to function as the backpack's buoyancy system. The life raft is transferred from back of the garment to back of the backpack by use of a universal bladder cover mounting means. The raft can be converted from automatic water activation to manual activation so that only after the backpack is released would the wearer actuate the manual detonator. The recovery bladder envelopes the equipment then doubles as the transport bladder, preserving valued equipment regardless of depth of water or ensnaring bottom conditions.
Figure 103:
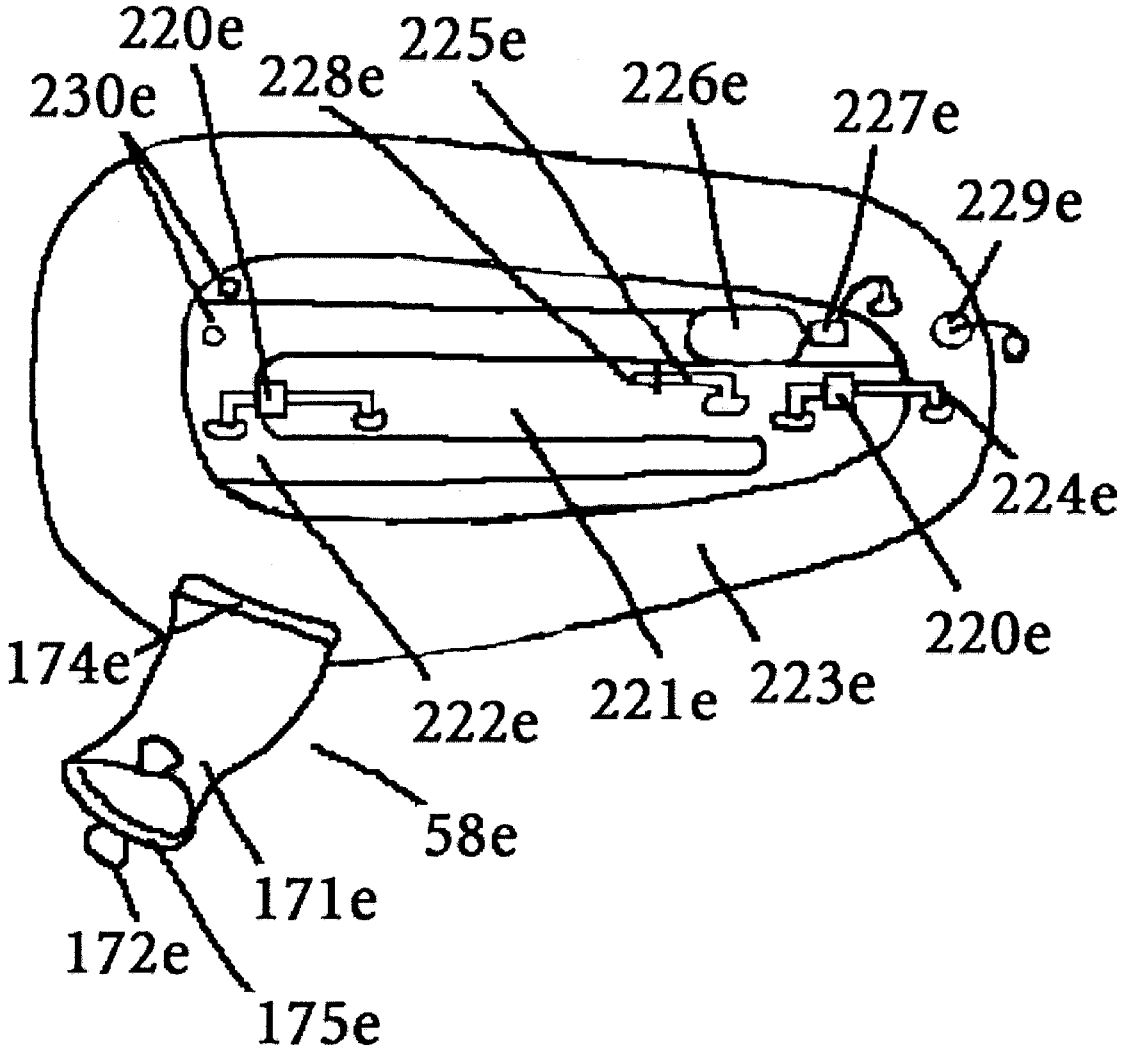
FIG. 103 is a superior view of a triple chambered dual pressure raft illustrating the role of the over-pressure relief valve in allowing shared compressed gas inflation of structurally distinct chambers. Once inflated perforation of one bladder, will not deflate the remaining bladders. A high-pressure floor can preferably confer immediate buoyant assistance as a float. If the soldier or individual's attached ballast dictates, a larger cylinder supplies the gas which spills from the floor through the over pressure valve creating additional soft displacement in the high volume perimeter tube. Cylinder selection allows sufficient gas to cover the ballast associated with any carry-able equipment while sustaining the high pressure in the floor needed to maintain its rigidity. Full inflation would require excessive heavy and bulky cylinders and regulators incompatible with a PFD integrated personal life raft.

As shown in FIG. 102, in the event that the solider is transiting deep water the backpack 187*e* upon which his life may depend can be directly mounted to an internal universal mounting means 54*e* within the universally mounted cover 183*e*. The operator must be sure that the bladder 56*e* and 57*e* supplies buoyancy in excess of the attached ballast 187*e*. The operator may elect to convert the inflator to solely manual operation whose rip cord can be shoulder strap mounted 213*e* so that the wearer can jettison the backpack before inflation to avoid deployment of a highly buoyant device on their back which could float them face down. In abysmal water 211*e* or in treacherous waters where the lake bottom 195*e* is littered with ensnaring debris 212*e* the directly mounted equipment recovery system will assure the survivor of the equipment upon which their life may depend.

During certain missions soldiers may be carrying radio gear or other equipment that is in excess of the 40 lbs. generated by the maximum sized ⅜ inch necked compressed gas cylinder. In that event the larger ½-inch inflator 227*e* allows larger cylinders 226*e* to be attached. The dual chamber floor which can be inflated by the same compressed gas cylinder by passing pressurized gas through check valve 220*e* is designed to be fully inflated on the standard 38 g cylinder. The extra gas is passed through an over pressure relief valve 220*e* and conduit 224*e* into the large perimeter tube 223*e* where it creates the displacement needed to assure valuable equipment will not be lost. The balance of the high volume perimeter tube is inflated by the windsock 58*e*. The high volume perimeter tube of the personal life raft is protected by large bore dump and over pressure valve 229*e*, which is set to spill at lower psi than the pass through over pressure valve 220*e* assuring that the floor is more rigid than the outer tube. The primary 221*e* and secondary 222*e* high-pressure floor chambers are quickly inflated to rigidity by compressed gas means supplying a working platform. The personal life raft built from two layers will twist if the perimeter tube is inflated to high pressure because of the tension generated in the floor as the perimeter tube seeks to pull away as it is inflated. The high pressure rigid floor 221*e* and 222*e* when combined with a lower pressure perimeter tube allows a more visual pleasing conformation simulating that found in a three layer raft in which the floor is mounted from the bottom of the tube rather than from the inside seam. The two chambers of the high-pressure floor each have there own oral inflation vent means 230*e*.

Figure 104:
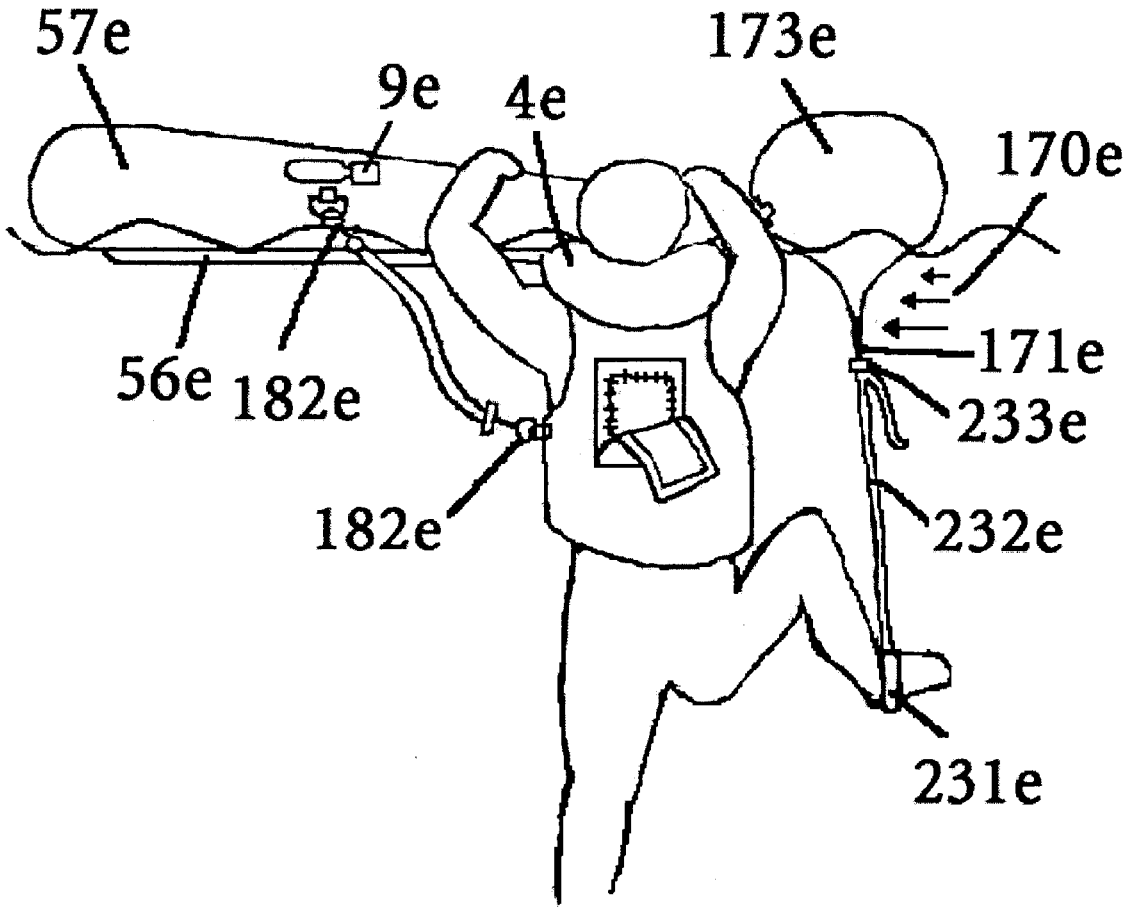
FIG. 104 is a side view illustrating a victim using an extended arm-leg powered high-pressure hydrostatic pump. Self-locking foot pedal and variable length arm, which adjusts to the individual's height, allows efficient use of the victim's complete body weight to assure rapid and firm inflation of their personal life raft. A leg powered high-pressure hydrostatic pump allows the victim to keep both hands on the raft to control it in heavy sea and winds as it is inflating. With the pedal powered pump the victim's entire weight can be used to power the hydrostatic pump for rapid extrication for cold water to avoid life-threatening hypothermia.

When the hydrostatic pump 173*e* in FIG. 104 is attached directly to the high volume perimeter tube 57*e* of the personal life raft. A variably sized stirrup 231*e* is connected by a pump arm 232*e* whose length can be changed by adjustment means 233*e*, which is attached to the. elongated neck 171*e* of the pump collector. Using the leg muscles to force the bladder under water the pressure from the water 170*e* shifts the air out of the pump'collector 173*e* and through the one-way valve into the raft 57*e*.

Figure 105:
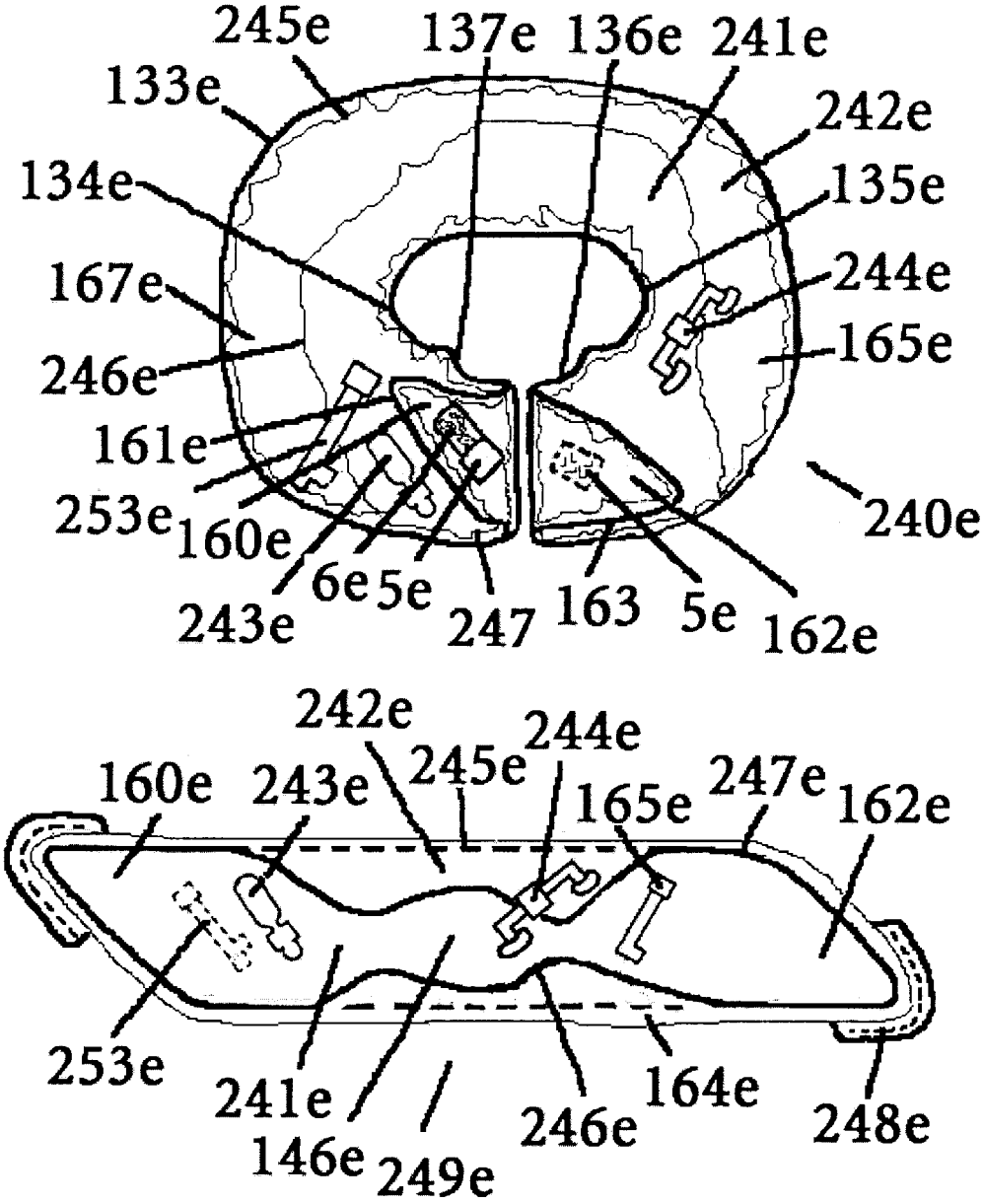
FIG. 105 is a superior view of a variable volume life jacket illustrating the use of a low volume high pressure compressed gas-inflated chamber inflated by either a 16 g, 25 g or 38 g CO2 cylinder, though such is not considering limiting and other sizes can be provided and are considered within the scope of the invention. The smallest cylinder creates sufficient pressure for the self-closing self-adjusting and self-locking features to operate. If used with one of the much more expensive large cylinders, the extra gas spills over to confer additional low-pressure buoyancy. Use of the largest cylinder brings the high volume secondary chamber up to full operating pressure, volume, turning torque and freeboard. An over-sized dual chambered inner bladder is also shown, which can be a combination of a low volume and a high volume chamber sharing a common wall. The upper drawing shows the inner bladder contained within a smaller outer cover, which supplies final shape. The over pressure relief valve can be found on the second chamber protecting both chambers from over-pressurization. A one-way check valve moves the excess high-pressure air from the low volume to the high volume chamber. When the PFD is orally inflated before water entry the water activated detonation results in gas safely vented through the combined oral inflator/over pressure valve.
Figure 106:
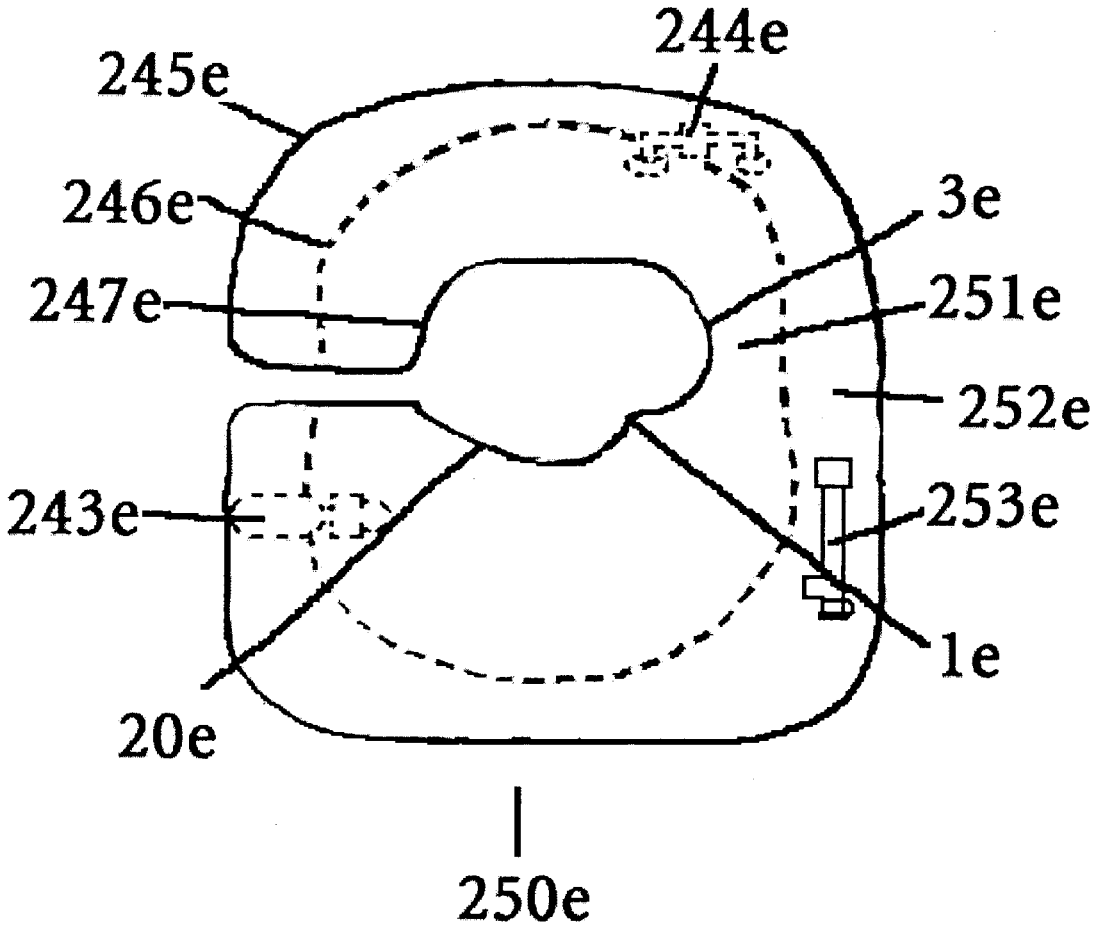
FIG. 106 is a superior view of a single wall, dual chambered, ballistics' vest PFD, which is ideal for military or sport hunters, though such is not considered limiting. The low volume high-pressure chamber can be on the inferior side. An inflator can accept 12 g, 16 g, 25 g or 38 g cylinders, though such is not considered limiting and other sizes can be used and are considered within the scope of the invention. A low volume high pressure chamber can operate the self closing angle that generates the fabric tension needed to bring the cephalo-mandibulo-thoracic bladder across the midline supporting the unconscious victim's head in the axis of corrective rotation. The secondary chamber can receive any excess pressurized gas through a one-way check valve or from oral inflation. The primary high-pressure chamber assures corrective turning. The secondary chamber improves posterior displacement and consequently freeboard and head angle.

FIG. 105 is a variable displacement PFD 240*e* that can be used with either inexpensive small compressed gas cylinders 243*e*, intermediate or large cylinders depending on budget, size and attached ballast. In an effort to decrease the cost of using inflatable life jackets the compressed gas costs can be considerably reduced if a standard size 16 g cylinder is selected. The 15 lbs. of buoyancy supplied by a 16 g cylinder is the minimum lift that can supply corrective turning. Corrective turning is dependent upon the mandibulo-thoracic lift supplied by midline crossing arms 160*e* and 162*e*. Sufficient displacement beneath the chin is acquired at the expense of freeboard, which is dependent upon the amount of air located behind the head 146*e*. The key is to isolate and localize the critical displacement in a low-volume high-pressure bladder 241*e* which can be functionally if not physically attached to a high volume chamber 242*e* that can be inflated orally to increase freeboard once the victim has survived the insult of sudden entry. The over sized, variable displacement, dual pressure, dual chamber inner bladder 249*e* is contained with outer bladder 133*e* which supplies the right closure angle 134*e* and the left closure angle 135*e* as well as the right crico-thyroid notch 137*e* and the left crico-thyroid 136*e*. The purpose for using a dual wall design is so that cross over arm 161*e* and cross under arm 163*e* can have the additional fabric sewn in so that they can achieve complete midline closure as required for cephalo-mandibular support. A most cost effective design is to weld the low volume high-pressure bladder 241*e* right to the high volume chamber 242*e*. The two bladders can be simultaneously welded 247*e* in the area of the cross over arms; the smaller bladder is welded to the larger bladder at 246*e*, while the large bladder is separately closed at weld line 245*e*. The simplest design leaves the high-pressure chamber structurally and functionally separate but use of an over pressure relief valve 244*e* allows excess gas to move from the low volume to the high volume chamber. The use of a bypass over pressure valve 244*e* relieves the wearer of the responsibility of completing the inflation orally in order to achieve improved freeboard. The use of pass through over pressure valve is complemented by incorporation of an oral inflation over pressure relief valve 253*e* in the secondary bladder so that in case the secondary was fully inflated before the primary was inflated with compressed gas the excess gas can escape through 253*e*. The inner bladder is reversibly secure at 248*e* so that it can be removed for cleaning the garment.

The single wall dual chambered variable displacement unilateral cross over arm PFD 250*e* as is required by military, law or sportsmen can be stored with the dual zipper cover an held out of the way of the gun butt zone so as to not interfere with shooting. The original ballistics vest design is enhanced by creating a variable volume PFD that for straight Kevlar bullet proof vest can be operated on a 16 g cylinder which is a considerably smaller easier to pack leading to a lower profile consequently improved compliance. The use of differing cylinders 243*e* can pass excess gas through over pressure relief valve 244*e* from low volume chamber 251*e* to higher volume chamber 252*e*. Both chambers are protected from excess pressure by combined oral inflation over pressure valve 253*e*. In the single wall design the fabric tension generate by closure angle 3*e* brings the cephalo-mandibular bladder across the neck while the single sided crico-thyroid notch 1*e* prevents compression of the voice box. Weld line 245*e* closes the larger secondary bladder 252*e* while weld line 246*e* mounts the smaller high-pressure bladder 251*e* to the top of the, large bladder 252*e*. Weld line 247*e* welds all three layers closed around the neck.

Water extrication is critical to survival corrective turning will not protect the victim from the lethality of hypothermia. The personal life raft must be affordable which means two layers of fabric and minimal compressed gas apparatus. Must be light enough, which means two layers of fabric and minimal compressed gas apparatus. Must pack small enough to be carried when needed, which means two layers of fabric and minimal compressed gas apparatus. Most oceans of the world require that the victim exit quickly to survive. While the use of ⅜" or ½" CO2 cylinders will inflate the floor plus additional life if critical to survive entry, complete inflation requires larger systems than can be carried or afforded this manual inflation is necessary. Oral inflation takes to long if achievable thus the windsock or hydrostatic pump is critical to exiting the water within the time required for survival. The victim can inflate and exit the water within 4–6 cycles of a variable pressure hydrostatic pump 260*e* with a 1 cubic ft collector. The elongated conduit 276*e* the carries the compressed gas from the hydrostatic pump to the raft also allows the collector to be waved freely to assure that the one cubic foot of air is scooped into the collector. The victim can rest on the rigid floor 56*e* while filling the collector, sealing the elongated neck 171*e* of the low-pressure collector 261*e* with complementary fabric lock 277*e*. The length of pump arm 263*e* is set prior to for low pressure pumping, which is done by the foot held within stirrup 231*e* leaving the arms free to manage the raft in heavy winds or seas. Three or four cycles of the hydrostatic pump will completely fill the high volume perimeter tube 57*e*. As the individual pulls on the tail of the pump arm through the adjustment means 270*e* the pump arm can be shortened from 263*e* to 266*e* allowing the collector to be forced further under water forcing high pressured air through the check valve 272*e*. If the pump arm tail 271*e* is pulled as far as it will go the pump arm is now adjusted to its shortest length creating the deepest stroke. As the collector is pulled to 4–5 feet under water pressures of 2.5 psi are generated bringing the life raft's perimeter tube to structural pressure allowing the victim to exit the water. An optional disconnects 273*e* creating a length of tubing equal to or greater than the length of the windsock. When the tube is held up toward the opening the windsock can be used to collect and store rainwater or act as a solar still. With the hydrostatic pump extended the windsock can be dragged behind the raft as a drogue or suspended beneath the raft serving as sea ballast to decrease chances of tumbling.

Certain advantages and/or features of the embodiments shown in FIGS. 82 through 107 include, but are not limited to: (1) Crico-thyroid protective inflatable enclosure; (2) Unilateral eccentric crico-thyroid protective inflatable enclosure; (3) Bilateral eccentric unilateral crico-thyroid protective inflatable enclosure; (4) Dual zipper enclosure then compression bladder cover; (5) Dual zipper compressive low profile bladder cover; (6) Vent at opposite side from site of pressurized inflation; (7) Blow a part closure means closes in direction from site of pressurized inflation towards the bladder vent; (8) High compression secondary zipper closes in direction from site of pressurized inflation towards the bladder vent; (9) Primary blow a part closure means distinct from secondary compressive closure means; (10) Garment mounted dual zipper, pneumatically released, compressive, low profile cover; (11) Garment integrated dual zipper, pneumatically released, compressive, low profile cover; (12) Variable size preset complementary fabric lock arrests self closure motion of inflatable mandibular arm(s); (13) Pneumaticaily compressed fabric lock securing midline closure of mandibular shelf; (14) Compressed gas inflator mounted on inferior aspect of anterior bladder inflating terminal loculated blow apart chamber; (15) Fold line indicator of creating transient loculated chamber; (16) Over pressure relief valve remotely located from source of compressed gas; (17) Blow off compressive over pressure valve cap; (18) Sleeve mounting means on bottom of bladder; (19) Reverse direction sleeve mounting means on top of bladder; (20) Strain relief collar superimposed on collar closure angle; (21) Optional attachment strap means between inferior-anterior collar and lower garment; (22) Two part handle mounting functionally and structurally distinct compressed gas activation lanyard handle on quick release, locking abdominal bladder mounting handle means; (23) Unilateral midline crossing cephalo-mandibular PFD; (24) Unilateral midline crossing cephalo-mandibular PFD high-tension low profile cover; (25) Loculated break point bladder with attached compress gas inflation means; (26) Inferior-anterior water activated inflation means; (27) Low tension, blow-apart break point in bladder cover at angle to high-tension blow apart perimeter zipper means; (28) Manual compressed gas activation ripcord lanyard supplies one half of complementary fabric lock to secure closure at cover break point; (29) Mandibulo-thoracic bladder flange crosses and is secured across midline; (30) Eccentric cover shifts inflator mass to left away from right shoulder area; (31) Reversible eccentric cervical compression collar PFD; (32) Independent collar orients majority of buoyancy in the thoracic area; (33) Concurrent cervical collar and abdominal bladder orients the majority of buoyancy of collar to the rear; (34) Universal mounting means within pneumatically opened bladder container; (35) High pressure compressed gas-inflated floor of personal life raft; (36) Raft perimeter inflated manually or in small part by compressed gas spilled over from floor; (37) Swing arm sleeve adapting small diameter bladder neck opening to large diameter garment neck opening; (38) Sleeve with midline cross over flange reversibly secured; (39) Tensioning sleeve transferring buoyant force from cervical collar to garment; (40) Sleeve coupling means allowing collar to rise and close about neck; (41) Sequential blow a-part constrictions that transiently localize inflating gas; (42) Primary break point closure compressing loculated bladder fold; (43) Secondary blow apart stricture about bladder creating mechanical fold point then directs expanding bladder across midline; (44) Tertiary blow a-part stricture arresting blow a-part zipper progress until bladder has crossed the midline; (45) Two or more small-bore vents separate along inferior-superior axis (facilitate flooding while not allowing rapidly expanding bladder to blow through); (46) Garment integrated external reversible bladder mounting means (allowing alternate use of garment, cleaning of garment and bladder separately, maintenance, repair or replacement); (47) Secure reversible midline cross over flange attachment means; (48) Bilateral midline crossing arms; (49) Bilateral midline crossing arms with integrated crico-thyroid enclosure; (50) Remote automatic compressed gas inflation means; (51) Overpressure relief at opposite end of bladder from compressed gas inflation means; (52) Low volume bilateral midline crossing arms with integrated crico-thyroid enclosure; (53) Abdominal bladder with arm of specified length to establish mandated body angle; (54) Compressed gas manual inflation means mounted on abdominal bladder release means; (55) Two part handle allowing independent or concurrent use; (56) Quick release inflatable rescue bladder stored beneath ballistic protection; (57) Redundant personal flotation device stored beneath ballistic protection; (58) Dual zipper high compression bladder cover integrated within body of garment; (59) Single wall self closing, cricothyroid protecting bladder loosely stowed within garment; (60) Single wall self closing, crico-thyroid protecting bladder attached to garment by swing arm; (61) Single wall self closing, crico-thyroid protecting bladder release-ably attached to garment by swing arm; (62) Over sized inner bladder inflated to conform to outer fabric wall; (63) Elongated linear inner bladder inflated to extended cross over and cross under mandibular arms; (64) Blow apart midline closure allows inflated arms to exit garment; (65) Sleeve directing pneumatic ram though blow a-part opening across midline garment opening; (66) Dual wall self closing, crico-thyroid protecting bladder loosely stowed within garment; (67) Single wall self closing, crico-thyroid protecting bladder attached to garment by swing arm; (68) Single wall self closing, crico-thyroid protecting bladder releaseably attached to garment by swing arm; (69) Linear inner bladder with extended rams and cephalic pillow; (70) Dual over sized inner bladders of dual wall PFD with over pressure relief valve on secondary bladder with automatic inflation, primary bladder with manual inflation and no over pressure valve; (71) Fabric weldable nut; (72) Windsock secured to raft via fabric-integrated nut; (73) Finger grip pocket; (74) Windsock base stiffener; (75) Finger grip ninety degrees to base stiffener; (76) Elongated neck of pneumatic collector; (77) Locking lanyard closing hydrostatic collector orifice; (78) Universal garment and portable equipment mounting means for bladder cover; (79) Secure quick release locking mounting means; (80) Buoyant marking and equipment mounted bladder recovery system; (81) Water activated bladder deployment tethered to equipment; (82) Spooled line connecting equipment to surface bladder mounted; (83) Life vest doubling as equipment marking bladder, automatically released on submersion; (84) Miniature water activated compressed gas cylinder and bladder contained within blow apart cover attached via tether to equipment via hooks, snaps, hook and loop or ties; (85) Personal life raft doubling as high lift equipment float; (86) Shoulder mounted manual ripcord for personal life raft that envelops equipment; (87) Dual pressure variable displacement raft; (88) Compressed gas inflated floor with manually inflated perimeter; (89) Compressed gas inflated floor with over pressure relief into raft perimeter chamber; (90) Utility float capable of wide range of automatic filled displacements; (91) Over pressure relief between floor chambers; (92) Three-chambered life raft, two of which fully inflate the third partially, inflated; (93) Raft perimeter tube pressure set to relieve at lower pressure than raft floor to perimeter pressure relief valve; (94) Variable pressure hydrostatic pump; (95) Elongated neck on pump collector; (96) Variable length pump arm means; (97) Adjustment means for pump arm; (98) Locking stirrup attached to inferior aspect of pump arm; (99) Variable pressure manual hydrostatic pump; (100) Hydrostatic pump collector connected by in line check valve; (101) Hydrostatic pump collector connected to raft by quick release means; (102) Hydrostatic pump collector with tube of length equal to or greater than the length of the collector; (103) Collection and storage of rain within pump collector with tube is secured attached to opening of collector; (104) Two or more over sized inner chambers of differing size; (105) Low volume high-pressure gas inflated bladder-generating corrective turning torque; (106) High-volume low-pressure orally inflated chamber contributing increased displacement to enhance freeboard; (107) Low volume high-pressure compress gas inflated bladder combined with high volume orally inflated low-pressure chamber within same cover; (108) Low volume high-pressure compress gas inflated bladder sharing common wall with high volume orally inflated low-pressure chamber; (109) Low volume high pressure compress gas inflated bladder sharing common wall and connected via pressure relief valve to the high volume orally inflated low pressure chamber; (110) Low volume high-pressure compress gas inflated bladder sharing common wall with high volume orally inflated low-pressure chamber within common cover; (111) Single wall low-volume, high-pressure compress gas inflated bladder sharing common wall and connected via pressure relief valve to the high volume orally inflated low pressure chamber; (112) Alternate compression means transiently reduces volume of bladder prior to closure of blow apart cover; (113) Reversibly mounted sleeve adapting small bladder neck opening to large garment neck opening; (114) Inferior remote compressed gas and inflation means (quick and deep submersion-reduced corrective turning time); (115) Anterior swing arm of compression collar with mechanical relief notch surrounding wearer's crico-thyroid cartilage; (116) Anterior swing arm of compression collar with eccentric cam shaped mechanical relief notch surrounding wearer's crico-thyroid cartilage; (117) Bilateral anterior swing arms of compression collar with mechanical relief notches surrounding wearer's crico-thyroid cartilage; (118) Bilateral anterior swing arms of compression collar with eccentric cam shaped mechanical relief notches surrounding wearer's crico-thyroid cartilage; (119) Posterior swing arm of compression collar with mechanical relief notch around crico-thyroid cartilage allowing reversible usage of pneumatic compression collar; (120) Posterior swing arm of compression collar with symmetric mechanical relief notch around crico-thyroid cartilage allowing reversible usage of pneumatic compression collar; (121) Dual zipper high compression bladder cover; (122) Primary Blow apart zipper mounted within high volume cover secures bladder within cover; (123) Secondary non-blow apart zipper compresses bladder, reducing cover to lowest profile volume; (124) Compression zipper directed away from end of compressed gas entry; (125) Bladder vent at opposite end from entry of compress gas venting any residual gas during high compression—low profile stowage; (126) Attachment between crico-thyroid notches and garment/harness to redirecting abrasive seam upon inflation/compression; (127) Anterior mounted compressed gas inflation means allowing rapid actuation upon submersion in water or increased hydrostatic pressure; (128) Anterior mounted compressed gas inflation means creates critical midline crossing deployment necessary in traditional jacket; (129) Upon detonation the bladder expands and separates the blow apart zipper allowing the unsupported anterior bladder to unfold across midline as the bladder is filling, before significant displacement develops. With a posterior positioning or side positioning of the CO2 cylinder the developing displacement creates a force that results an unsupported bladder inflating behind the neck. With the rarer side-opening garment the anterior portion can be secured to the garment completely around the neck. In that case as the bladder inflates resulting in increasing displacement which would normally preferito stay at the surface and inflate behind a flaccid flexed head & neck, the circumferential attachment forces the expansion underwater and around the neck and chin to the opposite side. For the more common midline opening garment such as a wind breaker, fishing vest etc the initial step must be to get the high volume anterior chamber into position across the midline first before becoming fully inflated because with the midline opening garment the far left side of the bladder can not be mechanical attached as is the case in the side entry ballistics vest. With inflatables the amount of ballast contributed by the CO2 cylinder and detonator is negligible compared to the rapid and sequential force generated upon directed inflation of the bladder; (130) Self-closing posterior swing arm; (131) Adjustable diameter pneumatic compression cervical collar; (132) Wearer adjusted neck diameter pneumatic compression cervical collar; (133) Wearer adjusted neck diameter pneumatic compression cervical collar adjusted during usage via repositioning complementary fabric lock; (134) Wearer adjusted neck diameter pneumatic compression cervical collar adjusted before usage via modifying exposure of complementary fabric lock to arrest further self closure upon inflation at a predetermine neck diameter; (135) Two or more position, wearer adjusted neck diameter, pneumatic compression cervical collar adjusted before usage by modifying location of exposed complementary fabric lock which arrests arm swing during inflation at the predetermine neck diameter; (136) Fabric lock welded directly to bladder wall; (137) Remotely located over pressure valve allows use of ultra-light fabric and self-closing architecture while protecting the bladder from relatively low pressure fabric failure; (138) Variable position eccentric displacement collar; (139) Variable position eccentric displacement collar with flange on one side sewn to fabric cover or welded directly to the cervical bladder. Bladder opening shifts from left to right as high displacement position is repositioned from front to back to accommodate the addition or deletion of thoracic or abdominal bladders as is acceptable for side opening garments; (140) Variable position eccentric displacement collar with flange on both top and bottom side sewn to fabric cover or welded directly to the cervical bladder so that bladder opening remains on the same side to accommodate handedness of a particular front opening vest; (141) Variable anterior displacement collar; (142) Low volume position anterior chamber; (143) High volume position anterior chamber; (144) Variable position collar re-distributing buoyant moment about victim's axis of corrective turning action adjusted to complement operation specific configuration of attached high density gear; (145) Adjustable, eccentric displacement collar with infinitely variable attachment means; (146) Cervical compression collar configured to provide high displacement anteriorly and low displacement posteriorly to supply sufficient torque for corrective turning action when used as a single bladder airway protective PFD; (147) Cervical compression collar configured to provide low displacement anteriorly and high displacement posteriorly providing improved freeboard when used in conjunction with thoracic or abdominal bladder; (148) Universal mount for bladder stowage means; (149) Universal mount for bladder stowage integrated into garment means; (150) Universal mount for bladder stowage integrated into backpack means; (151) Universal mount for bladder stowage integrated into harness means; (152) Universal mount for bladder stowage integrated into equipment transport means; (153) Universal mount for variety of bladder design means within stowage container; (154) Secondary cervical compression PFD adapted to stowage container's universal mounting means; (155) Secondary yoke collar style life jacket PFD adapted to stowage container's universal mounting means; (156) Secondary float adapted for stowage utilizing container's universal mounting means; (157) Secondary life raft adapted for stowage utilizing container's universal mounting means; (158) Secondary utility transport craft adapted for stowage utilizing container's universal mounting means; (159) Ballistics Vest with multiple garment integrated, redundant airway protective PFDs; (160) High torque cervical compression collar complemented by thoracic and or abdominal PFDs serving primarily as displacement means until released; (161) Dual Zipper bladder storage cover design the first encloses the bladder then compresses the bladder to its lowest volume; (162) Dual Release abdominal bladder accessed by either external or internal handle that allows wearer to quickly release deflated PFD for use in rescue effort or once inflated upon the wearer and the fabric inverted the internal component of the handle first unlocks zipper then acts as lanyard for opening zipper then acts as a handle for handing off PFD or attaching to equipment or as a signal device; (163) Quick release coupler attached to universal mounting means for securing chest strap of abdominal bladder/PFD to equipment of choice; (164) Longitudinal complementary fabric lock securing compression of bladder while preparing pneumatic breakaway system; (165) Fabric lock used to temporarily secure bladder in compressed state is entered through breakaway means ensuring its removal before breakaway means can be closed; (166) One or more garment integrated bladder-mounting means allowing the addition or removal of one or more airway protective bladders in one or more positions as dictated by the ballast and buoyant moments contributed by other attached gear; (167) Universal, reversible, abdominal, thoracic and dorsal bladder mounting means allowing operation specific selection of shape, displacement, location and functions of auxiliary abdominal bladder to be reallocated during a mission; (168) Water egress means comprised of multiple bladders with a variety of inflation means a relatively low volume compress gas inflated floor capable of releasing raft automatically from its storage within the garment upon water entry. A high volume chamber inflated orally or with a windsock or wind scoop; (169) Thoracic bladder; (170) Permanently mounted thoracic bladder; (171) Structurally connected permanently mounted thoracic bladder; (172) Separating thoracic bladder; (173) Quick release separating thoracic bladder; (174) Quick release separating thoracic bladder configured as a stand-alone personal flotation device; (175) Quick release separating thoracic bladder configured as a stand-alone personal flotation device with secondary chamber serving as water or gas storage device; (176) Strain relief sleeve; (177) Compressive strain relief sleeve; (178) One-sided compressive strain relief sleeve; (179) Circumferential compressive strain relief sleeve; (180) Reversible snap lock for bladder mounting means allowing in use quick release; (181) Reduction sleeve connecting the small diameter compression collar to the large diameter garment neck opening; (182) Tensioning sleeve connecting the buoyant force of the cervical compression collar to the ballast laden garment; (183) Combined reduction and tensioning sleeve; (184) Combined reduction and tensioning sleeve attached directly to a flange welded onto the cervical compression bladder; (185) Combined reduction and tensioning sleeve attached directly to a fabric cover enclosing the cervical compression bladder; (186) Self Closing Compression collar with inferior flange for mounting to neck diameter reduction tension-transfer sleeve connecting to garment/harness; (187) Self Closing Compression collar with inferior and superior flange for reversibly mounting to neck diameter-reduction tension-transfer sleeve connecting to garment/harness; (188) Reversible secure locking universal mounting means for pneumatically releasing bladder container means upon at thoracic, abdominal and dorsal positions on garment, harness, back pack and strap means for adaptation to any piece of equipment; (189) Inflatable Crico-thyroid cartilage protective notch, cover, tunnel; (190) Dual Zipper; (191) Dual Wall ((i) Oversized inner bladder restrained by outer wall, additional inflatable available for increased midline closure, additional inflatable available for increased cephalomandibular shelf, increased size of pneumatic ram in garment encapsulated life jacket, increased length of cross over arms in garment mounted life jacket, increased length of garment blowout cross over arms, and (ii) two air retentive bladders within an exterior fabric container, identical volume inner bladders within a constrictive fabric cover PFD; (192) Double bladder PFD ((i) firm high pressure, low displacement, turning chamber distinct from soft low pressure, high displacement freeboard chamber, (ii) low volume high pressure compressed gas, self closing, crico-thyroid protective, corrective turning bladder, (iii) structurally distinct high volume, low pressure orally inflated freeboard chamber, (iv) structurally distinct high volume, low pressure oral and partially compress gas inflated freeboard chamber, (v) structurally and functionally distinct low volume-high pressure chamber and high volume-low pressure chamber encapsulated within a garment, (vi) oversized low volume-high pressure chamber and high volume-low pressure chamber enclosed within constrictive outer fabric wall, (vii) low volume-high pressure chamber and high volume-low pressure chamber functionally connected via a pressure relief valve, (viii) low volume-high pressure chamber sharing common structural wall with high volume-low pressure chamber functionally distinct, (ix) low volume-high pressure chamber, sharing common structural wall with high volume-low pressure chamber, functionally connected via a pressure relief valve); and (193) Variable volume dual chambered PFD ((i) pressure relief valve coupled high pressure-low pressure chamber, (ii) pressure relief valve coupled high pressure-medium pressure chamber, (iii) pressure relief valve coupled high pressure-high pressure chamber; (194) abdominal body angle arm; (195) abdominal body angle arm of set length to establish a 30 degree body angle; (196) abdominal body angle arm of variable length to establish a body angle ranging from 0–90 degrees; (197) adjustable length body angle arm; (198) abdominal bladder body angle arm with adjustment means; and (199) abdominal bladder body angle arm with quick release adjustment means Thus, the present invention provides a garment attached or integrated, centerline crossing, self closing, cephalo-mandibular splinting, reversible collar PFD preferably stowed in dual zipper high compression cover with auxiliary garment integrated rapid access redundant rescue PFD and life raft.

Thus, the present invention provides a self-closing mandibular splint that encapsulates the crico thyroid cartilage protecting from the compression associated with a self-closing life jacket. The self closing midline crossing feature has allowed the PFD to provide reliable corrective turning without the need for chest and crotch straps which frees military personnel from straps and bulk that interferes with shouldering their rifle and having unobstructed access to the numerous pockets containing survival gear. The recreational boater benefits from the same lack of straps and bulk by vastly improved comfort and appearance that leads to the compliance critical to assure that the PFD is being worn before the unexpected water entry.

For either the military or recreational user a low profile collar PFD is appreciated. The blow apart cover provides automatic operation which may be needed by the unconscious victim. A dual closure system is preferably provided that first encloses the bladder within a large cover then the second closure means reduces the size of the cover to the amount of the compressed fabric. In this level of compression residual air determines the final size thus the disclosed bladder preferably provides the inflation and venting means at opposite ends. The high compression zipper can close from the inflation end towards the venting ends. Moving all residual air towards the vent where it can be evacuated creates a very low profile stowed PFD. The dual zipper cover creates such high tension around the perimeter thus requiring consideration of traditional break point designs which may fail in that the fabric tension exceeded the capacity of the break point remain closed. Consequently the blow apart zipper begins to open and once that process has begun the tension in the fabric is sufficient to open the cover by itself. The break point should not be in line with the blow apart zipper. Rather, it is preferably placed at an angle across the end where the fabric tension is dramatically reduced. The second complication of the high compression cover is that on detonation of the compressed gas cylinder the air travels end-to-end and the whole cover swells until the zipper is rip as under or the cover fabric ripped apart. Thus a transiently loculated bladder is preferably provided to receive the initial gas. As it expands the gas compresses the crease closing off the loculated bladder so pressure continues to rise. This small bladder is preferably located near the breakpoint where it opens the break point and starts the blow apart zipper. Secondary blow apart restrictions assure the bladder fills then folds across the midline before continuing to deploy the remainder of the bladder. Large unilateral cross arm bladders require that the swing arm flange which attaches the bladder to the vest cross the midline or the bladder may rise up and inflated beside the neck.

Placement of the dual chambered variable volume bladder within an outer shell confers obvious advantages. Previous abdominal bladders are attached at the base of a tactical plate in order to transfer the considerable force needed to buoy the individual and their gear. Use of both plates attached 19.5 lbs. to the garment. Attaching ammo and guns further weighted down the garment.

The use of body angle arm connecting the garment to the bladder allows the mandated body angle to be created as required for approval.

The dual wall PFD can include an outer fabric wall which can be fabricated to have cross over arms of any length. The inner bladder is no longer restricted to a circular shape. In a semi-circular or linear shape over sized arms can be created that will press against the outer wall which establishes the final functional shape.

The disclosed dual chamber PFD separates the low volume high-pressure chamber, which operates the self-closing self-locking midline crossing mandibular arms conferring corrective turning. The larger secondary bladder, which is orally, inflated supplies the additional buoyancy needed for increased freeboard. Use of a pressure relief valve between the corrective turning and freeboard chambers creates a variable volume PFD so that the 90 lb. adult may feel comfortable with a 16 g cylinder while her 150 lb. son prefers a 25 g and her husband needs a 38 g cylinder.

Furthermore, a pressurized floor meets several critical design features for the life raft. A small CO2 cylinder can fully inflate the floor conferring 40 lbs. of lift. The floor is sufficiently rigid so as to give the victim a platform upon which to rest that will not bend nor submerge while manually inflating the high volume perimeter tube.

While the high volume outer tube can be orally inflated, a windsock collector allows the manual inflation at a much faster rate which can be life saving in cold water. The windsock preferably has a plastic nut welded into the windsock allowing its secure attachment to the boat's inflation valve. The nut can be attached by a lanyard to the windsock to prevent its loss. Historically caps and nuts so attached are in need of frequent replacement thus the structural integration of the nut prevents it from being lost or from rubbing and abrading the air retentive fabric of the windsock. The weldable nut also supplies the re-enforcement needed about the orifice connecting the windsock to the raft.

When the wind is blowing the windsock is easily filled. If there is no wind when the victim is floating in water over their head the classic triangular windsock shape is a poor collector. In the classic windsock shape the majority of the volume is near the opening so as the mouth is squeezed closed a majority of the windsock's contents are lost. Rather than a traditional triangular windsock shape a rectangular or slight reverse triangular shape can be preferably used to allow increased capture and transfer rate.

Filling of the traditional windsock is a function of keeping the mouth of the windsock open, which is how the triangular design evolved. To facilitate filling by the victim submerged in water up to their neck, a stiffener is included in the base of the 'windsock' collector and the hands hold the opening at ninety degrees to the stiffener. To guide the frightened user, finger grip holds, such as stiff webbing direct the user to the correct position to open the mouth of the 'windsock'.

If the victim of a small vessel was anticipating use of the personal life raft the 'windsock' collector once full is compressed against their chest or the deck of the vessel. In the water neither are readily available for compression of the entrapped air. In the water, trying to squeeze the balloon while holding onto one end is difficult and precarious. The disclosed collector is redesigned so that the length is greater than the width, with the base as wide or wider than the opening such as a long rectangle. The length creates an extended neck to allow closure while retaining a cubic foot of air. The long neck allows the collector's closure while retaining a much higher percentage of its internal volume resulting in improved efficacy, faster life raft inflation therefore quicker exit from hypothermic inducing waters.

With one had holding onto the pressure inflated floor, the constricted neck can be held by the other hand and pulled under water as the victim shifts their weight onto the hydrostatic pump. The mounting pressure of the water against the windsock results in the air being expressed into the raft.

Given that the windsock can hold 40 to 80 lbs. of air a simple locking lanyard can secure the wrist to the 'windsock' so that even if the hands are to numb to grasp the mouth of the hydrostatic pump the pump can still be worked.

A variable pressure pump can be created by a variable length arm connecting the collector and foot. The pump arm can be lengthened to accommodate the individual's height and the stirrup attached to the foot. Once the pump arm length is adjusted to the length of the victim's leg and secured to the foot as a self locking pedal, the victim can then stand on the hydrostatic pump with all their weight while holding onto the raft with both hands. As the raft is filled the pump arm is shortened so that the collector is pulled to increasing depths. The person can generate 2.5 psi of pressure well in excess of what can be created by the lungs. The variable pressure hydrostatic pump only takes 3–5 cycles to completely inflate and pressurize the raft.

Current regulations require a life raft to be comprised of three chambers. In recognition of the desire for redundancy of puncture-able chambers and appreciating the time line required to effect a change in governmental regulations the inner floor can be divided into two chambers. The two chambers can be separately inflated but that would require duplication in cylinders and inflator mechanisms at considerable cost and bulk. Alternatively, the dual chambers can be connected by an overpressure relief-one way check valve keeping the personal life raft smaller, lighter and more affordable for inclusion within the life jacket yet compliant with current regulations.

Parts List (FIGS. 82 through 107)

1*e* Asymmetric crico-thyroid relief cam with single sided notch in the high volume anterior component of the cephalo-mandibular stabilizing collar life jacket

2*e* Symmetric bilateral relief notch in posterior arm provides crico-thyroid relief on reversal, allows anterior and posterior reversal of bladder or entire jacket in the case of a side entry garment. Reversal of PFD allows improved ability to swim or remain vertical in the water column. Binding tape softens welded seam edge.

3*e* Self closing angle creates fabric tension upon inflation that closes, overlaps and seals the anterior and posterior swing arms, creating cephalo-mandibular splint

4*e* Self-closing pneumatically driven low volume posterior swing arm

5*e* Complementary fabric lock cover that can be positioned prior to use to adjust location of the functionally exposed fabric lock creating variable adjustment means for neck diameter of inflatable swing arm

6*e* Complementary fabric lock arresting automatic closure of swing arm in the intermediate neck diameter position. Adjustable stop for personally sizing the adjustable collar. The variable position stop limits the final position of the self-closing swing arm allowing close closure without compression of the victim's throat.

7*e* Indicated fold line guiding stowage of bladder creating temporarily loculated blow out bladder during initial step of rupture of high-tension low profile stowage cover.

8*e* Loculated blow out chamber now combined with remainder of PFD collar as a structurally rigidimandibular shelf once in position.

9*e* Inferior water, hydrostatic or manually activated compressed gas inflator located on inferior side of the loculated portion of the bladder, supplying the pressure for the high displacement free arm to blow open the high tension cover then unfold across the midline as the initial step of inflation

10*e* Anterior rigid ballistics plate within body armor garment creating centers of ballast and buoyancy that requires off setting high displacement anterior bladder component;

11*e* Superior reversible secure attachment means of cervical compression collar to the garment when used with low volume swing arm bladder in front from victim's neck.

12*e* Optional webbing and stowage pocket to connect force of anterior bladder to submerged inferior edge of garment integrated 9.5 lb. rigid tactical plate, connected after deployment.

13*e* Compression cap for overpressure valve prevents vacuum backfill of bladder during packaging after deflation. Blows off at 2.0 psi blow off a prevents intrusion of debris into over pressure valve mechanism

14*e* Dual Function handle-either manual activation of abdominal bladder compressed gas means or quick-release zipper lock handle for removing deflated abdominal bladder for use as rescue; device

15*e* Stowed abdominal bladder, protected behind ballistics fabric.

16*e* Over pressure relief valve to protect ultra-light fabric from forces associated with torque generated by self-closing collar

17*e* Midline opening garment vest or jacket

18*e* Bladder quick release connector for securing bladder in the event of sudden entry from elevation

19*e* Compressive strain relief sleeve

20*e* Second portion of crico-thyroid notch effaced back to line of mandibulo-thoracic bladder

21*e* Neck diameter specific bladder opening

25*e* Sequential and progressive dual zipper bladder containment then compression means

26*e* Temporary vertical lightweight fabric wall

27*e* Identical length superior and inferior circumferential high compression external cover closure means

28*e* Horizontal superior fabric surface

29*e* Concentric medial and lateral perimeters of increasing length

33*e* Reversible pressure actuated deployment means

30*e* Compression and structural closure means

31*e* High volume intermediate storage means loosely enclosing inflatable bladder

32*e* Low volume, low profile compressed final storage

33*e* Pneumatically operated blow a part closure means

34*e* Buttons for securing front closure of garment

36*e* Main bladder

37*e* Inferior side of the loculated detonation-initiation chamber portion 8 of bladder folded back upon itself along a line 7 which is contiguous and parallel to the cover break point

38*e* Fold compressed by the cover functionally distinguishing that portion of the bladder that inflates initially thereby opening the cover from the remainder of the collar bladder.

39*e* Primary complementary reversible locking means at a leveraged angle to the perimeter blow apart zipper allowing the break point fabric lock to keep the cover closed until either manually or automatically activated.

40*e* Primary complementary two sided reversible locking means such as loop that keeps cover closed in peel position allowing secure yet reliably releasable closure means for the PFD cover.

41*e* Pull means for first manually separating reversible break point fabric lock then actuating compressed gas cylinder inflation means

42*e* Ripcord means connecting the pull force to compressed gas inflation means

43*e* Cross-over swing arm/flange attachment means mechanically restricting final relocation of inflated bladder, assuring that the right side of bladder although stowed on the left side of the garment prior to inflation upon rigid inflation will relocate to the correct side and not behind the neck of the wearer. The reversible bladder swing arm flange attachment means marks the most lateral intrusion of disruptive bulk of the deflated PFD into the gun butt zone of the ballistics' vest

44*e* Cover angled away from gun butt zone to reduce intrusion of PFD bulk into gun butt zone of ballistics' vest

45*e* Dual function reversible secure midline cross over and bladder mount securing means

46*e* Gun butt zone receives and steadies the rifle during use. Any gear degrades utility of ballistics vest

47*e* Volumetric dead space. To maintain a state of high compression of the bladder which assists on opposing premature bladder inflation prior to the cover opening, the covers internal volume is reduce by creating a dead space adjacent the neck opening.

48*e* To reduce intrusion of the rigid compressed gas cylinder into the gun butt zone the cylinder is shifted to the left this shift is accommodated by extending the cover to the left.

49*e* Reduction and tension coupling sleeve/swing arm flange, reducing the diameter of the garment neck opening to match the diameter of the cervical compression bladder opening.

50*e* Inferior now superior reversible attachment means allowing reversal of the high displacements and low displacement portions of the cervical compression bladder. Shifting the high volume chamber from the front to the rear, offsets the net shift in the centers of ballast and buoyancy that occurs upon the inclusion of additional anterior buoyancy through the mounting of a secondary abdominal bladder

51*e* Quick release rescue raft initially functioning as abdominal buoyancy means

52*e* Reversible universal secure collar bladder mounting means allows interchangeable bladders to meet operation needs

53*e* Non-releasable abdominal cover integrated into garment

54*e* Secure high strength quick release mounting means secured by snap locking means

55*e* Posterior crico-thyroid notch now facing anteriorly upon reversal of high and low volume portions of the cervical compression collar

56*e* Inner compressed gas raft floor pneumatically drives release of conveyance from garment integrated storage means when submerged

57*e* Oral or windsock inflated high displacement perimeter buoyant means

58*e* Locking wind sock air trap manual inflation means

60*e* Reversible transferable life jacket mounting means

61*e* Connecting swing arm flange welded directly to the exterior face of the bladder fabric or sewn to an additional cover layer enveloping inflatable bladder

62*e* Tensioning swing arm member transferring force from bladder to the submerged garment

63*e* Exterior stowage cover

64*e* Anterior swing arm

65*e* Lateral posterior weld seam

70*e* Bilateral Velcro™ sleeve the envelopes the tightly compressed collar PFD

71*e* Temporary, complementary Velcro™ strip that keeps the tightly compressed bladder from expanding while preparing the breakaway closure means

72*e* Inferior portion of bladder cover

73*e* Deflated and tightly compressed cervical PFD bladder releasing from temporary closure means

80*e* Secondary blow apart sequential inflation regulations means

81*e* Tertiary blow apart sequential inflation regulations means

82*e* Deflated bladder

83*e* Splayed open initial portion of the bladder cover additional opening prevented from progressing until pressure develops in the loculated initial portion of the bladder

84*e* Lower vent of a dual vent system to rapidly flood water activated compressed gas inflator

85*e* Upper vent of a dual vent system to rapidly flood water activated compressed gas inflator

86*e* Garment collar covering PFD mounting means allowing PFD to be transferred between a variety of garments

90*e* Collar life jacket with complementary bilateral self closing angles which upon inflation create fabric tension that closes the neck opening, overlapping adjusting size and locking the left and right swing arms

91*e* Mirror image asymmetric crico-thyroid relief cam with single sided notch in the bilateral low volume anterior arms of the low profile recreational cephalo-mandibular stabilizing collar life jacket

92*e* Exterior weld line from interior patch welded on the inside of bladder sealing stitching from sewn through fabric lock

93*e* Bladder vent and combined oral inflator located at opposite end of blow apart closure means and simultaneously at the closure end of cover compression zipper

94*e* Stitch attaching fabric lock to fabric coated on one side.

95*e* Left and right anterior bladder arms crisscrossing midline opening garment.

96*e* Adapting coupler and conduit connecting remote compressed gas with loculated blow apart bladder component

97*e* Remote inflation means attached to back side of loculated chamber to blow open lock and initiate sequential deployment of inflating collar life jacket

98*e* Remotely located compressed gas and inflator means, decreasing collar bulk and increasing depth of submersion accelerating hydrostatic or water activated inflation

99*e* Remote over pressure valve combined with vent and oral inflation valve.

100*e* 0 to 90 degree adjustable length body angle arm. (Suspension member hangs the unconscious victim from abdominal buoyant moment placing the victim's body in strict accordance with published Federal mandates for body angle as measured relative to the water's surface).

101*e* Acceptable body angle is measured from the victim's spinal axis to the water's surface as required by testing and approving regulatory agencies

102*e* Complementary reversible mounting means permanently attached to manual detonation means for securing manual ripcord to abdominal bladder releasing means

103*e* Complementary mounting means permanently attached to abdominal bladder releasing means for mounting compressed gas rip cord

104*e* Releasable half of complementary quick release locking means for abdominal bladder

105*e* Garment mounted half of complementary quick release locking means for abdominal bladder

106*e* Ripcord handle for manual activation of compressed gas inflation means of abdominal bladder

107*e* Free arm reversible complementary locking means for securing redundant abdominal rescue life jacket into compressed configuration as the victim's garment integrated abdominal bladder

108*e* Body angle arm mounted reversible complementary locking means for securing redundant abdominal rescue life jacket into compressed configuration as the victim's garment integrated abdominal bladder

109*e* Secure releasable bladder mounting means

110*e* Garment integrated cover compression zipper analogous to garment attached cover compression zipper 33*e*

111*e* Compression zipper pull in final stages of compressing bladder and closing garment integrated cover analogous to external cover compression means 27*e*

112*e* Garment integrated blow apart bladder deployment zipper

113*e* Blow apart zipper pull in the closed or set position opposite the loculated detonation bladder and break a-part point

114*e* Residual air compressed during packaging of bladder within dual zipper compression closure

120*e* Left bladder-garment attachment swing arm

121*e* Left reversible swing arm attachment means allows removal

122*e* Right bladder-garment attachment swing arm

123*e* Right reversible swing arm attachment means allows removal

124*e* Deflated midline compression mandibular splint bladder

125*e* Independent cephalo-mandibular bladder removably enclosed within garment

126*e* Left mandibulo-thoracic bladder

127*e* Right mandibulo-thoracic bladder

130*e* Oversized inner air retentive bladder

131*e* Opening in garment integrated retaining tube for dual wall PFD directing escape of dual wall cross over and cross under bladders across midline elevating wearer's mandible and supporting the head

132*e* Additional deflated dual wall PFD bladder functions as pneumatic ram upon inflation

133*e* Exterior fabric wall of dual wall PFD, which determines the final shape of the inflated conformation

134*e* Right self closing angle incorporated into external fabric wall of a dual wall PFD, directing tension created upon inflation of inner bladder to bring the right bladder under right lateral and central aspects of mandible.

135*e* Left self closing angle incorporated into external fabric wall of a dual wall PFD, directing tension created upon inflation of inner bladder to bring the left bladder under left lateral and central aspects of mandible.

136*e* Left crico-thyroid relief notch built into outer fabric shell of dual layer PFD allowing cephalo-mandibular support without impinging upon or compressing voice box

137*e* Right crico-thyroid notch in external wall

138*e* Differential cut i.e. the lower inner liner of the garment is larger than the outer shell of the garment

139*e* Smaller outer garment shell of the garment constructed of heavier fabric

140*e* Two dimensional single wall welded tube must be both air retentive and create the functional end shape of inflated PFD

141*e* Limited two-dimensional fabric available for single wall bladder welded construction. Bladder adjacent to midline retracts upon inflation opposing the creation of reliable mandibular support as needed for midline compression or midline crossover when welded

142*e* Two-dimensional inner bladder of a dual wall PFD, which only must contain air. Inner bladder length is solely determined by optimal design since the inner bladder's only function is to retain air. Outer wall defines location of various displacement-moments

143*e* Equivalent maximum length of bladder available when constructing a single wall out of two-dimension fabric analogous to 140*e* in above drawing

144*e* Additional bladder length available from dual wall construction for creating a cephalo-mandibular shelf either through midline compression or unilateral or bilateral midline crossover arms.

145*e* Right shoulder inner bladder restriction for improved flexibility about neck and elimination on superfluous inner bladder

146*e* Expanded diameter creating cephalic pillow on inflation

147*e* Left shoulder inner bladder restriction for improved flexibility about neck and elimination on superfluous inner bladder

148*e* High volume combined mandibular support and thoracic corrective turning bladder

149*e* Optional blow apart opening for protrusion of cross over and cross under mandibular arms

150*e* Pneumatic ram extends toward the midline during pressurization of the inner bladder

151*e* Compression closure of midline garment gap created by pressurized impact of bilateral mandibular arms

152*e* Inflated inner bladder remains larger than outer wall. The outer wall constrains extent of inflation bearing the strain of the fully inflated PFD

160*e* Inner cross over bladder

161*e* Outer cross over bladder

162*e* Inner cross under bladder

163*e* Outer cross under bladder

164*e* Middle layer

165*e* Oral airway without over pressure valve

166*e* Manual compressed gas inflator

167*e* Oversized dual inner bladders

170*e* Increasing hydrostatic pressure

171*e* Extended neck of hydrostatic pump

172*e* Wrist lanyard

173*e* Hydrostatic Pump

174*e* Stiffened base perpendicular to finger grip

175*e* Re-enforced opening perimeter

176*e* Finger grip stitching about three side of perimeter

177*e* Stiff finger grip pocket

178*e* Welded nut

179*e* Wrist lanyard stitched to finger grip

180*e* Transferable raft container reversibly mounted to back of garment

181*e* Pneumatically released raft cover

182*e* Quick release means

183*e* Universal bladder container mounts on back of garment, back of backpack, lower abdomen, in the thoracic area of the garment and on external equipment such as the ammo box. Pneumatically released cover can internally mount a range of bladders from surface recovery markers to PFDs, floats or personal life rafts.

184*e* Thoracic bladder within blow a-part cover mounted on universal mounting system.

185*e* Abdominal bladder within blow a-part cover mounted on universal mounting system.

186*e* Bladder cover's universal mounting means adapted to webbing that can be tied, zipped, snapped, buttoned onto any equipment so that it can be floated at the surface or a marker bladder sent aloft for recovery in event of immersion.

187*e* Backpack with integrated universal mount to accept wide range of surface marking or surface flotation bladders

188*e* Depth adjustable inflation mechanism adjusted to inflate posterior bladder last in sequence, only after cervical and thoracic/abdominal bladders have been inflated yet prove insufficient to achieve net positive buoyancy as demonstrated by increasing hydrostatic pressure.

189*e* Pneumatically released bladder such as a life raft attached via universal mount integrated into backpack.

190*e* Self-launching equipment marking buoyant device

191*e* Heavy gauge recovery line

192*e* Pneumatically released bladder cover means

193*e* Free spinning recovery line spool secured to universally mounted bladder container

194*e* Water's surface

195*e* Lake bottom

196*e* Sleeping roll

198*e* Depth actuated pneumatically released bladder attached via universal mount integrated into backpack.

200*e* Miniature universally mounted equipment marking and recovery system

201*e* Universal buoyant surface to equipment marker and or recovery attachment means

202*e* Pneumatically released stowage container cover means

203*e* Stowed bladder

204*e* Secure tether mounting on bladder

205*e* Bladder tether

206*e* Cover mounted free spinning spool of high strength recovery line

210*e* Universally mounted, self-releasing, manually or water activated deployment of equipment flotation bladder

211*e* Abysmal depths exceeding simpler marking and recovery systems

212*e* Ensnaring, entangling debris on lake bottom endangering simpler marking and recovery systems

213*e* Side release buckle and lanyard mounted on backpack shoulder strap for manual detonation of compressed gas cylinder

220*e* High pressure one way check valve

221*e* Primary rigid high-pressure chamber

222*e* Secondary rigid high-pressure floor

223*e* Flexible lower pressure perimeter chamber

224*e* Pressurized gas conduit connecting rigid high pressure structure with low pressure complementary structure

225*e* Oral inflation tube with one-way check valve

226*e* Over sized compressed gas cylinder

227*e* Over size inflator assembly

228*e* Optional no-lock low-pressure hose Self Contained Underwater Breathing Apparatus coupler for use by diver

229*e* Lower psi over pressure relief and air vent valve

230*e* Separate vent and oral inflation for each chamber in the floor

231*e* Variably sized, self locking hydrostatic pump pedal/stirrup

232*e* Adjustable length pump arm

233*e* Secure pump arm length adjustment means

240*e* Variable displacement, dual pressure, dual chamber, dual wall airway protective life jacket

241*e* Low volume high pressure compressed gas cylinder

242*e* High volume-low pressure orally inflated secondary chamber

243*e* Small, medium or large compressed gas cylinder

244*e* Optional over pressure relief one way check valve to allow compressed gas cylinder size located on the high pressure chamber to be upgraded to a larger cylinder to partially or fully inflate high volume bladder

245*e* High volume-low pressure bladder perimeter weld line

246*e* Low volume-high pressure bladder weld line

247*e* Combined high pressure and low-pressure bladder weld line

248*e* Secure reversible bladder to garment attachment means

249*e* Variable displacement, dual pressure, dual chamber, inner bladder of an airway protective life jacket

250*e* Variable volume dual chambered ballistics vest

251*e* High pressure, low volume, inferior chamber

252*e* Zero, low, medium or high-pressure superior chamber depending on the size of the compress gas cylinder selected

253*e* Oral inflation tube with over pressure relief valve for both the high pressure low volume primary bladder and the zero, low, medium or high pressure superior secondary chamber including compressive over pressure valve cap

260*e* Variable pressure hydrostatic pump

261*e* Low-pressure hydrostatic pump 0.0 to 0.5 psi

262*e* Hydrostatic pressure 0.0 to 0.5 psi

263*e* Long arm of low-pressure hydrostatic pump

264*e* Medium pressure hydrostatic pump 0.5 to 1.5 psi

265*e* Hydrostatic pressure 0.5 to 1.5 psi

266*e* Medium length arm of medium pressure hydrostatic pump

267*e* High-pressure hydrostatic pump 1.5 to 2.5 psi

268*e* Hydrostatic pressure 1.5 to 2.5 psi

269*e* Short arm of high-pressure hydrostatic pump

270*e* Secure adjustable pump arm means attaching variable length arm to the gas collector

271*e* Short tail associated with using long arm low-pressure hydrostatic pump

272*e* Check valve

273*e* Optional disconnect

274*e* Disconnect length equal to or longer than length of the windsock

275*e* Welded straight connector between tubing and pump collector

276*e* Conduit transferring pressurized air into raft

277*e* Complementary reversible locking means entrapping air in pump collector The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A garment integrated multi-chambered personal flotation device; or life jacket, comprising:

a garment member; and a personal flotation device attached to the garment member, said personal flotation device including an inflatble buoyancy assembly attached to a front area of the garment member and an inflatable collar assembly attached approximate a neck area of the garment member.

2. The garment integrated personal flotation device or life jacket, of claim 1 wherein said garment is body armor.

3. The garment integrated personal flotation device of claim 1 wherein said personal flotation device further includes an inflatable raft.

4. The garment integrated personal flotation device of claim 3 wherein said raft is releasable.

5. The garment integrated personal flotation device of claim 3 wherein said raft is positioned at a back portion of the garment member.

6. A garment integrated muilti-chambered personal flotation device or life jacket, comprising:

a garment member; and a personal flotation device attached to the garment member;

wherein said personal flotation device comprises:

a first bladder;

a second bladder associated with said first bladder;

a first mobile buoyant assembly associated with said first bladder;

a second mobile buoyant assembly associated with said second bladder; and means for inflating said first bladder and said second bladder.

7. The garment integrated multi-chambered personal flotation device, or life jacket, of claim 6 wherein said first mobile buoyant assembly is in communication with said first bladder through a flexible tube.

8. The garment integrated multi-chambered personal flotation device, or life jacket, of claim 6 wherein said means for inflating comprises:

a compressed gas cylinder; and a detonator in communication with said compressed gas cylinder.

9. The garment integrated multi-chambered personal flotation device or life jacket of claim 6 wherein said garment is body armor.

10. The garment integrated multi-chambered personal flotation device or life jacket of claim 5 wherein said personal flotation device further includes an inflatable raft.

11. The garment integrated multi-chambered personal flotation device or life jacket of claim 10 wherein said raft is releasable.

12. The garment integrated multi-chambered personal flotation device or life jacket of claim 10 wherein said raft is positioned at a back portion of the garment member.

13. The garmented integrated multi-chambered personal flotation device or life jacket of claim 10 wherein said personal flotation device further includes an inflatable collar attached to the garment member.

14. The garmented integrated multi-chambered personal flotation device or life jacket of claim 6 wherein said personal flotation device further includes an inflatable collar attached to the garment member.

* * * * *